US012428858B2

(12) United States Patent
Anger et al.

(10) Patent No.: US 12,428,858 B2
(45) Date of Patent: Sep. 30, 2025

(54) BUILDING CLADDING ELEMENTS AND SYSTEMS

(71) Applicant: James Hardie Technology Limited, Dublin (IE)

(72) Inventors: Jesse Anger, Rosehill (AU); Jonathan Conway, Rosehill (AU); Robert Elliott Everhart, II, Lake Arrowhead, CA (US); Joseph Banta, Rosehill (AU); Ron Smith, Rosehill (AU); Steve Zondanos, Rosehill (AU); Benjamin Batres, Fontana, CA (US)

(73) Assignee: James Hardie Technology Limited, Dublin (IE)

( * ) Notice: Subject to any disclaimer, the term of this patent is extended or adjusted under 35 U.S.C. 154(b) by 309 days.

(21) Appl. No.: 18/255,079

(22) PCT Filed: Nov. 30, 2021

(86) PCT No.: PCT/US2021/061243
§ 371 (c)(1),
(2) Date: May 30, 2023

(87) PCT Pub. No.: WO2022/119846
PCT Pub. Date: Jun. 9, 2022

(65) Prior Publication Data

US 2024/0003145 A1 Jan. 4, 2024

Related U.S. Application Data

(60) Provisional application No. 63/120,037, filed on Dec. 1, 2020.

(30) Foreign Application Priority Data

Nov. 1, 2021 (AU) ..... 2021903483

(51) Int. Cl.
*E04F 19/06* (2006.01)
*E04F 13/08* (2006.01)
*E04F 13/14* (2006.01)

(52) U.S. Cl.
CPC ..... *E04F 19/061* (2013.01); *E04F 13/0889* (2013.01); *E04F 13/148* (2013.01)

(58) Field of Classification Search
CPC ... E04F 19/061; E04F 13/0889; E04F 13/148; E04F 19/06; E04F 2201/026;
(Continued)

(56) References Cited

U.S. PATENT DOCUMENTS 294,855 A 3/1884 Crawford
467,063 A 1/1892 Sword
(Continued)

FOREIGN PATENT DOCUMENTS

CA 1122379 A 4/1982
DE 3532112 3/1987
(Continued)

OTHER PUBLICATIONS

Boral TruExterior Siding and Trim, http://www.boralamerica.com/TruExterior/truexterior-siding as printed Nov. 25, 2015 in 2 pages.
(Continued)

*Primary Examiner* — Patrick J Maestri
(74) *Attorney, Agent, or Firm* — Knobbe, Martens, Olson & Bear, LLP

(57) ABSTRACT

A cladding system configured to be installed on a building substrate includes a plurality of fiber cement cladding elements and at least one trim element. The plurality of fiber cement cladding elements includes at least a first and second cladding element, each having a front face with a textured pattern, a rear face, first and second mating edges configured to allow mating between the first and second cladding
(Continued)

elements, and a plurality of intermediate grooves recessed from the front face. The at least one trim element includes one or more channels configured to receive a portion of at least one of the first and second cladding elements. Each of the plurality of grooves includes a first curved surface, a second curved surface, a third curved surface, a fourth curved surface, and a planar surface positioned between the second and fourth curved surfaces and substantially parallel to the front face.

24 Claims, 53 Drawing Sheets

(58) Field of Classification Search
CPC .. E04F 19/062; E04C 2/324; E04C 2002/004; E04C 2/288
See application file for complete search history.

(56) References Cited

U.S. PATENT DOCUMENTS

| | | | | |
|---|---|---|---|---|
| 525,442 | A | 9/1894 | Burrows | |
| 2,110,729 | A | 3/1938 | Hoggatt | |
| 3,535,844 | A * | 10/1970 | Glaros | E04D 3/366 52/592.1 |
| 4,261,152 | A | 4/1981 | Tellman | |
| 4,774,794 | A | 10/1988 | Grieb | |
| 4,955,169 | A | 9/1990 | Shisko | |
| 5,016,416 | A | 5/1991 | Munk | |
| 5,390,462 | A * | 2/1995 | Kreiter | E04F 21/0069 52/506.01 |
| 6,772,890 | B2 * | 8/2004 | Campbell | A47F 5/0846 211/94.01 |
| 8,336,269 | B1 | 12/2012 | Mollinger et al. | |
| 8,484,931 | B2 | 7/2013 | Gleeson et al. | |
| 8,733,410 | B2 | 5/2014 | Pervan | |
| D729,949 | S | 5/2015 | Hartman | |
| 9,140,018 | B2 | 9/2015 | Southwell | |
| 9,752,328 | B2 | 9/2017 | Everhart et al. | |
| 10,240,348 | B2 | 3/2019 | Pervan et al. | |
| 10,428,533 | B2 * | 10/2019 | Magnusson | E04F 13/0885 |
| 10,458,124 | B2 | 10/2019 | Arne et al. | |
| 10,519,673 | B2 | 12/2019 | Joshi et al. | |
| 2003/0046888 | A1 | 3/2003 | Ryan | |
| 2003/0046891 | A1 | 3/2003 | Colada et al. | |
| 2004/0206036 | A1 | 10/2004 | Pervan | |
| 2004/0231252 | A1 | 11/2004 | Benjamin | |
| 2005/0241264 | A1 * | 11/2005 | Albano | E04G 17/12 52/781.5 |
| 2005/0247022 | A1 | 11/2005 | Poupart | |
| 2006/0174575 | A1 | 8/2006 | Woods | |
| 2006/0185299 | A1 * | 8/2006 | Poupart | E04F 13/047 52/545 |
| 2008/0196354 | A1 | 8/2008 | Attebery | |
| 2009/0007516 | A1 | 1/2009 | Swanson | |
| 2010/0170182 | A1 | 7/2010 | Gately | |
| 2011/0167744 | A1 | 7/2011 | Whispell et al. | |
| 2011/0167750 | A1 | 7/2011 | Pervan | |
| 2012/0317909 | A1 | 12/2012 | MacKenzie | |
| 2013/0283720 | A1 | 10/2013 | Pervan et al. | |
| 2013/0312356 | A1 | 11/2013 | Foral | |
| 2014/0215945 | A1 | 8/2014 | Swanson | |
| 2014/0345226 | A1 | 11/2014 | Southwell | |
| 2019/0330856 | A1 | 10/2019 | MacPherson et al. | |

FOREIGN PATENT DOCUMENTS

| | | |
|---|---|---|
| DE | 102015111930 | 1/2017 |
| WO | WO 2004/081316 | 9/2004 |
| WO | WO 2005/098163 | 10/2005 |
| WO | WO 2010/065987 | 6/2010 |
| WO | WO 2020/260721 | 12/2020 |

OTHER PUBLICATIONS

Ready Pine Refinished Interior Tongue & Groove by Horizon Coatings, "The Original," http://www.readypine.com/About.htm, as printed Mar. 11, 2015 in 3 pages.
Search Report and Written Opinion received in International Application No. PCT/US21/61243, dated May 11, 2022.
Vintage Woodworks, "V-Groove Board," http://www.vintagewoodworks.com/v-groove.html as printed Mar. 11, 2015 in 2 pages.
International Search Report for International Application No. PCT/EP2020/068313 dated Sep. 24, 2020.

* cited by examiner

FIG. 4B
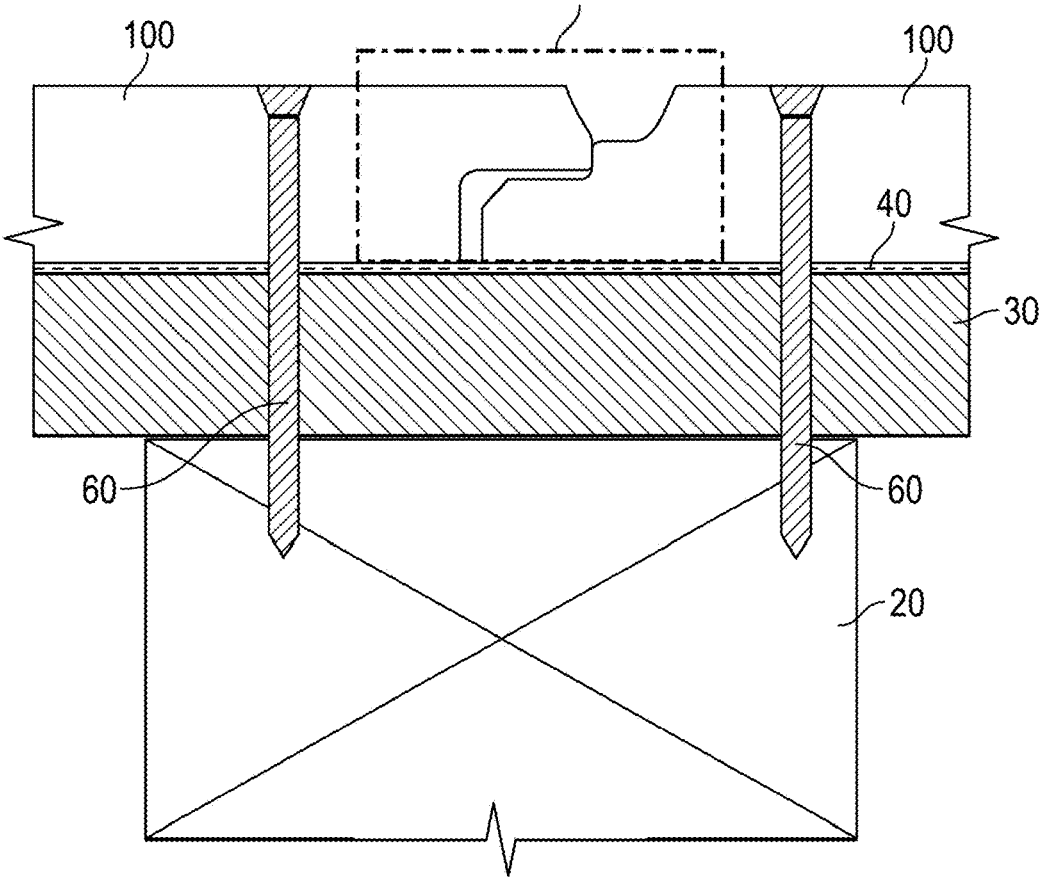
FIG. 4A
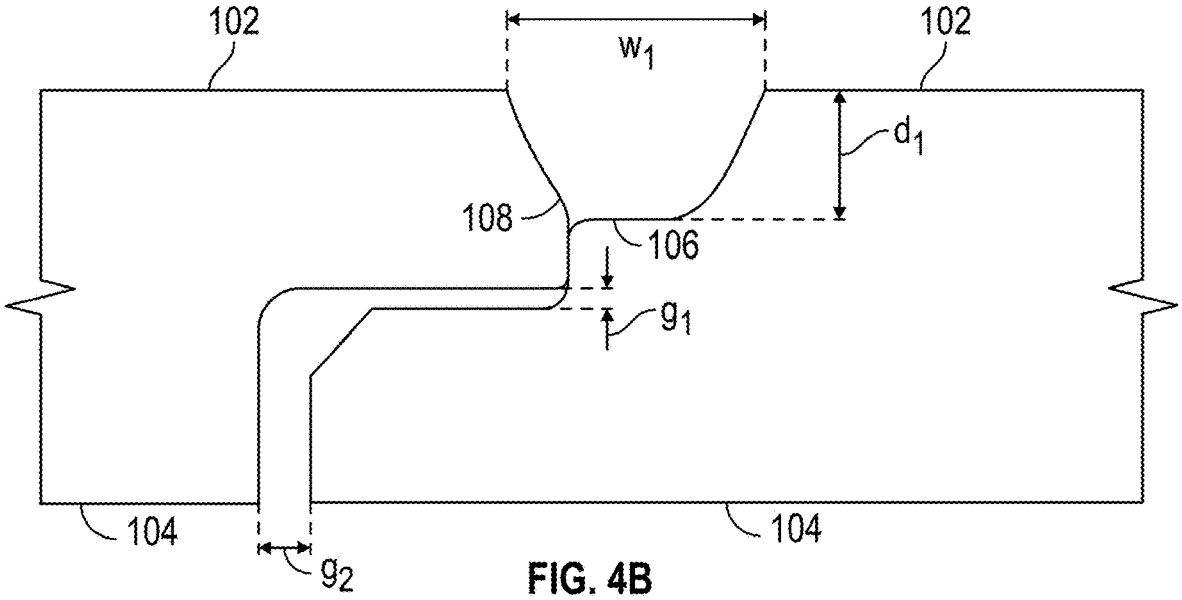
FIG. 4B

BUILDING CLADDING ELEMENTS AND SYSTEMS

CROSS-REFERENCE TO RELATED APPLICATIONS

This application is the U.S. National Phase of PCT/US2021/061243, filed Nov. 30, 2021 entitled "BUILDING CLADDING ELEMENTS AND SYSTEMS", which claims the benefit of U.S. Provisional Application Ser. No. 63/120,037, filed Dec. 1, 2020, entitled "BUILDING CLADDING ELEMENTS AND SYSTEMS," and Australian Provisional Application Serial No. 2021903483, filed Nov. 1, 2021, entitled "BUILDING TRIM SYSTEM," each of which is hereby incorporated by reference in its entirety and for all purposes.

FIELD

The present disclosure generally relates to building materials suitable for use in construction. In particular, the present disclosure relates to cladding elements and systems for use as a decorative and protective covering for building structures. The present disclosure also relates to trim elements and flashing elements for use with an exterior of building structures.

BACKGROUND

Cladding materials are commonly used to protect building structures from the elements and improve the aesthetic qualities of the exterior surface of the structures. The cladding materials can be in the form of boards, panels, shingles, planks or the like that are arranged and installed as a system on a wall surface. In some cladding systems, a series of cladding boards are arranged in rows and installed in a manner such that there is no overlap between adjacent boards and the external surfaces of adjacent boards are parallel and coplanar. Such configurations are conventionally known as "flat wall cladding". Installation of flat wall cladding systems may be advantageous as it creates the appearance of a clean, smooth and flat exterior surface. It is sometimes considered difficult and/or time consuming to install fiber cement cladding systems in such flat wall cladding configurations. In addition, it is often preferred when creating such a flat wall cladding appearance, that the dimension, configuration and placement of individual cladding boards are uniform and precise. In some instances, the normal dimensional variations of fiber cement, which are deemed to be within manufacturing tolerance, can become more noticeable when the fiber cement cladding panels are installed in a flat wall cladding configuration. This can result in an aesthetically undesirable flat wall cladding appearance. It is time consuming for an installer to then cut and adjust the fiber cement cladding panels to improve the aesthetic appearance, which in turn leads to wastage in terms of efficiencies of installation and product.

SUMMARY

The systems, methods, and devices described herein address one or more problems as described above and associated with existing construction systems and methods. The systems, methods and devices described herein have a variety of innovative aspects, no single one of which is indispensable or solely responsible for their desirable attributes. Without limiting the scope of the claims, the summary below describes some of the advantageous features.

Disclosed herein are various embodiments of cladding systems designed to compensate for variations in individual cladding elements, such as cladding boards, panels or planks, thereby reducing installation time and improving the overall appearance of the installed cladding. In some embodiments, the cladding system has a joint system that allows for quick and accurate mating of adjacent cladding elements such that the exterior surfaces of adjacent cladding elements can be quickly aligned despite thickness variations in the individual cladding elements. Furthermore, the joint system can be configured to enable two adjacent cladding elements to form a joint groove or other design between the adjacent cladding elements whereby the joint groove or other design between the adjacent cladding elements matches a face groove or other design on at least one face of each individual cladding element.

Also disclosed herein are various embodiments of fiber cement cladding systems and methods of installation. In some embodiments, the fiber cement cladding systems are configured to be installed in a manner such that the major external surfaces of adjacent fiber cement cladding elements are parallel and coplanar so as to create the appearance of a clean, smooth and flat surface. In a further embodiment, each individual cladding element can contain one or more face grooves extending across the major exterior surface and are configured such that all of the grooves, that is the one or more face grooves and the joint grooves have a uniform appearance when installed despite variations in the thickness of cladding elements.

In a first aspect of the present technology, a cladding system configured to be installed on an exterior of a building substrate is described. The cladding system comprises a plurality of cladding elements. The plurality of cladding elements comprises at least a first cladding element and a second cladding element, each of the first and second cladding elements comprising fiber cement and further comprising: a front face configured to face away from the building substrate when each of the first and second cladding elements is secured to the building substrate, wherein the front face comprises a textured pattern; a rear face opposite the front face and configured to face toward the building substrate when each of the first and second cladding elements is secured to the building substrate; a first mating edge extending between the front and rear faces and extending along a length or height of each of the first and second cladding elements; a second mating edge opposite the first mating edge and extending between the front and rear faces and along the length or height of each of the first and second cladding elements, wherein the first mating edge of the first cladding element is configured to mate with the second mating edge of the second cladding element to form a joint groove extending along the length or height of each of the first and second cladding elements; and a plurality of intermediate grooves recessed from the front face and extending substantially parallel to the first and second mating edges, wherein each of the plurality of intermediate grooves comprises: a first curved surface extending from the front face at least partially toward the rear face and having a first radius of curvature; a second curved surface connected to the first curved surface and having a second radius of curvature that is smaller than the first radius of curvature of the first curved surface; a third curved surface spaced from and opposite to the first curved surface, the third curved surface extending from the front face at least partially toward the rear face and having a third radius of curvature that is substantially equal to the first radius of curvature of the first curved surface; a fourth curved surface connected to the third curved surface and having a fourth radius of curvature that is smaller than the third radius of curvature of the third curved surface, wherein the fourth radius of curvature is substantially equal to the second radius of curvature of the second curved surface; and a planar surface connected to and positioned between the second and fourth curved surfaces, wherein the planar surface is substantially parallel to the front face.

In some embodiments, the cladding system further comprises at least one trim element is configured to be secured to the building substrate. In some embodiments, the at least one trim element comprises one or more channels configured to receive a portion of at least one of the first and second cladding elements.

In some embodiments, each of the first radius of curvature and the third radius of curvature is between approximately 0.3 inch (7.6 mm) and approximately 0.5 inch (12.7 mm). In some embodiments, a ratio between the first radius of curvature of the first curved surface and the second radius of curvature of the second curved surface is between approximately 10 and approximately 12. In some embodiments, a ratio between the third radius of curvature of the third curved surface and the fourth radius of curvature of the fourth curved surface is between approximately 10 and approximately 12. In some embodiments, each of the second radius of curvature and the fourth radius of curvature is between approximately 0.03 inch (0.76 mm) and approximately 0.05 inch (1.3 mm).

In some embodiments, the first and second curved surfaces are curved in the same direction. In some embodiments, the third and fourth curved surfaces are curved in the same direction. In some embodiments: a tangent line of the first curved surface at an intersection of the first curved surface and the front face is angled at a first angle with respect to the front face, wherein the first angle is less than 90°; and a tangent line of the third curved surface at an intersection of the third curved surface and the front face is angled at a second angle with respect to the front face that is substantially equal to the first angle.

In some embodiments, said textured pattern on the front face is configured to replicate an appearance of stucco. In some embodiments, said textured pattern on the front face comprises a knockdown textured pattern. In some embodiments, said textured pattern on the front face comprises a bush hammered stone textured pattern. In some embodiments, said textured pattern on the front face comprises a slate textured pattern. In some embodiments, said textured pattern on the front face comprises a brushed concrete textured pattern.

In some embodiments, the first and second cladding elements are panels. In some embodiments, the building substrate comprises a weather resistant barrier and one or more framing members. In some embodiments, the planar surface is substantially parallel to the rear face. In some embodiments, the plurality of intermediate grooves do not include said textured pattern. In some embodiments, the first and second mating edges do not include said textured pattern. In some embodiments, the first curved surface, second curved surface, third curved surface, fourth curved surface, and the planar surface are the only surfaces of each of the plurality of intermediate grooves. In some embodiments, the planar surface is the only non-curved surface of each of the plurality of grooves.

In a second aspect of the present technology, a cladding system configured to be installed on an exterior of a building substrate is described. The cladding system comprises a plurality of cladding elements and at least one trim element. The plurality of cladding elements comprises at least a first cladding element and a second cladding element, each of the first and second cladding elements comprising fiber cement and further comprising: a front face configured to face away from the building substrate when each of the first and second cladding elements is secured to the building substrate, wherein the front face comprises a textured pattern; a rear face opposite the front face and configured to face toward the building substrate when each of the first and second cladding elements is secured to the building substrate; a first mating edge extending between the front and rear faces and extending along a length or height of each of the first and second cladding elements; and a second mating edge opposite the first mating edge and extending between the front and rear faces and along the length or height of each of the first and second cladding elements, wherein the first mating edge of the first cladding element is configured to mate with the second mating edge of the second cladding element to form a joint groove extending along the length or height of each of the first and second cladding elements. The at least one trim element is configured to be secured to the building substrate. The at least one trim element comprises one or more channels configured to receive a portion of at least one of the first and second cladding elements.

In some embodiments, said textured pattern on the front face is configured to replicate an appearance of stucco. In some embodiments, said textured pattern on the front face comprises a knockdown textured pattern. In some embodiments, said textured pattern on the front face comprises a bush hammered stone textured pattern. In some embodiments, said textured pattern on the front face comprises a slate textured pattern. In some embodiments, said textured pattern on the front face comprises a brushed concrete textured pattern.

In some embodiments, the cladding system further comprises at least one intermediate groove recessed from the front face. In some embodiments, the at least one intermediate groove does not include said textured pattern. In some embodiments, the at least one intermediate groove extends substantially parallel to the first and second mating edges. In some embodiments, the at least one intermediate groove comprises: a first curved surface extending from the front face at least partially toward the rear face and having a first radius of curvature; a second curved surface connected to the first curved surface and having a second radius of curvature that is different than the first radius of curvature of the first curved surface; a third curved surface spaced from the first curved surface, the third curved surface extending from the front face at least partially toward the rear face and having a third radius of curvature; a fourth curved surface connected to the third curved surface and having a fourth radius of curvature that is different than the third radius of curvature of the third curved surface; and a planar surface connected to and positioned between the second and fourth curved surfaces, wherein the planar surface is substantially parallel to the front face.

In some embodiments, the second radius of curvature of the second curved surface is smaller than the first radius of curvature of the first curved surface. In some embodiments, the third curved surface is opposite to the first curved surface. In some embodiments, the third radius of curvature of the third curved surface is substantially equal to the first radius of curvature of the first curved surface. In some embodiments, the fourth radius of curvature of the fourth curved surface is smaller than the third radius of curvature of the third curved surface. In some embodiments, the fourth radius of curvature of the fourth curved surface is substantially equal to the second radius of curvature of the second curved surface. In some embodiments, each of the first radius of curvature and the third radius of curvature is between approximately 0.3 inch (7.6 mm) and approximately 0.5 inch (12.7 mm). In some embodiments, a ratio between the first radius of curvature of the first curved surface and the second radius of curvature of the second curved surface is between approximately 10 and approximately 12. In some embodiments, a ratio between the third radius of curvature of the third curved surface and the fourth radius of curvature of the fourth curved surface is between approximately 10 and approximately 12. In some embodiments, each of the second radius of curvature and the fourth radius of curvature is between approximately 0.03 inch (0.76 mm) and approximately 0.05 inch (1.3 mm).

In some embodiments, the first and second curved surfaces are curved in the same direction. In some embodiments, the third and fourth curved surfaces are curved in the same direction. In some embodiments, the first curved surface, second curved surface, third curved surface, fourth curved surface, and the planar surface are the only surfaces of the at least one intermediate groove. In some embodiments, the planar surface is the only non-curved surface of the at least one intermediate groove. In some embodiments: a tangent line of the first curved surface at an intersection of the first curved surface and the front face is angled at a first angle with respect to the front face, wherein the first angle is less than 90°; and a tangent line of the third curved surface at an intersection of the third curved surface and the front face is angled at a second angle with respect to the front face that is substantially equal to the first angle. In some embodiments, the first and second cladding elements are panels. In some embodiments, the first and second mating edges do not include said textured pattern. In some embodiments, the building substrate comprises a weather resistant barrier and one or more framing members. In some embodiments, the building substrate further comprises sheathing positioned between the weather resistant barrier and the one or more framing members.

In a third aspect of the present technology, a method of installing a cladding system on an exterior of a building substrate is described. The method comprises: securing at least one trim element to the building substrate, wherein the at least one trim element comprises one or more channels; obtaining at least a first cladding element and a second cladding element, each of the first and second cladding elements comprising fiber cement and further comprising: a front face comprising a textured pattern; a rear face opposite the front face; a first mating edge extending between the front and rear faces and along a length or height of each of the first and second cladding elements; and a second mating edge opposite the first mating edge and extending between the front and rear faces and along the length or height of each of the first and second cladding elements; positioning a portion of at least one of the first and second cladding elements within one of the one or more channels of the at least one trim element; positioning the first mating edge of the first cladding element adjacent to the second mating edge of the second cladding element to form a joint groove extending along the length or height of each of the first and second cladding elements; and securing the first and second cladding elements to the building substrate.

In some embodiments, said building substrate comprises a weather resistant barrier and a plurality of framing members, and wherein said securing at least one trim element to the building substrate comprises inserting one or more fasteners through the at least one trim element and the weather resistant barrier and into one of the plurality of framing members. In some embodiments, said building substrate further comprises sheathing, and wherein said securing the at least one trim element to the building substrate comprises inserting one or more fasteners through the at least one trim element, weather resistant barrier, sheathing, and into said one of the plurality of framing members. In some embodiments, the method further comprises cutting said at least one of the first and second cladding elements prior to positioning said portion of said at least one of the first and second cladding elements within said one of the one or more channels of the at least one trim element. In some embodiments, said cutting said at least one of the first and second cladding elements comprises cutting said at least one of the first and second cladding elements at an approximately 45° angle prior to positioning said portion of said at least one of the first and second cladding elements within said one of the one or more channels of the at least one trim element. In some embodiments, the method further comprises positioning the first cladding element vertically above the second cladding element such that said joint groove extends in a generally horizontal direction along the building substrate. In some embodiments, said positioning said portion of said at least one of the first and second cladding elements within said one of the one or more channels of the at least one trim element comprises: positioning a first portion of the first cladding element within said one of the one or more channels of the at least one trim element; and positioning a second portion of the second cladding element within said one of the one or more channels of the at least one trim element. In some embodiments, said positioning the first cladding element vertically above the second cladding element occurs: after said positioning said first portion of the first cladding element within said one of the one or more channels of the at least one trim element; and before said positioning said second portion of the second cladding element within said one of the one or more channels of the at least one trim element.

In some embodiments, the method further comprises applying a sealing agent along said at least one of the first and second cladding elements proximate said portion of at least one of the first and second cladding elements after positioning said portion within said one of the one or more channels of the at least one trim element. In some embodiments, the method further comprises positioning the first cladding element horizontally adjacent the second cladding element such that said joint groove extends in a generally vertical direction along the building substrate.

In some embodiments, the method further comprises applying a sealing agent along at least one of the first mating edge of the first cladding element and the second mating edge of the second cladding element prior to said positioning the first mating edge of the first cladding element adjacent to the second mating edge of the second cladding element to form said joint groove. In some embodiments, said positioning said portion of at least one of the first and second cladding elements within said one of the one or more channels of the at least one trim element comprises positioning a first portion of the first cladding element within said one of the one or more channels of the at least one trim element. In some embodiments, the method further comprises applying a sealing agent along the first cladding element proximate said first portion of the first cladding element after positioning said portion within said one of the one or more channels of the at least one trim element. In some embodiments, the method further comprises positioning the first and second cladding elements such that said joint groove is aligned with a framing member of the building substrate.

In some embodiments, the building substrate comprises a plurality of framing members and a weather resistant barrier, and wherein the method further comprises positioning sealing tape between said joint groove and said weather resistant barrier and along a height of said joint groove. In some embodiments, said securing the first and second cladding elements to the building substrate comprises inserting a plurality of fasteners through each of the first and second cladding elements and into framing members of the building substrate. In some embodiments, the plurality of fasteners are pre-finished. In some embodiments, the method further comprises positioning a portion of a flashing element within said one of the one or more channels of the at least one trim element.

In some embodiments, the method further comprises cutting said flashing element prior to positioning said portion of the flashing element within said one of the one or more channels of the at least one trim element. In some embodiments, said cutting said flashing element comprises cutting said flashing element at an approximately 45° angle prior to positioning said portion of the flashing element within said one of the one or more channels of the at least one trim element. In some embodiments, said positioning said portion of at least one of the first and second cladding elements within said one of the one or more channels of the at least one trim element occurs after said positioning said portion of the flashing element within said one of the one or more channels of the at least one trim element. In some embodiments, the method further comprises positioning a flashing element over a top edge of at least one of the first and second cladding elements and securing the flashing element to the building substrate. In some embodiments, the method further comprises applying a sealing agent along at least a portion of said top edge prior to said positioning the flashing element over the top edge.

In some embodiments, the method further comprises positioning a portion of the flashing element within said one of the one or more channels of the at least one trim element. In some embodiments, the method further comprises cutting said flashing element prior to positioning said portion of the flashing element within said one of the one or more channels of the at least one trim element. In some embodiments, said cutting said flashing element comprises cutting said flashing element at an approximately 45° angle prior to positioning said portion of the flashing element within said one of the one or more channels of the at least one trim element.

In some embodiments, each of the first and second cladding elements further comprises at least one intermediate groove recessed from the front face. In some embodiments, the at least one intermediate groove extends substantially parallel to the first and second mating edges. In some embodiments, the at least one intermediate groove does not include said textured pattern.

In some embodiments, the at least one intermediate groove comprises: a first curved surface extending from the front face at least partially toward the rear face and having a first radius of curvature; a second curved surface connected to the first curved surface and having a second radius of curvature that is different than the first radius of curvature of the first curved surface; a third curved surface spaced from the first curved surface, the third curved surface extending from the front face at least partially toward the rear face and having a third radius of curvature; a fourth curved surface connected to the third curved surface and having a fourth radius of curvature that is different than the third radius of curvature of the third curved surface; and a planar surface connected to and positioned between the second and fourth curved surfaces, wherein the planar surface is substantially parallel to the front face.

In some embodiments, the second radius of curvature of the second curved surface is smaller than the first radius of curvature of the first curved surface. In some embodiments, the third curved surface is opposite to the first curved surface. In some embodiments, the third radius of curvature of the third curved surface is substantially equal to the first radius of curvature of the first curved surface. In some embodiments, the fourth radius of curvature of the fourth curved surface is smaller than the third radius of curvature of the third curved surface. In some embodiments, the fourth radius of curvature of the fourth curved surface is substantially equal to the second radius of curvature of the second curved surface. In some embodiments: a ratio between the first radius of curvature of the first curved surface and the second radius of curvature of the second curved surface is between approximately 10 and approximately 12; and a ratio between the third radius of curvature of the third curved surface and the fourth radius of curvature of the fourth curved surface is between approximately 10 and approximately 12.

In some embodiments, the first and second curved surfaces are curved in the same direction and wherein the third and fourth curved surfaces are curved in the same direction. In some embodiments, the first curved surface, second curved surface, third curved surface, fourth curved surface, and the planar surface are the only surfaces of the at least one intermediate groove. In some embodiments, the planar surface is the only non-curved surface of the at least one intermediate groove. In some embodiments, the first and second cladding elements are panels. In some embodiments, the first and second mating edges do not include said textured pattern.

In a fourth aspect of the present technology, a cladding panel configured to be secured to a building substrate is described. The cladding panel comprises fiber cement and further comprises: a front face configured to face away from the building substrate when the cladding panel is secured to the building substrate, wherein the front face comprises a textured pattern; a rear face opposite the front face and configured to face toward the building substrate when the cladding panel is secured to the building substrate; a first mating edge extending between the front and rear faces and extending along a length or height of the cladding panel, wherein the first mating edge comprises a profile including a plurality of surfaces, at least one of said plurality of surfaces being non-perpendicular relative to both of the front face and the rear face; a second mating edge opposite the first mating edge and extending between the front and rear faces and along the length or height of the cladding panel, wherein the second mating edge comprises a profile including a plurality of surfaces, at least one of said plurality of surfaces of the second mating edge being non-perpendicular relative to both of the front face and the rear face; and a plurality of intermediate grooves recessed from the front face and extending substantially parallel to the first and second mating edges. Each of the plurality of intermediate grooves comprises: a first curved surface extending from the front face at least partially toward the rear face and having a first radius of curvature; a second curved surface connected to the first curved surface and having a second radius of curvature that is smaller than the first radius of curvature of the first curved surface; a third curved surface spaced from and opposite to the first curved surface, the third curved surface extending from the front face at least partially toward the rear face and having a third radius of curvature that is substantially equal to the first radius of curvature of the first curved surface; a fourth curved surface connected to the third curved surface and having a fourth radius of curvature that is smaller than the third radius of curvature of the third curved surface, wherein the fourth radius of curvature is substantially equal to the second radius of curvature of the second curved surface; and a planar surface connected to and positioned between the second and fourth curved surfaces, wherein the planar surface is substantially parallel to the front face.

In some embodiments, each of the first radius of curvature and the third radius of curvature is between approximately 0.3 inch (7.6 mm) and approximately 0.5 inch (12.7 mm). In some embodiments, a ratio between the first radius of curvature of the first curved surface and the second radius of curvature of the second curved surface is between approximately 10 and approximately 12. In some embodiments, a ratio between the third radius of curvature of the third curved surface and the fourth radius of curvature of the fourth curved surface is between approximately 10 and approximately 12. In some embodiments, each of the second radius of curvature and the fourth radius of curvature is between approximately 0.03 inch (0.76 mm) and approximately 0.05 inch (1.3 mm). In some embodiments, the first and second curved surfaces are curved in the same direction and wherein the third and fourth curved surfaces are curved in the same direction.

In some embodiments: a tangent line of the first curved surface at an intersection of the first curved surface and the front face is angled at a first angle with respect to the front face, wherein the first angle is less than 90°; and a tangent line of the third curved surface at an intersection of the third curved surface and the front face is angled at a second angle with respect to the front face that is substantially equal to the first angle. In some embodiments, said textured pattern on the front face is configured to replicate an appearance of stucco. In some embodiments, the planar surface is substantially parallel to the rear face. In some embodiments, the plurality of intermediate grooves do not include said textured pattern. In some embodiments, the first and second mating edges do not include said textured pattern. In some embodiments, the first curved surface, second curved surface, third curved surface, fourth curved surface, and the planar surface are the only surfaces of each of the plurality of intermediate grooves. In some embodiments, the planar surface is the only non-curved surface of each of the plurality of grooves. In some embodiments, the first mating edge of the cladding panel is configured to mate with a first mating edge of an additional cladding panel. In some embodiments, the second mating edge of the cladding panel is configured to mate with a second mating edge of the additional cladding panel.

In some embodiments, any of the cladding panels described above are manufactured using a Hatschek process.

In a fifth aspect of the present technology, a cladding element configured to be secured to a building substrate is described. The cladding element comprises fiber cement and further comprises: a front face comprising a textured pattern; a rear face opposite the front face; a first mating edge extending between the front and rear faces; a second mating edge opposite the first mating edge and extending between the front and rear faces; at least one intermediate groove recessed from the front face and extending along a length or height of the cladding element. The at least one intermediate groove comprises: a first curved surface extending from the front face at least partially toward the rear face and having a first radius of curvature; a second curved surface connected to the first curved surface and having a second radius of curvature that is different than the first radius of curvature of the first curved surface; a third curved surface spaced from the first curved surface, the third curved surface extending from the front face at least partially toward the rear face and having a third radius of curvature; a fourth curved surface connected to the third curved surface and having a fourth radius of curvature that is different than the third radius of curvature of the third curved surface; and a planar surface connected to and positioned between the second and fourth curved surfaces, wherein the planar surface is substantially parallel to the front face.

In some embodiments, the at least one intermediate groove does not include said textured pattern. In some embodiments, the at least one intermediate groove extends substantially parallel to the first and second mating edges. In some embodiments, the second radius of curvature of the second curved surface is smaller than the first radius of curvature of the first curved surface. In some embodiments, the third curved surface is opposite to the first curved surface. In some embodiments, the third radius of curvature of the third curved surface is substantially equal to the first radius of curvature of the first curved surface. In some embodiments, the fourth radius of curvature of the fourth curved surface is smaller than the third radius of curvature of the third curved surface. In some embodiments, the fourth radius of curvature of the fourth curved surface is substantially equal to the second radius of curvature of the second curved surface. In some embodiments, each of the first radius of curvature and the third radius of curvature is between approximately 0.3 inch (7.6 mm) and approximately 0.5 inch (12.7 mm).

In some embodiments, a ratio between the first radius of curvature of the first curved surface and the second radius of curvature of the second curved surface is between approximately 10 and approximately 12. In some embodiments, a ratio between the third radius of curvature of the third curved surface and the fourth radius of curvature of the fourth curved surface is between approximately 10 and approximately 12. In some embodiments, each of the second radius of curvature and the fourth radius of curvature is between approximately 0.03 inch (0.76 mm) and approximately 0.05 inch (1.3 mm). In some embodiments, the first and second curved surfaces are curved in the same direction and wherein the third and fourth curved surfaces are curved in the same direction. In some embodiments, the first curved surface, second curved surface, third curved surface, fourth curved surface, and the planar surface are the only surfaces of the at least one intermediate groove. In some embodiments, the planar surface is the only non-curved surface of the at least one intermediate groove.

In some embodiments: a tangent line of the first curved surface at an intersection of the first curved surface and the front face is angled at a first angle with respect to the front face, wherein the first angle is less than 90°; and a tangent line of the third curved surface at an intersection of the third curved surface and the front face is angled at a second angle with respect to the front face that is substantially equal to the first angle. In some embodiments, the cladding element is a panel. In some embodiments, the first and second mating edges do not include said textured pattern. In some embodiments, the first mating edge of the cladding element is configured to mate with a first mating edge of an additional cladding element. In some embodiments, the second mating edge of the cladding element is configured to mate with a second mating edge of the additional cladding element.

In some embodiments, any of the cladding panels described above are manufactured using a Hatschek process.

In a sixth aspect of the present technology, a cladding panel configured to be secured to a building substrate is described. The cladding panel comprises fiber cement and further comprises: a front face configured to face away from the building substrate when the cladding panel is secured to the building substrate, wherein the front face comprises a textured pattern; a rear face opposite the front face and configured to face toward the building substrate when the cladding panel is secured to the building substrate; a first mating edge extending between the front and rear faces and extending along a length or height of the cladding panel, wherein the first mating edge comprises a profile including a plurality of surfaces, at least one of said plurality of surfaces being non-perpendicular relative to both of the front face and the rear face; and a second mating edge opposite the first mating edge and extending between the front and rear faces and along the length or height of the cladding panel, wherein the second mating edge comprises a profile including a plurality of surfaces, at least one of said plurality of surfaces of the second mating edge being non-perpendicular relative to both of the front face and the rear face.

In some embodiments, said textured pattern on the front face is configured to replicate an appearance of stucco. In some embodiments, said textured pattern on the front face comprises a knockdown textured pattern. In some embodiments, said textured pattern on the front face comprises a bush hammered stone textured pattern. In some embodiments, said textured pattern on the front face comprises a slate textured pattern. In some embodiments, said textured pattern on the front face comprises a brushed concrete textured pattern.

In some embodiments, the cladding panel further comprises a plurality of intermediate grooves recessed from the front face. In some embodiments, the plurality of intermediate grooves extend substantially parallel to the first and second mating edges. In some embodiments, each of the plurality of intermediate grooves comprises: a first curved surface extending from the front face at least partially toward the rear face and having a first radius of curvature; a second curved surface connected to the first curved surface and having a second radius of curvature that is smaller than the first radius of curvature of the first curved surface; a third curved surface spaced from and opposite to the first curved surface, the third curved surface extending from the front face at least partially toward the rear face and having a third radius of curvature that is substantially equal to the first radius of curvature of the first curved surface; a fourth curved surface connected to the third curved surface and having a fourth radius of curvature that is smaller than the third radius of curvature of the third curved surface, wherein the fourth radius of curvature is substantially equal to the second radius of curvature of the second curved surface; and a planar surface connected to and positioned between the second and fourth curved surfaces, wherein the planar surface is substantially parallel to the front face.

In some embodiments, each of the first radius of curvature and the third radius of curvature is between approximately 0.3 inch (7.6 mm) and approximately 0.5 inch (12.7 mm). In some embodiments, a ratio between the first radius of curvature of the first curved surface and the second radius of curvature of the second curved surface is between approximately 10 and approximately 12. In some embodiments, a ratio between the third radius of curvature of the third curved surface and the fourth radius of curvature of the fourth curved surface is between approximately 10 and approximately 12. In some embodiments, each of the second radius of curvature and the fourth radius of curvature is between approximately 0.03 inch (0.76 mm) and approximately 0.05 inch (1.3 mm). In some embodiments, the first and second curved surfaces are curved in the same direction and wherein the third and fourth curved surfaces are curved in the same direction.

In some embodiments: a tangent line of the first curved surface at an intersection of the first curved surface and the front face is angled at a first angle with respect to the front face, wherein the first angle is less than 90°; and a tangent line of the third curved surface at an intersection of the third curved surface and the front face is angled at a second angle with respect to the front face that is substantially equal to the first angle. In some embodiments, the planar surface is substantially parallel to the rear face. In some embodiments, the plurality of intermediate grooves do not include said textured pattern. In some embodiments, the first and second mating edges do not include said textured pattern. In some embodiments, the first curved surface, second curved surface, third curved surface, fourth curved surface, and the planar surface are the only surfaces of each of the plurality of intermediate grooves. In some embodiments, the planar surface is the only non-curved surface of each of the plurality of grooves. In some embodiments, the first mating edge of the cladding panel is configured to mate with a first mating edge of an additional cladding panel. In some embodiments, the second mating edge of the cladding panel is configured to mate with a second mating edge of the additional cladding panel.

In some embodiments, any of the cladding panels described above are manufactured using a Hatschek process.

In a seventh aspect of the present technology, a wall panel system for attachment to the exterior of a building structure is described. The wall panel system comprises: a plurality of fiber cement panels, each fiber cement panel comprising a pre-textured exterior surface having one or more integrally formed patterns thereon, wherein the one or more integrally formed patterns provides the fiber cement panel with a surface texture that does not resemble fiber cement, wherein the one or more integrally formed patterns are non-directional such that each fiber cement panel can be installed vertically or horizontally on the exterior of the building structure; and a plurality of fiber cement panel alignment members configured to be attached to an exterior corner of the building structure, each fiber cement panel alignment member comprising an elongate body having a first leg and a second leg, the first leg being positioned at an angle to the second leg, and at least one channel configured to receive an outer edge of each of two or more fiber cement panels so as to align the two or more fiber cement panels and conceal the outer edges of the two or more fiber cement panels; wherein the fiber cement panels and the fiber cement panel alignment members when installed on the exterior of the building structure together form a generally planar, textured wall surface bordered by the fiber cement panel alignment members, the textured wall surface having a textured finish that does not resemble fiber cement.

In some embodiments, said one or more integrally formed patterns is configured to replicate an appearance of stucco. In some embodiments, said one or more integrally formed patterns comprises a knockdown textured pattern. In some embodiments, said one or more integrally formed patterns comprises a bush hammered stone textured pattern. In some embodiments, said one or more integrally formed patterns comprises a slate textured pattern. In some embodiments, said one or more integrally formed patterns comprises a brushed concrete textured pattern.

In some embodiments, each of the plurality of fiber cement panels comprises an interior surface opposite said exterior surface and at least one intermediate groove recessed from the exterior surface. In some embodiments, the at least one intermediate groove comprises: a first curved surface extending from the exterior surface at least partially toward the interior surface and having a first radius of curvature; a second curved surface connected to the first curved surface and having a second radius of curvature that is different than the first radius of curvature of the first curved surface; a third curved surface spaced from the first curved surface, the third curved surface extending from the exterior surface at least partially toward the interior surface and having a third radius of curvature; a fourth curved surface connected to the third curved surface and having a fourth radius of curvature that is different than the third radius of curvature of the third curved surface; and a planar surface connected to and positioned between the second and fourth curved surfaces, wherein the planar surface is substantially parallel to the exterior surface.

In some embodiments, the second radius of curvature of the second curved surface is smaller than the first radius of curvature of the first curved surface. In some embodiments, the third curved surface is opposite to the first curved surface. In some embodiments, the third radius of curvature of the third curved surface is substantially equal to the first radius of curvature of the first curved surface. In some embodiments, the fourth radius of curvature of the fourth curved surface is smaller than the third radius of curvature of the third curved surface. In some embodiments, the fourth radius of curvature of the fourth curved surface is substantially equal to the second radius of curvature of the second curved surface. In some embodiments, each of the first radius of curvature and the third radius of curvature is between approximately 0.3 inch (7.6 mm) and approximately 0.5 inch (12.7 mm).

In some embodiments, a ratio between the first radius of curvature of the first curved surface and the second radius of curvature of the second curved surface is between approximately 10 and approximately 12. In some embodiments, a ratio between the third radius of curvature of the third curved surface and the fourth radius of curvature of the fourth curved surface is between approximately 10 and approximately 12. In some embodiments, each of the second radius of curvature and the fourth radius of curvature is between approximately 0.03 inch (0.76 mm) and approximately 0.05 inch (1.3 mm). In some embodiments, the first and second curved surfaces are curved in the same direction. In some embodiments, the third and fourth curved surfaces are curved in the same direction. In some embodiments, the first curved surface, second curved surface, third curved surface, fourth curved surface, and the planar surface are the only surfaces of the at least one intermediate groove.

In some embodiments, the planar surface is the only non-curved surface of the at least one intermediate groove. In some embodiments: a tangent line of the first curved surface at an intersection of the first curved surface and the exterior surface is angled at a first angle with respect to the exterior surface, wherein the first angle is less than 90°; and a tangent line of the third curved surface at an intersection of the third curved surface and the exterior surface is angled at a second angle with respect to the exterior surface that is substantially equal to the first angle.

In an eighth aspect of the present technology, a wall panel for attachment to a building structure is described. The wall panel comprises: a fiber cement substrate; a fiber cement exterior face that is visible when the wall panel is attached to the building structure; one or more textured patterns disposed on the fiber cement exterior face and integrally formed with the fiber cement substrate, wherein the one or more textured patterns provides the wall panel with a surface finish that does not resemble fiber cement, wherein the one or more textured patterns are non-directional such that the wall panel can be installed vertically or horizontally on the building structure; and a mating edge extending along an outer portion of the wall panel, the mating edge being configured to mate with a complementary mating edge on another wall panel in a manner so as to form a linear joint that is recessed from the fiber cement exterior face of the wall panel.

In some embodiments, said one or more textured patterns is configured to replicate an appearance of stucco. In some embodiments, said one or more textured patterns comprises a knockdown textured pattern. In some embodiments, said one or more textured patterns comprises a bush hammered stone textured pattern. In some embodiments, said one or more textured patterns comprises a slate textured pattern. In some embodiments, said one or more textured patterns comprises a brushed concrete textured pattern.

In some embodiments, the wall panel further comprises an interior face opposite the exterior face and at least one intermediate groove recessed from the exterior face. In some embodiments, the at least one intermediate groove comprises: a first curved surface extending from the exterior face at least partially toward the interior face and having a first radius of curvature; a second curved surface connected to the first curved surface and having a second radius of curvature that is different than the first radius of curvature of the first curved surface; a third curved surface spaced from the first curved surface, the third curved surface extending from the exterior face at least partially toward the interior face and having a third radius of curvature; a fourth curved surface connected to the third curved surface and having a fourth radius of curvature that is different than the third radius of curvature of the third curved surface; and a planar surface connected to and positioned between the second and fourth curved surfaces, wherein the planar surface is substantially parallel to the exterior face.

In some embodiments, the second radius of curvature of the second curved surface is smaller than the first radius of curvature of the first curved surface. In some embodiments, the third curved surface is opposite to the first curved surface. In some embodiments, the third radius of curvature of the third curved surface is substantially equal to the first radius of curvature of the first curved surface. In some embodiments, the fourth radius of curvature of the fourth curved surface is smaller than the third radius of curvature of the third curved surface. In some embodiments, the fourth radius of curvature of the fourth curved surface is substantially equal to the second radius of curvature of the second curved surface. In some embodiments, each of the first radius of curvature and the third radius of curvature is between approximately 0.3 inch (7.6 mm) and approximately 0.5 inch (12.7 mm).

In some embodiments, a ratio between the first radius of curvature of the first curved surface and the second radius of curvature of the second curved surface is between approximately 10 and approximately 12. In some embodiments, a ratio between the third radius of curvature of the third curved surface and the fourth radius of curvature of the fourth curved surface is between approximately 10 and approximately 12. In some embodiments, each of the second radius of curvature and the fourth radius of curvature is between approximately 0.03 inch (0.76 mm) and approximately 0.05 inch (1.3 mm). In some embodiments, the first and second curved surfaces are curved in the same direction. In some embodiments, the third and fourth curved surfaces are curved in the same direction. In some embodiments, the first curved surface, second curved surface, third curved surface, fourth curved surface, and the planar surface are the only surfaces of the at least one intermediate groove. In some embodiments, the planar surface is the only non-curved surface of the at least one intermediate groove. In some embodiments: a tangent line of the first curved surface at an intersection of the first curved surface and the exterior face is angled at a first angle with respect to the exterior face, wherein the first angle is less than 90°; and a tangent line of the third curved surface at an intersection of the third curved surface and the exterior face is angled at a second angle with respect to the exterior face that is substantially equal to the first angle.

In a ninth aspect of the present technology, a cladding system configured to be installed on an exterior of a building substrate is described. The cladding system comprises a plurality of cladding elements comprising at least a first cladding element and a second cladding element. Each of the first and second cladding elements comprise fiber cement and further comprise a front face configured to face away from the building substrate when each of the first and second cladding elements are secured to the building substrate; a rear face opposite the front face, the rear face configured to face toward the building substrate when each of the first and second cladding elements are secured to the building substrate; a first mating edge between the front face and the rear face and extending along a length or height of each of the first and second cladding elements; and a second mating edge between the front face and the rear face and extending along the length or height of each of the first and second cladding elements, the second mating edge positioned opposite of the first mating edge. The first mating edge comprises a first curved surface extending from the front face at least partially toward the rear face, the first curved surface having a first radius of curvature; a second curved surface connected to the first curved surface, the second curved surface having a second radius of curvature that is different from the first radius of curvature; a first planar surface connected to the second curved surface, wherein the first planar surface is parallel to the front face; and an abutment surface connected to the first planar surface, wherein the abutment surface is perpendicular to the first planar surface and the front face. The second mating edge comprises a first curved surface extending from the front face at least partially toward the rear face, the first curved surface of the second mating edge having a first radius of curvature that is equal to the first radius curvature of the first curved surface of the first mating edge; a second curved surface connected to the first curved surface of the second mating edge, the second curved surface of the second mating edge having a second radius of curvature that is different from the first radius of curvature of the first curved surface of the second mating edge; and an abutment surface connected to the second curved surface of the second mating edge, wherein the abutment surface of the second mating edge is perpendicular the front face. When the abutment surface of the first mating edge of the first cladding element contacts the abutment surface of the second mating edge of the second cladding element, the first and second curved surfaces and first planar surface of the first mating edge along with the first and second curved surfaces of the second mating edge form a joint groove extending along the first and second mating edges.

In some embodiments, the first mating edge further comprises a second planar surface extending from the rear face at least partially toward the front face, wherein the second planar surface is perpendicular to the rear face; and a third planar surface connected to and positioned between the abutment surface and the second planar surface of the first mating edge, wherein the third planar surface is perpendicular to the abutment surface and the second planar surface of the first mating edge; and the second mating edge further comprises a first planar surface extending from the rear face at least partially toward the front face, wherein the first planar surface of the second mating edge is perpendicular to the rear face; and a second planar surface connected to and positioned between the abutment surface and the first planar surface of the second mating edge, wherein the second planar surface of the second mating edge is perpendicular to the abutment surface and the first planar surface of the second mating edge; and when the abutment surface of the first mating edge of the first cladding element contacts the abutment surface of the second mating edge of the second cladding element, the first planar surface of the second mating edge is spaced from the second planar surface of the first mating edge by a first gap. In some embodiments, the first gap is between approximately 0.01 inch and approximately 0.1 inch. In some embodiments, when the abutment surface of the first mating edge of the first cladding element contacts the abutment surface of the second mating edge of the second cladding element, the second planar surface of the second mating edge is spaced from the third planar surface of the first mating edge by a second gap. In some embodiments, the first gap is greater than the second gap. In some embodiments, the second gap is between approximately 0.01 inch and approximately 0.05 inch. In some embodiments, a portion of the first mating edge is chamfered proximate the second and third planar surfaces of the first mating edge to form an angled surface between the second and third planar surfaces of the first mating edge, wherein the angled surface is transverse with respect both of the second and third planar surfaces of the first mating edge.

In some embodiments, the first radius of curvature of the first curved surface of the first mating edge is greater than the second radius of curvature of the second curved surface of the first mating edge. In some embodiments, a ratio of the first radius of curvature of the first curved surface of the first mating edge to the second radius of curvature of the second curved surface of the first mating edge is between 4 and 12. In some embodiments, a ratio of the first radius of curvature of the first curved surface of the first mating edge to the second radius of curvature of the second curved surface of the first mating edge is between 8 and 9. In some embodiments, the first planar surface of the first mating edge transitions to the abutment surface of the first mating edge at a first transition region, the first transition region having a third radius of curvature. In some embodiments, the third radius of curvature of the first transition region of the first mating edge is smaller than the first radius of curvature of the first curved surface of the first mating edge and the second radius of curvature of the second curved surface of the first mating edge.

In some embodiments, each of the first and second cladding elements further comprise at least one intermediate groove recessed from the front face, the at least one intermediate groove spaced from and extending parallel to the first and second mating edges, wherein the at least one intermediate groove comprises a first curved surface extending from the front face at least partially toward the rear face, the first curved surface of the at least one intermediate groove having a first radius of curvature; a second curved surface connected to the first curved surface of the at least one intermediate groove, the second curved surface of the at least one intermediate groove having a second radius of curvature that is different from the first radius of curvature of the first curved surface of the at least one intermediate groove; a third curved surface spaced from and opposite to the first curved surface of the at least one intermediate groove and extending from the front face at least partially toward the rear face, the third curved surface of the at least one intermediate groove having a third radius of curvature that is equal to the first radius of curvature of the first curved surface of the at least one intermediate groove; a fourth curved surface connected to the third curved surface of the at least one intermediate groove, the fourth curved surface having a fourth radius of curvature that is different from the third radius of curvature of the third curved surface of the at least one intermediate groove; and a planar surface connected to and positioned between the second and fourth curved surfaces of the at least one intermediate groove, wherein the planar surface of the at least one intermediate groove is parallel to the front face. In some embodiments, the planar surface of the at least one intermediate groove comprises a length that is within 5% of a length of the first planar surface of the first mating edge. In some embodiments, the first radius of curvature of the first curved surface of the at least one intermediate groove is equal to the first radius of curvature of the first curved surface of the first mating edge; and the third radius of curvature of the third curved surface of the at least one intermediate groove is equal to the first radius of curvature of the first curved surface of the second mating edge.

In some embodiments, the first curved surface of the first mating edge has a greater length than the second curved surface of the first mating edge and wherein the first curved surface of the second mating edge has a greater length than the second curved surface of the second mating edge. In some embodiments, the first and second curved surfaces of the first mating edge are curved in the same direction. In some embodiments, the first and second curved surfaces of the second mating edge are curved in opposite directions. In some embodiments, a thickness of each of the first and second cladding elements is between approximately 0.1 inch (2.5 mm) and approximately 1.5 inch (38.1 mm). In some embodiments, the second radius of curvature of the second curved surface of the first mating edge is less than approximately 0.05 in (1.3 mm). In some embodiments, the first radius of curvatures of the first curved surfaces of the first and second mating edges are between approximately 0.1 in (2.5 mm) and 1 in (25.4 mm). In some embodiments, the front face comprises a textured pattern on at least a portion thereof, the textured pattern configured to replicate an appearance of stucco. In some embodiments, the first and second cladding elements are panels.

In a tenth aspect of the present technology, a cladding element configured to secure to an exterior of a building substrate is described. The cladding element comprises fiber cement and further comprises a front face; a rear face opposite the front face; a first mating edge extending along a length or height of the cladding element between the front face and the rear face; a second mating edge extending along the length or height of the cladding element between the front face and the rear face, the second mating edge positioned opposite of the first mating edge; and at least one intermediate groove recessed from the front face and spaced from the first and second mating edges, the at least one intermediate groove extending parallel to the first and second mating edges. The first mating edge comprises a first curved surface extending from the front face at least partially toward the rear face, the first curved surface having a first radius of curvature; a second curved surface connected to the first curved surface, the second curved surface having a second radius of curvature that is different than the first radius of curvature; a first planar surface connected to the second curved surface, wherein the first planar surface is parallel to the front face; and an abutment surface connected to the first planar surface, wherein the abutment surface is perpendicular to the first planar surface and the front face. The second mating edge comprises a first curved surface extending from the front face at least partially toward the rear face, the first curved surface of the second mating edge having a first radius of curvature, wherein the first radius of curvature of the first curved surface of the second mating edge is equal to the first radius of curvature of the first curved surface of the first mating edge; a second curved surface connected to the first curved surface of the second mating edge, the second curved surface of the second mating edge having a second radius of curvature that is smaller than the first radius of curvature of the second mating edge; and an abutment surface connected to the second curved surface of the second mating edge, wherein the abutment surface of the second mating edge is perpendicular to the front face. The at least one intermediate groove comprises a first curved surface extending from the front face at least partially toward the rear face, the first curved surface of the at least one intermediate groove having a first radius of curvature; a second curved surface connected to the first curved surface of the at least one intermediate groove, the second curved surface having a second radius of curvature that is smaller than the first radius of curvature of the first curved surface of the at least one intermediate groove; a third curved surface spaced from and opposite to the first curved surface of the at least one intermediate groove and extending from the front face at least partially toward the rear face, the third curved surface of the at least one intermediate groove having a third radius of curvature that is equal to the first radius of curvature of the first curved surface of the at least one intermediate groove; a fourth curved surface connected to the third curved surface of the at least one intermediate groove, the fourth curved surface having a fourth radius of curvature that is smaller than the third radius of curvature of the third curved surface of the at least one intermediate groove; and a planar surface connected to and positioned between the second and fourth curved surfaces of the at least one intermediate groove, wherein the planar surface of the at least one intermediate groove is parallel to the front face.

In some embodiments, the planar surface of the at least one intermediate groove comprises a length that is within 5% of a length of the first planar surface of the first mating edge; the first radius of curvature of the first curved surface of the at least one intermediate groove is equal to the first radius of curvature of the first curved surface of the first mating edge; and the third radius of curvature of the third curved surface of the at least one intermediate groove is equal to the first radius of curvature of the first curved surface of the second mating edge.

In some embodiments, the first radius of curvature of the first curved surface of the first mating edge is greater than the second radius of curvature of the second curved surface of the first mating edge. In some embodiments, a ratio of the first radius of curvature of the first curved surface of the first mating edge to the second radius of curvature of the second curved surface of the first mating edge is between 4 and 12. In some embodiments, a ratio of the first radius of curvature of the first curved surface of the first mating edge to the second radius of curvature of the second curved surface of the first mating edge is between 8 and 9.

In some embodiments, the first curved surface of the first mating edge has a greater length than the second curved surface of the first mating edge and wherein the first curved surface of the second mating edge has a greater length than the second curved surface of the second mating edge. In some embodiments, the first and second curved surfaces of the first mating edge are curved in the same direction. In some embodiments, the first and second curved surfaces of the second mating edge are curved in opposite directions. In some embodiments, a thickness of the cladding element is between approximately 0.1 inch (2.5 mm) and approximately 1.5 inch (38.1 mm). In some embodiments, the second radius of curvature of the second curved surface of the first mating edge is less than approximately 0.05 in (1.3 mm). In some embodiments, the first radius of curvatures of the first curved surfaces of the first and second mating edges are between approximately 0.1 in (2.5 mm) and 1 in (25.4 mm). In some embodiments, the front face comprises a textured pattern on at least a portion thereof, the textured pattern configured to replicate an appearance of stucco.

In an eleventh aspect of the present technology, a cladding element configured to secure to an exterior of a building substrate is described. The cladding element comprises fiber cement and further comprises a front face; a rear face opposite the front face; a first mating edge extending along a length or height of the cladding element between the front face and the rear face; and a second mating edge extending along the length or height of the cladding element between the front face and the rear face, the second mating edge positioned opposite of the first mating edge. The first mating edge comprises a first curved surface extending from the front face at least partially toward the rear face, the first curved surface having a first radius of curvature; a second curved surface connected to the first curved surface, the second curved surface having a second radius of curvature that is different than the first radius of curvature; a first planar surface connected to the second curved surface, wherein the first planar surface is parallel to the front face; and an abutment surface connected to the first planar surface, wherein the abutment surface is perpendicular to the first planar surface and the front face. The second mating edge comprises a first curved surface extending from the front face at least partially toward the rear face, the first curved surface of the second mating edge having a first radius of curvature, wherein the first radius of curvature of the first curved surface of the second mating edge is equal to the first radius of curvature of the first curved surface of the first mating edge; a second curved surface connected to the first curved surface of the second mating edge, the second curved surface of the second mating edge having a second radius of curvature that is smaller than the first radius of curvature of the second mating edge; and an abutment surface connected to the second curved surface of the second mating edge, wherein the abutment surface of the second mating edge is perpendicular to the front face.

In some embodiments, the cladding element further comprises at least one intermediate groove recessed from the front face, the at least one intermediate groove spaced from and extending parallel to the first and second mating edges, wherein the at least one intermediate groove comprises a first curved surface extending from the front face at least partially toward the rear face, the first curved surface of the at least one intermediate groove having a first radius of curvature; a second curved surface connected to the first curved surface of the at least one intermediate groove, the second curved surface of the at least one intermediate groove having a second radius of curvature that is different from the first radius of curvature of the first curved surface of the at least one intermediate groove; a third curved surface spaced from and opposite to the first curved surface of the at least one intermediate groove and extending from the front face at least partially toward the rear face, the third curved surface of the at least one intermediate groove having a third radius of curvature; a fourth curved surface connected to the third curved surface of the at least one intermediate groove, the fourth curved surface having a fourth radius of curvature that is different from the third radius of curvature of the third curved surface of the at least one intermediate groove; and a planar surface connected to and positioned between the second and fourth curved surfaces of the at least one intermediate groove. In some embodiments, the third radius of curvature of the third curved surface of the at least one intermediate groove is equal to the first radius of curvature of the first curved surface of the at least one intermediate groove. In some embodiments, the planar surface of the at least one intermediate groove is parallel to the front face.

In some embodiments, the first radius of curvature of the first curved surface of the at least one intermediate groove is equal to the first radius of curvature of the first curved surface of the first mating edge; and the third radius of curvature of the third curved surface of the at least one intermediate groove is equal to the first radius of curvature of the first curved surface of the second mating edge. In some embodiments, the first curved surface of the first mating edge has a greater length than the second curved surface of the first mating edge and wherein the first curved surface of the second mating edge has a greater length than the second curved surface of the second mating edge. In some embodiments, a thickness of the cladding element is between approximately 0.1 inch (2.5 mm) and approximately 1.5 inch (38.1 mm). In some embodiments, the second radius of curvature of the second curved surface of the first mating edge is less than approximately 0.05 in (1.3 mm). In some embodiments, the first radius of curvatures of the first curved surfaces of the first and second mating edges are between approximately 0.1 in (2.5 mm) and 1 in (25.4 mm).

In a twelfth aspect of the present technology, a cladding system configured to be installed on an exterior of a building substrate is described. The cladding system comprises a plurality of fiber cement cladding elements comprising at least a first cladding element and a second cladding element, and at least one flashing element. Each of the first and second cladding elements is generally defined by a length and a height and comprises a front face configured to face away from the building substrate when each of the first and second cladding elements are secured to the building substrate, wherein the front face comprises a textured pattern on at least a portion thereof, the textured pattern configured to replicate an appearance of stucco; a rear face opposite the front face, the rear face configured to face toward the building substrate when each of the first and second cladding elements are secured to the building substrate; a top edge between the front face and the rear face and extending along the length; a bottom edge between the front face and the rear face and extending along the length, the bottom edge positioned opposite of the top edge; a first mating edge between the front face and the rear face and extending along the height; and a second mating edge between the front face and the rear face and extending along the height, the second mating edge positioned opposite of the first mating edge. The first mating edge comprises a first curved surface extending from the front face at least partially toward the rear face, the first curved surface having a first radius of curvature; a second curved surface connected to the first curved surface, the second curved surface having a second radius of curvature that is different from the first radius of curvature; a first planar surface connected to the second curved surface, wherein the first planar surface is parallel to the front face; and an abutment surface connected to the first planar surface, wherein the abutment surface is perpendicular to the first planar surface and the front face. The second mating edge comprises a first curved surface extending from the front face at least partially toward the rear face, the first curved surface of the second mating edge having a first radius of curvature that is equal to the first radius curvature of the first curved surface of the first mating edge; a second curved surface connected to the first curved surface of the second mating edge, the second curved surface of the second mating edge having a second radius of curvature that is different from the first radius of curvature of the first curved surface of the second mating edge; and an abutment surface connected to the second curved surface of the second mating edge, wherein the abutment surface of the second mating edge is perpendicular the front face; and wherein, when the abutment surface of the first mating edge of the first cladding element contacts the abutment surface of the second mating edge of the second cladding element, the first and second curved surfaces and first planar surface of the first mating edge along with the first and second curved surfaces of the second mating edge form a joint groove extending along the first and second mating edges. The at least one flashing element comprises a first arm configured to be secured to the building substrate and positioned in between portions of the rear faces of the first and second cladding elements and the building substrate; a second arm extending from and transverse to the first arm; a third arm extending from and transverse to the second arm, wherein the third arm comprises a height that is smaller than a height of the first arm; a channel formed by at least a portion of the first arm, the second arm, and the third arm, wherein the channel is sized to receive the bottom edge of the first and second cladding elements; and a fourth arm extending from the first arm across a portion of the channel towards the third arm, wherein the fourth arm is spaced from the second arm and comprises a length that is smaller than a length of the second arm, wherein the fourth arm is configured to at least partially support the bottom edges of the first and second cladding elements.

In some embodiments, the third arm is perpendicular to the second arm and parallel to the first arm. In some embodiments, the second arm is perpendicular to the first arm. In some embodiments, the at least one flashing element further comprises a fifth arm extending from the first arm, the fifth arm transverse to the first arm and spaced from the second arm; and a plurality of openings extending through a thickness of the second arm and spaced from one another along a length of the at least one flashing element, the plurality of openings providing a flow path for drainage flowing along portions of the front faces of the first and second cladding elements to travel out of the channel and to the fifth arm. In some embodiments, the fifth arm extends from the first arm at an angle that is between approximately 90° and approximately 105°. In some embodiments, the fifth arm extends from the first arm at an angle that is approximately 95°. In some embodiments, the at least one flashing element further comprises a sixth arm extending from and transverse to the fifth arm, the sixth arm parallel to the first arm and the third arm. In some embodiments, the sixth arm comprises a length that is greater than the length of the third arm. In some embodiments, the at least one flashing element further comprises a seventh arm extending from and transverse to the sixth arm, and wherein the seventh arm extends at least partially toward the building substrate when the at least one flashing element is secured to the building substrate.

In a thirteenth aspect of the present technology, a cladding system configured to be installed on an exterior of a building substrate is described. The cladding system comprises a plurality of fiber cement cladding elements comprising at least a first cladding element and a second cladding element, each of the first and second cladding elements generally defined by a length and a height; and at least one trim element configured to secure to the building substrate. Each of the first cladding elements comprises a front face configured to face away from the building substrate when each of the first and second cladding elements are secured to the building substrate; a rear face opposite the front face, the rear face configured to face toward the building substrate when each of the first and second cladding elements are secured to the building substrate; a first side edge between the front face and the rear face and extending along the height; a second side edge between the front face and the rear face and extending along the height, the second side edge positioned opposite of the first side edge; a first mating edge between the front face and the rear face and extending along the length; a second mating edge between the front face and the rear face and extending along the length, the second mating edge positioned opposite of the first mating edge; and at least one intermediate groove recessed from the front face and spaced from the first and second mating edges, the at least one intermediate groove extending parallel to the first and second mating edges. The first mating edge comprises a first curved surface extending from the front face at least partially toward the rear face, the first curved surface having a first radius of curvature; a second curved surface connected to the first curved surface, the second curved surface having a second radius of curvature that is different from the first radius of curvature; a first planar surface connected to the second curved surface, wherein the first planar surface is parallel to the front face; and an abutment surface connected to the first planar surface, wherein the abutment surface is perpendicular to the first planar surface and the front face. The second mating edge comprises a first curved surface extending from the front face at least partially toward the rear face, the first curved surface of the second mating edge having a first radius of curvature that is equal to the first radius curvature of the first curved surface of the first mating edge; a second curved surface connected to the first curved surface of the second mating edge, the second curved surface of the second mating edge having a second radius of curvature that is different from the first radius of curvature of the first curved surface of the second mating edge; and an abutment surface connected to the second curved surface of the second mating edge, wherein the abutment surface of the second mating edge is perpendicular the front face; and wherein, when the abutment surface of the first mating edge of the first cladding element contacts the abutment surface of the second mating edge of the second cladding element, the first and second curved surfaces and first planar surface of the first mating edge along with the first and second curved surfaces of the second mating edge form a joint groove extending along the first and second mating edges. The at least one trim element comprises one or more channels configured to receive at least one of the first and second side edges of each of the plurality of cladding elements.

In an fourteenth aspect of the present technology, a building trim system for finishing a building section is described. The building trim system comprises: at least one trim element, each trim element comprising: a trim body; at least one water management feature disposed on the trim body, and at least one trim element retaining formation.

In some embodiments, each trim body comprises: a trim body rear wall; and at least a first and a second trim body side wall.

In one embodiment, the at least one water management feature is disposed on a trim body side wall.

In one embodiment, the at least one water management feature is a channel.

In one embodiment, the at least one water management feature is a groove.

In one embodiment, at least a portion of the at least a first and second trim body side wall extend at a predetermined angle from the trim body rear wall.

In one embodiment, the at least a portion of at least a first trim body side wall extends at a predetermined angle between approximately 45° and approximately 135°.

In one embodiment, the at least a portion of a first trim body side wall extends at a predetermined angle of approximately 90°.

In one embodiment, the at least one water management feature comprises at least a portion of first trim body side wall, angled at 45 to 90° with respect to the trim body rear wall of the trim body.

In one embodiment, the trim element retaining formation comprises at least one trim retaining arm, each trim retaining arm extending from the trim body rear wall.

In one embodiment, the trim retaining arm further comprises an angled web, for providing a fixing face.

In one embodiment, the trim element is fixable to a building section through the trim retaining arm.

In one embodiment, each trim element retaining formation is disposed on a trim retaining arm.

In one embodiment, the trim element retaining formation comprises teeth.

In a fifteenth aspect of the present technology, a building trim system is described. The building trim system comprises at least one base trim element configured for accepting and retaining a trim element.

In one embodiment, each base trim element is directly fixable to a building section.

In one embodiment, each base trim element comprises:

a. a base trim central web portion;

b. a pair of base trim side arms comprising a first and a second base trim side arm, each of the first and second base trim side arms being spaced apart and extending from a respective side edge of the base trim central web, wherein the respective side edges of the base trim central web are opposing side edges; and c. a base trim retaining formation disposed on a portion of each base trim side arm, for accepting and retaining a trim element.

In one embodiment, at least one side arm of the pair of base trim side arms of the base trim element further comprises a flange portion.

In one embodiment, the flange portion further comprises an end arm portion.

In one embodiment, the trim element engaging formation is disposed on the end arm portion.

In one embodiment, the trim element engaging formation is a snap fit formation.

In one embodiment, at least one base trim element comprises an elongate "U" channel section.

In one embodiment, at least one base trim element comprises a discrete "U" section.

In one embodiment, the trim body is substantially polygonal in cross-section.

In one embodiment, the trim body is substantially rectangular in cross-section.

In one embodiment, the trim body is hollow.

In one embodiment, the trim body further comprises at least one reinforcing web.

In some embodiments, the building trim system further comprises a cover piece for disguising a joint between two adjacent trim elements.

In some embodiments, the building trim system further comprises an end piece.

In one embodiment, the end piece is an end closure piece, for providing an end cap for a trim element.

In one embodiment, the end piece is a corner connector, for connecting two adjacent trim elements.

In one embodiment, the corner connector further comprises an integrally formed cover strip.

In a sixteenth aspect of the present technology, a method of installing a building trim system is described. The method comprises the steps:

a. Providing a first trim element, b. Optionally cutting each end of the trim element to create a trim end face at a predetermined angle to suit the intended installation, c. Locating the trim element in a predetermined position adjacent an edge of a building section element to be trimmed, d. Directly fixing the trim element to the building section through the trim element retaining formation; and e. Repeating the steps above for any other edges of the building section element to be trimmed, bringing each further trim element end face into contact with a previously installed trim element end face.

In a seventeenth aspect of the present technology, a method of installing a building trim system is described. The method comprises the steps:

a. Providing at least one base trim element, configured to a predetermined length, b. Locating each trim base element in a respective predetermined position adjacent an edge of a building section element to be trimmed, and directly fixing through its central web portion to the building section, c. Providing a first trim element, configured to a predetermined length, d. Optionally cutting each end of the trim element to create a trim end face at a predetermined angle to suit the intended installation, e. Locating the trim element in a predetermined position adjacent an edge of a building section element to be trimmed, f. Connecting the trim element to the at least one base trim element, and g. Repeating the steps above for any subsequent edges of the building section element to be trimmed, bringing each subsequent trim element end face into contact with a previously installed trim element end face, if required.

In some embodiments, the method further comprises the steps of:

a. Preforming a trim element assembly corresponding to the desired finished trim configuration, by:

b. inserting a first insert formation of a first connector piece into an aperture of one trim element hollow shaped body and c. Inserting a second insert formation of a first connector into a corresponding aperture of a second trim element, and d. Repeating steps (i) and (ii) until the desired assembly is constructed, and e. Directly, or indirectly, fixing trim element assembly to building section in a predetermined location.

In one embodiment, the method further comprises a step of applying a sealant bead at least one joint between adjacent trim elements, for sealing the joints.

In one embodiment, the method further comprises the step of installing an accessory cover strip across at least one respective joint between adjacent trim elements, for covering and disguising the joint.

In one embodiment, the accessory cover strip is a snap fit cover strip.

In one embodiment, at least one connector piece is configured to include an integrally formed cover strip, for covering a joint between adjacent trim elements and disguising the joint.

In an eighteenth aspect of the present technology, a wall section comprises any of the building trim systems described above.

According to the present disclosure there is provided a cladding system as set out in appended claims 1 to 21 and claims 22 to 49. There is also provided a method of installing a cladding system as set out in appended claims 50 to 90. There is also provided a cladding panel as set out in appended claims 91 to 105. There is also provided a method of manufacturing a cladding panel as set out in appended claim 106. There is also provided a cladding element as set out in appended claims 107 to 126. There is also provided a method of manufacturing a cladding element as set out in appended claim 127. There is also provided a cladding panel as set out in appended claims 128 to 149. There is also provided a method of manufacturing a cladding panel as set out in appended claim 150. There is also provided a wall panel system as set out in appended claims 151 to 172. There is also provided a wall panel as set out in appended claims 173 to 194.

Additional Embodiments

1. A cladding system configured to be installed on an exterior of a building substrate, the cladding system comprising:

a plurality of cladding elements, the plurality of cladding elements comprising at least a first cladding element and a second cladding element, each of the first and second cladding elements comprising fiber cement and further comprising:

a front face configured to face away from the building substrate when each of the first and second cladding elements is secured to the building substrate, wherein the front face comprises a textured pattern;

a rear face opposite the front face and configured to face toward the building substrate when each of the first and second cladding elements is secured to the building substrate;

a first mating edge extending between the front and rear faces and extending along a length or height of each of the first and second cladding elements;

a second mating edge opposite the first mating edge and extending between the front and rear faces and along the length or height of each of the first and second cladding elements, wherein the first mating edge of the first cladding element is configured to mate with the second mating edge of the second cladding element to form a joint groove extending along the length or height of each of the first and second cladding elements; and a plurality of intermediate grooves recessed from the front face and extending substantially parallel to the first and second mating edges, wherein each of the plurality of intermediate grooves comprises:

a first curved surface extending from the front face at least partially toward the rear face and having a first radius of curvature;

a second curved surface connected to the first curved surface and having a second radius of curvature that is smaller than the first radius of curvature of the first curved surface;

a third curved surface spaced from and opposite to the first curved surface, the third curved surface extending from the front face at least partially toward the rear face and having a third radius of curvature that is substantially equal to the first radius of curvature of the first curved surface;

a fourth curved surface connected to the third curved surface and having a fourth radius of curvature that is smaller than the third radius of curvature of the third curved surface, wherein the fourth radius of curvature is substantially equal to the second radius of curvature of the second curved surface; and a planar surface connected to and positioned between the second and fourth curved surfaces, wherein the planar surface is substantially parallel to the front face.

2. The cladding system of Embodiment 1, further comprising at least one trim element configured to be secured to the building substrate, the at least one trim element comprising one or more channels configured to receive a portion of at least one of the first and second cladding elements.

3. The cladding system of Embodiment 1 or 2, wherein each of the first radius of curvature and the third radius of curvature is between approximately 0.3 inch (7.6 mm) and approximately 0.5 inch (12.7 mm).

4. The cladding system of any of Embodiments 1-3, wherein a ratio between the first radius of curvature of the first curved surface and the second radius of curvature of the second curved surface is between approximately 10 and approximately 12.

5. The cladding system of any of Embodiments 1-4, wherein a ratio between the third radius of curvature of the third curved surface and the fourth radius of curvature of the fourth curved surface is between approximately 10 and approximately 12.

6. The cladding system of any of Embodiments 1-5, wherein each of the second radius of curvature and the fourth radius of curvature is between approximately 0.03 inch (0.76 mm) and approximately 0.05 inch (1.3 mm).

7. The cladding system of any of Embodiments 1-6, wherein the first and second curved surfaces are curved in the same direction.

8. The cladding system of any of Embodiments 1-7, wherein the third and fourth curved surfaces are curved in the same direction.

9. The cladding system of any of Embodiments 1-8, wherein:

a tangent line of the first curved surface at an intersection of the first curved surface and the front face is angled at a first angle with respect to the front face, wherein the first angle is less than 90°; and a tangent line of the third curved surface at an intersection of the third curved surface and the front face is angled at a second angle with respect to the front face that is substantially equal to the first angle.

10. The cladding system of any of Embodiments 1-9, wherein said textured pattern on the front face is configured to replicate an appearance of stucco.

11. The cladding system of any of Embodiments 1-9, wherein said textured pattern on the front face comprises a knockdown textured pattern.

12. The cladding system of any of Embodiments 1-9, wherein said textured pattern on the front face comprises a bush hammered stone textured pattern.

13. The cladding system of any of Embodiments 1-9, wherein said textured pattern on the front face comprises a slate textured pattern.

14. The cladding system of any of Embodiments 1-9, wherein said textured pattern on the front face comprises a brushed concrete textured pattern.

15. The cladding system of any of Embodiments 1-14, wherein the first and second cladding elements are panels.

16. The cladding system of any of Embodiments 1-15, wherein the building substrate comprises a weather resistant barrier and one or more framing members.

17. The cladding system of any of Embodiments 1-16, wherein the planar surface is substantially parallel to the rear face.

18. The cladding system of any of Embodiments 1-17, wherein the plurality of intermediate grooves do not include said textured pattern.

19. The cladding system of any of Embodiments 1-18, wherein the first and second mating edges do not include said textured pattern.

20. The cladding system of any of Embodiments 1-19, wherein the first curved surface, second curved surface, third curved surface, fourth curved surface, and the planar surface are the only surfaces of each of the plurality of intermediate grooves.

21. The cladding system of any of Embodiments 1-20, wherein the planar surface is the only non-curved surface of each of the plurality of grooves.

22. A cladding system configured to be installed on an exterior of a building substrate, the cladding system comprising:

a plurality of cladding elements, the plurality of cladding elements comprising at least a first cladding element and a second cladding element, each of the first and second cladding elements comprising fiber cement and further comprising:

a front face configured to face away from the building substrate when each of the first and second cladding elements is secured to the building substrate, wherein the front face comprises a textured pattern;

a rear face opposite the front face and configured to face toward the building substrate when each of the first and second cladding elements is secured to the building substrate;

a first mating edge extending between the front and rear faces and extending along a length or height of each of the first and second cladding elements; and a second mating edge opposite the first mating edge and extending between the front and rear faces and along the length or height of each of the first and second cladding elements, wherein the first mating edge of the first cladding element is configured to mate with the second mating edge of the second cladding element to form a joint groove extending along the length or height of each of the first and second cladding elements; and at least one trim element configured to be secured to the building substrate, the at least one trim element comprising one or more channels configured to receive a portion of at least one of the first and second cladding elements.

23. The cladding system of Embodiment 22, wherein said textured pattern on the front face is configured to replicate an appearance of stucco.

24. The cladding system of Embodiment 22, wherein said textured pattern on the front face comprises a knockdown textured pattern.

25. The cladding system of Embodiment 22, wherein said textured pattern on the front face comprises a bush hammered stone textured pattern.

26. The cladding system of Embodiment 22, wherein said textured pattern on the front face comprises a slate textured pattern.

27. The cladding system of Embodiment 22, wherein said textured pattern on the front face comprises a brushed concrete textured pattern.

28. The cladding system of any of Embodiments 22-27, further comprising at least one intermediate groove recessed from the front face.

29. The cladding system of Embodiment 28, wherein the at least one intermediate groove does not include said textured pattern.

30. The cladding system of Embodiment 28 or 29, wherein the at least one intermediate groove extends substantially parallel to the first and second mating edges.

31. The cladding system of any of Embodiments 28-30, wherein the at least one intermediate groove comprises:

a first curved surface extending from the front face at least partially toward the rear face and having a first radius of curvature;

a second curved surface connected to the first curved surface and having a second radius of curvature that is different than the first radius of curvature of the first curved surface;

a third curved surface spaced from the first curved surface, the third curved surface extending from the front face at least partially toward the rear face and having a third radius of curvature;

a fourth curved surface connected to the third curved surface and having a fourth radius of curvature that is different than the third radius of curvature of the third curved surface; and a planar surface connected to and positioned between the second and fourth curved surfaces, wherein the planar surface is substantially parallel to the front face.

32. The cladding system of Embodiment 31, wherein the second radius of curvature of the second curved surface is smaller than the first radius of curvature of the first curved surface.

33. The cladding system of Embodiment 31 or 32, wherein the third curved surface is opposite to the first curved surface.

34. The cladding system of any of Embodiments 31-33, wherein the third radius of curvature of the third curved surface is substantially equal to the first radius of curvature of the first curved surface.

35. The cladding system of any of Embodiments 31-34, wherein the fourth radius of curvature of the fourth curved surface is smaller than the third radius of curvature of the third curved surface.

36. The cladding system of any of Embodiments 31-35, wherein the fourth radius of curvature of the fourth curved surface is substantially equal to the second radius of curvature of the second curved surface.

37. The cladding system of any of Embodiments 31-36, wherein each of the first radius of curvature and the third radius of curvature is between approximately 0.3 inch (7.6 mm) and approximately 0.5 inch (12.7 mm).

38. The cladding system of any of Embodiments 31-37, wherein a ratio between the first radius of curvature of the first curved surface and the second radius of curvature of the second curved surface is between approximately 10 and approximately 12.

39. The cladding system of any of Embodiments 31-38, wherein a ratio between the third radius of curvature of the third curved surface and the fourth radius of curvature of the fourth curved surface is between approximately 10 and approximately 12.

40. The cladding system of any of Embodiments 31-39, wherein each of the second radius of curvature and the fourth radius of curvature is between approximately 0.03 inch (0.76 mm) and approximately 0.05 inch (1.3 mm).

41. The cladding system of any of Embodiments 31-40, wherein the first and second curved surfaces are curved in the same direction.

42. The cladding system of any of Embodiments 31-41, wherein the third and fourth curved surfaces are curved in the same direction.

43. The cladding system of any of Embodiments 31-42, wherein the first curved surface, second curved surface, third curved surface, fourth curved surface, and the planar surface are the only surfaces of the at least one intermediate groove.

44. The cladding system of any of Embodiments 31-43, wherein the planar surface is the only non-curved surface of the at least one intermediate groove.

45. The cladding system of any of Embodiments 31-44, wherein:

a tangent line of the first curved surface at an intersection of the first curved surface and the front face is angled at a first angle with respect to the front face, wherein the first angle is less than 90°; and a tangent line of the third curved surface at an intersection of the third curved surface and the front face is angled at a second angle with respect to the front face that is substantially equal to the first angle.

46. The cladding system of any of Embodiments 22-45, wherein the first and second cladding elements are panels.

47. The cladding system of any of Embodiments 22-46, wherein the first and second mating edges do not include said textured pattern.

48. The cladding system of any of Embodiments 22-47, wherein the building substrate comprises a weather resistant barrier and one or more framing members.

49. The cladding system of Embodiment 48, wherein the building substrate further comprises sheathing positioned between the weather resistant barrier and the one or more framing members.

50. A method of installing a cladding system on an exterior of a building substrate, the method comprising:

securing at least one trim element to the building substrate, wherein the at least one trim element comprises one or more channels;

obtaining at least a first cladding element and a second cladding element, each of the first and second cladding elements comprising fiber cement and further comprising:

a front face comprising a textured pattern;

a rear face opposite the front face;

a first mating edge extending between the front and rear faces and along a length or height of each of the first and second cladding elements; and a second mating edge opposite the first mating edge and extending between the front and rear faces and along the length or height of each of the first and second cladding elements;

positioning a portion of at least one of the first and second cladding elements within one of the one or more channels of the at least one trim element;

positioning the first mating edge of the first cladding element adjacent to the second mating edge of the second cladding element to form a joint groove extending along the length or height of each of the first and second cladding elements; and securing the first and second cladding elements to the building substrate.

51. The method of Embodiment 50, wherein said building substrate comprises a weather resistant barrier and a plurality of framing members, and wherein said securing at least one trim element to the building substrate comprises inserting one or more fasteners through the at least one trim element and the weather resistant barrier and into one of the plurality of framing members.

52. The method of Embodiment 51, wherein said building substrate further comprises sheathing, and wherein said securing the at least one trim element to the building substrate comprises inserting one or more fasteners through the at least one trim element, weather resistant barrier, sheathing, and into said one of the plurality of framing members.

53. The method of any of Embodiments 50-52, further comprising cutting said at least one of the first and second cladding elements prior to positioning said portion of said at least one of the first and second cladding elements within said one of the one or more channels of the at least one trim element.

54. The method of Embodiment 53, wherein said cutting said at least one of the first and second cladding elements comprises cutting said at least one of the first and second cladding elements at an approximately 45° angle prior to positioning said portion of said at least one of the first and second cladding elements within said one of the one or more channels of the at least one trim element.

55. The method of any of Embodiments 50-54, further comprising positioning the first cladding element vertically above the second cladding element such that said joint groove extends in a generally horizontal direction along the building substrate.

56. The method of Embodiment 55, wherein said positioning said portion of said at least one of the first and second cladding elements within said one of the one or more channels of the at least one trim element comprises:

positioning a first portion of the first cladding element within said one of the one or more channels of the at least one trim element; and positioning a second portion of the second cladding element within said one of the one or more channels of the at least one trim element.

57. The method of Embodiment 56, wherein said positioning the first cladding element vertically above the second cladding element occurs:

after said positioning said first portion of the first cladding element within said one of the one or more channels of the at least one trim element; and before said positioning said second portion of the second cladding element within said one of the one or more channels of the at least one trim element.

58. The method of any of Embodiments 50-57, further comprising applying a sealing agent along said at least one of the first and second cladding elements proximate said portion of at least one of the first and second cladding elements after positioning said portion within said one of the one or more channels of the at least one trim element.

59. The method of any of Embodiments 50-58, further comprising positioning the first cladding element horizontally adjacent the second cladding element such that said joint groove extends in a generally vertical direction along the building substrate.

60. The method of Embodiment 59, further comprising applying a sealing agent along at least one of the first mating edge of the first cladding element and the second mating edge of the second cladding element prior to said positioning the first mating edge of the first cladding element adjacent to the second mating edge of the second cladding element to form said joint groove.

61. The method of Embodiment 59 or 60, wherein said positioning said portion of at least one of the first and second cladding elements within said one of the one or more channels of the at least one trim element comprises positioning a first portion of the first cladding element within said one of the one or more channels of the at least one trim element.

62. The method of Embodiment 61, further comprising applying a sealing agent along the first cladding element proximate said first portion of the first cladding element after positioning said portion within said one of the one or more channels of the at least one trim element.

63. The method of any of Embodiments 50-62, further comprising positioning the first and second cladding elements such that said joint groove is aligned with a framing member of the building substrate.

64. The method of any of Embodiments 50-63, wherein the building substrate comprises a plurality of framing members and a weather resistant barrier, and wherein the method further comprises positioning sealing tape between said joint groove and said weather resistant barrier and along a height of said joint groove.

65. The method of any of Embodiments 50-64, wherein said securing the first and second cladding elements to the building substrate comprises inserting a plurality of fasteners through each of the first and second cladding elements and into framing members of the building substrate.

66. The method of Embodiment 65, wherein the plurality of fasteners are pre-finished.

67. The method of any of Embodiments 50-66, further comprising positioning a portion of a flashing element within said one of the one or more channels of the at least one trim element.

68. The method of Embodiment 67, further comprising cutting said flashing element prior to positioning said portion of the flashing element within said one of the one or more channels of the at least one trim element.

69. The method of Embodiment 68, wherein said cutting said flashing element comprises cutting said flashing element at an approximately 45° angle prior to positioning said portion of the flashing element within said one of the one or more channels of the at least one trim element.

70. The method of Embodiment 68 or 69, wherein said positioning said portion of at least one of the first and second cladding elements within said one of the one or more channels of the at least one trim element occurs after said positioning said portion of the flashing element within said one of the one or more channels of the at least one trim element.

71. The method of any of Embodiments 50-70, further comprising positioning a flashing element over a top edge of at least one of the first and second cladding elements and securing the flashing element to the building substrate.

72. The method of Embodiment 71, further comprising applying a sealing agent along at least a portion of said top edge prior to said positioning the flashing element over the top edge.

73. The method of Embodiment 71 or 72, further comprising positioning a portion of the flashing element within said one of the one or more channels of the at least one trim element.

74. The method of Embodiment 73, further comprising cutting said flashing element prior to positioning said portion of the flashing element within said one of the one or more channels of the at least one trim element.

75. The method of Embodiment 74, wherein said cutting said flashing element comprises cutting said flashing element at an approximately 45° angle prior to positioning said portion of the flashing element within said one of the one or more channels of the at least one trim element.

76. The method of any of Embodiments 50-75, wherein each of the first and second cladding elements further comprises at least one intermediate groove recessed from the front face.

77. The method of Embodiment 76, wherein the at least one intermediate groove extends substantially parallel to the first and second mating edges.

78. The method of Embodiment 76 or 77, wherein the at least one intermediate groove does not include said textured pattern.

79. The method of any of Embodiments 76-78, wherein the at least one intermediate groove comprises:

a first curved surface extending from the front face at least partially toward the rear face and having a first radius of curvature;

a second curved surface connected to the first curved surface and having a second radius of curvature that is different than the first radius of curvature of the first curved surface;

a third curved surface spaced from the first curved surface, the third curved surface extending from the front face at least partially toward the rear face and having a third radius of curvature;

a fourth curved surface connected to the third curved surface and having a fourth radius of curvature that is different than the third radius of curvature of the third curved surface; and a planar surface connected to and positioned between the second and fourth curved surfaces, wherein the planar surface is substantially parallel to the front face.

80. The method of Embodiment 79, wherein the second radius of curvature of the second curved surface is smaller than the first radius of curvature of the first curved surface.

81. The method of Embodiment 79 or 80, wherein the third curved surface is opposite to the first curved surface.

82. The method of any of Embodiments 79-81, wherein the third radius of curvature of the third curved surface is substantially equal to the first radius of curvature of the first curved surface.

83. The method of any of Embodiments 79-82, wherein the fourth radius of curvature of the fourth curved surface is smaller than the third radius of curvature of the third curved surface.

84. The method of any of Embodiments 79-83, wherein the fourth radius of curvature of the fourth curved surface is substantially equal to the second radius of curvature of the second curved surface.

85. The method of any of Embodiments 79-84, wherein:

a ratio between the first radius of curvature of the first curved surface and the second radius of curvature of the second curved surface is between approximately 10 and approximately 12; and a ratio between the third radius of curvature of the third curved surface and the fourth radius of curvature of the fourth curved surface is between approximately 10 and approximately 12.

86. The method of any of Embodiments 79-85, wherein the first and second curved surfaces are curved in the same direction and wherein the third and fourth curved surfaces are curved in the same direction.

87. The method of any of Embodiments 79-86, wherein the first curved surface, second curved surface, third curved surface, fourth curved surface, and the planar surface are the only surfaces of the at least one intermediate groove.

88. The method of any of Embodiments 79-87, wherein the planar surface is the only non-curved surface of the at least one intermediate groove.

89. The method of any of Embodiments 79-88, wherein the first and second cladding elements are panels.

90. The method of any of Embodiments 79-89, wherein the first and second mating edges do not include said textured pattern.

91. A cladding panel configured to be secured to a building substrate, the cladding panel comprising fiber cement and further comprising:

a front face configured to face away from the building substrate when the cladding panel is secured to the building substrate, wherein the front face comprises a textured pattern;

a rear face opposite the front face and configured to face toward the building substrate when the cladding panel is secured to the building substrate;

a first mating edge extending between the front and rear faces and extending along a length or height of the cladding panel, wherein the first mating edge comprises a profile including a plurality of surfaces, at least one of said plurality of surfaces being non-perpendicular relative to both of the front face and the rear face;

a second mating edge opposite the first mating edge and extending between the front and rear faces and along the length or height of the cladding panel, wherein the second mating edge comprises a profile including a plurality of surfaces, at least one of said plurality of surfaces of the second mating edge being non-perpendicular relative to both of the front face and the rear face; and a plurality of intermediate grooves recessed from the front face and extending substantially parallel to the first and second mating edges, wherein each of the plurality of intermediate grooves comprises:

a first curved surface extending from the front face at least partially toward the rear face and having a first radius of curvature;

a second curved surface connected to the first curved surface and having a second radius of curvature that is smaller than the first radius of curvature of the first curved surface;

a third curved surface spaced from and opposite to the first curved surface, the third curved surface extending from the front face at least partially toward the rear face and having a third radius of curvature that is substantially equal to the first radius of curvature of the first curved surface;

a fourth curved surface connected to the third curved surface and having a fourth radius of curvature that is smaller than the third radius of curvature of the third curved surface, wherein the fourth radius of curvature is substantially equal to the second radius of curvature of the second curved surface; and a planar surface connected to and positioned between the second and fourth curved surfaces, wherein the planar surface is substantially parallel to the front face.

92. The cladding panel of Embodiment 91, wherein each of the first radius of curvature and the third radius of curvature is between approximately 0.3 inch (7.6 mm) and approximately 0.5 inch (12.7 mm).

93. The cladding panel of Embodiment 91 or 92, wherein a ratio between the first radius of curvature of the first curved surface and the second radius of curvature of the second curved surface is between approximately 10 and approximately 12.

94. The cladding panel of any of Embodiments 91-93, wherein a ratio between the third radius of curvature of the third curved surface and the fourth radius of curvature of the fourth curved surface is between approximately 10 and approximately 12.

95. The cladding panel of any of Embodiments 91-94, wherein each of the second radius of curvature and the fourth radius of curvature is between approximately 0.03 inch (0.76 mm) and approximately 0.05 inch (1.3 mm).

96. The cladding panel of any of Embodiments 91-95, wherein the first and second curved surfaces are curved in the same direction and wherein the third and fourth curved surfaces are curved in the same direction.

97. The cladding panel of any of Embodiments 91-96, wherein:

a tangent line of the first curved surface at an intersection of the first curved surface and the front face is angled at a first angle with respect to the front face, wherein the first angle is less than 90°; and a tangent line of the third curved surface at an intersection of the third curved surface and the front face is angled at a second angle with respect to the front face that is substantially equal to the first angle.

98. The cladding panel of any of Embodiments 91-97, wherein said textured pattern on the front face is configured to replicate an appearance of stucco.

99. The cladding panel of any of Embodiments 91-98, wherein the planar surface is substantially parallel to the rear face.

100. The cladding panel of any of Embodiments 91-99, wherein the plurality of intermediate grooves do not include said textured pattern.

101. The cladding panel of any of Embodiments 91-100, wherein the first and second mating edges do not include said textured pattern.

102. The cladding panel of any of Embodiments 91-101, wherein the first curved surface, second curved surface, third curved surface, fourth curved surface, and the planar surface are the only surfaces of each of the plurality of intermediate grooves.

103. The cladding panel of any of Embodiments 91-102, wherein the planar surface is the only non-curved surface of each of the plurality of grooves.

104. The cladding panel of any of Embodiments 91-103, wherein the first mating edge of the cladding panel is configured to mate with a first mating edge of an additional cladding panel.

105. The cladding panel of Embodiment 104, wherein the second mating edge of the cladding panel is configured to mate with a second mating edge of the additional cladding panel.

106. A method of manufacturing the cladding panel of any of Embodiments 91-105 using a Hatschek process.

107. A cladding element configured to be secured to a building substrate, the cladding element comprising fiber cement and further comprising:

a front face comprising a textured pattern;

a rear face opposite the front face;

a first mating edge extending between the front and rear faces;

a second mating edge opposite the first mating edge and extending between the front and rear faces;

at least one intermediate groove recessed from the front face and extending along a length or height of the cladding element, wherein the at least one intermediate groove comprises:

a first curved surface extending from the front face at least partially toward the rear face and having a first radius of curvature;

a second curved surface connected to the first curved surface and having a second radius of curvature that is different than the first radius of curvature of the first curved surface;

a third curved surface spaced from the first curved surface, the third curved surface extending from the front face at least partially toward the rear face and having a third radius of curvature;

a fourth curved surface connected to the third curved surface and having a fourth radius of curvature that is different than the third radius of curvature of the third curved surface; and a planar surface connected to and positioned between the second and fourth curved surfaces, wherein the planar surface is substantially parallel to the front face.

108. The cladding element of Embodiment 107, wherein the at least one intermediate groove does not include said textured pattern.

109. The cladding element of Embodiment 107 or 108, wherein the at least one intermediate groove extends substantially parallel to the first and second mating edges.

110. The cladding element of any of Embodiments 107-109, wherein the second radius of curvature of the second curved surface is smaller than the first radius of curvature of the first curved surface.

111. The cladding element of any of Embodiments 107-110, wherein the third curved surface is opposite to the first curved surface.

112. The cladding element of any of Embodiments 107-111, wherein the third radius of curvature of the third curved surface is substantially equal to the first radius of curvature of the first curved surface.

113. The cladding element of any of Embodiments 107-112, wherein the fourth radius of curvature of the fourth curved surface is smaller than the third radius of curvature of the third curved surface.

114. The cladding element of any of Embodiments 107-113, wherein the fourth radius of curvature of the fourth curved surface is substantially equal to the second radius of curvature of the second curved surface.

115. The cladding element of any of Embodiments 107-114, wherein each of the first radius of curvature and the third radius of curvature is between approximately 0.3 inch (7.6 mm) and approximately 0.5 inch (12.7 mm).

116. The cladding element of Embodiment 107-115, wherein a ratio between the first radius of curvature of the first curved surface and the second radius of curvature of the second curved surface is between approximately 10 and approximately 12.

117. The cladding element of any of Embodiments 107-116, wherein a ratio between the third radius of curvature of the third curved surface and the fourth radius of curvature of the fourth curved surface is between approximately 10 and approximately 12.

118. The cladding element of any of Embodiments 107-117, wherein each of the second radius of curvature and the fourth radius of curvature is between approximately 0.03 inch (0.76 mm) and approximately 0.05 inch (1.3 mm).

119. The cladding element of any of Embodiments 107-118, wherein the first and second curved surfaces are curved in the same direction and wherein the third and fourth curved surfaces are curved in the same direction.

120. The cladding element of any of Embodiments 107-119, wherein the first curved surface, second curved surface, third curved surface, fourth curved surface, and the planar surface are the only surfaces of the at least one intermediate groove.

121. The cladding element of any of Embodiments 107-120, wherein the planar surface is the only non-curved surface of the at least one intermediate groove.

122. The cladding element of any of Embodiments 107-121, wherein:

a tangent line of the first curved surface at an intersection of the first curved surface and the front face is angled at a first angle with respect to the front face, wherein the first angle is less than 90°; and a tangent line of the third curved surface at an intersection of the third curved surface and the front face is angled at a second angle with respect to the front face that is substantially equal to the first angle.

123. The cladding element of any of Embodiments 107-122, wherein cladding element is a panel.

124. The cladding element of any of Embodiments 107-123, wherein the first and second mating edges do not include said textured pattern.

125. The cladding element of any of Embodiments 107-124, wherein the first mating edge of the cladding element is configured to mate with a first mating edge of an additional cladding element.

126. The cladding element of Embodiment 125, wherein the second mating edge of the cladding element is configured to mate with a second mating edge of the additional cladding element.

127. A method of manufacturing the cladding element of any of Embodiments 107-126 using a Hatschek process.

128. A cladding panel configured to be secured to a building substrate, the cladding panel comprising fiber cement and further comprising:

a front face configured to face away from the building substrate when the cladding panel is secured to the building substrate, wherein the front face comprises a textured pattern;

a rear face opposite the front face and configured to face toward the building substrate when the cladding panel is secured to the building substrate;

a first mating edge extending between the front and rear faces and extending along a length or height of the cladding panel, wherein the first mating edge comprises a profile including a plurality of surfaces, at least one of said plurality of surfaces being non-perpendicular relative to both of the front face and the rear face; and a second mating edge opposite the first mating edge and extending between the front and rear faces and along the length or height of the cladding panel, wherein the second mating edge comprises a profile including a plurality of surfaces, at least one of said plurality of surfaces of the second mating edge being non-perpendicular relative to both of the front face and the rear face.

129. The cladding panel of Embodiment 128, wherein said textured pattern on the front face is configured to replicate an appearance of stucco.

130. The cladding panel of Embodiment 128, wherein said textured pattern on the front face comprises a knock-down textured pattern.

131. The cladding panel of Embodiments 128, wherein said textured pattern on the front face comprises a bush hammered stone textured pattern.

132. The cladding panel of Embodiment 128, wherein said textured pattern on the front face comprises a slate textured pattern.

133. The cladding panel of Embodiment 128, wherein said textured pattern on the front face comprises a brushed concrete textured pattern.

134. The cladding panel of Embodiment 128, further comprising a plurality of intermediate grooves recessed from the front face.

135. The cladding panel of Embodiment 134, wherein the plurality of intermediate grooves extend substantially parallel to the first and second mating edges.

136. The cladding panel of Embodiment 134 or 135, wherein each of the plurality of intermediate grooves comprises:

a first curved surface extending from the front face at least partially toward the rear face and having a first radius of curvature;

a second curved surface connected to the first curved surface and having a second radius of curvature that is smaller than the first radius of curvature of the first curved surface;

a third curved surface spaced from and opposite to the first curved surface, the third curved surface extending from the front face at least partially toward the rear face and having a third radius of curvature that is substantially equal to the first radius of curvature of the first curved surface;

a fourth curved surface connected to the third curved surface and having a fourth radius of curvature that is smaller than the third radius of curvature of the third curved surface, wherein the fourth radius of curvature is substantially equal to the second radius of curvature of the second curved surface; and a planar surface connected to and positioned between the second and fourth curved surfaces, wherein the planar surface is substantially parallel to the front face.

137. The cladding panel of Embodiment 136, wherein each of the first radius of curvature and the third radius of curvature is between approximately 0.3 inch (7.6 mm) and approximately 0.5 inch (12.7 mm).

138. The cladding panel of Embodiment 136 or 137, wherein a ratio between the first radius of curvature of the first curved surface and the second radius of curvature of the second curved surface is between approximately 10 and approximately 12.

139. The cladding panel of any of Embodiments 136-138, wherein a ratio between the third radius of curvature of the third curved surface and the fourth radius of curvature of the fourth curved surface is between approximately 10 and approximately 12.

140. The cladding panel of any of Embodiments 136-139, wherein each of the second radius of curvature and the fourth radius of curvature is between approximately 0.03 inch (0.76 mm) and approximately 0.05 inch (1.3 mm).

141. The cladding panel of any of Embodiments 136-140, wherein the first and second curved surfaces are curved in the same direction and wherein the third and fourth curved surfaces are curved in the same direction.

142. The cladding panel of any of Embodiments 136-141, wherein:

a tangent line of the first curved surface at an intersection of the first curved surface and the front face is angled at a first angle with respect to the front face, wherein the first angle is less than 90°; and a tangent line of the third curved surface at an intersection of the third curved surface and the front face is angled at a second angle with respect to the front face that is substantially equal to the first angle.

143. The cladding panel of any of Embodiments 136-142, wherein the planar surface is substantially parallel to the rear face.

144. The cladding panel of any of Embodiments 136-143, wherein the plurality of intermediate grooves do not include said textured pattern.

145. The cladding panel of any of Embodiments 136-144, wherein the first and second mating edges do not include said textured pattern.

146. The cladding panel of any of Embodiments 136-145, wherein the first curved surface, second curved surface, third curved surface, fourth curved surface, and the planar surface are the only surfaces of each of the plurality of intermediate grooves.

147. The cladding panel of any of Embodiments 136-146, wherein the planar surface is the only non-curved surface of each of the plurality of grooves.

148. The cladding panel of any of Embodiments 128-147, wherein the first mating edge of the cladding panel is configured to mate with a first mating edge of an additional cladding panel.

149. The cladding panel of Embodiment 148, wherein the second mating edge of the cladding panel is configured to mate with a second mating edge of the additional cladding panel.

150. A method of manufacturing the cladding panel of any of Embodiments 128-149 using a Hatschek process.

151. A wall panel system for attachment to the exterior of a building structure comprising:

a plurality of fiber cement panels, each fiber cement panel comprising a pre-textured exterior surface having one or more integrally formed patterns thereon, wherein the one or more integrally formed patterns provides the fiber cement panel with a surface texture that does not resemble fiber cement, wherein the one or more integrally formed patterns are non-directional such that each fiber cement panel can be installed vertically or horizontally on the exterior of the building structure; and a plurality of fiber cement panel alignment members configured to be attached to an exterior corner of the building structure, each fiber cement panel alignment member comprising an elongate body having a first leg and a second leg, the first leg being positioned at an angle to the second leg, and at least one channel configured to receive an outer edge of each of two or more fiber cement panels so as to align the two or more fiber cement panels and conceal the outer edges of the two or more fiber cement panels;

wherein the fiber cement panels and the fiber cement panel alignment members when installed on the exterior of the building structure together form a generally planar, textured wall surface bordered by the fiber cement panel alignment members, the textured wall surface having a textured finish that does not resemble fiber cement.

152. The wall panel system of Embodiment 151, wherein said one or more integrally formed patterns is configured to replicate an appearance of stucco.

153. The wall panel system of Embodiment 151 or 152, wherein said one or more integrally formed patterns comprises a knockdown textured pattern.

154. The wall panel system of any of Embodiments 151-153, wherein said one or more integrally formed patterns comprises a bush hammered stone textured pattern.

155. The wall panel system of any of Embodiments 151-154, wherein said one or more integrally formed patterns comprises a slate textured pattern.

156. The wall panel system of any of Embodiments 151-155, wherein said one or more integrally formed patterns comprises a brushed concrete textured pattern.

157. The wall panel system of any of Embodiments 151-156, wherein each of the plurality of fiber cement panels comprises an interior surface opposite said exterior surface and at least one intermediate groove recessed from the exterior surface.

158. The wall panel system of Embodiment 157, wherein the at least one intermediate groove comprises:

a first curved surface extending from the exterior surface at least partially toward the interior surface and having a first radius of curvature;

a second curved surface connected to the first curved surface and having a second radius of curvature that is different than the first radius of curvature of the first curved surface;

a third curved surface spaced from the first curved surface, the third curved surface extending from the exterior surface at least partially toward the interior surface and having a third radius of curvature;

a fourth curved surface connected to the third curved surface and having a fourth radius of curvature that is different than the third radius of curvature of the third curved surface; and a planar surface connected to and positioned between the second and fourth curved surfaces, wherein the planar surface is substantially parallel to the exterior surface.

159. The wall panel system of Embodiment 158, wherein the second radius of curvature of the second curved surface is smaller than the first radius of curvature of the first curved surface.

160. The wall panel system of Embodiment 158 or 159, wherein the third curved surface is opposite to the first curved surface.

161. The wall panel system of any of Embodiments 158-160, wherein the third radius of curvature of the third curved surface is substantially equal to the first radius of curvature of the first curved surface.

162. The wall panel system of any of Embodiments 158-161, wherein the fourth radius of curvature of the fourth curved surface is smaller than the third radius of curvature of the third curved surface.

163. The wall panel system of any of Embodiments 158-162, wherein the fourth radius of curvature of the fourth curved surface is substantially equal to the second radius of curvature of the second curved surface.

164. The wall panel system of any of Embodiments 158-163, wherein each of the first radius of curvature and the third radius of curvature is between approximately 0.3 inch (7.6 mm) and approximately 0.5 inch (12.7 mm).

165. The wall panel system of any of Embodiments 158-164, wherein a ratio between the first radius of curvature of the first curved surface and the second radius of curvature of the second curved surface is between approximately 10 and approximately 12.

166. The wall panel system of any of Embodiments 158-165, wherein a ratio between the third radius of curvature of the third curved surface and the fourth radius of curvature of the fourth curved surface is between approximately 10 and approximately 12.

167. The wall panel system of any of Embodiments 158-166, wherein each of the second radius of curvature and the fourth radius of curvature is between approximately 0.03 inch (0.76 mm) and approximately 0.05 inch (1.3 mm).

168. The wall panel system of any of Embodiments 158-167, wherein the first and second curved surfaces are curved in the same direction.

169. The wall panel system of any of Embodiments 158-168, wherein the third and fourth curved surfaces are curved in the same direction.

170. The wall panel system of any of Embodiments 158-169, wherein the first curved surface, second curved surface, third curved surface, fourth curved surface, and the planar surface are the only surfaces of the at least one intermediate groove.

171. The wall panel system of any of Embodiments 158-170, wherein the planar surface is the only non-curved surface of the at least one intermediate groove.

172. The wall panel system of any of Embodiments 158-171, wherein:

a tangent line of the first curved surface at an intersection of the first curved surface and the exterior surface is angled at a first angle with respect to the exterior surface, wherein the first angle is less than 90°; and a tangent line of the third curved surface at an intersection of the third curved surface and the exterior surface is angled at a second angle with respect to the exterior surface that is substantially equal to the first angle.

173. A wall panel for attachment to a building structure comprising:

a fiber cement substrate;

a fiber cement exterior face that is visible when the wall panel is attached to the building structure;

one or more textured patterns disposed on the fiber cement exterior face and integrally formed with the fiber cement substrate, wherein the one or more textured patterns provides the wall panel with a surface finish that does not resemble fiber cement, wherein the one or more textured patterns are non-directional such that the wall panel can be installed vertically or horizontally on the building structure; and a mating edge extending along an outer portion of the wall panel, the mating edge being configured to mate with a complementary mating edge on another wall panel in a manner so as to form a linear joint that is recessed from the fiber cement exterior face of the wall panel.

174. The wall panel of Embodiment 173, wherein said one or more textured patterns is configured to replicate an appearance of stucco.

175. The wall panel of Embodiment 173, wherein said one or more textured patterns comprises a knockdown textured pattern.

176. The wall panel of Embodiment 173, wherein said one or more textured patterns comprises a bush hammered stone textured pattern.

177. The wall panel of Embodiment 173, wherein said one or more textured patterns comprises a slate textured pattern.

178. The wall panel of Embodiment 173, wherein said one or more textured patterns comprises a brushed concrete textured pattern.

179. The wall panel of any of Embodiments 173-178, further comprising an interior face opposite the exterior face and at least one intermediate groove recessed from the exterior face.

180. The wall panel of Embodiment 179, wherein the at least one intermediate groove comprises:

a first curved surface extending from the exterior face at least partially toward the interior face and having a first radius of curvature;

a second curved surface connected to the first curved surface and having a second radius of curvature that is different than the first radius of curvature of the first curved surface;

a third curved surface spaced from the first curved surface, the third curved surface extending from the exterior face at least partially toward the interior face and having a third radius of curvature;

a fourth curved surface connected to the third curved surface and having a fourth radius of curvature that is different than the third radius of curvature of the third curved surface; and a planar surface connected to and positioned between the second and fourth curved surfaces, wherein the planar surface is substantially parallel to the exterior face.

181. The wall panel of Embodiment 180, wherein the second radius of curvature of the second curved surface is smaller than the first radius of curvature of the first curved surface.

182. The wall panel of Embodiment 180 or 181, wherein the third curved surface is opposite to the first curved surface.

183. The wall panel of any of Embodiments 180-182, wherein the third radius of curvature of the third curved surface is substantially equal to the first radius of curvature of the first curved surface.

184. The wall panel of any of Embodiments 180-183, wherein the fourth radius of curvature of the fourth curved surface is smaller than the third radius of curvature of the third curved surface.

185. The wall panel of any of Embodiments 180-184, wherein the fourth radius of curvature of the fourth curved surface is substantially equal to the second radius of curvature of the second curved surface.

186. The wall panel of any of Embodiments 180-185, wherein each of the first radius of curvature and the third radius of curvature is between approximately 0.3 inch (7.6 mm) and approximately 0.5 inch (12.7 mm).

187. The wall panel of any of Embodiments 180-186, wherein a ratio between the first radius of curvature of the first curved surface and the second radius of curvature of the second curved surface is between approximately 10 and approximately 12.

188. The wall panel of any of Embodiments 180-187, wherein a ratio between the third radius of curvature of the third curved surface and the fourth radius of curvature of the fourth curved surface is between approximately 10 and approximately 12.

189. The wall panel of any of Embodiments 180-188, wherein each of the second radius of curvature and the fourth radius of curvature is between approximately 0.03 inch (0.76 mm) and approximately 0.05 inch (1.3 mm).

190. The wall panel of any of Embodiments 180-189, wherein the first and second curved surfaces are curved in the same direction.

191. The wall panel of any of Embodiments 180-190, wherein the third and fourth curved surfaces are curved in the same direction.

192. The wall panel of any of Embodiments 180-191, wherein the first curved surface, second curved surface, third curved surface, fourth curved surface, and the planar surface are the only surfaces of the at least one intermediate groove.

193. The wall panel of any of Embodiments 180-192, wherein the planar surface is the only non-curved surface of the at least one intermediate groove.

194. The wall panel of any of Embodiments 180-193, wherein:

a tangent line of the first curved surface at an intersection of the first curved surface and the exterior face is angled at a first angle with respect to the exterior face, wherein the first angle is less than 90°; and a tangent line of the third curved surface at an intersection of the third curved surface and the exterior face is angled at a second angle with respect to the exterior face that is substantially equal to the first angle.

BRIEF DESCRIPTION OF THE DRAWINGS

Certain embodiments of the present disclosure will now be described, by way of example only, with reference to the accompanying drawings. From figure to figure, the same or similar reference numerals may be used to designate similar components of an illustrated embodiment.

FIG. 4A illustrates a cross-sectional view taken through a portion of the structure illustrated in FIG. 2 in accordance with aspects of this disclosure.

FIG. 4B illustrates an enlarged view of a portion of that which is shown in FIG. 4A in accordance with aspects of this disclosure.

DETAILED DESCRIPTION

Figure 1:
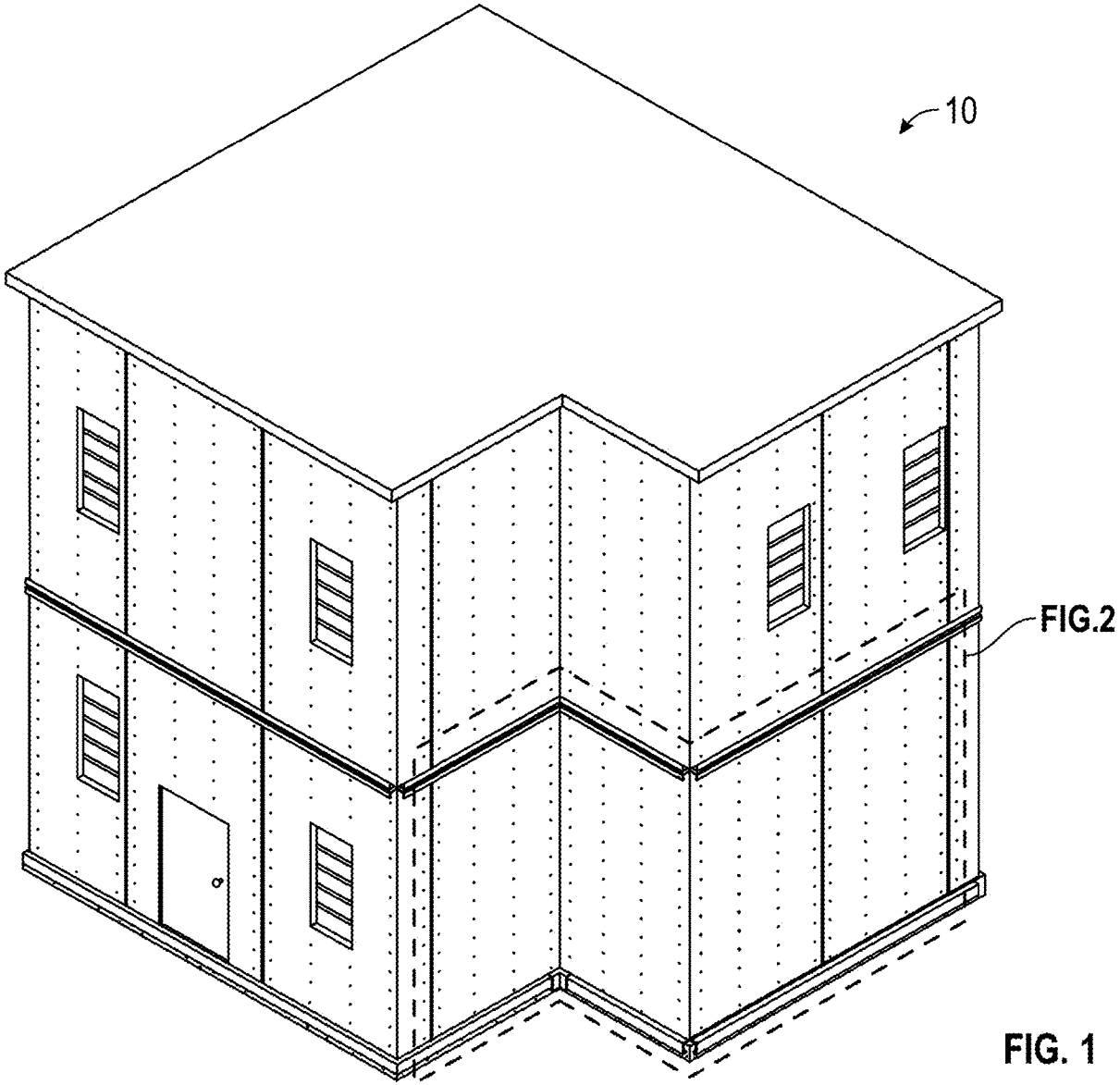
FIG. 1 illustrates an example structure in accordance with aspects of this disclosure.

In the following detailed description, reference is made to the accompanying drawings, which form a part hereof. In the drawings, similar symbols typically identify similar components, unless context dictates otherwise. The illustrative embodiments described in the detailed description and drawings are not meant to be limiting. Other embodiments may be used, and other changes may be made, without departing from the spirit or scope of the subject matter presented herein. It will be readily understood that the embodiments of the present disclosure, as generally described herein and illustrated in the figures, can be arranged, substituted, combined, and designed in a wide variety of different configurations, all of which are explicitly contemplated and made part of this disclosure. The drawing figures are not necessarily to scale and certain features may be shown exaggerated in scale or in somewhat generalized or schematic form in the interest of clarity and conciseness.

Generally described, the present disclosure describes cladding elements that provide a desirable aesthetic appearance and retain suitable structural characteristics. In one or more of the examples that follow, the cladding elements are fiber cement cladding elements. The fiber cement cladding elements are generally provided with a smooth finish, however in alternative embodiments the fiber cement cladding element can include a textured surface finish (also referred to herein as a "textured pattern"), such as for example textures that resemble a woodgrain aesthetic, a stucco or render type aesthetic, a brick aesthetic or other similar type aesthetics, or any of the textured patterns disclosed herein.

In one or more of the examples discussed herein, cladding elements include one or more grooves extending along an height and/or length thereof which impart desirable aesthetic characteristics to the cladding elements individually and to a cladding system and/or structure including a plurality of such cladding elements. As discussed further below, such grooves comprise joint grooves and/or face grooves. In some instances the term intermediate grooves is used in addition to or instead of the term face grooves. In one embodiment, opposing edges of a cladding element are configured to be mating edges such that the opposing mating edges of adjacent cladding elements seat together to form a joint groove in a cladding system. In an alternative embodiment, one or more face grooves are formed in an exterior face of a cladding element. In a further embodiment, a cladding element comprises one or more face grooves formed on an exterior face of the cladding element and opposing mating edges of a cladding element are configured such that the opposing mating edges of adjacent cladding elements seat together to form a joint groove in a cladding system.

In some instances, the thicknesses of the cladding elements may vary above and/or below the desired manufacturing thicknesses in accordance with normal manufacturing tolerances. Such minor variation in thickness can result in a slight variation of the size and/or shape of joint grooves formed between mating edges of adjacent cladding elements and/or face grooves formed on an exterior surfaces of cladding elements. In such cases, the slight variation can result in difficulties when trying to achieve a uniform visual appearance of the grooves either on the individual cladding elements or within cladding elements forming a cladding system. For example, in cladding elements including joint or face grooves having sloped side walls, variations in thickness relative to the design thickness may cause a variation in the apparent width of the grooves. Such variations in groove width may be large enough to be visible, among adjacent cladding elements, among grooves of the same cladding element, or along the length of a single groove. Thus, the visual appearance of the joint and or face grooves may appear dissimilar or otherwise non-uniform to an observer even when cladding elements are manufactured within industry standard tolerances.

In some aspects, portions of the cross-sections of the joint or face grooves can be designed to minimize the effect of variations in thicknesses of the cladding elements or other variations in the grooves formed on and/or by the cladding elements. As described further below, the profiles (e.g., cross-sections) of the grooves can include a plurality of curved and/or flat surfaces which are sized, shaped, and/or arranged so as to make any variations in the height, depth, and/or other characteristics of the grooves appear visually imperceptible. Additionally, as also discussed further below, mating edges of the disclosed cladding elements can have characteristics which form a joint groove having a size, shape, and/or appearance that matches the size, shape, and/or appearance of the grooves recessed from the front faces of the cladding elements. Such configurations can advantageously provide a uniform visual appearance of grooves along wall portions despite the existence of joints between adjacent cladding elements.

The present disclosure also describes finishing elements which include for example, one or more horizontal and/or vertical trim elements, corner trim elements that can be positioned at corners of a building or other structure where edges of two adjacent cladding elements meet and flashing elements. Various embodiments of the corner trim elements described herein can be positioned at inward or outward corners along an exterior of the building or other structure. In some embodiments, the trim elements are formed from a plurality of legs which form channels sized and/or shaped to receive portions of edges of cladding elements. Such trim elements can advantageously aid alignment and positioning of cladding elements during installation and can also provide an improved aesthetic appearance at corner locations of the building. In further embodiments, the trim elements are configured to assist and enhance water management within a cladding system.

Also described in the present disclosure are flashing elements that can be positioned at joints and/or junctions between adjacent cladding elements and/or can receive and/or align portions (for example, ends or edges) of cladding elements. In some embodiments, the flashing elements can function as both permanent flashing elements which provide waterproofing benefits and also as alignment and/or positioning devices during installation. In some embodiments, the flashing elements can be positioned between top and bottom ends or edges of cladding elements (e.g., wall panels) along a junction between adjacent vertical stories of a structure. In some embodiments, the flashing elements can be positioned along a base of the structure at or near a foundation of the structure. In some embodiments, the flashing elements provide improved drainage functionality and efficiency as described further below. Each of the above described components, cladding elements comprising various aesthetic surface finishes including smooth and/or textured finishes; together with finishing elements including one or more of the herein described trim elements and/or one or more of the herein described flashing elements synergistically work together to enable an end user to install a cladding system faster, whilst reducing waste and achieving an improved aesthetic finish when the cladding system as herein described is installed on a building structure.

Overview of Cladding Systems

Figure 2:
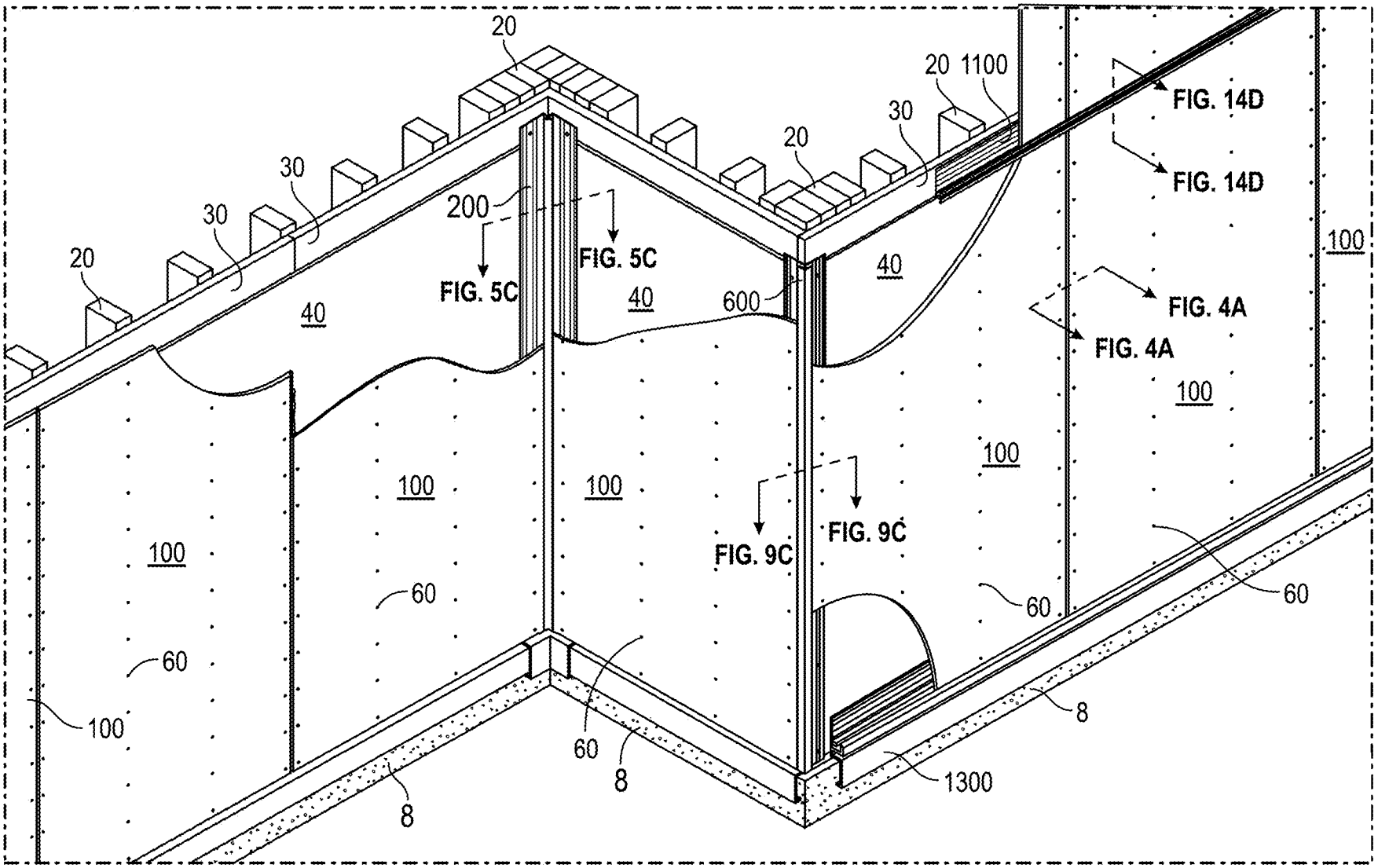
FIG. 2 illustrates an enlarged view of a portion of the structure of FIG. 1 with certain portions removed in accordance with aspects of this disclosure.

FIG. 1 illustrates an exemplary building structure 10. Structure 10 can include and/or be formed from any of the cladding elements, flashing elements, trim elements, and/or any other building component discussed herein or include other building elements that are known to one of skill in the art. FIG. 2 illustrates an enlarged view of a portion of the structure 10 with certain elements removed or partially removed to better illustrate how the cladding elements, flashing elements, trim elements, and/or any of the other building components discussed herein along with other structural components can interact with one another and/or be installed to form the structure 10. While structure 10 may be referred to herein as a building structure, such reference is not intended to be limiting. Any or all of the cladding elements, flashing elements, trim elements, and/or any of the other building components discussed herein are suitable for use within a variety of structures and applications. Additionally, any or all of the cladding elements, flashing elements, trim elements, and/or any of the other building components discussed herein can be combined together in various combinations to form a cladding system.

FIG. 2 illustrates cladding elements 100, a first corner trim element 200, a second corner trim element 600, a first flashing element 1100, and a second flashing element 1300. As described further below, cladding elements 100, first and second corner trim elements 200, 600, and/or first and second flashing elements 1100, 1300 can be secured to a building substrate (which may also be referred to as a "building section" herein), such as a building wall, structural support, and/or a cladding support member attached to a building wall. FIG. 2 shows portions of the cladding elements 100 and weather resistant barrier 40 removed to better illustrate various components of the structure 10. As illustrated in FIG. 2, the building substrate includes one or more of framing members 20 such as, for example, wood or steel studs to which sheathing 30 (such as, for example, plywood or oriented strand board (OSB)) is attached, and/or a weather resistant barrier 40, among other components. As also illustrated in FIG. 2, structure 10 can be supported by a structural foundation 8, which can be, for example, a concrete slab. In some embodiments, the building substrate does not include sheathing 30, for example, where it is intended that the cladding elements 110 provide resistance against lateral forces.

The cladding elements 100, first and second corner trim elements 200, 600, and/or first and second flashing elements 1100, 1300 can be secured to framing members 20, sheathing 30, and/or weather resistant barrier 40 via fasteners 60. The number, spacing, and/or positioning of fasteners 60 can be varied in order to appropriately secure the cladding elements 100, first and second corner trim elements 200, 600, and/or first and second flashing elements 1100, 1300 to the framing members 20, sheathing 30, and/or weather resistant barrier 40. Although the fasteners 60 are visible in the illustrated embodiment (FIG. 2), in one exemplary embodiment, the fasteners 60 comprise small diameter finishing nails or brad nails, wherein the diameter of the nails is such that the nail heads are easily masked after installation. In such an exemplary embodiment, the nail heads penetrate the fiber cement cladding elements such that the nail head is positioned slightly beneath the exterior surface of the cladding element. Consequently, the fasteners are easily covered by coating layers such as for example, paint and are not readily visible to an end user once the cladding elements have been installed. In some embodiments, the fasteners 60 (for example, nails) or portions thereof (for example, fastener heads thereof) are pre-finished, for example, are coated during manufacturing. In some embodiments, the fasteners 60 (for example, nails) or portions thereof (for example, fastener heads thereof) can be touched up with paint after installation on a building substrate using a brush or other tool to match a color of the cladding elements 100. The securement methods used will be in accordance with local building code requirements, which typically dictate the number, spacing, and/or alignment of fasteners. In some embodiments, fasteners 60 secure the cladding elements 100 to the framing members 20, sheathing 30, and/or weather resistant barrier 40 along and near edges of the cladding elements 100 (such as at vertically oriented edges given the exemplary orientation illustrated in FIG. 2). Any of the cladding elements 100, first and second corner trim elements 200, 600, first and second flashing elements 1100, 1300, framing members 20, sheathing 30, weather resistant barrier 40, and/or fasteners 60 can form a cladding system. While not illustrated, in some embodiments, the cladding system can include one or more furring strips (e.g., battens) positioned between the sheathing 30 and/or weather resistant barrier 40 and the cladding elements 100 which can function to set the cladding elements 100 apart from the sheathing 30 and/or weather resistant barrier 40 and establish a capillary air gap which can allow for drainage and/or evaporation. In implementations where such furring strips are utilized, insulation material can be placed between the weather resistant barrier 40 and the cladding elements 100. The weather resistant barrier 40 can be a non-woven, non-perforate house wrap and/or can be any weather resistant barrier that complies with local building code requirements.

As illustrated, cladding elements 100 (which are described in more detail below) can be installed to a building substrate by positioning edges thereof adjacent to one another in a mating and/or interlocking fashion. For example, cladding elements 100 have mating edges which can engage one another to form joints, and in some cases, "joint grooves," along vertical and/or horizontal directions when installed. As also illustrated in FIG. 2, in the instance where a structure 10 has one or more corners, first and second corner trim elements 200, 600 can be secured to the building substrate to receive edges of the cladding elements 100 at said corners of the structure 10. Such first and second corner trim elements 200, 600 can provide robust weatherproofing at the corners and can provide a desirable aesthetic finish by, for example, covering (e.g., "hiding") such edges of the cladding elements 100. Such "covering" of edges of the cladding elements 100 can significantly improve the visual appearance of corners of the structure 10 since certain dimensions of the cladding elements 100 may not be uniform due to manufacturing and/or construction installation challenges (e.g., on-site cutting). Such first and second corner trim elements 200, 600 can also be simpler and quicker to install in comparison to some common approaches of forming corners using trimmed (e.g., smaller size) cladding elements. First and second corner trim elements 200, 600 can be used in "inward" and/or "outward" corner configurations respectively along an exterior of structure 10 as illustrated in FIG. 2. Although not illustrated, it is also possible to use first and second corner trim elements 200, 600 in "inward" and/or "outward" corner configurations respectively in the interior of a structure if so desired.

As illustrated in FIG. 2 and as discussed further below, first and second flashing elements 1100, 1300 can advantageously provide waterproofing and/or drainage functionality along joints (e.g., "horizontal" joints) of the structure 10 and also can provide alignment and/or positioning benefits. As shown, first flashing element 1100 can be utilized along horizontal joints between adjacent vertical stories of structure 10 and second flashing element 1300 can be utilized along the horizontal joint between a first (e.g., bottommost) story and the foundation 8 of the structure 10. If desired, it is also possible to use second flashing element 1300 along horizontal joints between adjacent vertical stories of a structure. As also discussed further below, first and second flashing elements 1100, 1300 can also provide a desirable aesthetic finish to such horizontal joints of the structure 10 by, for example, covering (e.g., "hiding") edges of the cladding elements 100, such as top and/or bottom edges of the cladding elements 100.

Cladding Elements

Figure 3A:
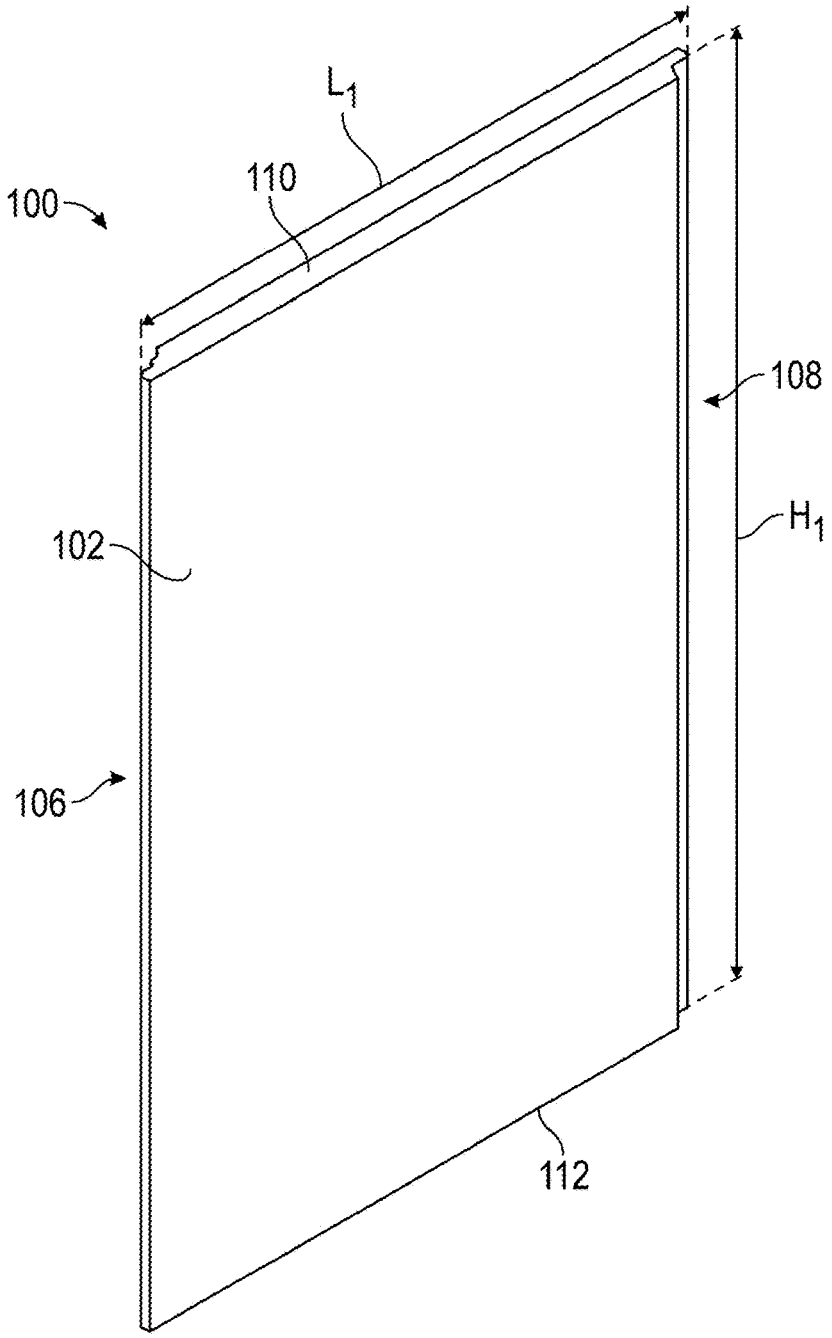
FIG. 3A illustrates an embodiment of a cladding element in accordance with aspects of this disclosure.
Figure 3B:
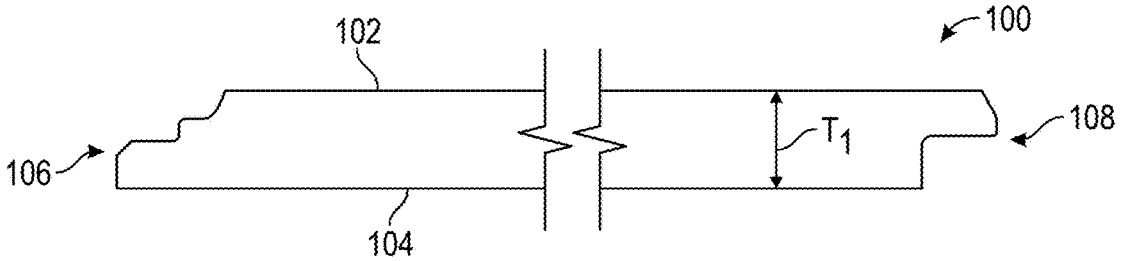
FIG. 3B illustrates a top or cross-sectional view of the cladding element of FIG. 3A in accordance with aspects of this disclosure.

FIG. 3A illustrates a perspective view of the cladding element 100. FIG. 3B illustrates a top or cross-sectional view of the cladding element 100. As shown, the cladding element 100 can be generally defined by a height $H_1$ and a length $L_1$. Cladding element 100 can include a front face 102, a rear face 104 opposite the front face 102, a first edge 106, a second edge 108 opposite the first edge 106, a third edge 110, and a fourth edge 112 opposite the third edge 110. When the cladding element 100 is arranged as illustrated in FIG. 2 (for example, in a "vertical" orientation), edge 110 can be a top edge of the cladding element 100, edge 112 can be a bottom edge of the cladding element 100, and the edges 106, 108 can be side edges of the cladding element 100. When the cladding element 100 is secured to a building substrate (for example, via fasteners 60), the front face 102 can face away from the building substrate and the rear face 104 can face toward the building substrate. The cladding element 100 can be a panel, for example. In a further embodiment, the cladding element 100 can be a plank, whereby the length $L_1$ is greater than the height $H_1$.

The length $L_1$ of the cladding element 100 can be 2 ft, 3 ft, 4 ft, 5 ft, 6 ft, 7 ft, 8 ft, 9 ft, 10 ft, 12 ft, 13 ft, 14 ft, 15 ft, or 16 ft, or any value or range within or bounded by any of these ranges, among other values, although values outside these values or ranges can be used in some cases. The height $H_1$ of the cladding element 100 can vary according to the type of cladding element 100. In one embodiment cladding element 100 is a panel, in such an embodiment the height $H_1$ can be 2 ft, 3 ft, 4 ft, 5 ft, 6 ft, 7 ft, 8 ft, 9 ft, 10 ft, 12 ft, 13 ft, 14 ft, ft, or 16 ft, or any value or range within or bounded by any of these ranges or values, although values outside these values or ranges can be used in some cases. In a further embodiment, cladding element 100 could be a plank wherein, the height $H_1$ can be 5 inch, 5.25 inch, 5.5 inch, 5.75 inch, 6 inch, 6.25 inch, 6.5 inch, 6.75 inch, 7 inch, 7.25 inch, 7.5 inch, 7.75 inch, 8 inch, 8.25 inch, 8.5 inch, 8.75 inch, 9 inch, 9.25 inch, 9.5 inch, 9.75 inch, 10 inch, 10.25 inch, 10.5 inch, 10.75 inch, 11 inch, 11.25 inch, 11.5 inch, 11.75 inch, 12 inch, 12.25 inch, 12.5 inch, 12.75 inch, 13 inch, 13.25 inch, 13.5 inch, 13.75 inch, 14 inch, 14.25 inch, 14.5 inch, 14.75 inch, 15 inch, 15.25 inch, 15.5 inch, 15.75 inch, 16 inch, 16.25 inch, 16.5 inch, 16.75 inch, 17 inch, 17.25 inch, 17.5 inch, 17.75 inch, 18 inch, or any value or range within or bounded by any of these ranges or values, although values outside these values or ranges can be used in some cases; and the length $L_1$ can be 2 ft, 3 ft, 4 ft, 5 ft, 6 ft, 7 ft, 8 ft, 9 ft, 10 ft, 12 ft, 13 ft, 14 ft, 15 ft, or 16 ft, or any value or range within or bounded by any of these ranges, among other values, although values outside these values or ranges can be used in some cases. In either embodiment, the cladding element 100 can have a thickness $T_1$ of 0.1 inch, 0.2 inch, 0.3 inch, 0.4 inch, 0.5 inch, 0.6 inch, 0.7 inch, 0.8 inch, 0.9 inch, 1 inch, 1.1 inch, 1.2 inch, 1.3 inch, 1.4 inch, 1.5 inch, 1.6 inch, 1.7 inch, 1.8 inch, 1.9 inch, or 2 inch, or any value or range within or bounded by any of these ranges or values, although values outside these values or ranges can be used in some cases. In one exemplary embodiment, cladding element 100 can have a thickness $T_1$ of 0.1 inch, 0.2 inch, 0.3 inch, 0.4 inch, 0.5 inch, 0.6 inch, 0.7 inch or 0.8 inch or any value or range within or bounded by any of these ranges or values.

While the term "edge" is used in reference to cladding element 100, this terminology is not intended to be limiting, and edges 106, 108, 110, 112 described with reference to cladding element 100 can also be referred to as "ends" without departing from the intended meaning. Additionally, while the terms "length" and "height" are used in reference to cladding element 100, such terminology is not intended to be limiting, but rather, is merely employed for purposes of convenience in describing aspects of the cladding element 100, for example, with reference to the orientation illustrated in FIG. 2 and/or FIG. 3A. For example, length $L_1$ of the cladding element 100 can also be referred to as a "width" of the cladding element 100.

In the exemplary embodiments, the cladding element 100 comprises fiber cement. In the exemplary embodiments cladding element 100 can be formed from a fiber cement composition including fibers such as cellulose and/or synthetic fibers (e.g., polypropylene), Portland cement, silica and water. In some embodiments, the fiber cement composition further comprises density modifiers and/or additives.

An exemplary dry weight % fiber cement composition is outlined below in Table 1. It is to be understood that exemplary dry weight % of the Portland Cement can be between 20%-40% and additional components of the fiber cement composition shown in Table 1 can make up a remaining percentage of the fiber cement composition.

TABLE 1

| Components | Range wt % |
|---|---|
| Portland Cement | 20-40 |
| Silica | 25-75 |
| Fiber | 5-15 |
| Density Modifiers | 0-10 |
| Additives | 0-10 |

In some embodiments, the cladding element 100 comprises a smooth finish however in alternative embodiments, the cladding element 100 comprises a textured pattern to enhance the appearance of the cladding element 100, and in turn, an exterior of the structure 10 when installed thereon. In one example, the cladding element 100 can include a texture on the front face 102 (or a portion thereof) which replicates the appearance of stucco. In such embodiments, a visual appearance of the cladding elements 100 on a structure 10 can replicate a conventional stucco exterior finish. Additionally, the cladding elements 100 can possess the features and/or characteristics discussed elsewhere herein that allow for decreased construction time in comparison to conventional techniques in forming stucco exterior finishes. In other exemplary embodiments, cladding element 100 can include textures that resemble a woodgrain aesthetic, a brick aesthetic or other similar type aesthetics which enhance the finished appearance of the cladding element 100. As another example, cladding element 100 can comprise any of the textured patterns discussed with reference to FIGS. 20-25. In some implementations, cladding element 100 comprises a textured pattern (such as any of those discussed herein), for example, on front face 102. In some implementations, the rear face 104 does not comprise a textured pattern. In some implementations, the front face 102 comprises such textured pattern and the edges 106, 108 do not comprise the textured pattern, for example, such that a joint groove formed when edges 106, 108 mate with one another (as described elsewhere herein) does not comprise the textured pattern.

FIG. 3B illustrates profiles of the edges 106, 108. As discussed further below and as shown in more detail in FIGS. 4B-4D, edges 106, 108 can include one or more or a plurality of surfaces which provide a mating engagement for cladding elements 100 when positioned adjacent one another and/or when secured to a building substrate. Such mating edges 106, 108 can advantageously form a desirable aesthetic "joint groove" along portions of the structure 10 when the cladding elements 100 are installed.

FIG. 4A illustrates a cross-section taken through a portion of the structure shown in FIG. 2. FIG. 4B illustrates a first mating edge 106 of a first cladding element 100 positioned adjacent (e.g., abutted with) a second mating edge 108 of a second cladding element 100, while FIG. 4A illustrates the cladding elements 100 secured, via fasteners 60, to a building substrate comprising weather resistant barrier 40, sheathing 30, and framing member 20. In particular, FIG. 4B illustrates an enlarged view of the joint groove formed by the abutting first and second mating edges 106, 108 of the cladding elements 100 without also illustrating the weather resistant barrier 40, sheathing 30, or framing member 20. While FIG. 4A illustrates two fasteners 60 securing the cladding elements 100 to the weather resistant barrier 40, sheathing 30, and framing member 20, such number and/or positioning of the two fasteners 60 is merely illustrative. As discussed above, an alternative number and/or positioning of fasteners is possible.

Figure 4C:
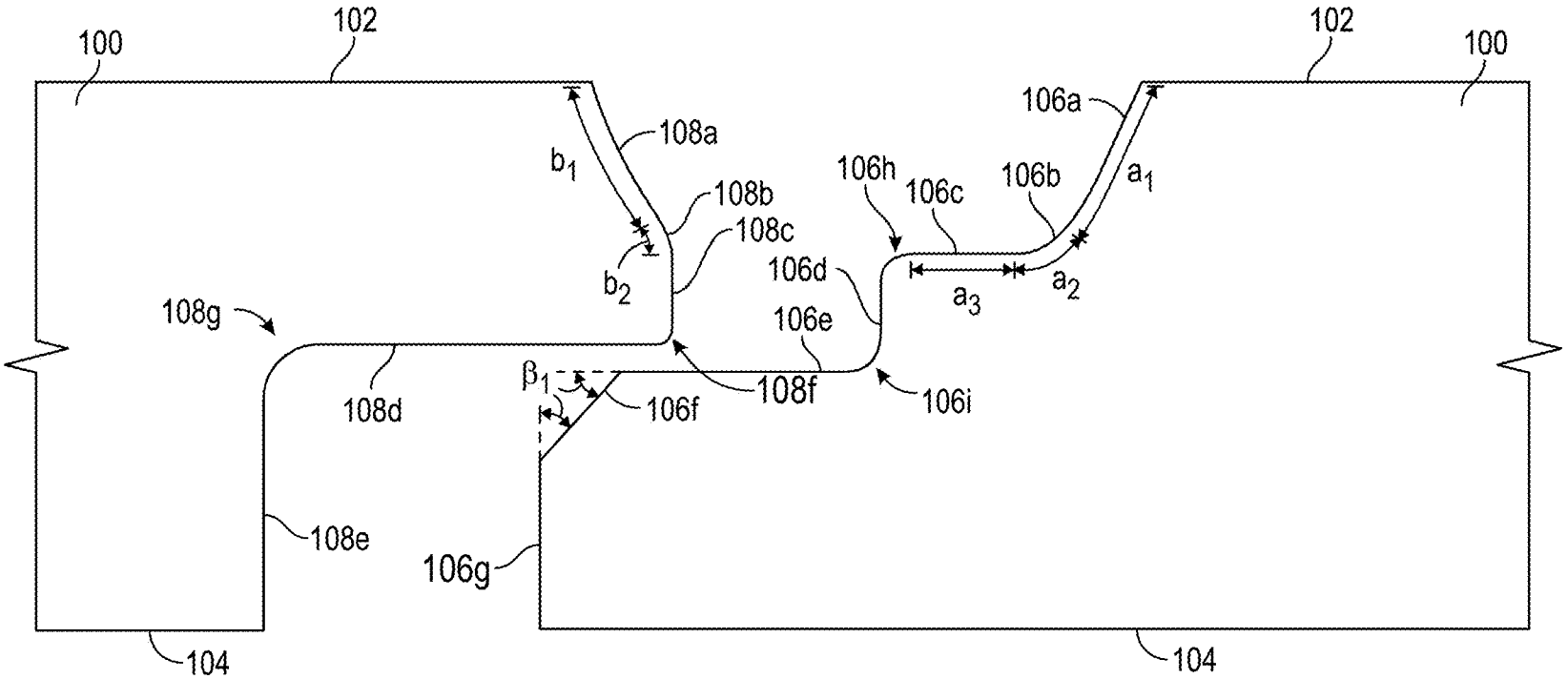
FIG. 4C illustrates an enlarged view of the portion shown in FIG. 4B in accordance with aspects of this disclosure.

FIG. 4C illustrates another enlarged view of the cross-sections of first and second mating edges 106, 108 of cladding elements 100 slightly spaced apart from one another to better illustrate aspects thereof. As discussed above, first and second mating edges 106, 108 of cladding elements 100 can have a profile that facilitates a mating configuration when an edge 106 of a first cladding element 100 is positioned adjacent (e.g., abutted to) an edge 108 of a second cladding element 100. Additionally, as mentioned above, first and second mating edges 106, 108 can include a profile that facilitates formation of a "joint groove" at and/or near the front faces 102 when such first and second mating edges 106, 108 are abutting one another, as illustrated in FIG. 4B.

With reference to FIG. 4C, first mating edge 106 can include one or more or a plurality of surfaces which can define a profile of the first mating edge 106. Any or all of the surfaces discussed below with reference to the mating edge 106 can extend along (e.g., continuously along) the height $H_1$ of the cladding element 100. First mating edge 106 can include, one, two, three, four, five, six, seven, or eight or more surfaces which can define the profile of the edge 106. As shown, first mating edge 106 can include a first curved surface 106*a*, a second curved surface 106*b*, a first planar surface 106*c*, an abutment surface 106*d*, a second planar surface 106*e*, and/or a third planar surface 106*g*. In some embodiments, first mating edge 106 additionally includes a first transition region 106*h* between the first planar surface 106*c* and the abutment surface 106*d* and/or a second transition region 106*i* between the abutment surface 106*d* and the second planar surface 106*e*.

Use of the terms "first," "second,", "third," or similar terminology when describing surfaces first mating edge 106 is not intended to be limiting nor is it intended to mean that the inclusion of any one of such numbered surfaces necessarily requires inclusion of any of the other numbered surfaces described with respect to mating edge 106.

The first curved surface 106*a* of first mating edge 106 can be connected to and/or can extend from the front face 102 in a direction at least partially toward the rear face 104. The first curved surface 106*a* of first mating edge 106 can be positioned between the front face 102 and the second curved surface 106*b* of first mating edge 106. The first curved surface 106*a* of first mating edge 106 can have a radius of curvature between approximately 0.1 inch and approximately 1 inch. For example, the first curved surface 106*a* of first mating edge 106 can have a radius of curvature between approximately 0.2 inch and approximately 0.9 inch, between approximately 0.3 inch and approximately 0.8 inch, between approximately 0.4 inch and approximately 0.7 inch, between approximately 0.5 inch and approximately 0.6 inch, or between approximately 0.3 inch and approximately 0.5 inch, or any value or range within or bounded by any of these ranges or values, although values outside these values or ranges can be used in some cases.

In some embodiments, a ratio between the radius of curvature of the first curved surface 106*a* of first mating edge 106 and the thickness $T_1$ of the cladding element 100 is between approximately 0.1 and approximately 2. For example, in some embodiments, a ratio between the radius of curvature of the first curved surface 106*a* of first mating edge 106 and the thickness $T_1$ of the cladding element 100 is between approximately 0.2 and approximately 1.9, between approximately 0.3 and approximately 1.8, between approximately 0.4 and approximately 1.7, between approximately 0.5 and approximately 1.6, between approximately 0.6 and approximately 1.5, between approximately 0.7 and approximately 1.8, between approximately 0.8 and approximately 1.7, between approximately 0.9 and approximately 1.6, between approximately 1 and approximately 1.5, between approximately 1.1 and approximately 1.4, or between approximately 1.2 and approximately 1.3, or any value or range within or bounded by any of these ranges or values, although values outside these values or ranges can be used in some cases.

The second curved surface 106*b* of first mating edge 106 can be connected to and/or can extend from the first curved surface 106*a* of first mating edge 106 in a direction at least partially toward the rear face 104. The second curved surface 106*b* of first mating edge 106 can be positioned between the first curved surface 106*a* of first mating edge 106 and the first planar surface 106*c* of first mating edge 106. The second curved surface 106*b* of first mating edge 106 can have a radius of curvature that is different than the radius of curvature of the first curved surface 106*a* of first mating edge 106. For example, the second curved surface 106*b* of first mating edge 106 can have a radius of curvature that is smaller than the radius of curvature of the first curved surface 106*a* of first mating edge 106. The second curved surface 106*b* of first mating edge 106 can have a radius of curvature that is between approximately 0.01 inch and approximately 0.1 inch. For example, the second curved surface 106*b* of first mating edge 106 can have a radius of curvature between approximately 0.02 inch and approximately 0.09 inch, between approximately 0.03 inch and approximately 0.08 inch, between approximately 0.04 inch and approximately 0.07 inch, between approximately 0.05 inch and approximately 0.06 inch, or between approximately 0.04 inch and approximately 0.06 inch, or any value or range within or bounded by any of these ranges or values, although values outside these values or ranges can be used in some cases. In some embodiments, the first and second curved surfaces 106*a*, 106*b* of first mating edge 106 are curved in the same direction, for example, in a direction away from a building substrate to which the cladding element 100 is secured.

In some embodiments, a ratio between the radius of curvature of the second curved surface 106*b* of first mating edge 106 and the thickness $T_1$ of the cladding element 100 is between approximately 0.005 and approximately 1. For example, in some embodiments, a ratio between the radius of curvature of the second curved surface 106*b* of first mating edge 106 and the thickness $T_1$ of the cladding element 100 is between approximately 0.01 and approximately 0.9, between approximately 0.02 and approximately 0.8, between approximately 0.03 and approximately 0.7, between approximately 0.04 and approximately 0.6, between approximately 0.05 and approximately 0.5, between approximately 0.06 and approximately 0.4, between approximately 0.07 and approximately 0.3, between approximately 0.08 and approximately 0.2, between approximately 0.09 and approximately 0.2, between approximately 0.1 and approximately 0.2, or between approximately 0.05 and approximately 0.2, or any value or range within or bounded by any of these ranges or values, although values outside these values or ranges can be used in some cases.

In some embodiments, a ratio between the radius of curvature of the first curved surface 106*a* of first mating edge 106 and the radius of curvature of the second curved surface 106*b* of first mating edge 106 can be between approximately 2 and approximately 20. For example, a ratio between the radius of curvature of the first curved surface 106*a* of first mating edge 106 and the radius of curvature of the second curved surface 106*b* of first mating edge 106 can be between approximately 4 and approximately 18, between approximately 6 and approximately 16, between approximately 8 and approximately 14, between approximately 10 and approximately 12, between approximately 4 and approximately 12, between approximately 6 and approximately 10, between approximately 8 and approximately 9, or any value or range within or bounded by any of these ranges or values.

In some embodiments, the second curved surface 106*b* of first mating edge 106 has a radius of curvature that is less than or equal to approximately 0.1 inch. For example, in some embodiments, the second curved surface 106*b* has a radius of curvature that is less than or equal to approximately 0.1 inch, less than or equal to approximately 0.09 inch, less than or equal to approximately 0.08 inch, less than or equal to approximately 0.07 inch, less than or equal to approximately 0.06 inch, or less than or equal to approximately 0.05 inch.

Figure 4D:
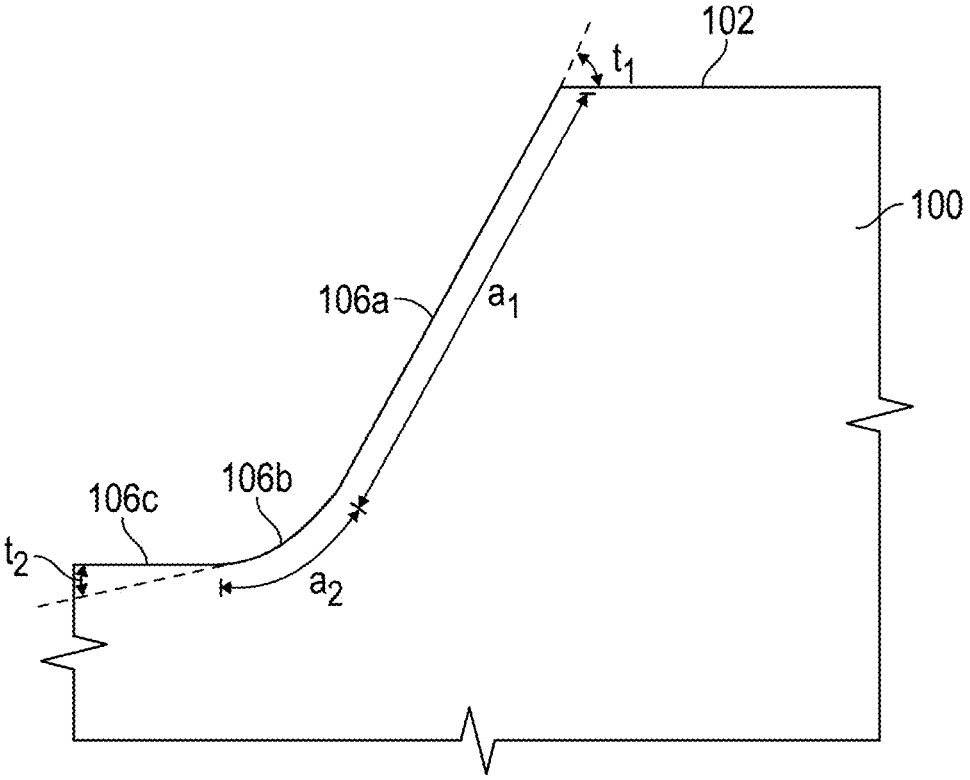
FIG. 4D-4E illustrate additional enlarged views of portions of that which is shown in FIG. 4C in accordance with aspects of this disclosure.

The first curved surface 106*a* of first mating edge 106 can have a length $a_1$ and the second curved surface 106*b* of first mating edge 106 can have a length $a_2$, as shown in FIGS. 4C-4D, and such lengths $a_1$ and $a_2$ can be different. For example, $a_1$ can be greater than $a_2$. The first planar surface 106*c* of first mating edge 106 can have a length $a_3$. Length $a_3$ can be different than either or both of lengths $a_1$ and az. For example, length $a_3$ can be greater than or equal to length $a_2$ and/or length $a_3$ can be less than or equal to length $a_1$. In some embodiments, length $a_2$ is smaller than length $a_1$ and/or smaller than length $a_3$.

Use of the term "length" with respect to lengths $a_1$, $a_2$, and $a_3$, is not intended to be limiting, and the lengths $a_1$, $a_2$, and $a_3$ can also be referred to as "widths" $a_1$, $a_2$, and $a_3$ of the respective surfaces 106*a*, 106*b*, 106*c*. Accordingly, regardless of whether the term "length" or "width" is used to describe surfaces 106*a*, 106*b*, 106*c*, such "length" or "width" can define portions of the cross-section of first mating edge 106 as shown in FIGS. 4C-4D.

FIG. 4D illustrates yet another enlarged view of a portion of the cross-section shown in FIG. 4C. As shown, a tangent line of the first curved surface 106*a* of first mating edge 106 can be angled at an angle $t_1$ with respect to the front face 102. Such angle $t_1$ can be between approximately 45° and approximately 90°. For example, such angle $t_1$ can be between approximately 50° and approximately 85°, between approximately 55° and approximately 80°, between approximately 60° and approximately 75°, or between approximately 65° and approximately 70°, or any value or range within or bounded by any of these ranges or values, although values outside these values or ranges can be used in some cases.

As also shown in FIG. 4D, a tangent line of the second curved surface 106*b* of first mating edge 106 can be angled at an angle $t_2$ with respect to the first planar surface 106*c* of first mating edge 106. Such angle $t_2$ can be between approximately 0° and approximately 45°. For example, such angle $t_2$ can be between approximately 5° and approximately 40°, between approximately 10° and approximately 35°, between approximately 15° and approximately 30°, between approximately 20° and approximately 25°, between approximately 0° and approximately 30°, between approximately 0° and approximately 20°, or between approximately 0° and approximately 10°, or any value or range within or bounded by any of these ranges or values, although values outside these values or ranges can be used in some cases. In some embodiments, the first planar surface 106*c* of first mating edge 106 is parallel to the front face 102. In some embodiments, the angle $t_1$ is greater than the angle $t_2$.

With reference to FIG. 4C, in some embodiments, the abutment surface 106*d* of first mating edge 106 is transverse with respect to the first planar surface 106*c* of first mating edge 106, the second planar surface 106*e* of first mating edge 106, the front face 102, and/or the rear face 104. For example, the abutment surface 106*d* of first mating edge 106 can be perpendicular to the first planar surface 106*c* of first mating edge 106, the second planar surface 106*e* of first mating edge 106, the front face 102, and/or the rear face 104.

In some embodiments, the second planar surface 106*e* of first mating edge 106 is parallel with respect to the front face 102, first planar surface 106*c* of first mating edge 106, and/or the rear face 104. In some embodiments, the third planar surface 106*g* of first mating edge 106 is transverse with respect to the rear face 104, second planar surface 106*e* of first mating edge 106, first planar surface 106*c* of first mating edge 106, and/or the front face 102. For example, the third planar surface 106*g* of first mating edge 106 can be perpendicular with respect to the rear face 104, second planar surface 106*e* of first mating edge 106, first planar surface 106*c* of first mating edge 106, and/or the front face 102. In some embodiments, the third planar surface 106*g* of first mating edge 106 is parallel with respect to the abutment surface 106*d* of first mating edge 106.

In some embodiments, first mating edge 106 additionally includes a first transition region 106*h* between the first planar surface 106*c* of first mating edge 106 and the abutment surface 106*d* of first mating edge 106 and/or a second transition region 106*i* of first mating edge 106 between the abutment surface 106*d* of first mating edge 106 and the second planar surface 106*e* of first mating edge 106. Such optional transitions regions 106*h*, 106*i* of first mating edge 106 can comprise a chamfered or curved surface. For example, such optional transition regions 106*h*, 106*i* of first mating edge 106 can comprise a curved surface having a radius of curvature that is between approximately 0.01 inch and approximately 0.05 inch, between approximately 0.01 inch and approximately 0.04 inch, between approximately 0.01 inch and approximately 0.03 inch, between approximately 0.01 inch and approximately 0.02 inch, between approximately 0.02 inch and approximately 0.05 inch, between approximately 0.02, inch and approximately 0.04 inch, or between approximately 0.02 inch and approximately 0.03 inch, or any value or range within or bounded by any of these ranges or values, although values outside these values or ranges can be used in some cases.

In some embodiments, a portion of first mating edge 106 is chamfered proximate the second and third planar surfaces 106*e*, 106*g* of first mating edge 106 to form an angled surface 106*f* of first mating edge 106 in between the second and third planar surfaces 106*e*, 106*g* of first mating edge 106. The angled surface 106*f* of first mating edge 106 can be angled with respect to the second and third planar surfaces 106*e*, 106*g* of first mating edge 106 at an angle $\beta_1$, as shown in FIG. 4C. Angle $\beta_1$ can be between approximately 0° and approximately 90°. For example, such angle $\beta_1$ can be between approximately 5° and approximately 85°, between approximately 10° and approximately 80°, between approximately 15° and approximately 75°, between approximately 20° and approximately 70°, between approximately 25° and approximately 65°, between approximately 30° and approximately 60°, between approximately 35° and approximately 55°, or between approximately 40° and approximately 50°, or any value or range within or bounded by any of these ranges or values, although values outside these values or ranges can be used in some cases.

With continued reference to FIG. 4C, the second mating edge 108 can include one or more or a plurality of surfaces which can define a profile of the edge 108. Any or all of the surfaces discussed below with reference to the second mating edge 108 can extend along (e.g., continuously along) the height $H_1$ of the cladding element 100. The second mating edge 108 can include, one, two, three, four, five, six, seven, or eight or more surfaces which can define the profile of the edge 108. As shown, the second mating edge 108 can include a first curved surface 108*a*, a second curved surface 108*b*, an abutment surface 108*c*, a first planar surface 108*d*, and/or a second planar surface 108*e*. In some embodiments, the second mating edge 108 additionally includes a first transition region 108*f* between the abutment surface 108*c* and the first planar surface 108*d* and/or a second transition region 108*g* between the first planar surface 108*d* and the second planar surface 108*e*.

Use of the terms "first," "second," or similar terminology when describing surfaces the second mating edge 108 is not intended to be limiting nor is it intended to mean that the inclusion of any one of such numbered surfaces necessarily requires inclusion of any of the other numbered surfaces described with respect to second mating edge 108.

The first curved surface 108*a* of second mating edge 108 can be connected to and/or can extend from the front face 102 in a direction at least partially toward the rear face 104. The first curved surface 108*a* of second mating edge 108 can be positioned between the front face 102 and the second curved surface 108*b* of second mating edge 108. The first curved surface 108*a* of second mating edge 108 can have a radius of curvature between approximately 0.1 inch and approximately 1 inch. For example, the first curved surface 108*a* of second mating edge 108 can have a radius of curvature between approximately 0.2 inch and approximately 0.9 inch, between approximately 0.3 inch and approximately 0.8 inch, between approximately 0.4 inch and approximately 0.7 inch, between approximately 0.5 in and approximately 0.6 inch, or between approximately 0.3 inch and approximately 0.5 inch, or any value or range within or bounded by any of these ranges or values, although values outside these values or ranges can be used in some cases.

The first curved surface 108*a* of second mating edge 108 can have a radius of curvature that is similar or identical to the radius of curvature of the first curved surface 106*a* of mating edge 106. This can advantageously facilitate a uniform visual appearance of the joint groove formed when the first and second mating edges 106, 108 abut one another in adjacent cladding elements 100. In some embodiments, the radius of curvature of the first curved surface 108*a* of second mating edge 108 is within 50%, 40%, 30%, 20%, 10%, 5%, 2%, or 1% of the radius of curvature of the first curved surface 106*a* of first mating edge 106.

In some embodiments, a ratio between the radius of curvature of the first curved surface 108*a* of second mating edge 108 and the thickness $T_1$ of the cladding element 100 is between approximately 0.1 and approximately 2. For example, in some embodiments, a ratio between the radius of curvature of the first curved surface 108*a* of second mating edge 108 and the thickness $T_1$ of the cladding element 100 is between approximately 0.2 and approximately 1.9, between approximately 0.3 and approximately 1.8, between approximately 0.4 and approximately 1.7, between approximately 0.5 and approximately 1.6, between approximately 0.6 and approximately 1.5, between approximately 0.7 and approximately 1.8, between approximately 0.8 and approximately 1.7, between approximately 0.9 and approximately 1.6, between approximately 1 and approximately 1.5, between approximately 1.1 and approximately 1.4, or between approximately 1.2 and approximately 1.3, or any value or range within or bounded by any of these ranges or values, although values outside these values or ranges can be used in some cases.

The second curved surface 108*b* of second mating edge 108 can be connected to and/or can extend from the first curved surface 108*a* of second mating edge 108 in a direction at least partially toward the rear face 104. The second curved surface 108*b* of second mating edge 108 can be positioned between the first curved surface 108*a* of second mating edge 108 and the abutment surface 108*c* of second mating edge 108. The second curved surface 108*b* of second mating edge 108 can have a radius of curvature that is different than the radius of curvature of the first curved surface 108*a* of second mating edge 108. For example, the second curved surface 108*b* of second mating edge 108 can have a radius of curvature that is smaller than the radius of curvature of the first curved surface 108*a* of second mating edge 108. The second curved surface 108*b* of second mating edge 108 can have a radius of curvature that is between approximately 0.01 inch and approximately 0.1 inch. For example, the second curved surface 108*b* of second mating edge 108 can have a radius of curvature between approximately 0.02 inch and approximately 0.09 inch, between approximately 0.03 inch and approximately 0.08 inch, between approximately 0.04 inch and approximately 0.07 inch, between approximately 0.05 inch and approximately 0.06 inch, or between approximately inch and approximately 0.06 inch, or any value or range within or bounded by any of these ranges or values, although values outside these values or ranges can be used in some cases. In some embodiments, the first and second curved surfaces 108*a*, 108*b* of second mating edge 108 are curved in different directions.

In some embodiments, a ratio between the radius of curvature of the second curved surface 108*b* of second mating edge 108 and the thickness $T_1$ of the cladding element 100 is between approximately 0.005 and approximately 1. For example, in some embodiments, a ratio between the radius of curvature of the second curved surface 108*b* of second mating edge 108 and the thickness $T_1$ of the cladding element 100 is between approximately 0.01 and approximately 0.9, between approximately 0.02 and approximately 0.8, between approximately 0.03 and approximately 0.7, between approximately 0.04 and approximately 0.6, between approximately 0.05 and approximately 0.5, between approximately 0.06 and approximately 0.4, between approximately 0.07 and approximately 0.3, between approximately 0.08 and approximately 0.2, between approximately 0.09 and approximately 0.2, between approximately 0.1 and approximately 0.2, or between approximately 0.05 and approximately 0.2, or any value or range within or bounded by any of these ranges or values, although values outside these values or ranges can be used in some cases.

In some embodiments, the radius of curvature of the second curved surface 108*b* of the second mating edge 108 is the same as the radius of curvature of the second curved surface 106*b* of the first mating edge 106. Alternatively, in some embodiments, the radius of curvature of the second curved surface 108*b* of the second mating edge 108 is different than the radius of curvature of the second curved surface 106*b* of the first mating edge 106. For example, in some embodiments, the radius of curvature of the second curved surface 108*b* of the second mating edge 108 is greater than the radius of curvature of the second curved surface 106*b* of the first mating edge 106. As another example, in some embodiments, the radius of curvature of the second curved surface 108*b* of the second mating edge 108 is less than the radius of curvature of the second curved surface 106*b* of the first mating edge 106. In some embodiments, the radius of curvature of the second curved surface 108*b* of the second mating edge 108 is within 50%, 40%, 30%, 20%, 10%, 5%, 2%, or 1% as the radius of curvature of the second curved surface 106*b* of the first mating edge 106.

In some embodiments, a ratio between the radius of curvature of the first curved surface 108*a* of second mating edge 108 and the radius of curvature of the second curved surface 108*b* of second mating edge 108 can be between approximately 2 and approximately 20. For example, a ratio between the radius of curvature of the first curved surface 108*a* of second mating edge 108 and the radius of curvature of the second curved surface 108*b* of second mating edge 108 can be between approximately 4 and approximately 18, between approximately 6 and approximately 16, between approximately 8 and approximately 14, between approximately 10 and approximately 12, between approximately 4 and approximately 12, between approximately 6 and approximately 10, between approximately 7 and approximately 9, or any value or range within or bounded by any of these ranges or values.

In some embodiments, the second curved surface 108*b* of second mating edge 108 has a radius of curvature that is less than or equal to approximately 0.1 inch. For example, in some embodiments, the second curved surface 108*b* of second mating edge 108 has a radius of curvature that is less than or equal to approximately 0.1 inch, less than or equal to approximately 0.09 inch, less than or equal to approximately 0.08 inch, less than or equal to approximately 0.07 inch, less than or equal to approximately 0.06 inch, or less than or equal to approximately 0.05 inch.

The first curved surface 108*a* of second mating edge 108 can have a length $b_1$ and the second curved surface 108*b* of second mating edge 108 can have a length $b_2$, as shown in FIGS. 4C-4D. In some embodiments, such lengths $b_1$ and $b_2$ can be different. For example, $b_1$ can be greater than $b_2$. In some embodiments, the length $b_1$ of the first curved surface 108*a* of second mating edge 108 is equal to the length $a_1$ of the first curved surface 106*a* of first mating edge 106. In some embodiments, the length $b_2$ of the second curved surface 108*b* of second mating edge 108*b* is equal to the length $a_2$ of the second curved surface 106*b* of first mating edge 106. Alternatively, in some embodiments, the length $b_2$ of the second curved surface 108*b* of second mating edge 108*b* is different than (e.g., less than or greater than) the length $a_2$ of the second curved surface 106*b* of first mating edge 106.

Use of the term "length" with respect to lengths $b_1$ and $b_2$ is not intended to be limiting, and the lengths $b_1$ and $b_2$ can also be referred to as "widths" $b_1$ and $b_2$ of the respective surfaces 108*a*, 108*b*. Accordingly, regardless of whether the term "length" or "width" is used to describe surfaces 108*a*, 108*b*, such "length" or "width" can define portions of the cross-section of the second mating edge 108 as shown in FIGS. 4C-4D.

Figure 4E:
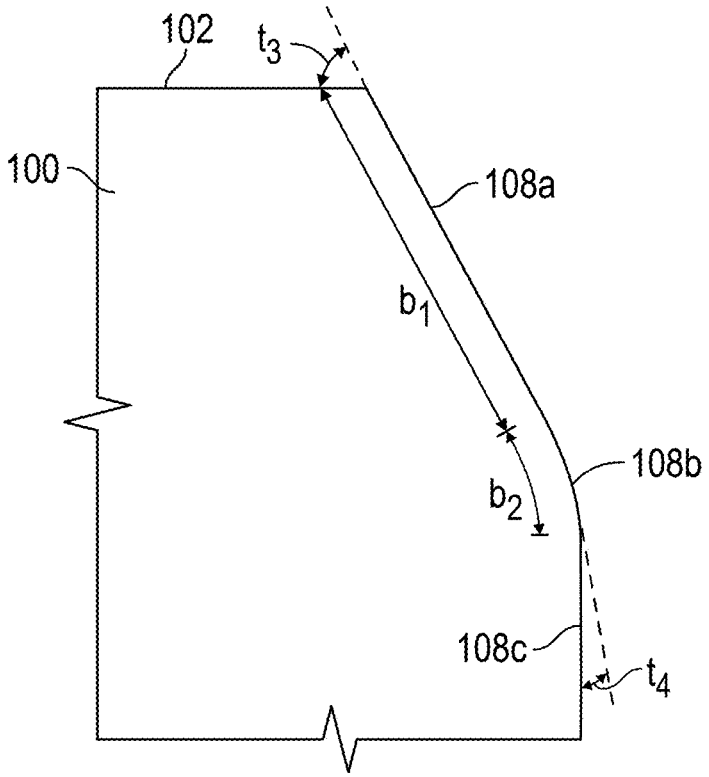

With reference to FIG. 4E, a tangent line of the first curved surface 108*a* of second mating edge 108 can be angled at an angle $t_3$ with respect to the front face 102. Such angle $t_3$ can be between approximately 45° and approximately 90°. For example, such angle $t_3$ can be between approximately 50° and approximately 85°, between approximately 55° and approximately 80°, between approximately 60° and approximately 75°, or between approximately 65° and approximately 70°, or any value or range within or bounded by any of these ranges or values, although values outside these values or ranges can be used in some cases.

With reference to FIGS. 4D-4E, in some embodiments, angle $t_1$ and/or angle $t_3$ is less than 90° (for example, less than 85°, less than 80°, less than 75°, less than 70°, less than 65°, less than 60°, less than 55°, less than 50°, or less than 45°), which can advantageously provide for a smoother and/or gradual transition between the front face 102 and the curved surfaces 106*a*, 108*a*. This in turn can minimize visual perceptibility of potential dimensional variations (that may occur during normal manufacturing) of joint grooves formed from a plurality of cladding elements 100 installed with one another on a building substrate.

As also shown in FIG. 4E, a tangent line of the second curved surface 108*b* of second mating edge 108 can be angled at an angle $t_4$ with respect to the abutment surface 108*c* of second mating edge 108. Such angle $t_4$ can be between approximately 0° and approximately 45°. For example, such angle $t_4$ can be between approximately 5° and approximately 40°, between approximately 10° and approximately 35°, between approximately 15° and approximately 30°, or between approximately 20° and approximately or any value or range within or bounded by any of these ranges or values, although values outside these values or ranges can be used in some cases. In some embodiments, the angle $t_3$ is greater than the angle $t_4$.

In some embodiments, the abutment surface 108*c* of second mating edge 108 is transverse with respect to the first planar surface 108*d* of second mating edge 108, the front face 102, and/or the rear face 104. For example, the abutment surface 108*c* of second mating edge 108 can be perpendicular to the first planar surface 108*d* of second mating edge 108, the front face 102, and/or the rear face 104.

In some embodiments, the first planar surface 108*d* of second mating edge 108 is parallel with respect to the front face 102 and/or the rear face 104. In some embodiments, the second planar surface 108*e* of second mating edge 108 is transverse with respect to the rear face 104, first planar surface 108*d* of second mating edge 108, and/or the front face 102. For example, the second planar surface 108*e* of second mating edge 108 can be perpendicular with respect to the rear face 104, first planar surface 108*d* of second mating edge 108, and/or the front face 102. In some embodiments, the second planar surface 108*e* of second mating edge 108 is parallel with respect to the abutment surface 108*c* of second mating edge 108.

In some embodiments as discussed above, the second mating edge 108 additionally includes a first transition region 108*f* between the abutment surface 108*c* and the first planar surface 108*d* and/or a second transition region 108*g* between the first planar surface 108*d* and the second planar surface 108*e*. Such optional transitions regions 108*f*, 108*g* of second mating edge 108 can comprise a chamfered or curved surface. The optional transition region 108*f* of second mating edge 108 can comprise a curved surface having a radius of curvature that is between approximately 0.001 inch and approximately 0.05 inch. For example, the optional transition region 108*f* of second mating edge 108 can comprise a curved surface having a radius of curvature that is between approximately 0.002 inch and approximately 0.04 inch, between approximately 0.004 inch and approximately 0.03 inch, between approximately inch and approximately 0.02 inch, between approximately 0.008 inch and approximately inch, or between approximately 0.01 inch and approximately 0.02 inch, or any value or range within or bounded by any of these ranges or values, although values outside these values or ranges can be used in some cases. The optional transition region 108*g* of second mating edge 108 can comprise a curved surface having a radius of curvature that is between approximately 0.01 inch and approximately 0.05 inch. For example, the optional transition region 108*g* can comprise a curved surface having a radius of curvature that is between approximately 0.01 inch and approximately 0.04 inch, between approximately 0.02 inch and approximately 0.04 inch, or between approximately 0.03 inch and approximately 0.04 inch, or any value or range within or bounded by any of these ranges or values, although values outside these values or ranges can be used in some cases. In some embodiments, the transition region 108*g* of second mating edge 108 comprises a radius of curvature that is greater than a radius of curvature of the transition region 108*f* of second mating edge 108. Alternatively, in some embodiments, the transition region 108*g* of second mating edge 108 comprises a radius of curvature that is equal to or less than a radius of curvature of the transition region 108*f* of second mating edge 108.

When a first mating edge 106 of a first cladding element 100 is positioned adjacent to a second mating edge 108 of a second cladding element 100, the various surfaces of the first and second mating edges 106, 108 can form a groove (referred to herein as a "joint groove") like that illustrated in at least FIG. 4B. Such joint groove can be formed when, for example, abutment surfaces 106*d* and 108*c* of first and second mating edges 106, 108 respectively contact one another. Advantageously, such contact between the abutment surfaces 106*d*, 108*c* of first and second mating edges 106, 108 respectively can provide tactile feedback to a worker installing the cladding elements 100 in a manner which indicates that the first and second mating edges 106, 108 have been correctly positioned so as to form the joint groove. Such joint groove can extend parallel to the height(s) $H_1$ of the adjacent cladding elements 100 and/or extend along the first and second mating edges 106, 108.

Advantageously, the synergistic combination and interaction of the various curved surfaces 106*a*, 106*b* of the first mating edge 106, first and second curved surfaces 108*a*, 108*b* of the second mating edge 108 and the planar surface 106*c* of first mating edge 106 act to minimize the effect of potential variations of aspects of the cladding elements 100 which are discussed above (e.g., thickness variations). By controlling aspects of such curved surfaces 106*a*, 106*b* of the first mating edge 106, first and second curved surfaces 108*a*, 108*b* of the second mating edge 108 and the planar surface 106*c* of first mating edge 106 relative to each other, it is possible to control the resulting dimensions of the resulting joint groove to ensure that minor manufacturing variations do not impact the resulting aesthetic. For example, the arrangement of the curved surfaces 106*a*, 106*b*, 108*a*, 108*b*, the planar surface 106*c* of first and second mating edges 106, 108 respectively, and/or the radius of curvatures of the curved surfaces 106*a*, 106*b*, 108*a*, 108*b* of first and second mating edges 106, 108 respectively can reduce the effect of such potential variations to a visually imperceptible level. The planar surface 106*c* of first mating edge 106, which can be parallel to the front face 102 in some embodiments as discussed above, can represent a common or focal point of the joint groove to an observer. The incorporation of the curved surfaces 106*a*, 106*b* and/or curved surfaces 108*a*, 108*b* of first and second mating edges 106, 108 respectively adjacent such planar surface 106*c* of first mating edge 106, can provide a "seamless" gradual transition that minimizes visual perceptibility of the above-mentioned potential variations between aspects of joint grooves created by a plurality of cladding elements 100 installed on a wall. Additionally, the dimensional (e.g., length) and/or curvature (e.g., radius of curvature) relationship discussed above with reference to the curved surfaces 106*a*, 106*b*, 108*a*, 108*b* and/or planar surface 106*c* of first and second mating edges 106, 108 respectively can advantageously enhance such benefits.

With reference to FIGS. 4B and 4C, although these figures may illustrate an apparent gap between the curved surface 108*b* of second mating edge 108 and planar surface 106*c* (and/or transition region 106*h*) of first mating edge 106, such gap may be visually imperceptible to an actual observer of the product and may be non-existent in some cases.

With reference to FIG. 4B, in some embodiments, the first and second mating edges 106, 108 can be configured such that, when abutment surfaces 106*d*, 108*c* contact one another, one or more gaps can be formed between one or more surfaces of the first and second mating edges 106, 108. For example, in some embodiments, when abutment surfaces 106*d*, 108*c* of first and second mating edges 106, 108 respectively contact one another a first gap $g_1$ can be formed between the first planar surface 108*d* of second mating edge 108 and the second planar surface 106*e* of first mating edge 106 (see FIGS. 4B-4C). Alternatively or additionally, in some embodiments, when abutment surfaces 106*d*, 108*c* of first and second mating edges 106, 108 respectively contact one another a second gap $g_2$ can be formed between the second planar surface 108*e* of second mating edge 108 and the third planar surface 106*g* of first mating edge 106 (see FIGS. 4B-4C). The gap $g_1$ can be between approximately 0.01 inch and approximately 0.05 inch, between approximately 0.01 inch and approximately 0.04 inch, between approximately 0.01 inch and approximately 0.03 inch, between approximately 0.01 inch and approximately 0.02 inch, between approximately 0.02 inch in and approximately 0.05 inch, between approximately 0.02 inch and approximately 0.04 inch, or between approximately 0.02 inch and approximately 0.03 inch, or any value or range within or bounded by any of these ranges or values, although values outside these values or ranges can be used in some cases. The gap $g_2$ can be between approximately 0.01 inch and approximately 0.1 inch. For example, the gap $g_2$ can be between approximately 0.02 inch and approximately 0.09 inch, between approximately 0.03 inch and approximately 0.07 inch, between approximately 0.04 inch and approximately 0.06 inch, or between approximately 0.03 inch and approximately 0.05 inch, or any value or range within or bounded by any of these ranges or values, although values outside these values or ranges can be used in some cases. In some embodiments, the gap $g_1$ is equal to the gap $g_2$. Alternatively, in some embodiments, the gap $g_1$ is less than gap $g_2$. Advantageously, the gaps $g_1$ and $g_2$ can allow sealant (e.g., caulking) to be placed between one or more of the surfaces of the first and second mating edges 106, 108.

In some cases, when abutment surface 106*d* of first mating edge 106 contacts (e.g., abuts) abutment surface 108*c* of second mating edge 108, first planar surface 108*d* of second mating edge 108 can be parallel with respect to first planar surface 106*c* and/or second planar surface 106*e* of first mating edge 106. In some cases, when abutment surface 106*d* of first mating edge 106 contacts (e.g., abuts) abutment surface 108*c* of second mating edge 108, first planar surface 108*d* of second mating edge 108 can be transverse (e.g., perpendicular) to third planar surface 106*g* of first mating edge 106. In some cases, when abutment surface 106*d* of first mating edge 106 contacts (e.g., abuts) abutment surface 108*c* of second mating edge 108, second planar surface 108*e* of second mating edge 108 can be parallel with respect to third planar surface 106*g* and/or abutment surface 106*d* of first mating edge 106. In some cases, when abutment surface 106*d* of first mating edge 106 contacts (e.g., abuts) abutment surface 108*c* of second mating edge 108, second planar surface 108*e* can be transverse (e.g., perpendicular) with respect to first planar surface 106*c* and/or second planar surface 106*e* of first mating edge 106.

With reference to FIG. 4B, the joint groove formed by the first and second mating edges 106, 108 of cladding element 100 can have a width $w_1$ and a depth $d_1$. Width $w_1$ can extend across a top of the joint groove along a plane parallel to at least one of the front faces 102 of two adjacent cladding elements 100.

Width $w_1$ can be between approximately 0.05 inch and approximately 1 inch. For example, width $w_1$ can be between approximately 0.06 inch and approximately 0.9 inch, between approximately 0.07 inch and approximately 0.8 inch, between approximately 0.08 in and approximately 0.7 inch, between approximately 0.09 inch and approximately 0.6 inch, between approximately 0.1 inch and approximately 0.5 inch, between approximately 0.11 inch and approximately 0.4 inch, between approximately 0.12 inch and approximately 0.3 inch, between approximately 0.13 inch and approximately 0.2 inch, between approximately 0.14 inch and approximately 0.19 inch, between approximately 0.15 inch and approximately 0.18 inch, between approximately 0.16 inch and approximately 0.17 inch, between approximately 0.15 inch and approximately 0.3 inch, or any value or range within or bounded by any of these ranges or values, although values outside these values or ranges can be used in some cases. In one exemplary embodiment, width $w_1$ is between approximately 0.15 inch and approximately 0.25 inch.

Depth $d_1$ can be between approximately 0.01 inch and approximately 0.5 inch. For example, depth $d_1$ can be between approximately 0.02 inch and approximately 0.5 inch, between approximately 0.03 inch and approximately 0.4 inch, between approximately 0.04 inch and approximately 0.3 inch, between approximately 0.05 inch and approximately 0.2 inch, between approximately 0.06 inch and approximately 0.1 inch, between approximately 0.07 inch and approximately 0.09 inch, or between approximately 0.05 inch and approximately 0.2 inch, or any value or range within or bounded by any of these ranges or values, although values outside these values or ranges can be used in some cases. In one exemplary embodiment, depth $d_1$ is between approximately 0.05 inch and approximately 0.15 inch.

In some embodiments, the ratio between width $w_1$ and depth $d_1$ is between approximately 0.5 and approximately 5. For example, the ratio between width $w_1$ and depth $d_1$ can be between approximately 0.6 and approximately 4.5, between approximately 0.7 and approximately 4, between approximately 0.8 and approximately 3.5, between approximately 0.9 and approximately 3, between approximately 1 and approximately 2.5, between approximately 1.1 and approximately 2, between approximately 1.2 and approximately 1.9, between approximately 1.3 and approximately 1.8, between approximately 1.4 and approximately 1.7, between approximately 1.5 and approximately 1.6, between approximately 1 and approximately 2, between approximately 1.5 and approximately 2.5, between approximately 2 and approximately 3, or between approximately 3 and approximately 4, or any value or range within or bounded by any of these ranges or values, although values outside these values or ranges can be used in some cases.

With reference to FIG. 4C, the length $a_3$ of the planar surface 106*c* of first mating edge 106 can be between approximately 0.01 inch and approximately 2 inch. For example, the length $a_3$ of the planar surface 106*c* of first mating edge 106 can be between approximately 0.02 inch and approximately 1.9 inch, between approximately 0.03 inch and approximately 1.8 inch, between approximately 0.04 inch and approximately 1.7 inch, between approximately 0.05 inch and approximately 1.6 inch, between approximately 0.06 inch and approximately 1.5 inch, between approximately 0.07 inch and approximately 1.4 inch, between approximately 0.08 inch and approximately 1.3 inch, between approximately 0.09 inch and approximately 1.2 inch, between approximately 0.1 inch and approximately 1.1 inch, between approximately 0.2 inch and approximately 1 inch, between approximately 0.3 inch and approximately 0.9 inch, between approximately 0.4 inch and approximately 0.8 inch, between approximately 0.5 inch and approximately 0.7 inch, between approximately 0.01 inch and approximately 0.1 inch, between approximately 0.02 inch and approximately 0.1 inch, between approximately 0.03 inch and approximately 0.1 inch, between approximately 0.04 inch and approximately 0.1 inch, between approximately 0.05 inch and approximately 0.1 inch, between approximately 0.06 inch and approximately 0.1 inch, between approximately 0.08 inch and approximately 0.1 inch, or between approximately 0.04 inch and approximately 0.08 inch, or any value or range within or bounded by any of these ranges or values, although values outside these values or ranges can be used in some cases.

With reference to FIGS. 4B-4C, in some embodiments, a ratio between the width $w_1$ of the joint groove formed by first and second mating edges 106, 108 and the length $a_3$ of the planar surface 106*c* of the first mating edge 106 is between approximately 1 and approximately 10. For example, the ratio between the width $w_1$ of the joint groove formed by first and second mating edges 106, 108 and the length $a_3$ of the planar surface 106*c* of first mating edge 106 can be between approximately 1.5 and approximately 9.5, between approximately 2 and approximately 9, between approximately 2.5 and approximately 8.5, between approximately 3 and approximately 8, between approximately 3.5 and approximately 7.5, between approximately 4 and approximately 7, between approximately 4.5 and approximately 6.5, between approximately 5 and approximately 6, between approximately 1 and approximately 9, between approximately 1 and approximately 8, between approximately 1 and approximately 7, between approximately 1 and approximately 6, between approximately 1 and approximately 5, between approximately 1 and approximately 4, between approximately 2 and approximately 5, or between approximately 1 and approximately 3, or any value or range within or bounded by any of these ranges or values, although values outside these values or ranges can be used in some cases.

With reference to FIGS. 4B-4C, in some embodiments, a ratio between the depth $d_1$ of the joint groove formed by first and second mating edges 106, 108 and the length $a_3$ of the planar surface 106*c* of first mating edge 106 is between approximately 0.5 and approximately 10. For example, the ratio between the depth $d_1$ of the joint groove formed by first and second mating edges 106, 108 and the length $a_3$ of the planar surface 106*c* of first mating edge 106 can be between approximately 0.5 and approximately 10, between approximately 0.6 and approximately 9.5, between approximately 0.7 and approximately 9, between approximately 0.8 and approximately 8.5, between approximately 0.9 and approximately 8, between approximately 1 and approximately 7.5, between approximately 1.1 and approximately 7, between approximately 1.2 and approximately 6.5, between approximately 1.3 and approximately 6, between approximately 1.4 and approximately 5.5, between approximately 1.5 and approximately 5, between approximately 1.6 and approximately 4.5, between approximately 1.7 and approximately 4, between approximately 1.8 and approximately 3.5, between approximately 1.9 and approximately 3, between approximately 2 and approximately 2.5, between approximately 1.6 and approximately 2, between approximately 1.7 and approximately 1.9, between approximately 0.5 and approximately 3, between approximately 0.5 and approximately 2, between approximately 0.5 and approximately 1, or between approximately 1 and approximately 3, or any value or range within or bounded by any of these ranges or values, although values outside these values or ranges can be used in some cases.

Figure 18A:
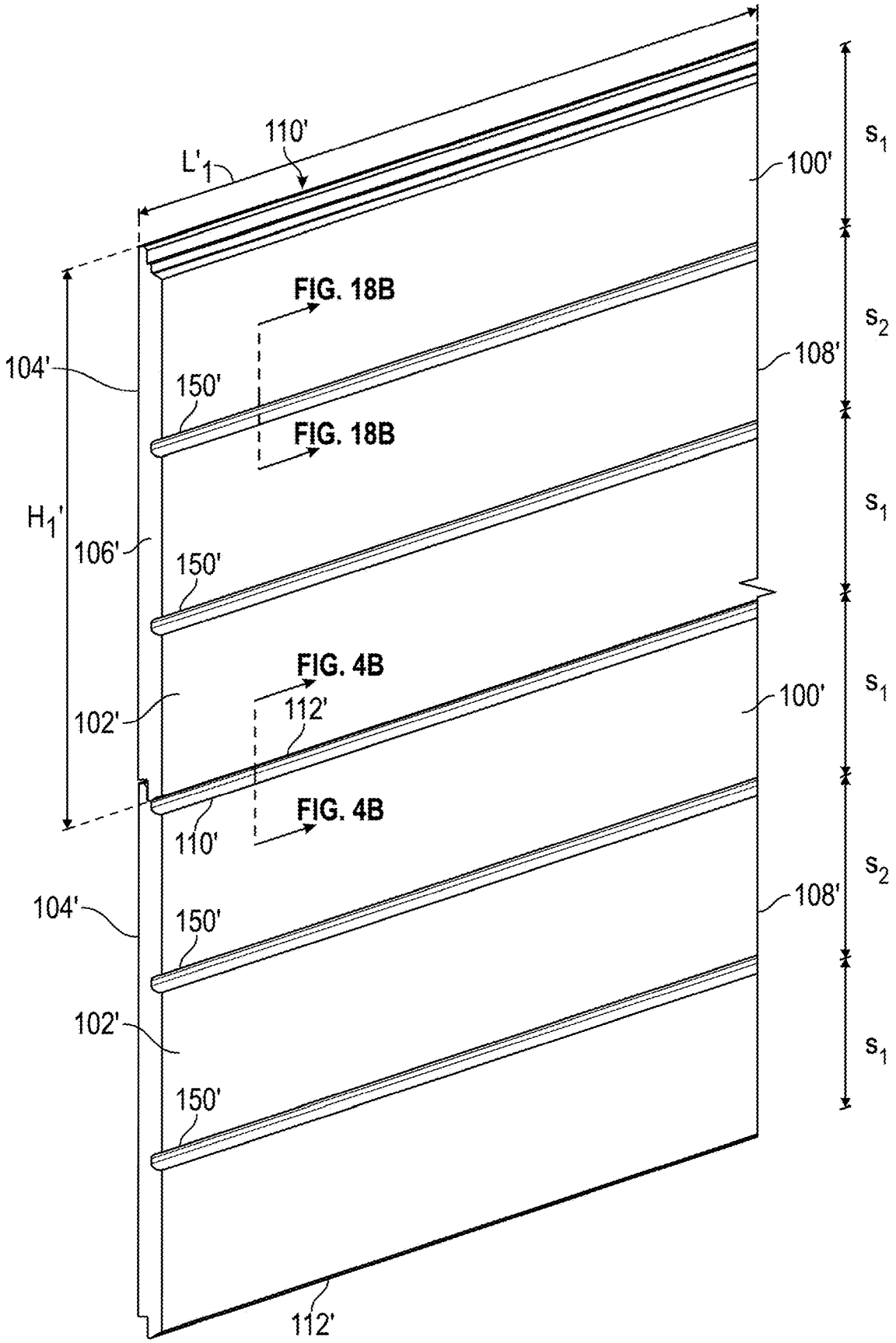
FIG. 18A illustrates another embodiment of a cladding element in accordance with aspects of this disclosure.

FIG. 18A illustrates another embodiment of a cladding element 100'. FIG. 18A illustrates two cladding elements 100' positioned vertically adjacent to one another, for example, "stacked" in a vertical configuration. Cladding element 100' can be similar or identical to cladding element 100 in some or many respects. For example, cladding element 100' can comprise a smooth fiber cement cladding panel such as that described above with reference to cladding element 100 or in an alternate example can include a textured pattern on a face thereof (e.g., front face 102') such as that described above with respect to cladding element 100. Cladding element 100' includes a height $H_1'$ that can be equal to, less than, or greater than height $H_1$ of cladding element 100. Length $L_1'$ can be equal to, less than, or greater than height $H_1$ of cladding element 100. As another example, cladding element 100' can have a thickness that is identical to thickness $T_1$ described above with reference to cladding element 100. Cladding element 100' can be a panel or a plank, for example.

Similar to that described above with reference to cladding element 100, cladding element 100' can include edges 110', 112', 106', 108'. Edges 110' and 112' can be opposite one another and edges 106', 108' can be opposite one another, as shown. When cladding element 100' is installed along a building substrate in an orientation like that shown in FIG. 18A with one or more other cladding elements 100', edge 110' can be a top edge of the cladding element 100', edge 112' can be a bottom edge of the cladding element 100', and edges 106', 108' can be side edges of the cladding element 100'. Cladding element 100' can also have a front face 102' and a rear face 104' opposite the front face 102' (see FIGS. 18A-18B). When cladding element 100' is secured to a building substrate (such as any of weather resistant barrier 40, sheathing 30, and/or framing members 20), the front face 102' can face away from the building substrate and the rear face 104' can face toward the building substrate.

As stated previously with respect to cladding element 100, while the term "edge" is used in reference to cladding element 100', this terminology is not intended to be limiting, and the edges 106', 108', 110', 112' described with reference to cladding element 100' can also be referred to as "ends" without departing from the intended meaning. Additionally, while the terms "length" and "height" are used in reference to cladding element 100', such terminology is not intended to be limiting. For example, length $L_1'$ of the cladding element 100' can also be referred to as a "width" of the cladding element 100'.

Edge 110' can include one or more or a plurality of surfaces which can define a profile of the edge 110', and such surface(s) can extend along (e.g., continuously along) the height $L_1'$ of the cladding element 100'. Edge 110' can be identical to first mating edge 106 of cladding element 100 as described above with reference to FIGS. 4C-4E. Edge 112' can include one or more or a plurality of surfaces which can define a profile of the edge 112', and such surface(s) can extend along (e.g., continuously along) the height $L_1'$ of the cladding element 100'. Edge 112' can be identical to second mating edge 108 of cladding element 100 as described above with reference to FIGS. 4C-4E. Advantageously, as illustrated in FIG. 18A, such configuration can allow mating edges 112', 110' of adjacent cladding elements 100' to form a joint groove along the joint between such mating edges 112', 110' of the cladding elements 100', and such joint groove can extend "horizontally" along the mating edges 112', 110' and/or length $L_1'$ of the cladding elements 100' when installed on a building substrate.

As also illustrated in FIG. 18A, cladding element 100' can include one or more or a plurality of face grooves or intermediate grooves 150'. For example, the cladding element 100' can include one, two, three, four, five, six, seven, or eight or more intermediate grooves 150'. Such intermediate grooves 150' can be recessed from the front face 102' of the cladding element 100' and can be positioned between and/or spaced from one or both of edges 110', 112'. Such intermediate grooves 150' can be spaced from one or both of edges 110', 112' at a spacing $s_1$ and can be spaced from one another at spacing(s) $s_2$. In some embodiments, the spacing $s_1$ is equal to the spacing $s_2$. Spacing $s_1$ and/or spacing $s_2$ can be approximately 2 inch, 4 inch, 6 inch, 8 inch, 10 inch, 12 inch, 14 inch, 16 inch, 18 inch, 20 inch, 22 inch, 24 inch, 26 inch, 28 inch, 30 inch, 32 inch, 34 inch, 36 inch, 38 inch, 40 inch, 42 inch, 44 inch, 46 inch, or 48 inch, or any value or range within or bounded by any of these ranges or values, although values outside these values or ranges can be used in some cases. Cladding element 100' can include one or more grooves 150' arranged substantially perpendicular to edges 106', 108' as shown (which can be oriented horizontally when cladding element 100' is secured to a building substrate) and/or can include one or more grooves (similar or identical to grooves 150') that are arranged substantially parallel to edges 106', 108' (which can be oriented vertically when cladding element 100' is secured to a building substrate).

In some implementations, cladding element 100' comprises a textured pattern (such as any of those discussed herein), for example, on front face 102'. In some implementations, the front face 102' comprises such textured pattern and the groove(s) 150" and/or the edges 110', 112' do not comprise a textured pattern. Additionally, in some implementations, a rear face of cladding element 100' (opposite the front face 102') does not comprise a textured pattern.

As illustrated in FIG. 18A, the intermediate groove(s) 150' can have a shape that matches and/or corresponds to the shape of the joint groove formed at the mating edges 110', 112'. For example, as described further below, various surfaces that can form and/or define a cross-section of the intermediate groove(s) 150' can have identical or similar characteristics as surfaces that can form and/or define a cross-section of the mating edges 110', 112' which can form the joint groove. As discussed above, mating edges 110', 112' can be identical to first and second mating edges 106, 108 which are shown and described with reference to FIGS. 4B-4D. This can advantageously create a uniform and desirable aesthetic appearance along the height $H_1'$ of the cladding elements 100' and along a height or portion of a height of a structure to which the cladding elements 100' are installed.

Figure 18B:
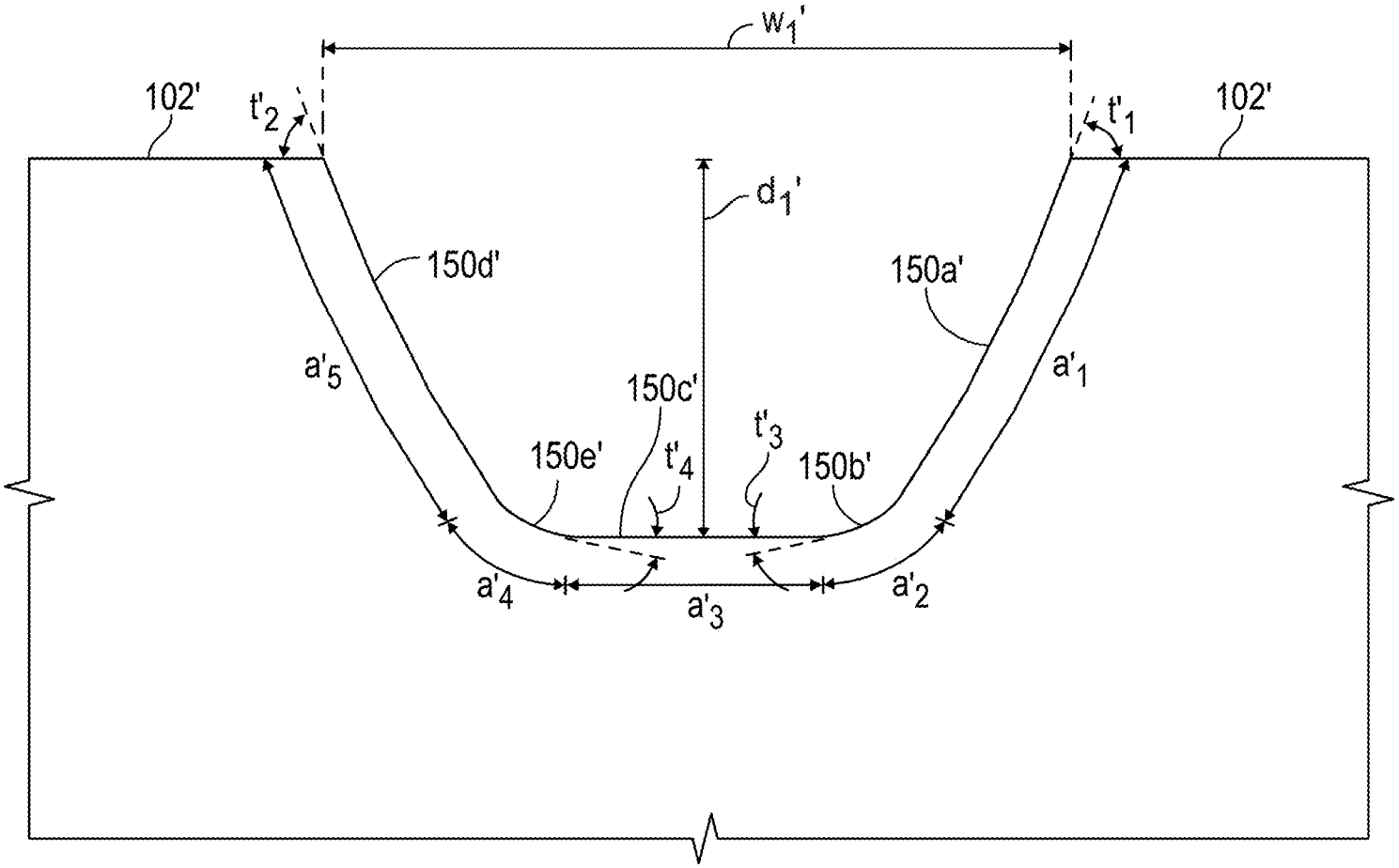
FIG. 18B illustrates a cross-section taken through a portion of the cladding element of FIG. 18A in accordance with aspects of this disclosure.

FIG. 18B illustrates a cross-sectional view of the intermediate groove 150'. The intermediate groove 150' can include one or more or a plurality of surfaces which can define a profile (e.g., cross-section) of the intermediate groove 150'. For example, the intermediate groove 150' can include, one, two, three, four, five, six, seven, or eight or more surfaces which can define the profile of the intermediate groove 150'. As shown, the intermediate groove 150' can include a first curved surface 150*a'*, a second curved surface 150*b'*, a planar surface 150*c'*, a third curved surface 150*d'*, and a fourth curved surface 150*e'*.

Use of the terms "first," "second," "third," "fourth," or similar terminology when describing surfaces the intermediate groove 150' is not intended to be limiting nor is it intended to mean that the inclusion of any one of such numbered surfaces necessarily requires inclusion of any of the other numbered surfaces described with respect to intermediate groove 150'.

The first curved surface 150*a'* of intermediate groove 150' can be connected to and/or can extend from the front face 102' in a direction at least partially toward the rear face 104'. The first curved surface 150*a'* of intermediate groove 150' can be positioned between the front face 102' and the second curved surface 150*b'* of intermediate groove 150'. The first curved surface 150*a'* of intermediate groove 150' can have a radius of curvature between approximately 0.1 inch and approximately 1 inch. For example, the first curved surface 150*a'* can have a radius of curvature between approximately 0.2 inch and approximately 0.9 inch, between approximately 0.3 inch and approximately 0.8 inch, between approximately 0.4 inch and approximately 0.7 inch, between approximately 0.5 inch and approximately 0.6 inch, or between approximately 0.3 inch and approximately 0.5 inch, or any value or range within or bounded by any of these ranges or values, although values outside these values or ranges can be used inch some cases.

In some embodiments, a ratio between the radius of curvature of the first curved surface 150*a'* of intermediate groove 150' and a thickness of the cladding element 100' is between approximately 0.1 and approximately 2. For example, in some embodiments, a ratio between the radius of curvature of the first curved surface 150*a'* of intermediate groove 150' and a thickness of the cladding element 100' is between approximately 0.2 and approximately 1.9, between approximately 0.3 and approximately 1.8, between approximately 0.4 and approximately 1.7, between approximately 0.5 and approximately 1.6, between approximately 0.6 and approximately 1.5, between approximately 0.7 and approximately 1.8, between approximately 0.8 and approximately 1.7, between approximately 0.9 and approximately 1.6, between approximately 1 and approximately 1.5, between approximately 1.1 and approximately 1.4, or between approximately 1.2 and approximately 1.3, or any value or range within or bounded by any of these ranges or values, although values outside these values or ranges can be used in some cases.

The second curved surface 150*b'* of intermediate groove 150' can be connected to and/or can extend from the first curved surface 150*a'* of intermediate groove 150'. In some implementations, the second curved surface 150*b'* extends from the first curved surface 150*a'* in a direction at least partially toward the rear face 104'. The second curved surface 150*b'* of intermediate groove 150' can be positioned between the first curved surface 150*a'* of intermediate groove 150' and the planar surface 150*c'* of intermediate groove 150'. The second curved surface 150*b'* of intermediate groove 150' can have a radius of curvature that is different than the radius of curvature of the first curved surface 150*a'* of intermediate groove 150'. For example, the second curved surface 150*b'* of intermediate groove 150' can have a radius of curvature that is smaller than the radius of curvature of the first curved surface 150*a'* of intermediate groove 150'. The second curved surface 150*b'* of intermediate groove 150' can have a radius of curvature that is between approximately 0.01 in and approximately 0.1 inch. For example, the second curved surface 150*b'* of intermediate groove 150' can have a radius of curvature between approximately 0.02 inch and approximately 0.09 inch, between approximately 0.03 inch and approximately 0.08 inch, between approximately 0.04 inch and approximately 0.07 inch, between approximately 0.05 inch and approximately 0.06 inch, between approximately 0.03 inch and approximately 0.05 inch, or between approximately 0.03 inch and approximately 0.04 inch, or any value or range within or bounded by any of these ranges or values, although values outside these values or ranges can be used in some cases. In some embodiments, the first and second curved surfaces 150*a'*, 150*b'* of intermediate groove 150' are curved in the same direction, for example, in a direction away from a building substrate to which the cladding element 100' is secured.

In some embodiments, a ratio between the radius of curvature of the second curved surface 150*b'* of intermediate groove 150' and a thickness of the cladding element 100 is between approximately 0.005 and approximately 1. For example, in some embodiments, a ratio between the radius of curvature of the second curved surface 150*b'* of intermediate groove 150' and a thickness of the cladding element 100 is between approximately 0.01 and approximately 0.9, between approximately 0.02 and approximately 0.8, between approximately 0.03 and approximately 0.7, between approximately 0.04 and approximately 0.6, between approximately 0.05 and approximately 0.5, between approximately 0.06 and approximately 0.4, between approximately 0.07 and approximately 0.3, between approximately 0.08 and approximately 0.2, between approximately 0.09 and approximately 0.2, between approximately 0.1 and approximately 0.2, or between approximately 0.05 and approximately 0.2, or any value or range within or bounded by any of these ranges or values, although values outside these values or ranges can be used in some cases.

In some embodiments, a ratio between the radius of curvature of the first curved surface 150*a*' of intermediate groove 150' and the radius of curvature of the second curved surface 150*b*' of intermediate groove 150' can be between approximately 2 and approximately 20. For example, a ratio between the radius of curvature of the first curved surface 150*a*' of intermediate groove 150' and the radius of curvature of the second curved surface 150*b*' of intermediate groove 150' can be between approximately 4 and approximately 18, between approximately 6 and approximately 16, between approximately 8 and approximately 14, between approximately 10 and approximately 12, between approximately 4 and approximately 12, between approximately 6 and approximately 10, or between approximately 11 and approximately 12, or any value or range within or bounded by any of these ranges or values.

In some embodiments, the second curved surface 150*b*' of intermediate groove 150' has a radius of curvature that is less than or equal to approximately 0.1 inch. For example, in some embodiments, the second curved surface 150*b*' has a radius of curvature that is less than or equal to approximately 0.1 inch, less than or equal to approximately 0.09 inch, less than or equal to approximately 0.08 inch, less than or equal to approximately 0.07 inch, less than or equal to approximately 0.06 inch, less than or equal to approximately 0.05 inch, or less than or equal to approximately 0.04 inch.

The planar surface 150*c*' of intermediate groove 150' is substantially parallel to the front face 102' and/or to the rear face 104' thereby forming a truncated 'U' or 'V' shaped groove. In an alternative embodiment, the planar surface 150*c*' of intermediate groove 150' can be curved to form a 'U' shaped groove or alternatively the planar surface 150*c*' of intermediate groove 150' can be pointed to form a 'V' shaped groove.

The third curved surface 150*d*' of intermediate groove 150' can be connected to and/or can extend from the front face 102' in a direction at least partially toward the rear face 104'. The third curved surface 150*d*' of intermediate groove 150' can be positioned between the front face 102' and the fourth curved surface 150*e*' of intermediate groove 150'. The third curved surface 150*d*' of intermediate groove 150' can have a radius of curvature between approximately 0.1 inch and approximately 1 inch. For example, the third curved surface 150*d*' of intermediate groove 150' can have a radius of curvature between approximately 0.2 inch and approximately 0.9 inch, between approximately 0.3 inch and approximately 0.8 inch, between approximately 0.4 inch and approximately 0.7 inch, between approximately 0.5 inch and approximately 0.6 inch, or between approximately 0.3 inch and approximately 0.5 inch, or any value or range within or bounded by any of these ranges or values. In at least one exemplary embodiment, the size and shape of third curved surface 150*d*' is equivalent to the size and shape of first curved surface 150*a'*.

In some embodiments, a ratio between the radius of curvature of the third curved surface 150*d*' of intermediate groove 150' and a thickness of the cladding element 100' is between approximately 0.1 and approximately 2. For example, in some embodiments, a ratio between the radius of curvature of the third curved surface 150*d*' of intermediate groove 150' and a thickness of the cladding element 100' is between approximately 0.2 and approximately 1.9, between approximately 0.3 and approximately 1.8, between approximately 0.4 and approximately 1.7, between approximately 0.5 and approximately 1.6, between approximately 0.6 and approximately 1.5, between approximately 0.7 and approximately 1.8, between approximately 0.8 and approximately 1.7, between approximately 0.9 and approximately 1.6, between approximately 1 and approximately 1.5, between approximately 1.1 and approximately 1.4, or between approximately 1.2 and approximately 1.3, or any value or range within or bounded by any of these ranges or values, although values outside these values or ranges can be used in some cases.

The fourth curved surface 150*e*' of intermediate groove 150' can be connected to and/or can extend from the third curved surface 150*d*' of intermediate groove 150'. In some implementations, the fourth curved surface 150*e*' extends from the third curved surface 150*d*' in a direction at least partially toward the rear face 104'. The fourth curved surface 150*e*' of intermediate groove 150' can be positioned between the third curved surface 150*d*' of intermediate groove 150' and the planar surface 150*c*' of intermediate groove 150'. The fourth curved surface 150*e*' of intermediate groove 150' can have a radius of curvature that is different than the radius of curvature of the third curved surface 150*d*' of intermediate groove 150'. For example, the fourth curved surface 150*e*' of intermediate groove 150' can have a radius of curvature that is smaller than the radius of curvature of the third curved surface 150*d*' of intermediate groove 150'. The fourth curved surface 150*e*' of intermediate groove 150' can have a radius of curvature that is between approximately 0.01 inch and approximately inch. For example, the fourth curved surface 150*e*' of intermediate groove 150' can have a radius of curvature between approximately 0.02 inch and approximately 0.09 inch, between approximately 0.03 inch and approximately 0.08 inch, between approximately 0.04 inch and approximately 0.07 inch, between approximately 0.05 inch and approximately 0.06 inch, or between approximately 0.03 inch and approximately 0.04 inch, or any value or range within or bounded by any of these ranges or values. In some embodiments, the third and fourth curved surfaces 150*d*', 150*e*' are curved in the same direction, for example, in a direction away from a building substrate to which the cladding element 100' is secured.

In some embodiments, a ratio between the radius of curvature of the fourth curved surface 150*e*' of intermediate groove 150' and a thickness of the cladding element 100' is between approximately 0.005 and approximately 1. For example, in some embodiments, a ratio between the radius of curvature of the fourth curved surface 150*e*' of intermediate groove 150' and a thickness of the cladding element 100' is between approximately 0.01 and approximately 0.9, between approximately 0.02 and approximately 0.8, between approximately 0.03 and approximately 0.7, between approximately 0.04 and approximately 0.6, between approximately 0.05 and approximately 0.5, between approximately 0.06 and approximately 0.4, between approximately 0.07 and approximately 0.3, between approximately 0.08 and approximately 0.2, between approximately 0.09 and approximately 0.2, between approximately 0.1 and approximately 0.2, or between approximately 0.05 and approximately 0.2, or any value or range within or bounded by any of these ranges or values, although values outside these values or ranges can be used in some cases.

In some embodiments, a ratio between the radius of curvature of the third curved surface 150*d*' of intermediate groove 150' and the radius of curvature of the fourth curved surface 150*e*' of intermediate groove 150' is between approximately 2 and approximately 20. For example, a ratio between the radius of curvature of the third curved surface 150*d*' of intermediate groove 150' and the radius of curvature of the fourth curved surface 150*e*' of intermediate groove 150' can be between approximately 4 and approximately 18, between approximately 6 and approximately 16, between approximately 8 and approximately 14, between approximately 10 and approximately 12, between approximately 4 and approximately 12, between approximately 6 and approximately 10, or between approximately 11 and approximately 12, or any value or range within or bounded by any of these ranges or values.

In some embodiments, the fourth curved surface 150e' of intermediate groove 150' has a radius of curvature that is less than or equal to approximately 0.1 inch. For example, in some embodiments, the fourth curved surface 150e' of intermediate groove 150' has a radius of curvature that is less than or equal to approximately 0.1 inch, less than or equal to approximately 0.09 inch, less than or equal to approximately 0.08 inch, less than or equal to approximately 0.07 inch, less than or equal to approximately 0.06 inch, less than or equal to approximately 0.05 inch, or less than or equal to approximately 0.04 inch.

In some embodiments, the radius of curvature of the first curved surface 150a' of intermediate groove 150' is equal to the radius of curvature of the third curved surface 150d' of intermediate groove 150' and/or the radius of curvature of the second curved surface 150b' of intermediate groove 150' is equal to the radius of curvature of the fourth curved surface 150e' of intermediate groove 150'. In some embodiments, the radius of curvature of the first curved surface 150a' of intermediate groove 150' is within 1%, 2%, 5%, 10%, 15%, 20%, 25%, 30%, 35%, 40%, 45%, or 50% of the radius of curvature of the third curved surface 150d' of intermediate groove 150', or any value or range within or bounded by any of these ranges or values. In some embodiments, the radius of curvature of the second curved surface 150b' of intermediate groove 150' is within 1%, 2%, 5%, 10%, 15%, 20%, 25%, 30%, 35%, 40%, 45%, or 50% of the radius of curvature of the fourth curved surface 150e' of intermediate groove 150', or any value or range within or bounded by any of these ranges or values.

The first curved surface 150a' of intermediate groove 150' can have a length $a_1'$ and the second curved surface 150b' of intermediate groove 150' can have a length $a_2'$, as shown in FIG. 18B. In some embodiments, lengths $a_1'$ and $a_2'$ are different. For example, $a_1'$ can be greater than $a_2'$. The planar surface 150c' of intermediate groove 150' can have a length $a_3'$. Length $a_3'$ can be different than either or both of lengths $a_1'$ and $a_2'$. For example, length $a_3'$ can be greater than or equal to length $a_2'$ and/or length $a_3'$ can be less than or equal to length $a_1'$. In some embodiments, length $a_2'$ is smaller than length $a_1'$ and/or smaller than length $a_3'$.

The third curved surface 150d' of intermediate groove 150' can have a length $a_5'$ and the fourth curved surface 150e' of intermediate groove 150' can have a length $a_4'$, as shown in FIG. 18B. In some embodiments, lengths $a_5'$ and $a_4'$ are different. For example, $a_5'$ can be greater than $a_4'$. The planar surface 150c' of intermediate groove 150' can have a length $a_3'$ that can be different than either or both of lengths $a_5'$ and $a_4'$. For example, length $a_3'$ can be greater than or equal to length $a_4'$ and/or length $a_3'$ can be less than or equal to length $a_5'$. In some embodiments, length $a_4'$ is smaller than length $a_5'$ and/or smaller than length $a_3'$.

Use of the term "length" with respect to lengths $a_1'$, $a_2'$, $a_3'$, $a_4'$, and $a_5'$ is not intended to be limiting, and the lengths $a_1'$, $a_2'$, $a_3'$, $a_4'$, and $a_5'$ can also be referred to as "widths" $a_1'$, $a_2'$, $a_3'$, $a_4'$, and $a_5'$ of the respective surfaces 150a', 150b', 150c', 150d', 150e' of intermediate groove 150'. Accordingly, regardless of whether the term "length" or "width" is used to describe surfaces 150a', 150b', 150c', 150d', 150e', such "length" or "width" can define portions of the cross-section of the intermediate groove 150' as shown in FIG. 18B.

As shown in FIG. 18B, a tangent line of the first curved surface 150a' of intermediate groove 150' can be angled at an angle $t_1'$ with respect to the front face 102'. Such angle $t_1'$ can be between approximately 45° and approximately 90°. For example, such angle $t_1'$ can be between approximately 50° and approximately 85°, between approximately 55° and approximately 80°, between approximately 60° and approximately 75°, or between approximately 65° and approximately 70°, or any value or range within or bounded by any of these ranges or values, although values outside these values or ranges can be used in some cases.

As also shown in FIG. 18B, a tangent line of the third curved surface 150d' of intermediate groove 150' can be angled at an angle $t_2'$ with respect to the front face 102'. Such angle $t_2'$ can be between approximately 45° and approximately 90°. For example, such angle $t_2'$ can be between approximately 50° and approximately 85°, between approximately and approximately 80°, between approximately 60° and approximately 75°, or between approximately 65° and approximately 70°, or any value or range within or bounded by any of these ranges or values, although values outside these values or ranges can be used in some cases.

In some embodiments, angle $t_1'$ and/or angle $t_2'$ is less than 90° (for example, less than 85°, less than 80°, less than 75°, less than 70°, less than 65°, less than 60°, less than 55°, less than 50°, or less than 45°), which can advantageously provide for a smoother and/or gradual transition between the front face 102' and the curved surfaces 150a', 150e'. This in turn can minimize visual perceptibility of potential dimensional variations (for example, in $d_1'$) between adjacent grooves 150' on the front face 102' which may occur during manufacturing.

In some embodiments, angle $t_1'$ is equal to $t_2'$. In some embodiments, angle $t_1'$ is within approximately 1°, approximately 2°, approximately 3°, approximately 4°, approximately 5°, approximately 6°, approximately 7°, approximately 8°, approximately 9°, or approximately 10° of angle $t_2'$, or within any value or range within or bounded by any of these values.

As also shown in FIG. 18B, a tangent line of the second curved surface 150b' of intermediate groove 150' can be angled at an angle $t_3'$ with respect to the planar surface 150c' of intermediate groove 150'. Such angle $t_3'$ can be between approximately 0° and approximately 45°. For example, such angle $t_3'$ can be between approximately 5° and approximately 40°, between approximately 10° and approximately 35°, between approximately 15° and approximately 30°, or between approximately 20° and approximately or any value or range within or bounded by any of these ranges or values, although values outside these values or ranges can be used in some cases. In some embodiments, the angle $t_1'$ is greater than the angle $t_3'$.

As also shown in FIG. 18B, a tangent line of the fourth curved surface 150e' of intermediate groove 150' can be angled at an angle $t_4'$ with respect to the planar surface 150c' of intermediate groove 150'. Such angle $t_4'$ can be between approximately 0° and approximately 45°. For example, such angle $t_4'$ can be between approximately 5° and approximately 40°, between approximately 10° and approximately 35°, between approximately 15° and approximately 30°, or between approximately 20° and approximately or any value or range within or bounded by any of these ranges or values, although values outside these values or ranges can be used in some cases. In some embodiments, the angle $t_2'$ is greater than the angle $t_4'$.

In some embodiments, angle $t_3'$ and $t_4'$ are equal. In some embodiments, angle $t_3'$ is within approximately 1°, approximately 2°, approximately 3°, approximately 4°, approximately 5°, approximately 6°, approximately 7°, approximately 8°, approximately 9°, or approximately 10° of angle $t_4°$, or within any value or range within or bounded by any of these values.

With continued reference to FIG. 18B, intermediate groove 150' can have a width $w_1'$ and a depth $d_1'$. Width $w_1'$ can extend across a top of the intermediate groove 150' along a plane that can be parallel to and/or co-planar with the front face 102 of cladding element 100'.

Width $w_1'$ can be between approximately 0.05 inch and approximately 1 inch. For example, width $w_1'$ can be between approximately 0.06 inch and approximately 0.9 in, between approximately 0.07 inch and approximately 0.8 inch, between approximately 0.08 inch and approximately 0.7 inch, between approximately 0.09 inch and approximately 0.6 inch, between approximately 0.1 inch and approximately 0.5 inch, between approximately 0.11 inch and approximately 0.4 inch, between approximately 0.12 inch and approximately 0.3 inch, between approximately 0.13 inch and approximately 0.2 inch, between approximately 0.14 inch and approximately 0.19 inch, between approximately 0.15 inch and approximately 0.18 inch, between approximately 0.16 inch and approximately 0.17 inch, between approximately 0.15 inch and approximately 0.3 inch, or any value or range within or bounded by any of these ranges or values, although values outside these values or ranges can be used in some cases.

Depth $d_1'$ can be between approximately 0.01 inch and approximately 0.5 inch. For example, depth $d_1'$ can be between approximately 0.02 inch and approximately 0.5 inch, between approximately 0.03 inch and approximately 0.4 inch, between approximately 0.04 inch and approximately 0.3 inch, between approximately 0.05 inch and approximately 0.2 inch, between approximately 0.06 inch and approximately 0.1 inch, between approximately 0.07 inch and approximately 0.09 inch, or between approximately 0.05 inch and approximately 0.2 inch, or any value or range within or bounded by any of these ranges or values, although values outside these values or ranges can be used in some cases. The depth $d_1'$ of intermediate groove 150' is generally selected relative to the thickness of cladding element 100'. Depth dr of the intermediate groove 150' is selected such that an aesthetic is achieved without negatively impacting the structural integrity of the cladding element 100'.

In some embodiments, the ratio between width $w_1'$ and depth $d_1'$ is between approximately 0.5 and approximately 5. For example, the ratio between width $w_1'$ and depth $d_1'$ can be between approximately 0.5 and approximately 5, between approximately 0.6 and approximately 4.5, between approximately 0.7 and approximately 4, between approximately and approximately 3.5, between approximately 0.9 and approximately 3, between approximately 1 and approximately 2.5, between approximately 1.1 and approximately 2, between approximately 1.2 and approximately 1.9, between approximately 1.3 and approximately 1.8, between approximately 1.4 and approximately 1.7, between approximately 1.5 and approximately 1.6, between approximately 1 and approximately 2, between 1.5 and 2.5, between approximately 2 and approximately 3, or between approximately 3 and approximately 4, or any value or range within or bounded by any of these ranges or values, although values outside these values or ranges can be used in some cases.

While such intermediate grooves 150' can impart desirable aesthetics to an exterior structure having cladding elements 100', it may be difficult in some cases to ensure a uniform visual appearance of the intermediate grooves 150' when a plurality of cladding elements 100' are installed along a portion of a structure (e.g., a wall). This is in part due to the natural variations within tolerance that occur when manufacturing cladding elements 100' with identical thicknesses. Such potential variations may result in non-uniformity between a plurality of intermediate grooves 150' appearing on a wall or other structure where the cladding elements 100' are installed. Advantageously, the combination and interaction of the various curved surfaces 150*a*', 150*b*', 150*d*', 150*e*', and the planar surface 150*c*' of intermediate groove 150' act to minimize the effect of such potential variations. For example, the arrangement of the curved surfaces 150*a*', 150*b*', 150*d*', 150*e*', the planar surface 150*c*' of intermediate groove 150', the radius of curvatures of the curved surfaces 150*a*', 150*b*', 150*d*', 150*e*' of intermediate groove 150', and/or the angles $t_1'$, $t_2'$ between curved surfaces 150*a*', 150*d*' and front face 102' can reduce the effect of such potential variations to a visually imperceptible level. The planar surface 150*c*' of intermediate groove 150', which can be parallel to the front face 102' in some embodiments as discussed above, can represent a common or focal point of the intermediate groove 150' to an observer. The incorporation of the curved surfaces 150*a*', 150*b*' and/or curved surfaces 150*d*', 150*e*' adjacent such planar surface 150*c*' of intermediate groove 150' can provide a "seamless" gradual transition that minimizes visual perceptibility of the above-mentioned potential variations between aspects of intermediate grooves 150' created by a plurality of cladding elements 100 installed on a wall. Additionally, the dimensional (e.g., length) and/or curvature (e.g., radius of curvature) relationship discussed above with reference to the curved surfaces 150*a*', 150*b*', 150*d*', 150*e*' and/or planar surface 150*c*' of intermediate groove 150' can advantageously enhance such benefits. The angles $t_1'$, $t_2'$ between curved surfaces 150*a*', 150*d*' and front face 102' can advantageously enhance such benefits.

With reference to FIG. 18B, the length $a_3'$ of the planar surface 150*c*' can be between approximately 0.01 inch and approximately 2 inches. For example, the length $a_3'$ of the planar surface 150*c*' of intermediate groove 150' can be between approximately 0.02 inch and approximately 1.9 inch, between approximately 0.03 inch and approximately 1.8 inch, between approximately 0.04 inch and approximately 1.7 inch, between approximately 0.05 inch and approximately 1.6 inch, between approximately 0.06 inch and approximately 1.5 inch, between approximately 0.07 inch and approximately 1.4 inch, between approximately 0.08 inch and approximately 1.3 inch, between approximately 0.09 inch and approximately 1.2 inch, between approximately 0.1 inch and approximately 1.1 inch, between approximately 0.2 inch and approximately 1 inch, between approximately 0.3 inch and approximately 0.9 inch, between approximately 0.4 inch and approximately 0.8 inch, between approximately 0.5 inch and approximately 0.7 inch, between approximately 0.01 inch and approximately 0.1 inch, between approximately 0.02 inch and approximately 0.1 inch, between approximately 0.03 inch and approximately 0.1 inch, between approximately 0.04 inch and approximately 0.1 inch, between approximately 0.05 inch and approximately 0.1 inch, between approximately 0.06 inch and approximately 0.1 inch, between approximately 0.08 inch and approximately 0.1 inch, or between approximately 0.04 inch and approximately 0.08 inch, or any value or range within or bounded by any of these ranges or values, although values outside these values or ranges can be used in some cases.

With reference to FIG. 18B, in some embodiments, a ratio between the width $w_1$' of the intermediate groove 150' and the length $a_3$' of the planar surface 150*c*' of intermediate groove 150' is between approximately 1 and approximately 10. For example, the ratio between the width $w_1$' of the intermediate groove 150' and the length $a_3$' of the planar surface 150*c*' of intermediate groove 150' can be between approximately 1.5 and approximately 9.5, between approximately 2 and approximately 9, between approximately 2.5 and approximately 8.5, between approximately 3 and approximately 8, between approximately 3.5 and approximately 7.5, between approximately 4 and approximately 7, between approximately 4.5 and approximately 6.5, between approximately 5 and approximately 6, between approximately 1 and approximately 9, between approximately 1 and approximately 8, between approximately 1 and approximately 7, between approximately 1 and approximately 6, between approximately 1 and approximately 5, between approximately 1 and approximately 4, between approximately 2 and approximately 5, or between approximately 1 and approximately 3, or any value or range within or bounded by any of these ranges or values, although values outside these values or ranges can be used in some cases.

With continued reference to FIG. 18B, in some embodiments, a ratio between the depth $d_1$' of the intermediate groove 150' and the length $a_3$' of the planar surface 150*c*' of intermediate groove 150' is between approximately 0.5 and approximately 10. For example, the ratio between the depth $d_1$' of the intermediate groove 150' and the length $a_3$' of the planar surface 150*c*' of intermediate groove 150' can be between approximately 0.5 and approximately 10, between approximately 0.6 and approximately 9.5, between approximately 0.7 and approximately 9, between approximately 0.8 and approximately 8.5, between approximately 0.9 and approximately 8, between approximately 1 and approximately 7.5, between approximately 1.1 and approximately 7, between approximately 1.2 and approximately 6.5, between approximately 1.3 and approximately 6, between approximately 1.4 and approximately 5.5, between approximately 1.5 and approximately 5, between approximately 1.6 and approximately 4.5, between approximately 1.7 and approximately 4, between approximately 1.8 and approximately 3.5, between approximately 1.9 and approximately 3, between approximately 2 and approximately 2.5, between approximately 1.6 and approximately 2, between approximately 1.7 and approximately 1.9, between approximately 0.5 and approximately 3, between approximately 0.5 and approximately 2, between approximately 0.5 and approximately 1, or between approximately 1 and approximately 3, or any value or range within or bounded by any of these ranges or values, although values outside these values or ranges can be used in some cases.

Advantageously, various aspects of intermediate groove 150' can be related to various aspects of the joint groove formed from mating edges 110', 112' so that both grooves have a similar or uniform visual appearance. As discussed above, mating edges 110', 112' can be identical to first and second mating edges 106, 108 (respectively). Accordingly, aspects of the intermediate groove 150' are described and/or compared below with respect aspects of the first and second mating edges 106, 108.

In some embodiments, the radius of curvature of the first curved surface 150*a*' of intermediate groove 150' is equal to the radius of curvature of the first curved surface 106*a* of first mating edge 106. In some embodiments, the radius of curvature of the first curved surface 150*a*' of intermediate groove 150' is within 50%, 40%, 30%, 20%, 10%, 5%, 2%, or 1% of the radius of curvature of the first curved surface 106*a* of first mating edge 106, or any value or range of values within or bounded by any of these values. In some embodiments, the length $a_1$' of the first curved surface 150*a*' of the intermediate groove 150' is equal to the length $a_1$ of the first curved surface 106*a* of the first mating edge 106. In some embodiments, the length $a_1$' of the first curved surface 150*a*' of intermediate groove 150' is within 50%, 40%, 30%, 20%, 10%, 5%, 2%, or 1% of the length $a_1$ of the first curved surface 106*a* of first mating edge 106, or any value or range of values within or bounded by any of these values.

In some embodiments, the radius of curvature of the second curved surface 150*b*' of intermediate groove 150' is equal to the radius of curvature of the second curved surface 106*b* of first mating edge 106. In some embodiments, the radius of curvature of the second curved surface 150*b*' of intermediate groove 150' is within 50%, 40%, 30%, 20%, 10%, 5%, 2%, or 1% of the radius of curvature of the second curved surface 106*b* of first mating edge 106, or any value or range of values within or bounded by any of these values. In some embodiments, the length $a_2$' of the second curved surface 150*b*' of the intermediate groove 150' is equal to the length $a_2$ of the second curved surface 106*b* of the first mating edge 106. In some embodiments, the length $a_2$' of the second curved surface 150*b*' of intermediate groove 150' is within 50%, 40%, 30%, 20%, 10%, 5%, 2%, or 1% of the length $a_2$ of the second curved surface 106*b* of first mating edge 106, or any value or range of values within or bounded by any of these values.

In some embodiments, the radius of curvature of the fourth curved surface 150*e*' of intermediate groove 150' is different than the radius of curvature of the second curved surface 108*b* of the second mating edge 108. For example, in some embodiments, the radius of curvature of the fourth curved surface 150*e*' of intermediate groove 150' is less than the radius of curvature of the second curved surface 108*b* of the second mating edge 108. In some embodiments, the radius of curvature of the fourth curved surface 150*e*' of intermediate groove 150' is within 50%, 40%, 30%, 20%, 10%, 5%, 2%, or 1% of the radius of curvature of the second curved surface 108*b* of the second mating edge 108, or any value or range of values within or bounded by any of these values.

In some embodiments, the radius of curvature of the third curved surface 150*d*' of intermediate groove 150' is equal to the radius of curvature of the first curved surface 108*a* of second mating edge 108. In some embodiments, the radius of curvature of the third curved surface 150*d*' of intermediate groove 150' is within 50%, 40%, 30%, 20%, 10%, 5%, 2%, or 1% of the radius of curvature of the first curved surface 108*a* of second mating edge 108, or any value or range of values within or bounded by any of these values. In some embodiments, the length $a_5$' of the third curved surface 150*d*' of the intermediate groove 150' is equal to the length $b_1$ of the first curved surface 108*a* of the second mating edge 108. In some embodiments, the length $a_5$' of the third curved surface 150*d*' of intermediate groove 150' is within 50%, 40%, 30%, 20%, 10%, 5%, 2%, or 1% of the length $b_1$ of the first curved surface 108*a* of second mating edge 108, or any value or range of values within or bounded by any of these values.

In some embodiments, with reference to FIGS. 4B-4C and FIG. 18B, the width $w_1$' of the intermediate groove 150' is equal to the width $w_1$ of the joint groove formed by the first and second mating edges 106, 108. In some embodiments, the width $w_1'$ of the intermediate groove 150' is within 50%, 40%, 30%, 20%, 10%, 5%, 2%, or 1% of the width $w_1$ of the joint groove formed by the first and second mating edges 106, 108, or any value or range of values within or bounded by any of these values, although values outside these values or ranges can be used in some cases.

In some embodiments, with reference to FIGS. 4B-4C and FIG. 18B, the depth $d_1'$ of the intermediate groove 150' is equal to the depth $d_1$ of the joint groove formed by the first and second mating edges 106, 108. In some embodiments, the depth $d_1'$ of the intermediate groove 150' is within 50%, 40%, 30%, 20%, 10%, 5%, 2%, or 1% of the depth $d_1$ of the joint groove formed by the first and second mating edges 106, 108, or any value or range of values within or bounded by any of these values, although values outside these values or ranges can be used in some cases.

In some embodiments, with reference to FIGS. 4B-4C and FIG. 18B, the length $a_3'$ of the planar surface 150*c'* of the intermediate groove 150' is equal to the length $a_3$ of the planar surface 106*c* of the first mating edge 106. In some embodiments, the length $a_3'$ of the planar surface 150*c'* of the intermediate groove 150' is within 50%, 40%, 30%, 20%, 10%, 5%, 2%, or 1% of the length $a_3$ of the planar surface 106*c* of the first mating edge 106, or any value or range of values within or bounded by any of these values, although values outside these values or ranges can be used in some cases.

With continued reference to FIGS. 4B-4C and FIG. 18B, in some embodiments, when abutment surfaces 106*d*, 108*c* of first and second mating edges 106, 108 contact one another (e.g., when adjacent cladding elements 100' are installed on a building substrate), one or more surfaces of first and second mating edges 106, 108 can be transverse (e.g., perpendicular) and/or parallel with respect to one or more surfaces of the intermediate groove(s) 150' (which can be recessed from the front face 102' of the cladding elements 100'). For example, in some embodiments, when abutment surfaces 106*d*, 108*c* of first and second mating edges 106, 108 contact one another, the planar surface 150*c'* of intermediate groove 150' is parallel with respect to the first planar surface 106*c* and/or the second planar surface 106*e* of first mating edge 106, and/or parallel with respect to the first planar surface 108*d* of second mating edge 108. Additionally or alternatively, in some embodiments, when abutment surfaces 106*d*, 108*c* of first and second mating edges 106, 108 contact one another, the planar surface 150*c'* of intermediate groove 150' is transverse (e.g., perpendicular) with respect to the abutment surface 106*d* and/or third planar surface 106*g* of first mating edge 106, and/or is transverse (e.g., perpendicular) with respect to the abutment surface 108*c* and/or second planar surface 108*e* of second mating edge 108.

With reference to at least FIG. 4C, in some alternative embodiments, the first mating edge 106 includes a straight surface instead of the first curved surface 106*a* of the first mating edge 106 and/or the second curved surface 106*b* of the first mating edge 106, and such straight surface can extend between the first planar surface 106*c* of the first mating edge 106 and the front face 102. Additionally or alternatively, in some embodiments, the second mating edge 108 includes a straight surface instead of the first curved surface 108*a* of the second mating edge 108 and/or the second curved surface 108*b* of the second mating edge 108, and such straight surface can extend between the abutment surface 108*c* of the second mating edge 108 and the front face 102.

With continued reference to FIG. 4C, in some alternative embodiments, the first mating edge 106 has only one of the first or second curved surfaces 106*a*, 106*b*. Additionally or alternatively, in some embodiments, the second mating edge 108 has only one of the first or second curved surfaces 108*a*, 108*b*.

With reference to FIG. 18B, in some alternative embodiments, the intermediate groove 150' includes a straight surface instead of the first curved surface 150*a'* of the intermediate groove 150' and/or the second curved surface 150*b'* of the intermediate groove 150', and such straight surface can extend between the planar surface 150*c'* of the intermediate groove 150' and the front face 102. Additionally or alternatively, in some embodiments, the intermediate groove 150' includes a straight surface instead of the third curved surface 150*d'* of the intermediate groove 150' and/or the fourth curved surface 150*e'* of the intermediate groove 150', and such straight surface can extend between the planar surface 150*c'* of the intermediate groove 150' and the front face 102. In some alternative embodiments, the intermediate groove 150' has only one of the first or second curved surfaces 150*a'*, 150*b'* and/or the intermediate groove 150' has only one of the third or fourth curved surfaces 150*d'*, 150*e'*.

Figure 19A:
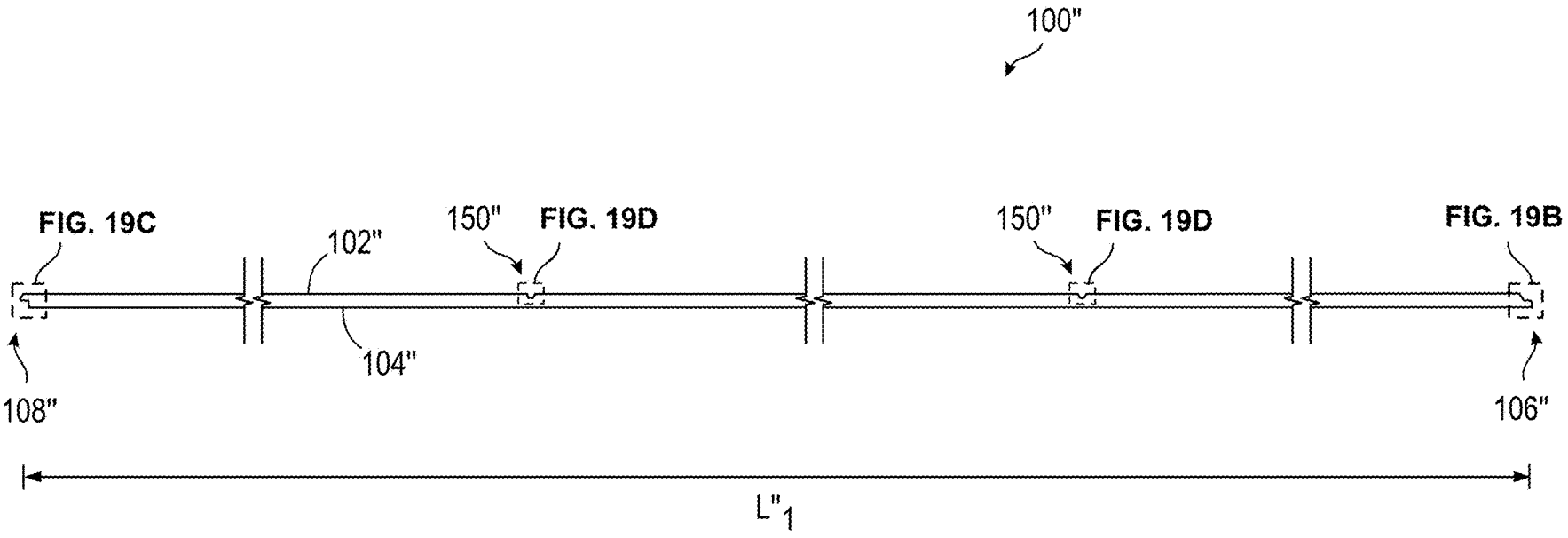
FIG. 19A illustrates another embodiment of a cladding element in accordance with aspects of this disclosure.

FIG. 19A illustrates a side view of another embodiment of a cladding element 100". Cladding element 100" includes a front face 102", a rear face 104", an edge 106", and an edge 108" opposite edge 106". Edge 106", 108" each may be referred to herein as "mating edges". As shown in FIG. 19A and as discussed further below, cladding elements 100" can include one or a plurality of grooves 150" between edges 106", 108". Cladding element 100" can include one or more grooves 150" arranged substantially parallel to edges 106", 108" as shown and/or can include one or more grooves (similar or identical to grooves 150") that are arranged substantially perpendicular to edges 106", 108". When cladding element 100" is secured to a building substrate (such as any of weather resistant barrier 40, sheathing 30, and/or framing members 20), the front face 102" faces away from the building substrate and the rear face 104" faces toward the building substrate. Multiple cladding elements 100" can be assembled in a manner in which edges 106", 108" are oriented horizontally on a structure and mate with one another (for example, in an overlapping manner). Additionally or alternatively, multiple cladding elements 100" can be assembled in a manner in which edges 106", 108" are oriented vertically on a structure and mate with one another (for example, in an overlapping manner). Cladding element 100" can comprise fiber cement, similar or identical to as described with respect to cladding elements 100, 100'.

Cladding element 100" can include a height, length, and thickness similar or identical to any of the heights, lengths, and thicknesses described with reference to any of the other cladding elements described herein (such as cladding elements 100, 100'). As shown in FIG. 19A, cladding element 100" includes a length $L_1$". Depending on the orientation of cladding element 100" when installed on a building substrate (for example, in a horizontal or vertical orientation), length $L_1$" may be referred to as a height or width of cladding element 100". Length $L_1$" can be equal to any of the values described above with respect to length $L_1$ and/or height $H_1$ of cladding element 100. A thickness of cladding element 100" can be equal to any of the values described above with respect to thickness $T_1$ of cladding element 100. Cladding element 100" can be a panel or a plank, for example. As stated previously with respect to cladding elements 100, 100', while the term "edge" is used in reference to cladding element 100", this terminology is not intended to be limiting, and the edges 106", 108" described with reference to cladding element 100" can also be referred to as "ends" without departing from the intended meaning. In some implementations, cladding element 100" comprises a textured pattern (such as any of those discussed herein), for example, on front face 102". In some implementations, the front face 102" comprises a textured pattern and the groove(s) 150" and/or the edges 106", 108" do not comprise a textured pattern. Additionally, in some implementations, rear face 104" of cladding element 100" does not comprise a textured pattern.

Edge 106" (which can be referred to as a "first mating edge 106") can include one or more or a plurality of surfaces which can define a profile of edge 106". Any or all of the surfaces discussed below with reference to edge 106" can extend along (e.g., continuously along) a height or length of the cladding element 100 (depending upon the installation orientation). Edge 106" can include, one, two, three, four, five, six, seven, or eight or more surfaces which can define the profile of the edge 106".

Figure 19B:
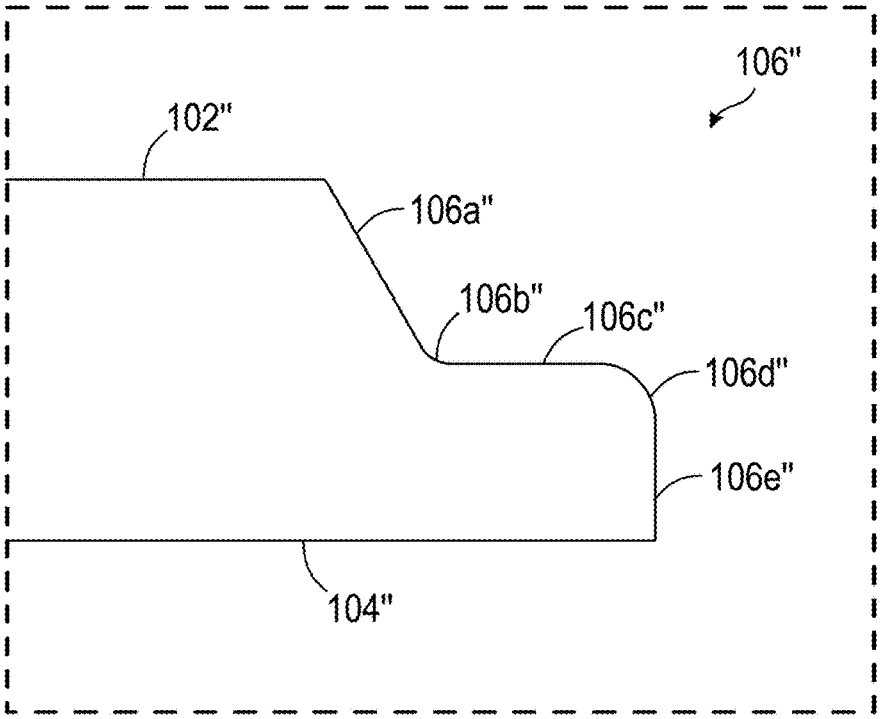
FIGS. 19B-19D illustrate enlarged views of portions of the cladding element of FIG. 19A in accordance with aspects of this disclosure.

FIG. 19B illustrates an enlarged cross-sectional view of edge 106". As shown, edge 106" can include a first surface 106*a*", a second surface 106*b*", a third surface 106*c*", a fourth surface 106*d*", and a fifth surface 106*e*". The fifth surface 106*e*" may also be referred to as an "abutment surface" since the fifth surface 106*e*" can abut an abutment surface 108*e*" of edge 108" when an edge 106" of a first cladding element 100" is mated with an edge 108" of a second cladding element 100". In some variants, edge 106" does not include the fourth surface 106*d*" and the third surface 106*c*" is directly connected to the fifth surface 106*e*". Use of the terms "first," "second,", "third," "fourth," "fifth," or similar terminology when describing surfaces of edge 106" is not intended to be limiting nor is it intended to mean that the inclusion of any one of such numbered surfaces necessarily requires inclusion of any of the other numbered surfaces described with respect to edge 106".

The first surface 106*a*" can be connected to and/or can extend from the front face 102" in a direction at least partially toward the rear face 104". The first surface 106*a*" can be substantially straight as shown. The second surface 106*b*" can be connected to and/or can extend from the first surface 106*a*". The second surface 106*b*" can be positioned between the first surface 106*a*" and the third surface 106*c*" as shown. The second surface 106*b*" can have a radius of curvature that is between approximately 0.01 inch and approximately 0.1 inch. For example, the second surface 106*b*" can have a radius of curvature between approximately 0.01 inch and approximately 0.09 inch, between approximately 0.01 inch and approximately 0.08 inch, between approximately 0.01 inch and approximately 0.07 inch, between approximately 0.01 inch and approximately 0.06 inch, between approximately 0.01 inch and approximately 0.05 inch, between approximately 0.01 inch and approximately 0.04 inch, or between approximately 0.02 inch and approximately 0.04 inch, or any value or range within or bounded by any of these ranges or values, although values outside these values or ranges can be used in some cases. In some embodiments, the second surface 106*b*" has a radius of curvature that is less than or equal to approximately 0.1 inch. For example, in some embodiments, the second surface 106*b*" has a radius of curvature that is less than or equal to approximately 0.09 inch, less than or equal to approximately 0.08 inch, less than or equal to approximately 0.07 inch, less than or equal to approximately 0.06 inch, less than or equal to approximately 0.05 inch, or less than or equal to approximately 0.04 inch.

With continued reference to FIG. 19B, the third surface 106*c*" can be planar. The third surface 106*c*" can be parallel to the front face 102" and/or the rear face 104". As shown, the third surface 106*c*" can be connected to and between the second surface 106*b*" and the fourth surface 106*d*".

In some embodiments, edge 106" includes a fourth surface 106*d*". The fourth surface 106*d*" can have a radius of curvature that is between approximately 0.01 inch and approximately 0.1 inch. For example, the fourth surface 106*d*" can have a radius of curvature between approximately 0.01 inch and approximately 0.09 inch, between approximately 0.02 inch and approximately 0.08 inch, between approximately 0.03 inch and approximately 0.07 inch, or between approximately 0.04 inch and approximately 0.06 inch, or any value or range within or bounded by any of these ranges or values, although values outside these values or ranges can be used in some cases. In some embodiments, the fourth surface 106*d*" has a radius of curvature that is less than or equal to approximately 0.1 inch, for example, less than or equal to approximately 0.09 inch, less than or equal to approximately 0.08 inch, less than or equal to approximately 0.07 inch, less than or equal to approximately 0.06 inch, or less than or equal to approximately 0.05 inch.

As shown in FIG. 19B, the second surface 106*b*" can be curved in a different direction as the fourth surface 106*d*". In some embodiments, a ratio between a radius of curvature of the fourth surface 106*d*" and a radius of curvature of the second surface 106*b*" is between approximately 1 and approximately 4, between approximately 1 and approximately 3, or between approximately 2 and approximately 3, or any value or range within or bounded by any of these ranges or values, although values outside these values or ranges can be used in some cases.

The fifth surface 106*e*" can be connected to and between the rear face 104" and the fourth surface 106*d*". Where edge 106" does not include the fourth surface 106*d*", the fifth surface 106*e*" can be connected to and between the rear face 104" and the third surface 106*c*". The fifth surface 106*e*" can be perpendicular to the rear face 104", the front face 102", and/or the third surface 106*c*".

Figure 19C:
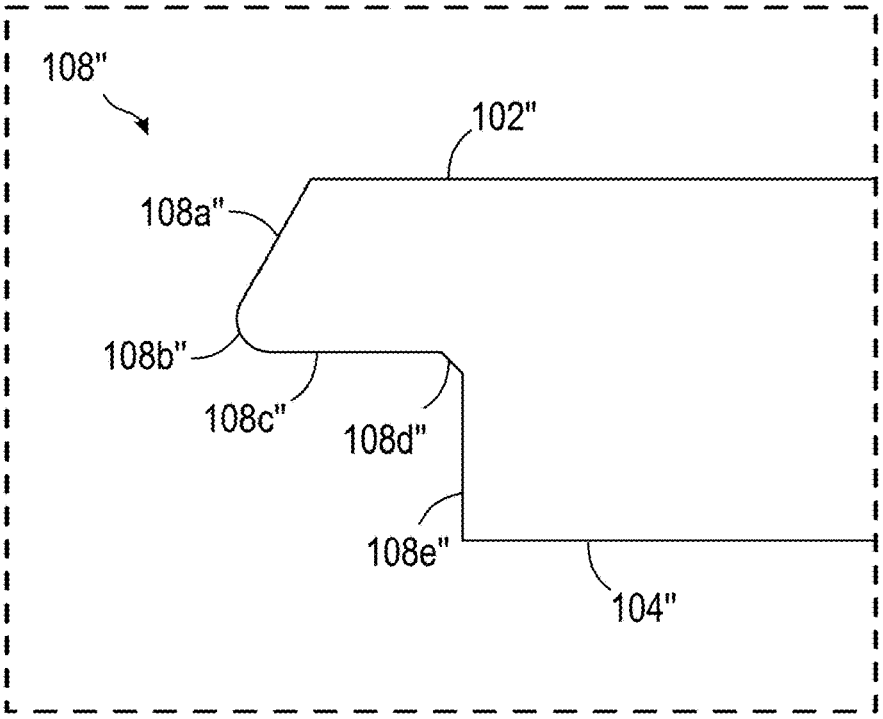

FIG. 19C illustrates an enlarged cross-sectional view of edge 108". As shown, edge 108" can include a first surface 108*a*", a second surface 108*b*", a third surface 108*c*", a fourth surface 108*d*", and a fifth surface 108*e*". The fifth surface 108*e*" may also be referred to as an "abutment surface" since the fifth surface 108*e*" can abut an abutment surface 106*e*" of edge 106" when an edge 108" of a first cladding element 100" is mated with an edge 106" of a second cladding element 100". In some variants, edge 108" does not include the fourth surface 108*d*" and the third surface 108*c*" is directly connected to the fifth surface 108*e*". Use of the terms "first," "second,", "third," "fourth," "fifth," or similar terminology when describing surfaces of edge 108" is not intended to be limiting nor is it intended to mean that the inclusion of any one of such numbered surfaces necessarily requires inclusion of any of the other numbered surfaces described with respect to edge 108".

The first surface 108*a*" can be connected to and/or can extend from the front face 102" in a direction at least partially toward the rear face 104". The first surface 108*a*" can be substantially straight as shown. The second surface 108*b*" can be connected to and/or can extend from the first surface 108*a*". The second surface 108*b*" can be positioned between the first surface 108*a*" and the third surface 108*c*"

as shown. The second surface 108*b*" can have a radius of curvature that is between approximately 0.01 inch and approximately 0.1 inch. For example, the second surface 108*b*" can have a radius of curvature between approximately 0.01 inch and approximately 0.09 inch, between approximately 0.01 inch and approximately 0.08 inch, between approximately 0.01 inch and approximately 0.07 inch, between approximately 0.01 inch and approximately 0.06 inch, between approximately 0.01 inch and approximately 0.05 inch, between approximately 0.01 inch and approximately 0.04 inch, or between approximately 0.02 inch and approximately 0.04 inch, or any value or range within or bounded by any of these ranges or values, although values outside these values or ranges can be used in some cases. In some embodiments, the second surface 108*b*" has a radius of curvature that is less than or equal to approximately 0.1 inch, for example, less than or equal to approximately 0.09 inch, less than or equal to approximately 0.08 inch, less than or equal to approximately 0.07 inch, less than or equal to approximately 0.06 inch, less than or equal to approximately 0.05 inch, or less than or equal to approximately 0.04 inch.

With continued reference to FIG. 19B, the third surface 108*c*" can be planar. The third surface 108*c*' can be parallel to the front face 102" and/or the rear face 104". As shown, the third surface 108*c*" can be connected to and between the second surface 108*b*" and the fourth surface 108*d*'. In some embodiments, edge 108" includes a fourth surface 108*d*". The fourth surface 108*d*" can be substantially straight as shown. In some embodiments, the fourth surface is angled relative to the third surface 108*c*" and/or the fifth surface 108*e*" at approximately a 45° angle.

The fifth surface 108*e*" can be connected to and between the rear face 104" and the fourth surface 108*d*". Where edge 108" does not include the fourth surface 108*d*", the fifth surface 108*e*" can be connected to and between the rear face 104" and the third surface 108*c*". The fifth surface 108*e*" can be perpendicular to the rear face 104", the front face 102", and/or the third surface 108*c*".

In some embodiments, a radius of curvature of the second surface 106*b*" of edge 106" is substantially equal to a radius of curvature of the second surface 108*b*" of edge 108". In some embodiments, a ratio of a radius of curvature of the second surface 106*b*" of edge 106" an a radius of curvature of the second surface 108*b*" of edge 108" is between approximately 0.5 and approximately 1.5, for example, between approximately 0.6 and approximately 1.4, between approximately 0.7 and approximately 1.3, between approximately 0.8 and approximately 1.2, or between approximately 0.9 and approximately 1.1, or any value or range within or bounded by any of these ranges or values.

Multiple cladding elements 100" can be placed adjacent to one another on a building substrate such that an edge 106" of a first cladding element 100" mates with an edge 108" of a second cladding element 108". For example, multiple cladding elements 100" can be placed adjacent to one another on a building substrate such that a portion of edge 108" (for example, surface 108*a*", 108*b*", 108*c*", and/or 108*d*") of a first cladding element 100" overlaps a portion of edge 106" (for example, surface 106*b*", 106*c*", 106*d*", and/or 106*e*") of a second cladding element 100". An illustrative overlapping arrangement of an edge 106" of a first cladding element 100" and an edge 108" of a second cladding element 108" is shown in FIG. 19E. When assembled in such manner, the fifth surface 106*e*" of the first cladding element 100" can abut and/or be placed proximate to (for example, spaced by a gap) the fifth surface 108*e*" of the second cladding element 100". As mentioned previously, the fifth surfaces 106*e*", 108*e*" can be referred to as "abutment surfaces". When the abutments surfaces 106*e*", 108*e*" contact one another or are placed adjacent to one another (for example, by a gap), other surfaces of the edges 106", 108*e*" can form a joint groove which creates a desirable aesthetic along portions of the structure to which the cladding elements 100" are secured. When the abutments surfaces 106*e*", 108*e*" contact one another or are placed adjacent to one another (for example, by a gap), the third surface 108*c*" can be positioned adjacent (e.g., over) the third surface 106*c*", the first surfaces 106*a*" and 108*a*" can be positioned near one another, and the second surfaces 106*b*" and 108*b*" can be positioned near one another. In some embodiments, edges 106", 108" of two adjacent cladding elements 100" form a V-shaped groove (for example, surfaces 106*a*" and 108*a*" form a V-shape when edges 106" and 108" are postponed adjacent one another).

In some embodiments, as illustrated in FIG. 19A, cladding element 100" includes one or a plurality of grooves 150" between edges 106", 108". Such grooves 150" may be referred to as "intermediate grooves" herein. Cladding element 100" can include, one, two, three, four, five, six, seven, or eight or more intermediate grooves 150" between edges 106", 108". Such intermediate grooves 150" can be spaced from one another and/or from edges 106", 108" in a similar or identical manner as that described with reference to intermediate grooves 150', edges 110', 112' of cladding element 100'. For example, the intermediate grooves 150" can be spaced from one another (and/or from edges 106", 108") at a spacing of 4 inch, 6 inch, 8 inch, 10 inch, 12 inch, 14 inch, 16 inch, 18 inch, 20 inch, 22 inch, or 24 inch on center.

Figure 19D:
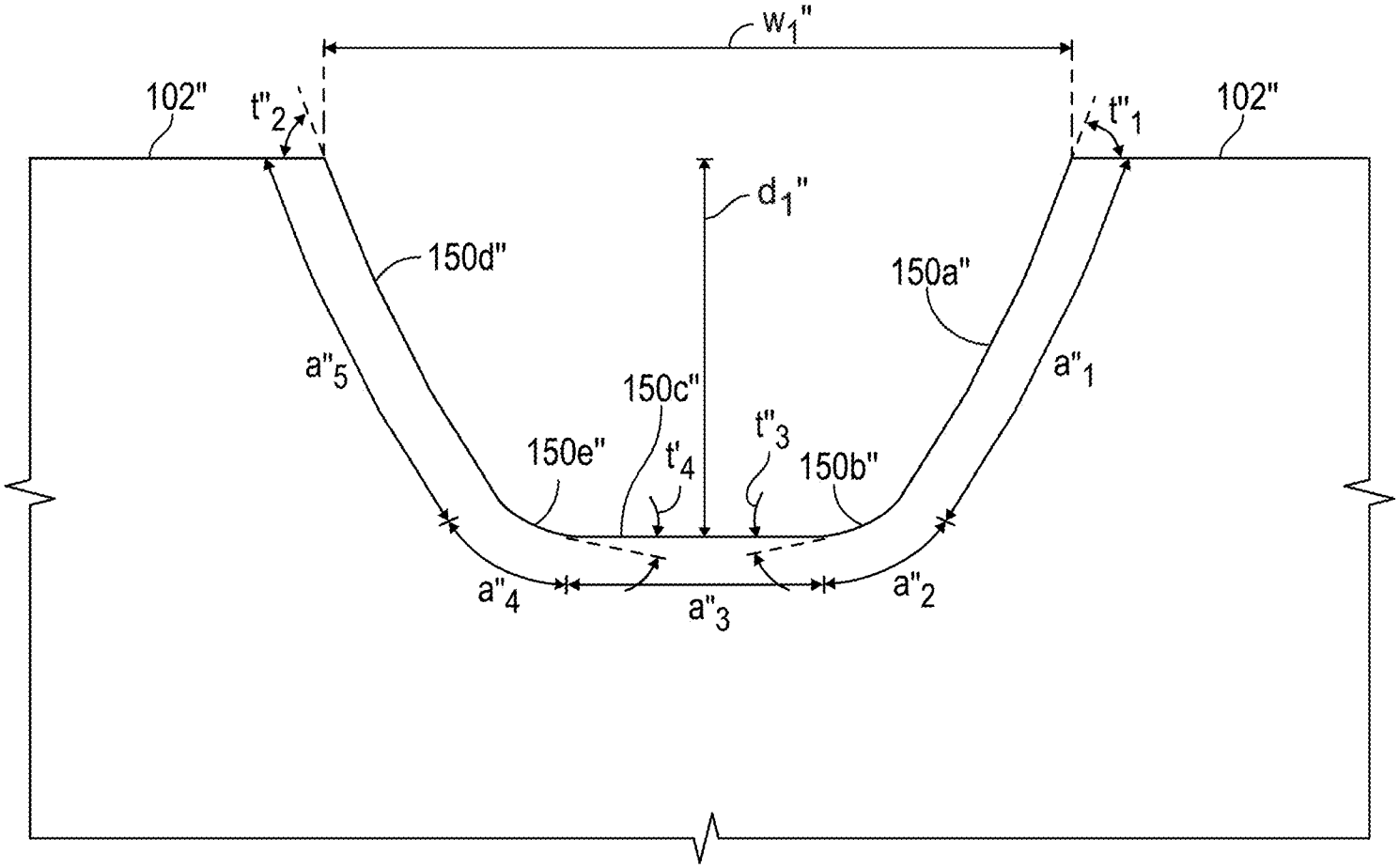
Figure 19E:
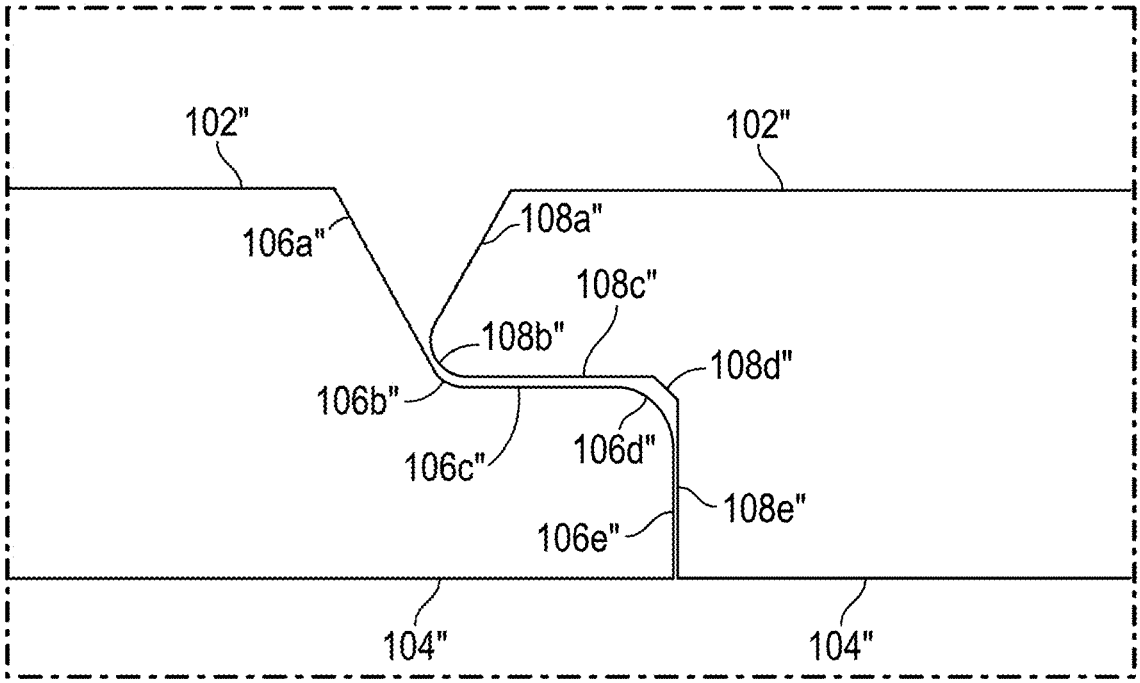
FIG. 19E illustrates an overlapping arrangement of edges of adjacent cladding elements in accordance with aspects of this disclosure.

FIG. 19D illustrates an enlarged cross-sectional view of the intermediate groove 150". The intermediate groove 150" can be identical to the intermediate groove 150'. Accordingly, the discussion above with respect to the intermediate groove 150' of cladding element 100' is equally applicable to the intermediate groove 150" of cladding element 100". For example, the intermediate groove 150" can include a first curved surface 150*a*", a second curved surface 150*b*", a planar surface 150*c*", a third curved surface 150*d*", and a fourth curved surface 150*e*", each of which can be identical (respectively) to the first curved surface 150*a*', second curved surface 150*b*', planar surface 150*c*', third curved surface 150*d*', and fourth curved surface 150*e*' as described above with respect to the intermediate groove 150'. For example, each of the first curved surface 150*a*", second curved surface 150*b*", third curved surface 150*d*", and fourth curved surface 150*e*" of the intermediate groove 150" can each have a radius of curvature that can be identical (respectively) to the radius of curvatures discussed above with respect to the first curved surface 150*a*', second curved surface 150*b*', third curved surface 150*d*', and fourth curved surface 150*e*' of the intermediate groove 150'. Additionally the relationship between (for example, ratio) any of the first curved surface 150*a*", second curved surface 150*b*", third curved surface 150*d*", and/or fourth curved surface 150*e*" of the intermediate groove 150" can be identical to any of the relationship between (for example, ratio) any of the first curved surface 150*a*', second curved surface 150*b*', planar surface 150*c*', third curved surface 150*d*', and/or fourth curved surface 150*e*' as described above with respect to the intermediate groove 150'.

As shown in FIG. 19D, the first curved surface 150*a*" can have a length $a_1$", the second curved surface 150*b*" can have a length $a_2$", the planar surface 150*c*" can have a length $a_3$", the third curved surface 150*d*" can have a length $a_5$", and the fourth curved surface 150*e*" can have a length $a_4$". Lengths $a_1$", $a_2$", $a_3$", $a_4$", $a_5$" can be identical to lengths $a_1$', $a_2$', $a_3$', $a_4$', $a_5$' discussed above with respect to intermediate groove 150'. A width $w_1$" extending across a top of the intermediate groove 150" (for example, along a plane parallel to and/or co-planar with front face 102") can be identical to width $w_1$' discussed above with respect to intermediate groove 150'. A depth $d_1$" of the intermediate groove 150" can be identical to the depth $d_1$' of the intermediate groove 150' discussed above.

With continued reference to FIG. 19D, a tangent line of the first curved surface 150*a*" can be angled at an angle $t_1$" with respect to the front face 102", a tangent line of the third curved surface 150*d*" can be angled at an angle $t_2$" with respect to the front face 102", a tangent line of the second curved surface 150*b*" can be angled at an angle $t_3$" with respect to the planar surface 150*c*", and a tangent line of the fourth curved surface 150*e*" can be angled at an angle $t_4$" with respect to the planar surface 150*c*". Angles $t_1$", $t_2$", $t_3$", and $t_4$" of intermediate groove 150" can be identical to angles $t_1$', $t_2$', $t_3$', and $t_4$' (respectively) of intermediate groove 150' discussed above.

Textured Patterns

Figure 20:
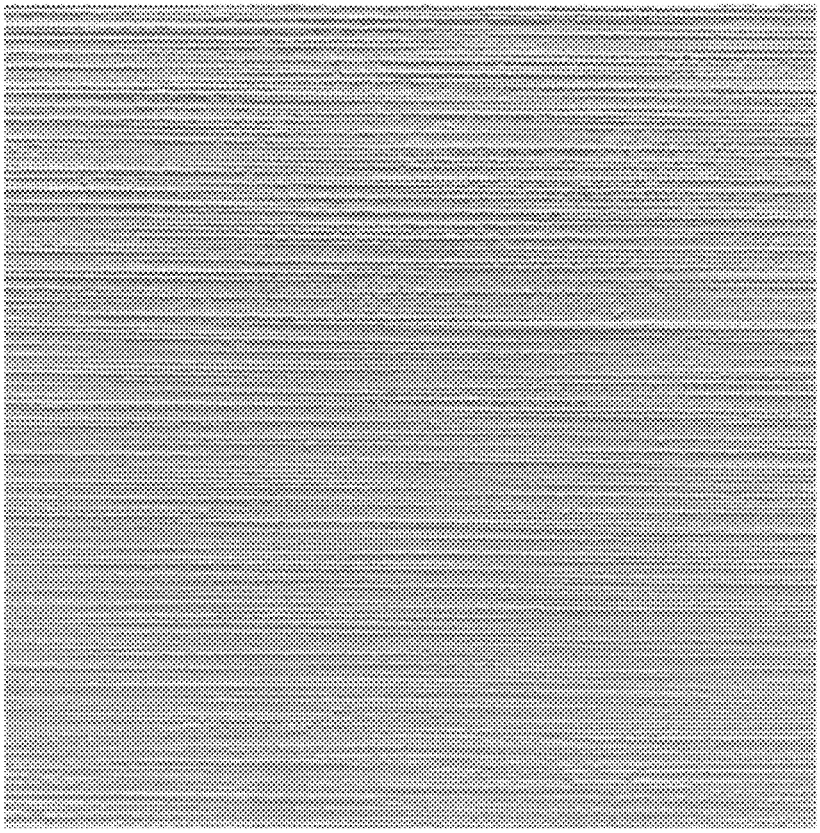
FIGS. 20-25 illustrate example textured patterns for cladding elements in accordance with aspects of this disclosure.
Figure 21:
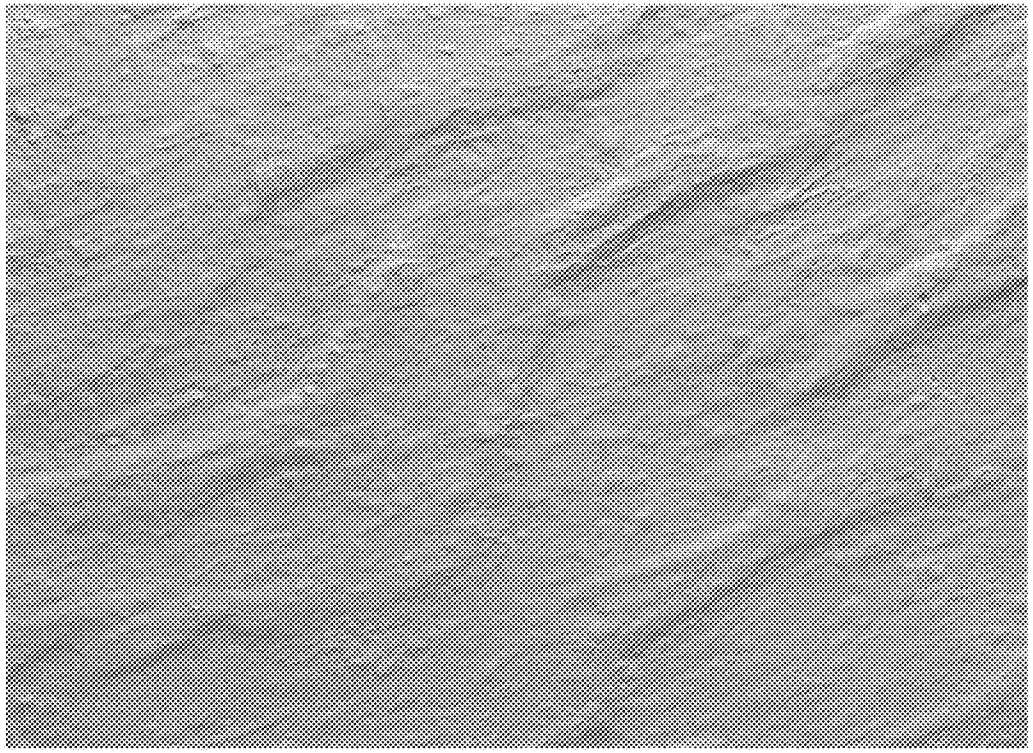
Figure 22:
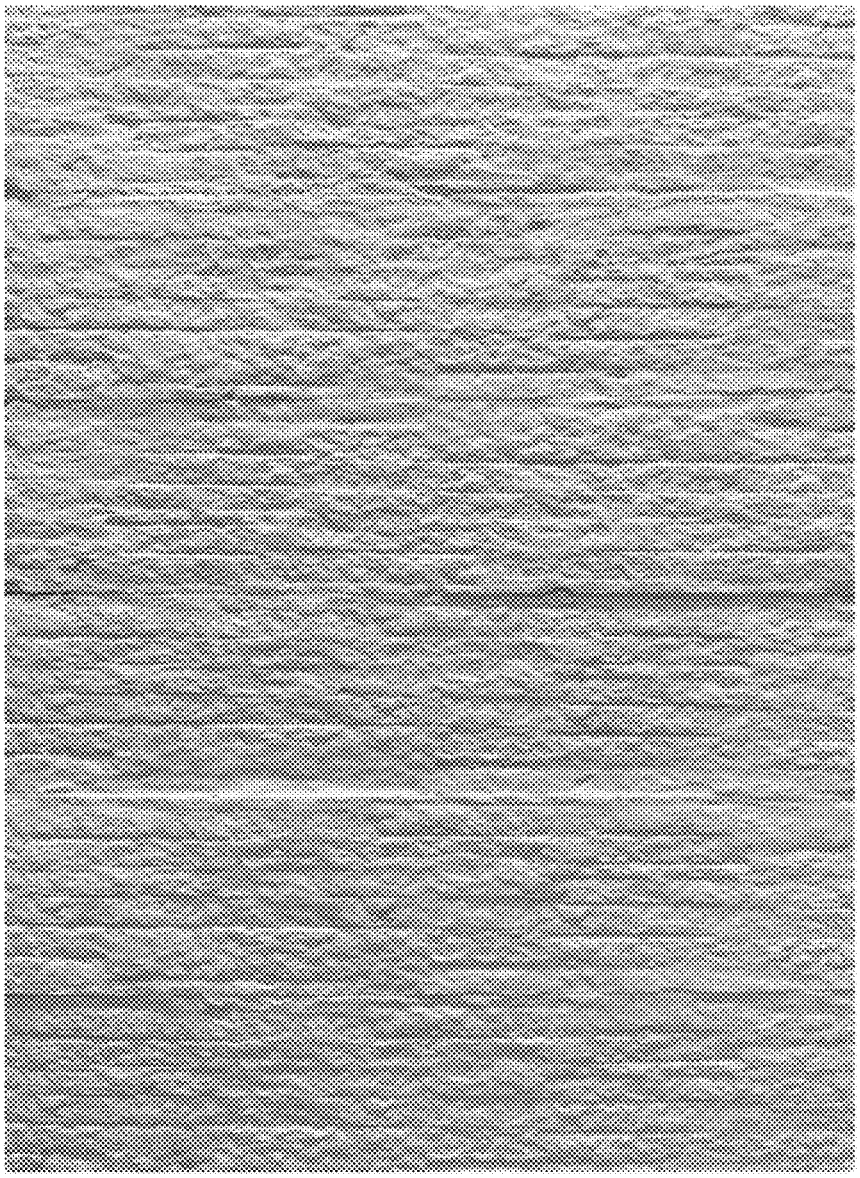
Figure 23:
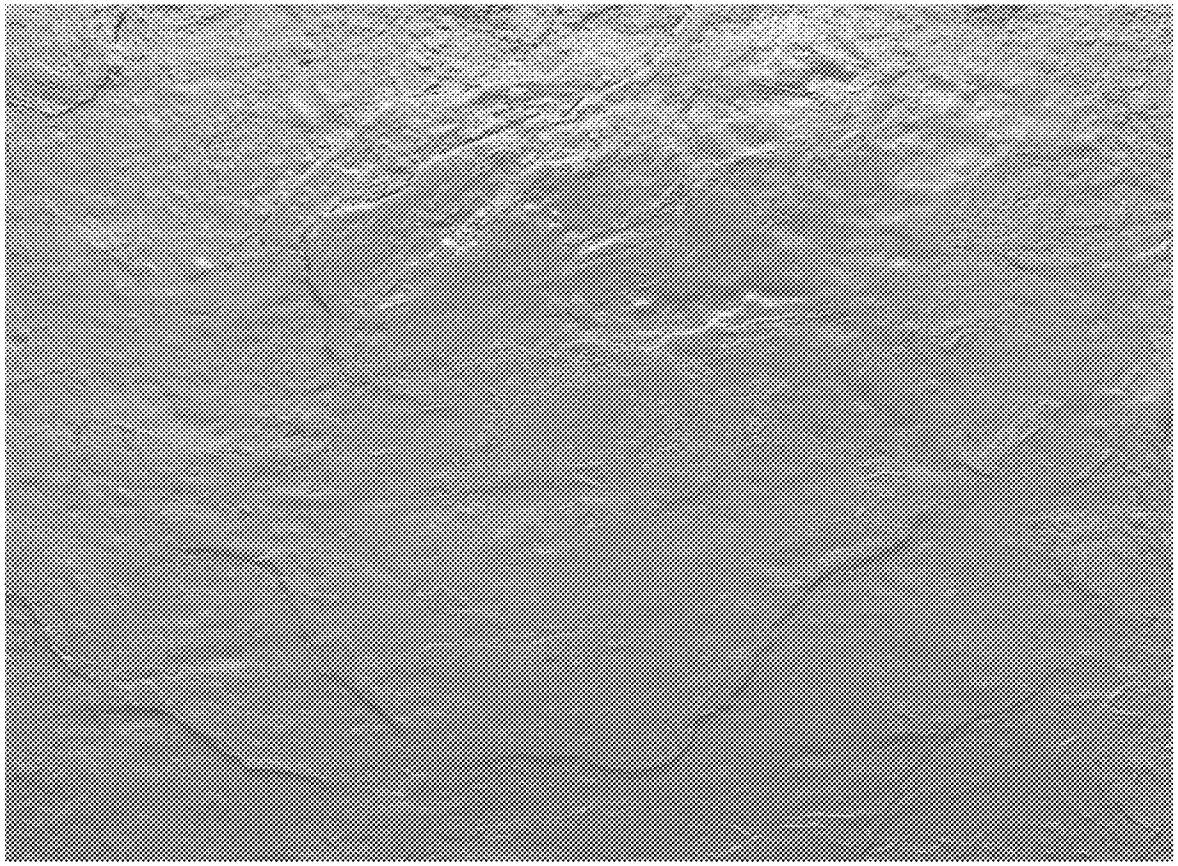
Figure 24:
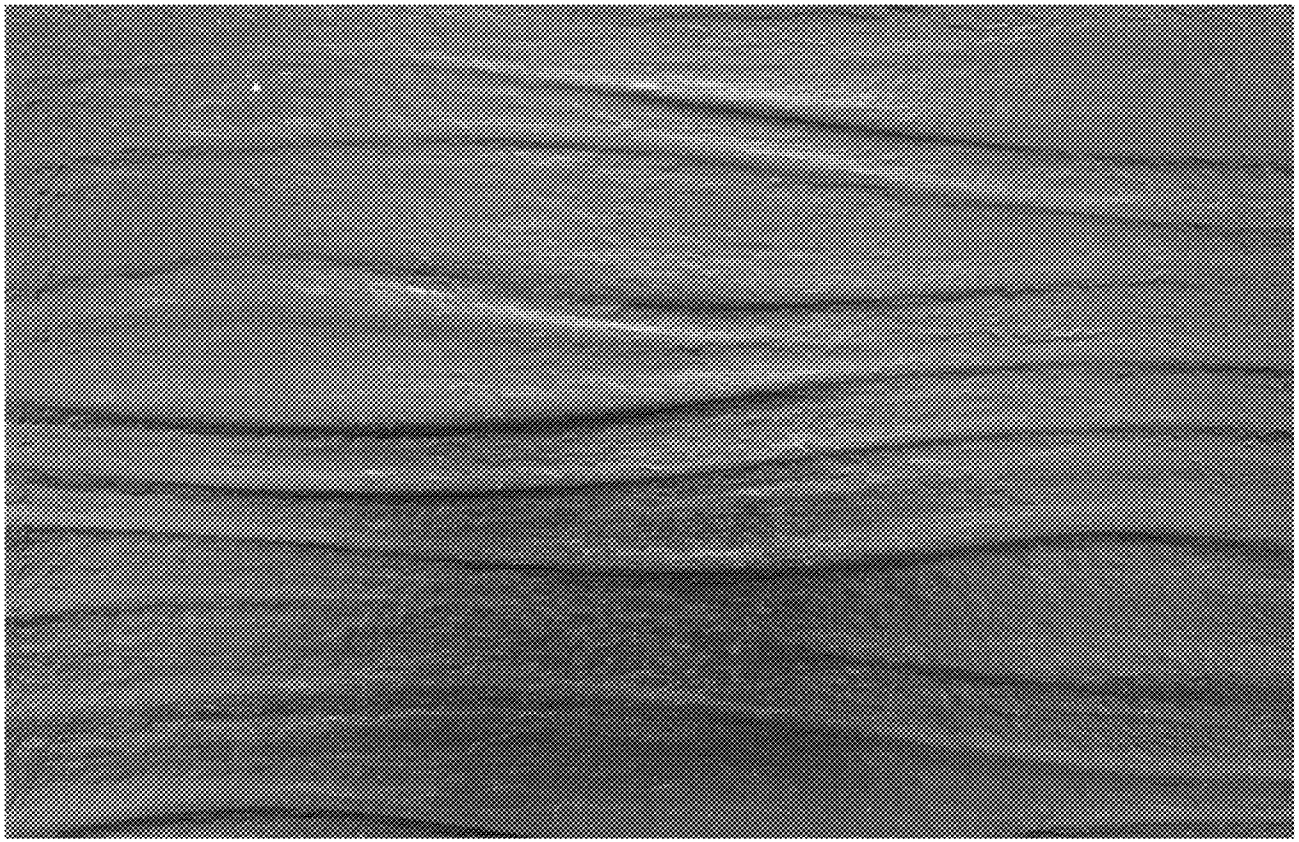
Figure 25:
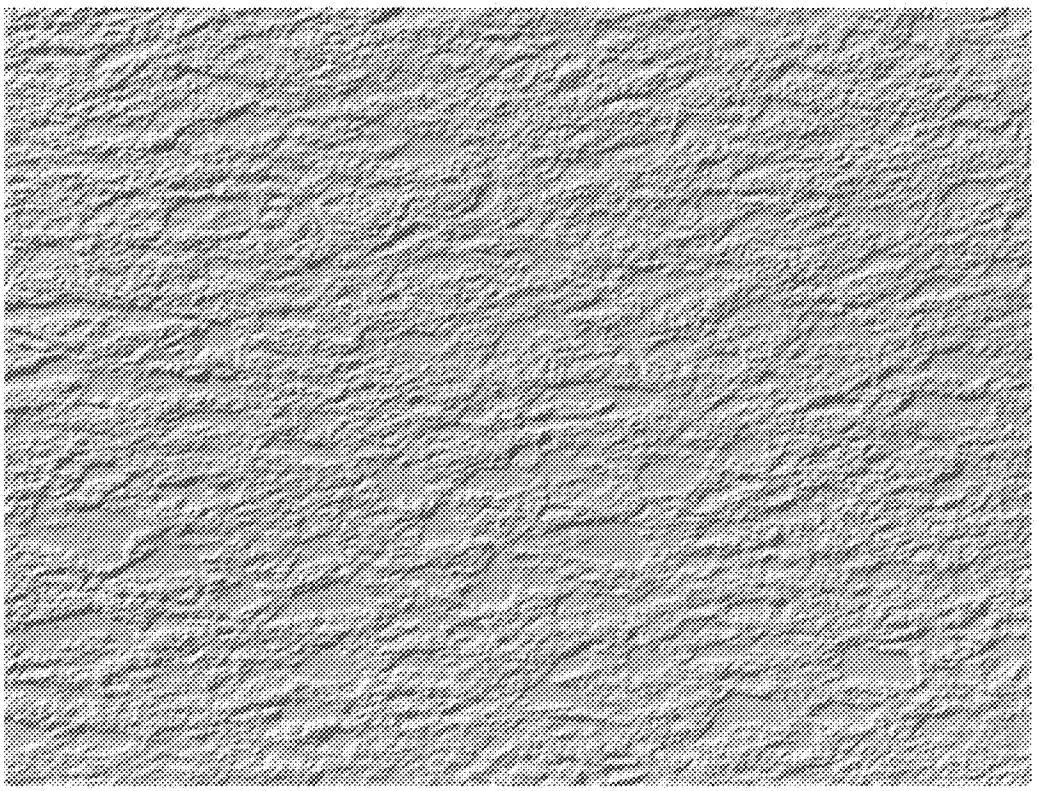

Any of the cladding elements (for example, cladding elements 100, 100', 100"), disclosed herein can include any of a variety of textured patterns to enhance the appearance of the cladding elements, and in turn, an exterior of a structure when installed thereon. In some implementations, the cladding elements (for example, cladding elements 100, 100', 100") can comprise fiber cement and can be integrally formed with a surface texture that does not resemble fiber cement (e.g., differs from conventional fiber cement textures). FIGS. illustrate example textured patterns, any of which can be utilized with any of the cladding elements disclosed herein (for example, cladding elements 100, 100', 100"). FIG. 20 illustrates a brushed concrete textured pattern, FIG. 21 illustrates a desert sand textured pattern, FIG. 22 illustrates a bush hammered stone textured pattern, FIG. 23 illustrates a slate textured pattern, FIG. 24 illustrates a flow textured pattern, and FIG. 25 illustrates a sparrow peck textured pattern. Any of the cladding elements disclosed herein (for example, cladding elements 100, 100', 100") can have a textured pattern on a portion thereof (for example, an exterior face thereof) that is configured to replicate the appearance of stucco (for example, a smooth sand or knock-down textured pattern). Any of the cladding elements disclosed herein (for example, cladding elements 100, 100', 100") can be made of fiber cement, and in such cases, any of the disclosed textured patterns can be formed on an entirety or a portion of the cladding elements (for example, a face thereof).

Trim Elements

FIGS. 5A-13 illustrate various example embodiments of inward and outward corner trim elements or sections thereof. In each of the example embodiments, collectively trim elements 200, 300, 400, 600, 700, 800, and 900 can generally comprise a substantially uniform cross-section extending along a height $h_1$ thereof. Although trim elements 500 and 1000 are only illustrated in cross-section (see FIGS. 8 and 13), it is to be understood that such trim elements 500, 1000 can also generally comprise a substantially uniform cross-section extending along heights thereof which may be similar or identical to heights $h_1$. The height $h_1$ can be, for example, 1 ft, 2 ft, 4 ft, 6 ft, 8 ft, 10 ft, 12 ft, 14 ft, or 16 ft, or any value or range within or bounded by any of these ranges or values, although values outside these values or ranges can be used in some cases. The height $h_1$ can be similar to or identical to or greater than the height $H_1$, $H_1$' of the cladding elements 100, 100' discussed above. Any of the components (for example, "legs") of the trim elements 200, 300, 400, 500, 600, 700, 800, 900, 1000 discussed below can comprise thicknesses of, for example, between approximately 0.5 mm and approximately 5 mm, between approximately 1 mm and approximately 4 mm, between approximately 2 mm and approximately 3 mm, or between approximately 1 mm and approximately 2 mm, or any value or range within or bounded by any of these ranges or values, although values outside these values or ranges can be used in some cases.

Trim elements 200, 300, 400, 500, 600, 700, 800, 900, 1000 (which may be referred to herein as "alignment members") can be utilized at corners of a structure where adjacent cladding elements 100, 100' meet. For example, trim elements 200, 300, 400, 500, 600, 700, 800, 900, 1000 can be utilized at exterior corner locations at a structure where adjacent cladding elements 100 meet. While FIG. 2 illustrates trim elements 200 and 600 at exterior corner configurations in structure 10, any of the other trim elements 300, 400, 500, 700, 800, 900, and/or 1000 can be utilized in a similar manner as that illustrated in FIG. 2 and/or as described with respect to trim elements 200, 600. First corner trim element 200 (and/or any of trim elements 300, 400, and/or 500) can be utilized at "inward" or "inside" corners whereby two surfaces of the structure converge along an exterior of structure 10 (see FIG. 2). Second corner trim element 600 (and/or any of trim elements 700, 800, 900, and/or 1000) can be utilized at "outward" or "outside" corners whereby two surfaces of the structure diverge along an exterior of structure 10 (see FIG. 2).

Any or all of trim elements 200, 300, 400, 500, 600, 700, 800, 900, 1000 can include and/or be formed from a metallic material. For example, any or all of trim elements 200, 300, 400, 500, 600, 700, 800, 900, 1000 can include and/or be formed from aluminum.

Use of terms "first," "second," "third," "fourth," "fifth," "sixth," and "seventh" or similar terminology when describing "legs" of trim elements 200, 300, 400, 500, 600, 700, 800, 900, 1000 is not intended to be limiting nor is it intended to mean that the inclusion of any one of such numbered legs necessarily requires inclusion of any of the other numbered legs described with respect to trim elements 200, 300, 400, 500, 600, 700, 800, 900, 1000.

Figure 5B:
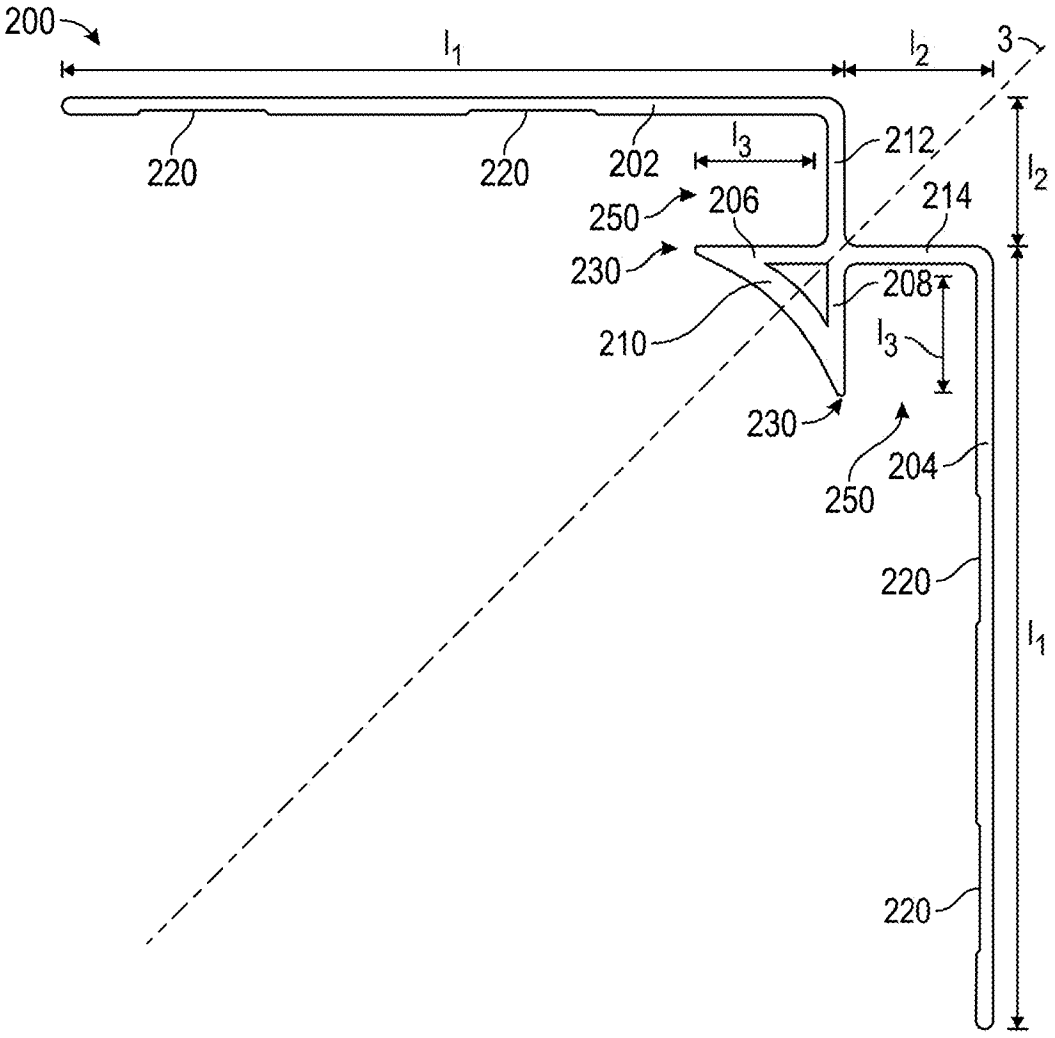
FIGS. 5A-5B illustrate an embodiment of a trim element in accordance with aspects of this disclosure.
Figure 5A:
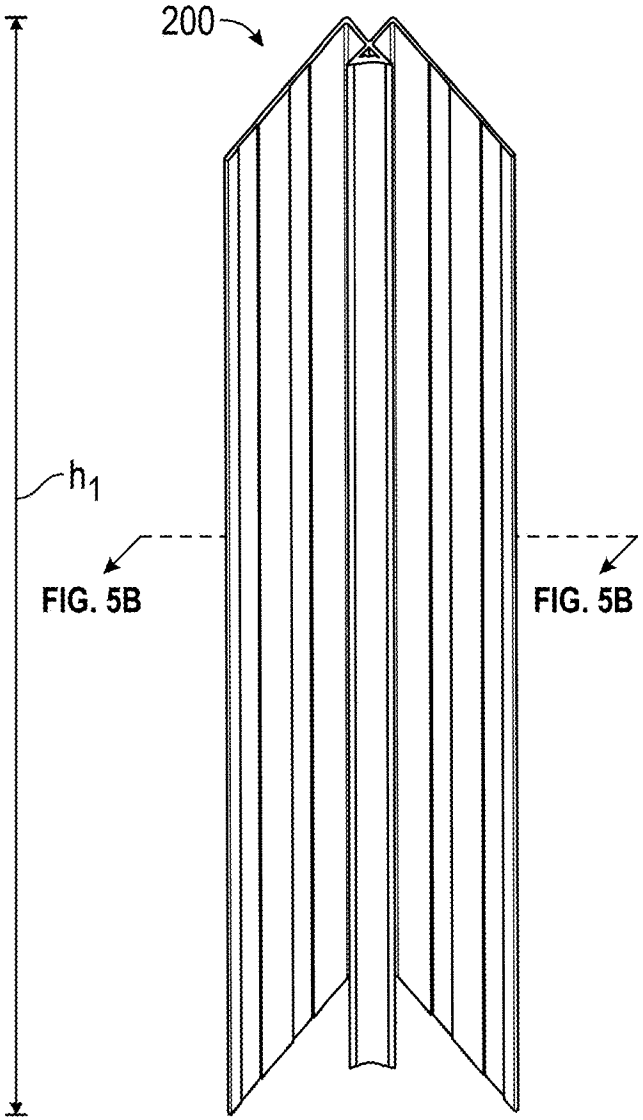

FIGS. 5A-5B illustrate an exemplary first corner trim element 200 suitable for use at an 'inward' or 'inside corner'. First corner trim element 200 can include a first leg 202, a second leg 204, a third leg 206, a fourth leg 208, a fifth leg 212, a sixth leg 214, and a seventh leg 210. Any or all of legs 202, 204, 206, 208, 212, 214, or 210 may be integrally formed. As shown in FIG. 5B, legs 206, 208, and 210 can form an interior region. In some embodiments, such interior region is hollow. In some embodiments, such interior region defined by legs 106, 108, 110 is not hollow and/or is filled with an insulation material.

As shown in FIG. 5B, first leg 202 of first corner trim element 200 is connected to the fifth leg 212 of first corner trim element 200 at an end thereof. First and fifth legs 202 and 212 of first corner trim element 200 can be transverse (e.g., perpendicular) to one another. Similarly, second leg 204 of first corner trim element 200 is connected to the sixth leg 214 of first corner trim element 200 at an end thereof, and second and sixth legs 204 and 214 of first corner trim element 200 can be transverse (e.g., perpendicular) to one another. Third and fourth legs 206 and/or 208 of first corner trim element 200 extend from fifth leg 212 and/or sixth leg 214 (for example, from ends of leg 212 and/or 214) of first corner trim element 200. Third leg 206 of first corner trim element 200 is parallel to first leg 202 of first corner trim element 200 and/or transverse (e.g., perpendicular) to fifth leg 212 of first corner trim element 200. Similarly, fourth leg 208 of first corner trim element 200 is parallel to second leg 204 of first corner trim element 200 and/or transverse (e.g., perpendicular) to sixth leg 214 of first corner trim element 200. As shown, third leg 206 of first corner trim element 200 can be spaced from first leg 202 of first corner trim element 200 and/or fourth leg 208 of first corner trim element 200 can be spaced from second leg 204 of first corner trim element 200 such that channels 250 are formed by the first and third legs 202, 206 and second and fourth legs 204, 208 alone or in combination with fifth and sixth legs 212, 214 of first corner trim element 200. Such channel 250 of first corner trim element 200 can be sized and/or shaped to receive portions of the cladding elements 100, 100'.

In some embodiments, first leg 202 and second leg 204 of first corner trim element 200 have equal lengths $l_1$, fifth and sixth legs 212, 214 of first corner trim element 200 have equal lengths $l_2$, and/or third and fourth legs 206, 208 of first corner trim element 200 have equal lengths $l_3$. In an alternate embodiment, first leg 202 of first corner trim element 200 is longer than second leg 204 of first corner trim element 200 and vice versa. Length $l_1$ can be greater than either or both of length $l_2$ and length $l_3$. Length $l_2$ can be equal to, greater than, or less than length $l_3$. Length $l_1$ can be between approximately 30 mm and 80 mm. For example, length $l_1$ can be between approximately 35 mm and approximately 75 mm, between approximately 40 mm and approximately 70 mm, between approximately 45 mm and approximately 65 mm, or between approximately 50 mm and approximately 60 mm, or any value or range within or bounded by any of these ranges or values, although values outside these values or ranges can be used in some cases. Length $l_2$ can be between approximately 1 mm and 20 mm. For example, length $l_1$ can be between approximately 5 mm and approximately mm, or between approximately 8 mm and approximately 12 mm, or any value or range within or bounded by any of these ranges or values, although values outside these values or ranges can be used in some cases. Length $l_3$ can be between approximately 1 mm and 20 mm. For example, length $l_3$ can be between approximately 5 mm and approximately 15 mm, or between approximately 8 mm and approximately 12 mm, or any value or range within or bounded by any of these ranges or values, although values outside these values or ranges can be used in some cases.

First corner trim element 200 can include seventh leg 210 which can be connected to and/or can extend between third and fourth legs 206 and 208 (such as between ends of third and fourth legs 206, 208). Seventh leg 210 of first corner trim element 200 can be curved, for example, as illustrated in FIG. 5B. Seventh leg 210 of first corner trim element 200 can have a radius of curvature that is between approximately 0.1 inch and approximately 1 inch. For example, leg 210 can have a radius of curvature between approximately 0.2 inch and approximately 0.9 inch, between approximately 0.3 inch and approximately 0.8 inch, between approximately 0.4 inch and approximately 0.7 inch, between approximately 0.5 inch and approximately 0.6 inch, or between approximately 0.3 inch and approximately 0.5 inch, or any value or range within or bounded by any of these ranges or values, although values outside these values or ranges can be used in some cases.

With continued reference to FIG. 5B, in some embodiments, transition regions 230 between seventh and third legs 210, 206 and/or seventh and fourth legs 210, 208 of first corner trim element 200 are chamfered and/or radiused. Such configurations can reduce interference between cladding elements 100 and/or other building components that may come in proximity to the transition regions 230 of first corner trim element 200 during installation.

As shown in FIG. 5B, first corner trim element 200 can include one or more or a plurality of recessed portions, such as recessed portions 220. Such recessed portions 220 can be recessed from surfaces of the first and second legs 202, 204, for example, as illustrated. The recessed portions 220 of first corner trim element 200 can have a thickness that is smaller than remainder thicknesses of the first and second legs 202, 204 of first corner trim element 200. The recessed portions 220 of first corner trim element 200 can advantageously provide an indication for where fasteners 60 should be positioned (e.g., aligned) when forced through the first and second legs 202, 204 of first corner trim element 200 and into a building substrate. The recessed portions 220 of first corner trim element 200 can also provide a space for fastener heads to "seat" so that the fastener heads are at (e.g., "flush") or below surfaces of the first and second legs 202, 204 of first corner trim element 200 in order to minimize interference with surfaces of the cladding elements 100, 100' when the cladding elements 100, 100' positioned within the channels 250 of first corner trim element 200. First leg 202 and/or second leg 204 of first corner trim element 200 can include one or more or a plurality of recessed portions 220, such as one, two, three, four, five, or six or more recessed portions 220. Such recessed portions 220 can extend continuously along the height $h_1$ of the first corner trim element 200 or can extend non-continuously along the height $h_1$ of the first corner trim element 200. The recessed portions 220 can be spaced from one another along the lengths $l_1$ of the first and second legs 202, 204 of first corner trim element 200 at a spacing that is between approximately 5 mm and mm. For example, the recessed portions 220 can be spaced from one another along the lengths $l_1$ of the first and second legs 202, 204 of first corner trim element 200 at a spacing that is between approximately 10 mm and approximately 25 mm, between approximately 15 mm and approximately 20 mm, or between approximately 10 mm and approximately 20 mm, or any value or range within or bounded by any of these ranges or values, although values outside these values or ranges can be used in some cases. The recessed portions 220 can have a length (or "width") extending along the length $l_1$ of the legs 202, 204 that is between approximately mm and 20 mm, for example, between approximately 6 mm and 19 mm, between approximately 7 mm and 18 mm, between approximately 8 mm and 17 mm, between approximately 9 mm and 16 mm, between approximately 10 mm and 15 mm, between approximately 11 mm and 14 mm, or between approximately 12 mm and 13 mm, or between approximately 8 mm and approximately 12 mm, or any value or range within or bounded by any of these ranges or values, although values outside these values or ranges can be used in some cases.

In some embodiments, first corner trim element 200 comprises a cross-section that is symmetrical along an axis 3, as illustrated in FIG. 5B.

Figure 5C:
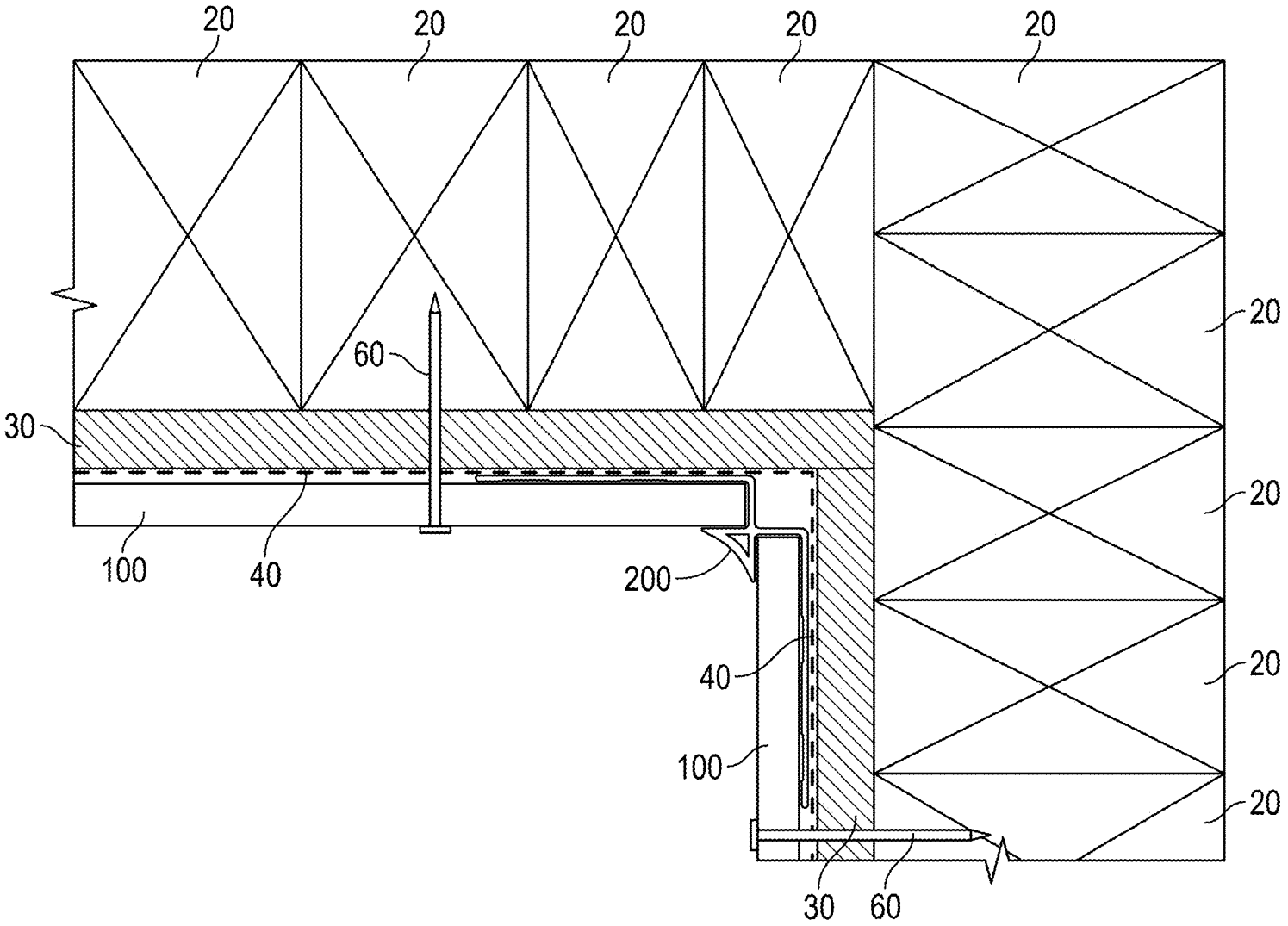
FIG. 5C illustrates an enlarged, cross-sectional view taken through a portion of the structure illustrated in FIG. 2 in accordance with aspects of this disclosure.

FIG. 5C illustrates an exemplary cross-section through a portion of structure 10 (as shown in FIG. 2), and in particular, illustrates how first corner trim element 200 can be secured to structure 10 along with cladding elements 100 and/or other building components. As shown, first corner trim element 200 can be secured to the framing members 20, sheathing and/or weather resistant barrier 40, for example, via fasteners which extend through the recessed portions 220 (not shown). Additionally, portions of ends or edges of the cladding elements 100 (such as first and second mating edges 106, 108) can be positioned within the channels 250 formed by the first corner trim element 200. While FIG. 5C illustrates straight ends/edges of cladding elements 100 (for example, where the profiles of the first and second mating edges 106, 108 discussed above have been "trimmed off"), it is to be understood that channels of the first corner trim element 200 can receive non-trimmed ends/edges of the cladding element 100, for example, having the surfaces discussed above with respect to first and second mating edges 106, 108. Advantageously, the first corner trim element 200 can "hide" and/or "cover" such ends/edges of the cladding elements 100 which can provide a desirable aesthetic appearance, especially where such ends/edges of the cladding elements 100 have been "trimmed" for size adjustment purposes on a construction site as is common.

Figure 6B:
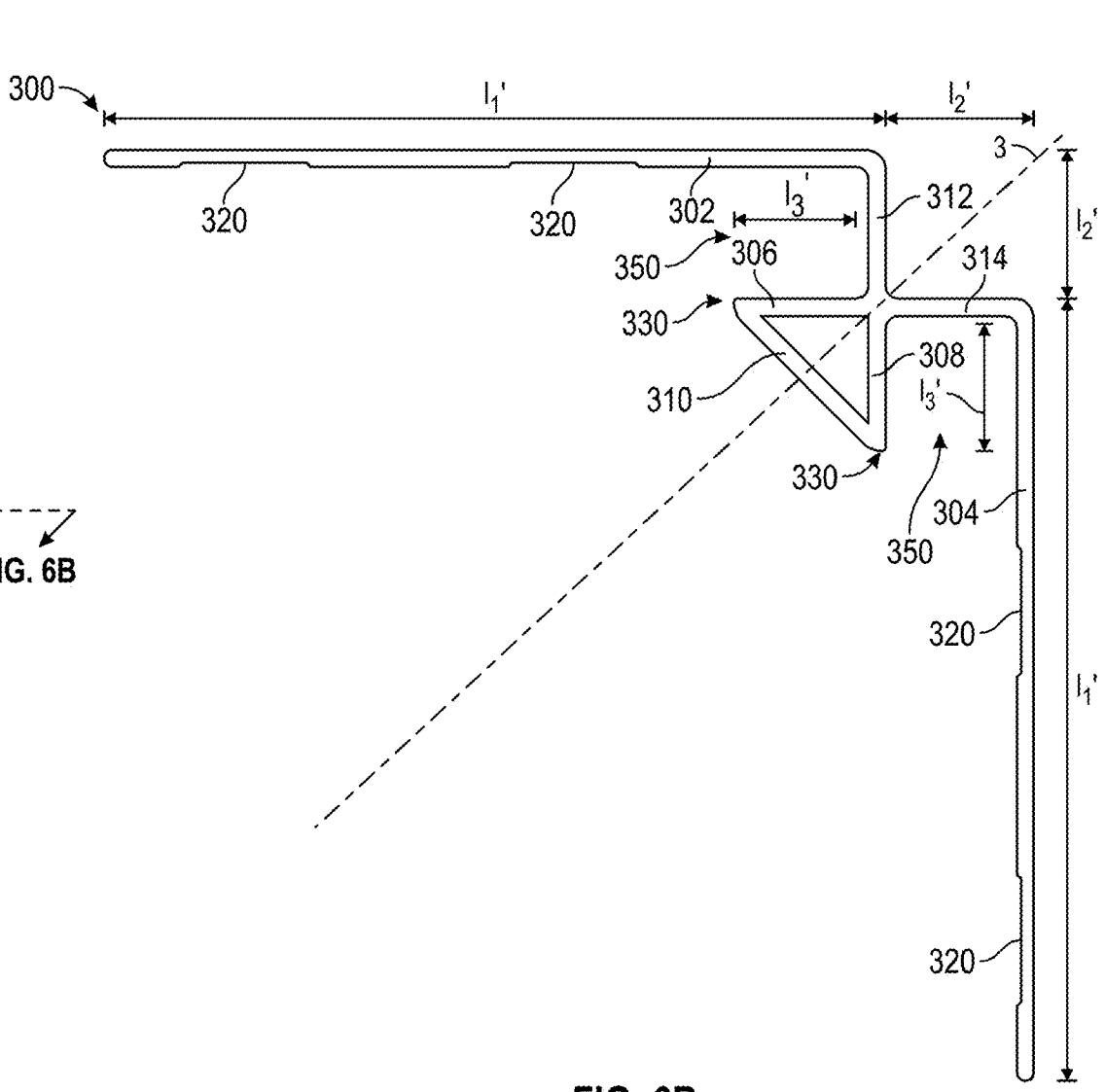
FIGS. 6A-6B illustrate another embodiment of a trim element in accordance with aspects of this disclosure.
Figure 6A:
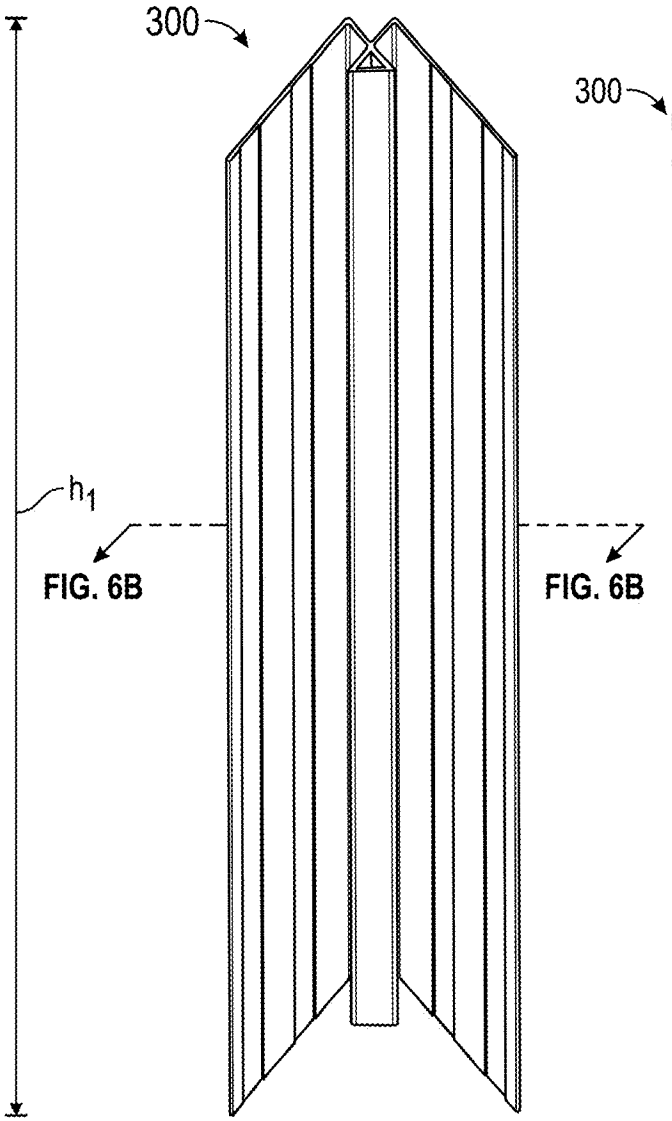

FIGS. 6A-6B illustrate a third embodiment of a corner trim element 300. Third corner trim element 300 can be similar or identical to first corner trim element 200 in some or many ways. For example, as indicated by the similar reference numerals, third corner trim element 300 can include first, second, third, fourth, fifth and sixth legs 302, 304, 306, 308, 312, 314, recessed portions 320, channels 350 which can be identical to first, second, third, fourth, fifth and sixth legs 202, 204, 206, 208, 212, 214, recessed portions 220, and channels 250 of first corner trim element 200 (respectively). Accordingly, the above description with reference to first, second, third, fourth, fifth and sixth legs 202, 204, 206, 208, 212, 214, recessed portions 220, and channels 250 of first corner trim element 200 is equally applicable to the first, second, third, fourth, fifth and sixth legs 302, 304, 306, 308, 312, 314, recessed portions 320, and channels 350 of third corner trim element 300 and is therefore not repeated here for the sake of brevity. As another example, length of first and second legs 302, 304, length $l_2$' of fifth and sixth legs 312, 314, and/or length $l_3$' of third and fourth legs 306, 308 can be identical to length $l_1$ of first and second legs 202, 204, length $l_2$ of fifth and sixth legs 212, 214, and/or length $l_3$ of third and fourth legs 206, 208 (respectively). Accordingly, the above description with reference to these components of first corner trim element 200 is equally applicable to corresponding components of third corner trim element 300 and is also therefore not repeated here for the sake of brevity. Additionally, similar to first corner trim element 200, third corner trim element 300 can comprise a cross-section that is symmetrical along axis 3, as illustrated in FIG. 6B. As another example, third corner trim element 300 can include transition regions 330 between seventh and third legs 310, 306 and/or seventh and fourth legs 310, 308 that are chamfered and/or radiused similar to transition regions 230 discussed with reference to first corner trim element 200. As shown in FIG. 6B, legs 306, 308, and 310 can form an interior region. In some embodiments, such interior region is hollow. In some embodiments, such interior region defined by legs 306, 308, and 310 is not hollow and/or is filled with an insulation material.

In one embodiment, third corner trim element 300 differs from first corner trim element 200 in that third corner trim element 300 includes a straight or planar seventh leg 310 instead of the curved seventh leg 210. Seventh leg 310 can be angled relative to either or both of third and fourth legs 306, 308 of third corner trim element 300. For example, seventh leg 310 can be angled with respect to one or both of third and fourth legs 306, 308 of third corner trim element 300 at an angle that is between approximately 0° and approximately 90°. For example, seventh leg 310 can be angled with respect to one or both of third and fourth legs 306, 308 of third corner trim element 300 at an angle that is between approximately 5° and approximately 85°, between approximately 10° and approximately 80°, between approximately 15° and approximately 75°, between approximately 20° and approximately 70°, between approximately 25° and approximately 65°, between approximately 30° and approximately 60°, between approximately 35° and approximately 55°, or between approximately 40° and approximately 50°, or any value or range within or bounded by any of these ranges or values, although values outside these values or ranges can be used in some cases. In the embodiment shown, seventh leg 310 is angled with respect to third and fourth legs 306, 308 of third corner trim element 300 at an angle of approximately 45°. Seventh leg 310 of third corner trim element 300 can comprise a length that is less than, equal to, or greater than length $l_3$' and/or length $l_2$'. Seventh leg 310 of third corner trim element 300 can comprise a length that is between approximately 5 mm and approximately 30 mm, between approximately 10 mm and approximately 25 mm, between approximately 15 mm and approximately 20 mm, or between approximately 14 mm and approximately 18 mm, or any value or range within or bounded by any of these ranges or values, although values outside these values or ranges can be used in some cases.

Third corner trim element 300 can be secured to a building substrate (such as framing members 20, sheathing 30, and/or weather resistant barrier 40) and/or can receive ends/edges of cladding elements 100, 100' in a similar or identical manner as that described with reference to first corner trim element 200 and as shown in FIG. 5C. Accordingly, the above description with reference to first corner trim element 200 and FIG. 5C is equally applicable to trim element 300 and is therefore not repeated here for the sake of brevity.

Figure 7B:
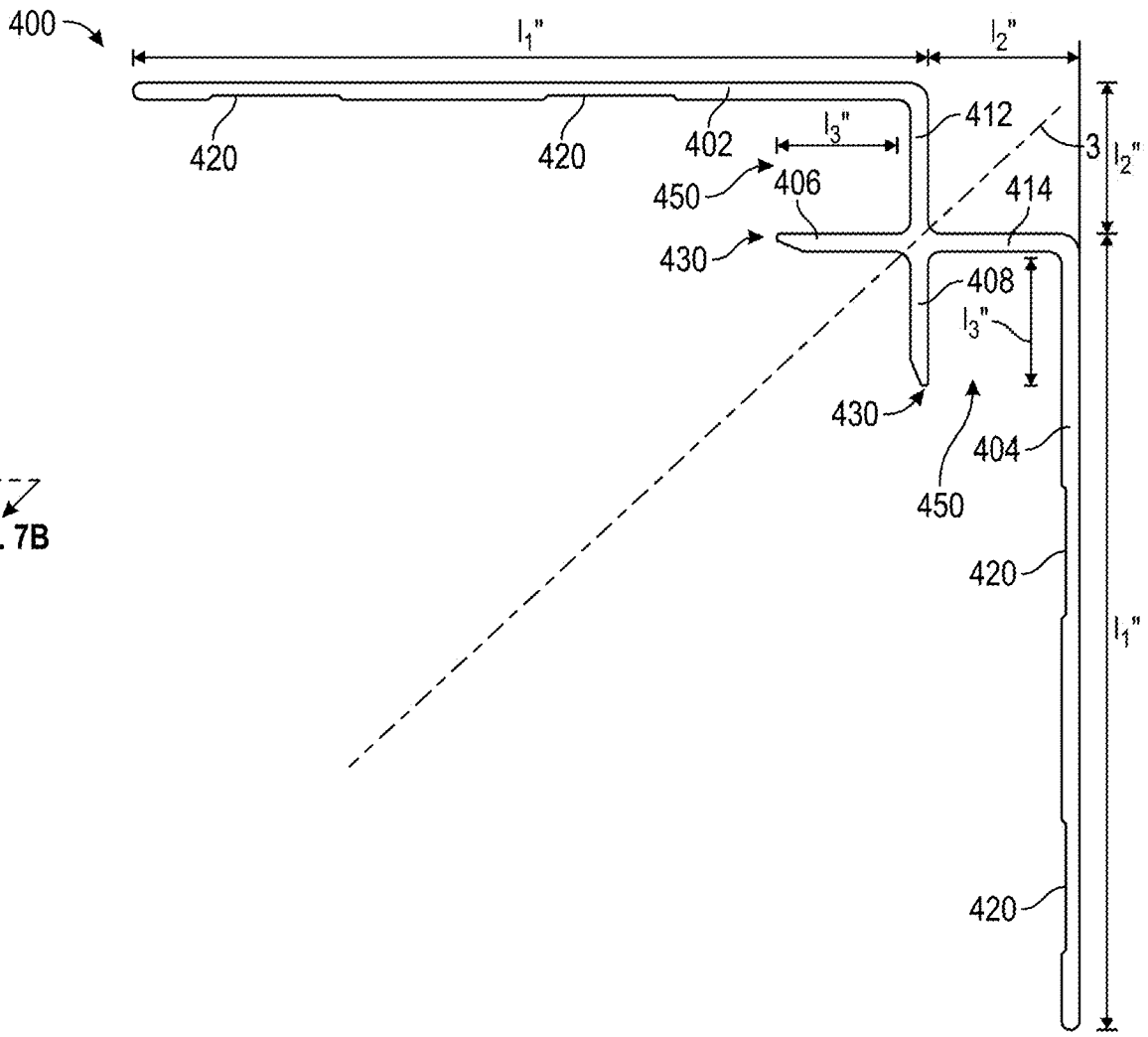
FIGS. 7A-7B illustrate another embodiment of a trim element in accordance with aspects of this disclosure.
Figure 7A:
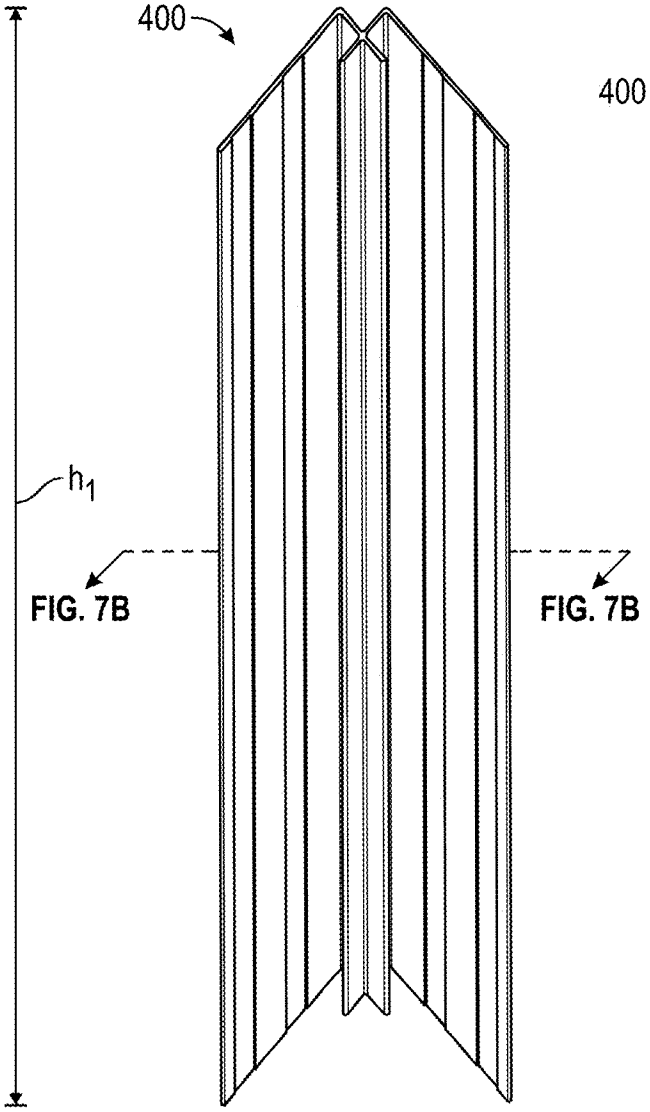

FIGS. 7A-7B illustrate a fourth embodiment of a corner trim element 400. Fourth corner trim element 400 can be similar or identical to first corner trim element 200 and/or third corner trim element 300 in some or many ways. For example, as indicated by the similar reference numerals, trim element 400 can include first, second, third, fourth, fifth and sixth legs 402, 404, 406, 408, 412, 414, recessed portions 420, channels 450 which can be identical to first, second, third, fourth, fifth and sixth legs 202, 204, 206, 208, 212, 214, recessed portions 220, and channels 250 of first corner trim element 200 (and/or similar corresponding components of third corner trim element 300). Accordingly, the above description with reference to first, second, third, fourth, fifth and sixth legs 202, 204, 206, 208, 212, 214, recessed portions 220, and channels 250 of first corner trim element 200 is equally applicable to the first, second, third, fourth, fifth and sixth legs 402, 404, 406, 408, 412, 414, recessed portions 420, and channels 450 of fourth corner trim element 400 and is therefore not repeated here for the sake of brevity. Additionally, length $l_1$" of first and second legs 402, 404, length $l_2$" of fifth and sixth legs 412, 414, and/or length $l_3$" of third and fourth legs 406, 408 can be identical to length $l_1$ of first and second legs 202, 204, length $l_2$ of fifth and sixth legs 212, 214, and/or length $l_3$ of third and fourth legs 206, 208 (respectively). Additionally, similar to first corner trim element 200, fourth corner trim element 400 comprises a cross-section that is symmetrical along axis 3, as illustrated in FIG. 7B.

Fourth corner trim element 400 can differ from first corner trim element 200 in that fourth corner trim element 400 does not include the curved leg 210. Additionally or alternatively, fourth corner trim element 400 can differ from third corner trim element 300 in that fourth corner trim element 400 does not include the seventh straight leg 310 of third corner trim element 300. In some embodiments, ends of third and fourth legs 406 and/or 408 of fourth corner trim element 400 are chamfered and/or radiused as indicated by reference numeral 430. Such configurations can reduce interference between cladding elements 100, 100' and/or other building components that may come in proximity to the chamfered and/or radiused ends 430 during installation.

Fourth corner trim element 400 can be secured to a building substrate (such as framing members 20, sheathing 30, and/or weather resistant barrier 40) and/or can receive ends/edges of cladding elements 100, 100' in a similar or identical manner as that described with reference to first corner trim element 200 and as shown in FIG. 5C. Accordingly, the above description with reference to first corner trim element 200 and FIG. 5C is equally applicable to trim element 400 and is therefore not repeated here for the sake of brevity.

Figure 8:
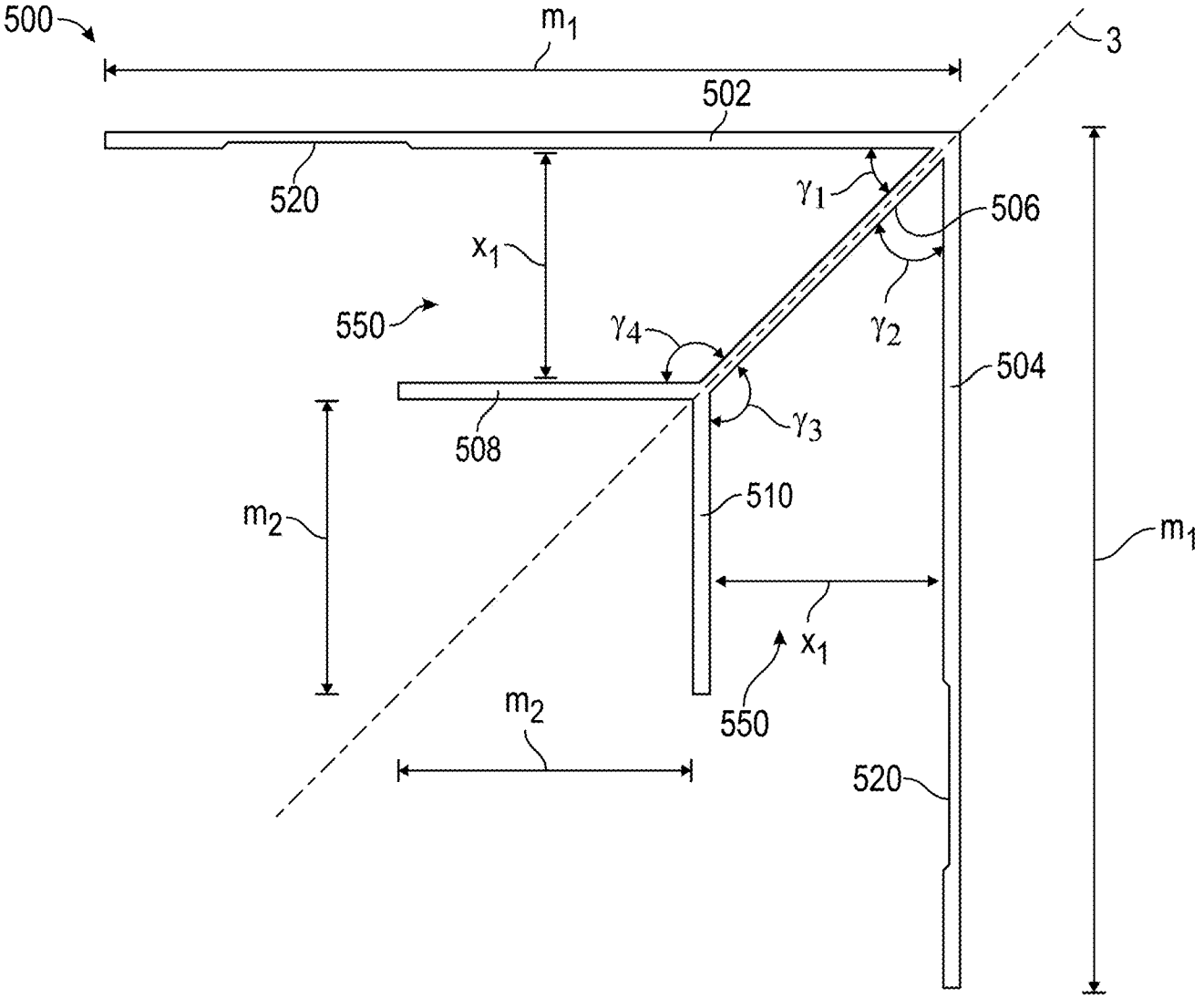
FIG. 8 illustrates another embodiment of a trim element in accordance with aspects of this disclosure.

FIG. 8 illustrates a fifth embodiment of a corner trim element 500. Fifth corner trim element 500 can be similar or identical to first, third and fourth corner trim elements 200, 300, 400 in some or many ways. Fifth corner trim element 500 can include a first leg 502, second leg 504, third leg 506, fourth leg 508, and a fifth leg 510. As shown, the first and second legs 502 and 504 of fifth corner trim element 500 are transverse (e.g., perpendicular) to one another. Fourth and fifth legs 508 and 510 of fifth corner trim element 500 are also transverse (e.g., perpendicular) to one another. As also shown, third leg 506 of fifth corner trim element 500 can be angled with respect to one or more of first, second, third or fourth legs 502, 504, 508, and/or 510 of fifth corner trim element 500. For example, third leg 506 of fifth corner trim element 500 can be angled with respect to the first leg 502 of fifth corner trim element 500 at an angle $\gamma_1$ and/or can be angled with respect to the second leg 504 of fifth corner trim element 500 at an angle $\gamma_2$. Angle $\gamma_1$ and/or angle $\gamma_2$ can be between approximately 10° and approximately 80°, for example, between approximately 10° and approximately 15°, between approximately 15° and approximately 20°, between approximately 20° and approximately 25°, between approximately 25° and approximately 30°, between approximately 30° and approximately 35°, between approximately 35° and approximately 40°, between approximately 40° and approximately 45°, between approximately 45° and approximately 50°, between approximately 50° and approximately 55°, between approximately 55° and approximately 60°, between approximately 60° and approximately 65°, between approximately 65° and approximately 70°, between approximately 70° and approximately 75°, between approximately 75° and approximately 80°, or between approximately 40° and approximately 50°, or any value or range within or bounded by any of these ranges or values, although values outside these values or ranges can be used in some cases. As another example, angle $\gamma_1$ and/or angle $\gamma_2$ can be equal to 45°. Angle $\gamma_1$ and/or angle $\gamma_2$ can be equal or different from each other. For example, angle $\gamma_1$ can be less than or greater than angle $\gamma_2$. Additionally or alternatively, third leg 506 of fifth corner trim element 500 can be angled with respect to the fifth leg 510 of fifth corner trim element 500 at an angle $\gamma_3$ and/or can be angled with respect to the fourth leg 508 of fifth corner trim element 500 at an angle $\gamma_4$. Angle $\gamma_3$ and/or angle $\gamma_4$ can be between approximately 100° and approximately 170°, for example, between approximately 100° and approximately 105°, between approximately 105° and approximately 110°, between approximately 110° and approximately 115°, between approximately 115° and approximately 120°, between approximately 120° and approximately 125°, between approximately 125° and approximately 130°, between approximately 130° and approximately 135°, between approximately 135° and approximately 140°, between approximately 140° and approximately 145°, between approximately 145° and approximately 150°, between approximately 150° and approximately 155°, between approximately 155° and approximately 160°, between approximately 160° and approximately 165°, between approximately 165° and approximately 170°, or between approximately 130° and approximately 140°, or any value or range within or bounded by any of these ranges or values, although values outside these values or ranges can be used in some cases. As another example, angle $\gamma_3$ and/or angle $\gamma_4$ can be equal to 135°. Angle $\gamma_3$ and/or angle $\gamma_4$ can be equal or different from each other. For example, angle $\gamma_3$ can be less than or greater than angle $\gamma_4$.

Fifth corner trim element 500 can include one or more or a plurality of recessed portions 520 that can be identical to the recessed portions 220 described above with reference to first corner trim element 200. Accordingly, the above description with reference to first corner trim element 200 and recessed portions 220 is equally applicable to fifth corner trim element 500 and is therefore not repeated here for the sake of brevity.

First, second, third, fourth and fifth legs 502, 504, 506, 508, and 510 of fifth corner trim element 500 define channels 550 which can be sized and/or shaped to receive ends/edges of cladding elements 100, 100' in a similar manner as that described above and illustrated with respect to first corner trim element 200. Additionally, similar to first corner trim element 200, fifth corner trim element 500 can comprise a cross-section that is symmetrical along axis 3, as illustrated in FIG. 8. Fifth corner trim element 500 can be secured to a building substrate (such as framing members 20, sheathing 30, and/or weather resistant barrier 40) and/or can receive ends/edges of cladding elements 100, 100' in a similar or identical manner as that described with reference to first corner trim element 200 and as shown in FIG. 5C. Accordingly, the above description with reference to first corner trim element 200 and FIG. 5C is equally applicable to trim element 500 and is therefore not repeated here for the sake of brevity.

In some cases, edges of cladding elements 100, 100' can be trimmed at an angle that matches the angle of the third leg 506 of fifth corner trim element 500 relative to the first and second legs 502, 504 and/or fourth and fifth legs 508, 510 of fifth corner trim element 500. For example, edges of cladding elements 100, 100' can be beveled to match a shape of the channels 550 defined by the first to fifth legs 502, 504, 506, 508, 510 (see FIG. 8) of fifth corner trim element 500. Such beveling can help installation of the cladding elements 100, 100' within channels 550 of fifth corner trim element 500 in some cases.

As shown in FIG. 8, first and second legs 502, 504 of fifth corner trim element 500 can have lengths $m_1$ and legs 508, 510 can have lengths $m_2$. Legs 508 and 510 can be spaced from legs 502 and 504 (respectively) by a distance $x_1$.

Length $m_1$ can be between approximately 1 inch and approximately 3 inch, for example, between approximately 1.1 inch and approximately 2.9 inch, between approximately 1.2 inch and approximately 2.8 inch, between approximately 1.3 inch and approximately 2.7 inch, between approximately 1.4 inch and approximately 2.6 inch, between approximately 1.5 inch and approximately 2.5 inch, between approximately 1.6 inch and approximately 2.4 inch, between approximately 1.7 inch and approximately 2.3 inch, between approximately 1.8 inch and approximately 2.2 inch, between approximately 1.9 inch and approximately 2.1 inch, between approximately 1 inch and approximately 2 inch, between approximately 1.5 inch and approximately 2 inch, or between approximately 1.75 inch and approximately 2 inch, or any value or range within or bounded by any of these ranges or values, although values outside these values or ranges can be used in some cases.

In some embodiments, the length $m_1$ of first leg 502 and/or second leg 504 of fifth corner trim element 500 is greater than 1.5 in. In some embodiments, the length $m_1$ of first leg 502 and/or second leg 504 of fifth corner trim element 500 is at least 1.5 in, at least 1.6 inch, at least 1.7 inch, at least 1.8 inch, at least 1.9 in, or at least 1.9 in. Such configurations can advantageously allow the first and second legs 502, 504 of fifth corner trim element 500 to have sufficient length to allow securement of the legs 502, 504 of fifth corner trim element 500 in corner configurations where there is an insulation board or layer (e.g., foam) positioned in between the first and second legs 502, 504 of fifth corner trim element 500 and other components of the building substrate while at the same time allowing fasteners to extend through the first and second legs 502, 504 of fifth corner trim element 500 and into framing members. It should be understood, that whilst this particular exemplary embodiment comprising additional components such as insulation board or a layer position in between the fifth corner trim element 500 and the other components of a building substrate, it is equally applicable to the other exemplary corner trim elements described herein.

Length $m_2$ can be between approximately 0.1 inch and approximately 2 inch, for example, between approximately 0.1 inch and approximately 2 inch, between approximately 0.2 inch and approximately 1.9 inch, between approximately 0.3 inch and approximately 1.8 inch, between approximately 0.4 inch and approximately 1.7 inch, between approximately 0.5 inch and approximately 1.6 inch, between approximately 0.6 inch and approximately 1.5 inch, between approximately 0.7 inch and approximately 1.4 inch, between approximately 0.8 inch and approximately 1.3 inch, between approximately 0.9 inch and approximately 1.2 inch, between approximately 1 inch and approximately 1.1 inch, or between approximately 0.3 inch and approximately 0.5 inch, or any value or range within or bounded by any of these ranges or values, although values outside these values or ranges can be used in some cases.

Distance $x_1$ can be between approximately 0.1 inch and approximately 2 inch, for example, between approximately 0.1 inch and approximately 2 inch, between approximately 0.2 inch and approximately 1.9 inch, between approximately 0.3 inch and approximately 1.8 inch, between approximately 0.4 inch and approximately 1.7 inch, between approximately 0.5 inch and approximately 1.6 inch, between approximately 0.6 inch and approximately 1.5 inch, between approximately 0.7 inch and approximately 1.4 inch, between approximately 0.8 inch and approximately 1.3 inch, between approximately 0.9 inch and approximately 1.2 inch, between approximately 1 inch and approximately 1.1 inch, or between approximately 0.3 inch and approximately 0.5 inch, or any value or range within or bounded by any of these ranges or values, although values outside these values or ranges can be used inch some cases.

Figure 9B:
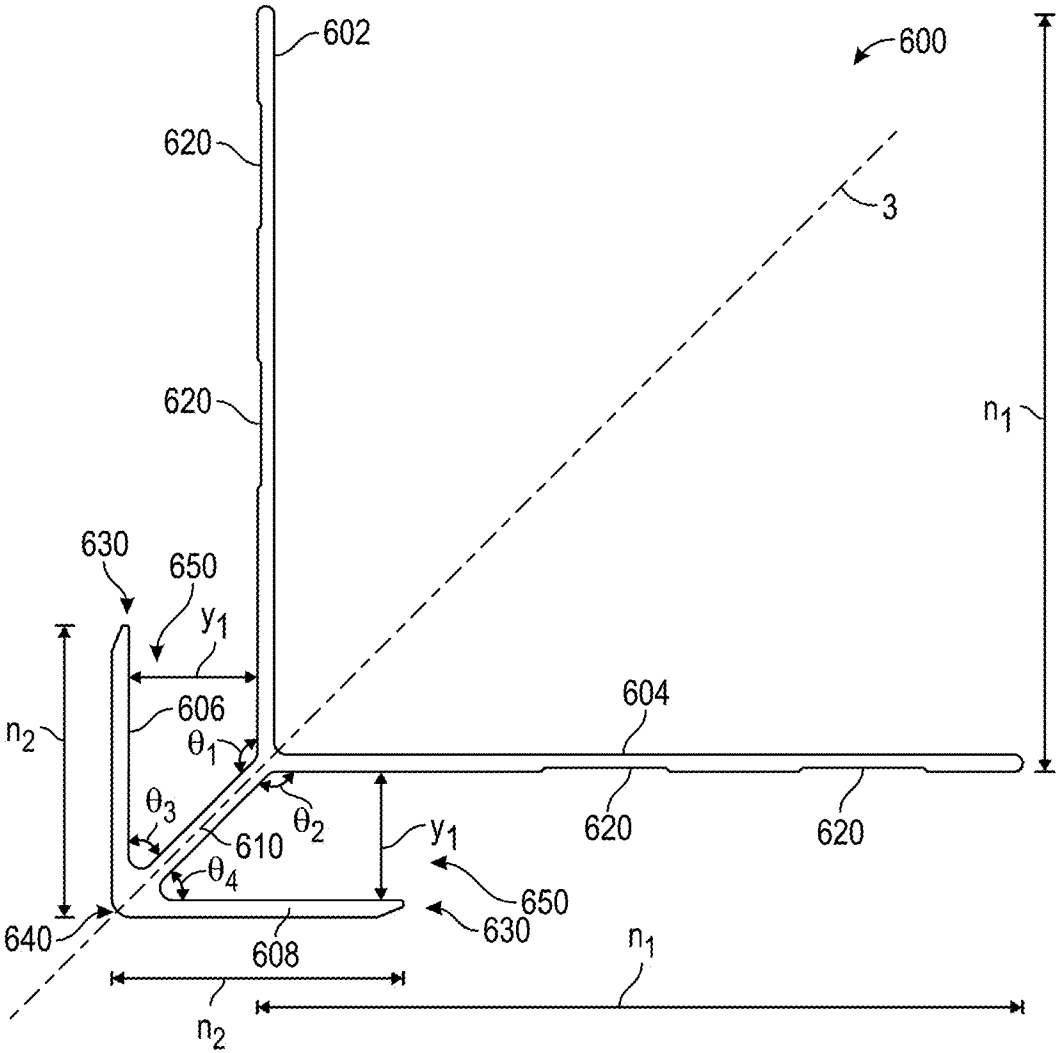
FIGS. 9A-9B illustrate another embodiment of a trim element in accordance with aspects of this disclosure.
Figure 9A:
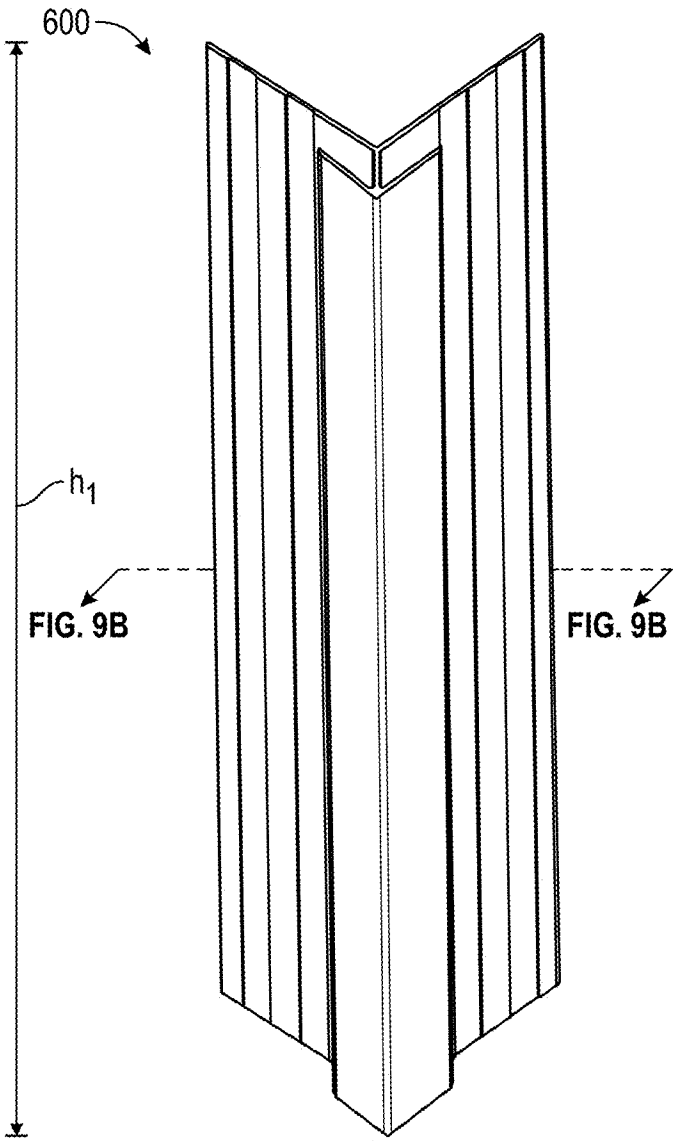

FIGS. 9A-9B illustrate an exemplary second corner trim element 600 which is suitable for use in an 'outward' corner. Second corner trim element 600 can include a first leg 602, a second leg 604, a third leg 606, a fourth leg 608, and a fifth leg 610. Any or all of legs 602, 604, 606, 608, and/or 610 may be integrally formed.

As shown in FIG. 9B, first and second legs 602, 604 of second corner trim element 600 can be transverse (e.g. perpendicular) with respect one another. Third and fourth legs 606, 608 of second corner trim element 600 can be transverse (e.g. perpendicular) with respect one another. First and third legs 602, 606 can be parallel to and/or spaced from one another by a distance $y_1$. Similarly, second and fourth legs 604, 608 can be parallel to and/or spaced from one another by distance $y_1$. Legs 602, 604, 606, 608, and/or 610 can define channels 650 that can be sized and/or shaped to receive portions of the cladding elements 100, 100'. Distance $y_1$ can be between approximately 5 mm and approximately 20 mm, for example, between approximately 6 mm and approximately 19 mm, between approximately 7 mm and approximately 18 mm, between approximately 8 mm and approximately 17 mm, between approximately 9 mm and approximately 16 mm, between approximately 10 mm and approximately 15 mm, between approximately 11 mm and approximately 14 mm, between approximately 12 mm and approximately 13 mm, or between approximately 9 mm and approximately 11 mm, or any value or range within or bounded by any of these ranges or values, although values outside these values or ranges can be used in some cases.

As also shown, fifth leg 610 of second corner trim element 600 can be angled with respect to one or more of first, second, third and/or fourth legs 602, 604, 606, and/or 608 of second corner trim element 600. For example, fifth leg 610 of second corner trim element 600 can be angled with respect to the first leg 602 of the second corner trim element 600 at an angle $\theta_1$ and/or can be angled with respect to the second leg 604 of the second corner trim element 600 at an angle $\theta_2$. Angle $\theta_1$ and/or angle $\theta_2$ can be between approximately 100° and approximately 170°, for example, between approximately 100° and approximately 105°, between approximately 105° and approximately 110°, between approximately 110° and approximately 115°, between approximately 115° and approximately 120°, between approximately 120° and approximately 125°, between approximately 125° and approximately 130°, between approximately 130° and approximately 135°, between approximately 135° and approximately 140°, between approximately 140° and approximately 145°, between approximately 145° and approximately 150°, between approximately 150° and approximately 155°, between approximately 155° and approximately 160°, between approximately 160° and approximately 165°, between approximately 165° and approximately 170°, or between approximately 130° and approximately 140°, or any value or range within or bounded by any of these ranges or values, although values outside these values or ranges can be used in some cases. As another example, angle $\theta_1$ and/or angle $\theta_2$ can be equal to 135°. Angle $\theta_1$ and/or angle $\theta_2$ can be equal or different from one another. For example, angle $\theta_1$ can be less than or greater than angle $\theta_2$. Additionally or alternatively, fifth leg 610 of second corner trim element 600 can be angled with respect to the third leg 606 of second corner trim element 600 at an angle $\theta_3$ and/or can be angled with respect to the fourth leg 608 of second corner trim element 600 at an angle $\theta_4$. Angle $\theta_3$ and/or angle $\theta_4$ can be between approximately 10° and approximately for example, between approximately 10° and approximately 15°, between approximately and approximately 20°, between approximately 20° and approximately 25°, between approximately 25° and approximately 30°, between approximately 30° and approximately 35°, between approximately 35° and approximately 40°, between approximately 40° and approximately 45°, between approximately 45° and approximately 50°, between approximately 50° and approximately 55°, between approximately 55° and approximately 60°, between approximately 60° and approximately 65°, between approximately 65° and approximately 70°, between approximately 70° and approximately 75°, between approximately 75° and approximately 80°, or between approximately 40° and approximately or any value or range within or bounded by any of these ranges or values, although values outside these values or ranges can be used in some cases. As another example, angle $\theta_3$ and/or angle $\theta_4$ can be equal to 45°. Angle $\theta_3$ and/or angle $\theta_4$ can be equal or different from one another. For example, angle $\theta_3$ can be less than or greater than angle $\theta_4$.

First leg 602 and second leg 604 of second corner trim element 600 can have equal lengths $n_1$ and/or third and fourth legs 606, 608 of second corner trim element 600 can have equal lengths $n_2$. Length $n_1$ can be greater than length $n_2$. Length $n_1$ can be between approximately 30 mm and approximately 80 mm. For example, length $n_1$ can be between approximately 35 mm and approximately 75 mm, between approximately 40 mm and approximately 70 mm, between approximately 45 mm and approximately 65 mm, or between approximately 50 mm and approximately 60 mm, or any value or range within or bounded by any of these ranges or values, although values outside these values or ranges can be used in some cases. Length $n_2$ can be between approximately 1 mm and approximately 40 mm. For example, length $n_2$ can be between approximately 5 mm and approximately 35 mm, between approximately 10 mm and approximately 30 mm, between approximately 15 mm and approximately 25 mm, or between approximately 20 mm and approximately 25 mm, or any value or range within or bounded by any of these ranges or values, although values outside these values or ranges can be used in some cases.

In some embodiments, ends of third and fourth legs 606 and/or 608 of second corner trim element 600 are chamfered and/or radiused as indicated by reference numeral 630. Additionally or alternatively, in some embodiments, a point or region where third, fourth and fifth legs 606, 608, and 610 of second corner trim element 600 meet comprises a radiused surface as indicated by reference numeral 640. Such surface 640 can have a radius of curvature that is between approximately 0.01 inch and approximately 0.5 inch. For example, the surface 640 can have a radius of curvature that is between approximately 0.02 inch and approximately 0.4 inch, between approximately 0.03 inch and approximately 0.3 inch, between approximately 0.04 inch and approximately 0.2 inch, between approximately 0.05 inch and approximately 0.1 inch, between approximately 0.06 inch and approximately 0.09 inch, between approximately 0.07 inch and approximately 0.08 inch, or between approximately 0.05 inch and approximately 0.07 inch, or any value or range within or bounded by any of these ranges or values, although values outside these values or ranges can be used in some cases. Such configurations can reduce interference between cladding elements 100, 100' and/or other building components that may come in proximity to the chamfered and/or radiused ends 630 and/or surfaces 640 of second corner trim element 600 during installation.

As shown in FIG. 9B, second corner trim element 600 can include one or more or a plurality of recessed portions, such as recessed portions 620. Such recessed portions 620 of second corner trim element 600 can be recessed from surfaces of the first and second legs 602, 604 of second corner trim element 600, for example, as illustrated, and such recessed portions 620 can have a thickness that is smaller than remainder thicknesses of the first and second legs 602, 604 of second corner trim element 600. The recessed portions 620 can advantageously provide an indication for where fasteners 60 should be aligned when forced through the first and second legs 602, 604 of second corner trim element 600 and into a building substrate. The recessed portions 620 of second corner trim element 600 can also provide a spaced for fastener heads to "seat" so that the fastener heads are at (e.g., "flush") or below surfaces of the first and second legs 602, 604 of second corner trim element 600 in order to minimize interference with surfaces of the cladding elements 100 when positioned within the channels 650. First and second legs 602 and/or 604 of second corner trim element 600 can include one or more or a plurality of recessed portions 620, such as one, two, three, four, five, or six or more recessed portions 620. Such recessed portions 620 of second corner trim element 600 can extend continuously along the height $h_1$ of the second corner trim element 600 or can extend non-continuously along the height $h_1$ of the second corner trim element 600. The recessed portions 620 of second corner trim element 600 can be spaced from one another along the lengths $n_1$ of the first and second legs 602, 604 of second corner trim element 600 at a spacing that is between approximately 5 mm and 30 mm. For example, the recessed portions 620 can be spaced from one another along the lengths $n_1$ of the first and second legs 602, 604 of second corner trim element 600 at a spacing that is between approximately 10 mm and approximately 25 mm, between approximately 15 mm and approximately 20 mm, or between approximately 10 mm and approximately 20 mm, or any value or range within or bounded by any of these ranges or values, although values outside these values or ranges can be used in some cases.

The recessed portions 620 can have a length (or "width") extending along the length $n_1$ of the first and second legs 602, 604 of second corner trim element 600 that is between approximately 5 mm and 20 mm, for example, between approximately 6 mm and 19 mm, between approximately 7 mm and 18 mm, between approximately 8 mm and 17 mm, between approximately 9 mm and 16 mm, between approximately 10 mm and 15 mm, between approximately 11 mm and 14 mm, or between approximately 12 mm and 13 mm, or between approximately 8 mm and approximately 12 mm, or any value or range within or bounded by any of these ranges or values, although values outside these values or ranges can be used in some cases. In some embodiments, the second corner trim element 600 includes one or more or a plurality of through-holes along height $h_1$ of the second corner trim element 600 and along the recessed portions 620. Such through-holes can be sized and/or shaped to allow fasteners to extend therethrough and into a building substrate.

In some embodiments, second corner trim element 600 comprises a cross-section that is symmetrical along an axis 3, as illustrated in FIG. 9B.

Figure 9C:
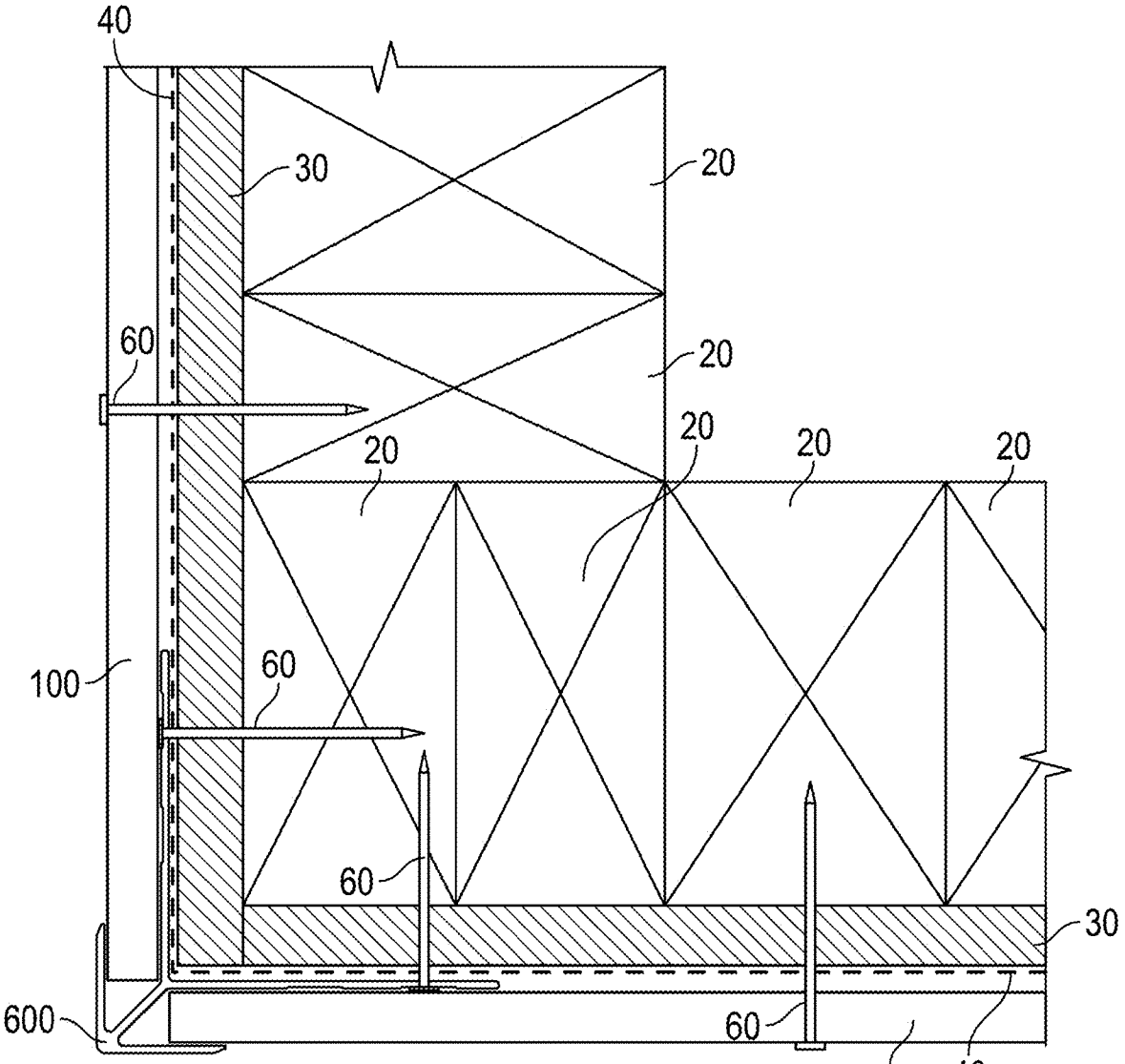
FIG. 9C illustrates an enlarged, cross-sectional view taken through a portion of the structure illustrated in FIG. 2 in accordance with aspects of this disclosure.

FIG. 9C illustrates an exemplary cross-section through a portion of structure (as indicated in FIG. 2), and in particular, illustrates how second corner trim element 600 can be secured to structure 10 along with cladding elements 100 and/or other building components. As shown, second corner trim element 600 can be secured to the framing members 20, sheathing 30, and/or weather resistant barrier 40, for example, via fasteners which extend through the recessed portions 620 (not shown). Additionally, portions of ends or edges of the cladding elements 100 (such as edges 106, 108) can be positioned within the channels 650 formed by the second corner trim element 600. While FIG. 9C illustrates straight ends/edges of cladding elements 100 (for example, where the profiles of the first and second mating edges 106, 108 discussed above have been "trimmed off"), it is to be understood that channels 650 of the second corner trim element 600 can receive non-trimmed ends/edges of the cladding element 100, for example, having the surfaces discussed above with respect to first and second mating edges 106, 108. Advantageously, the second corner trim element 600 can "hide" and/or "cover" such ends/edges of the cladding elements 100 which can provide a desirable aesthetic appearance, especially where such ends/edges of the cladding elements 100 have been "trimmed" for size adjustment purposes on a construction site as is common.

In some cases, edges of cladding elements 100, 100' can be trimmed at an angle that matches the angle of the leg 610 relative to the legs 602, 604, 606 and/or 608. For example, edges of cladding elements 100, 100' can be beveled to match a shape of the channels 650 defined by the legs 602, 604, 606, 608, 610 (see FIG. 8). Such beveling can help installation of the cladding elements 100, 100' within channels 650 in some cases.

Figure 10B:
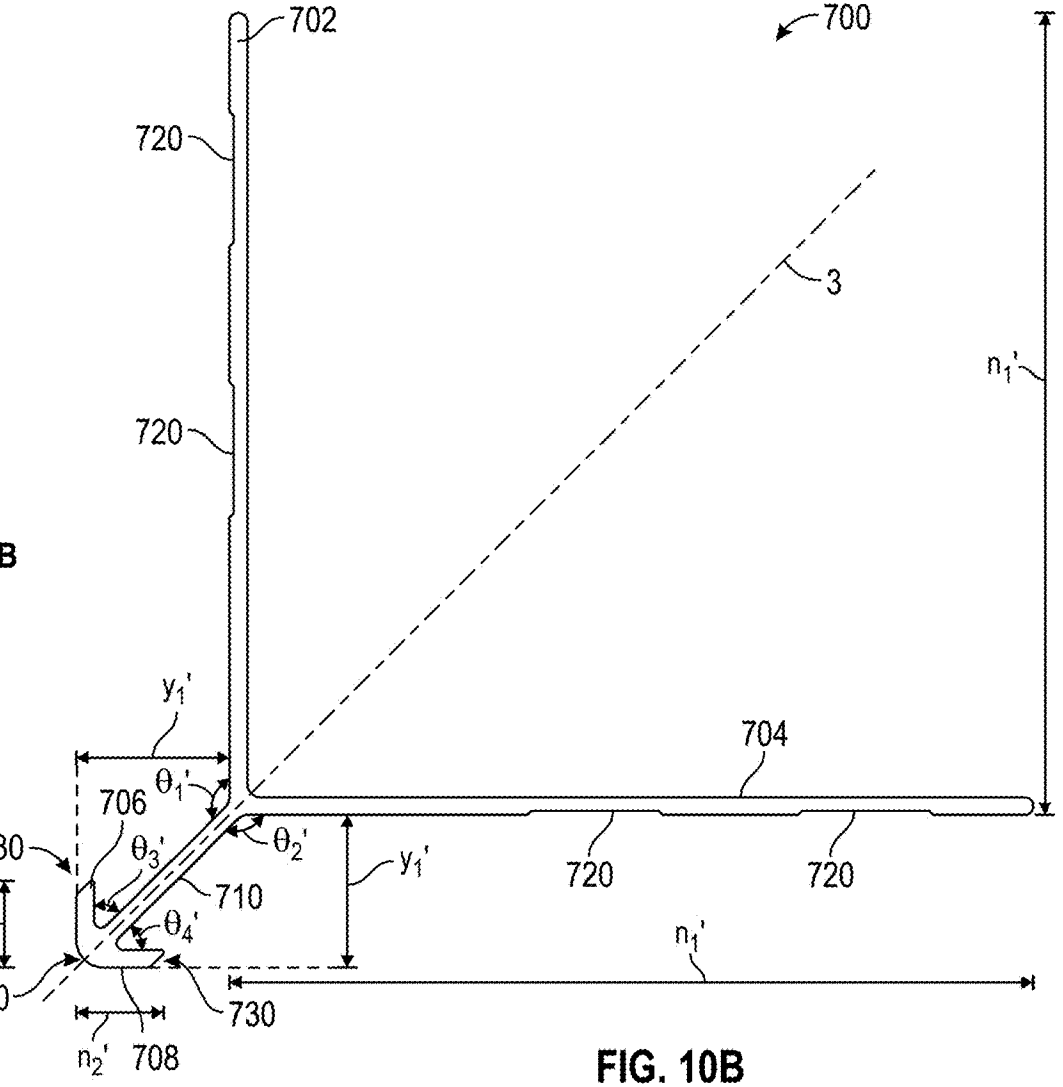
FIGS. 10A-10B illustrate another embodiment of a trim element in accordance with aspects of this disclosure.
Figure 10A:
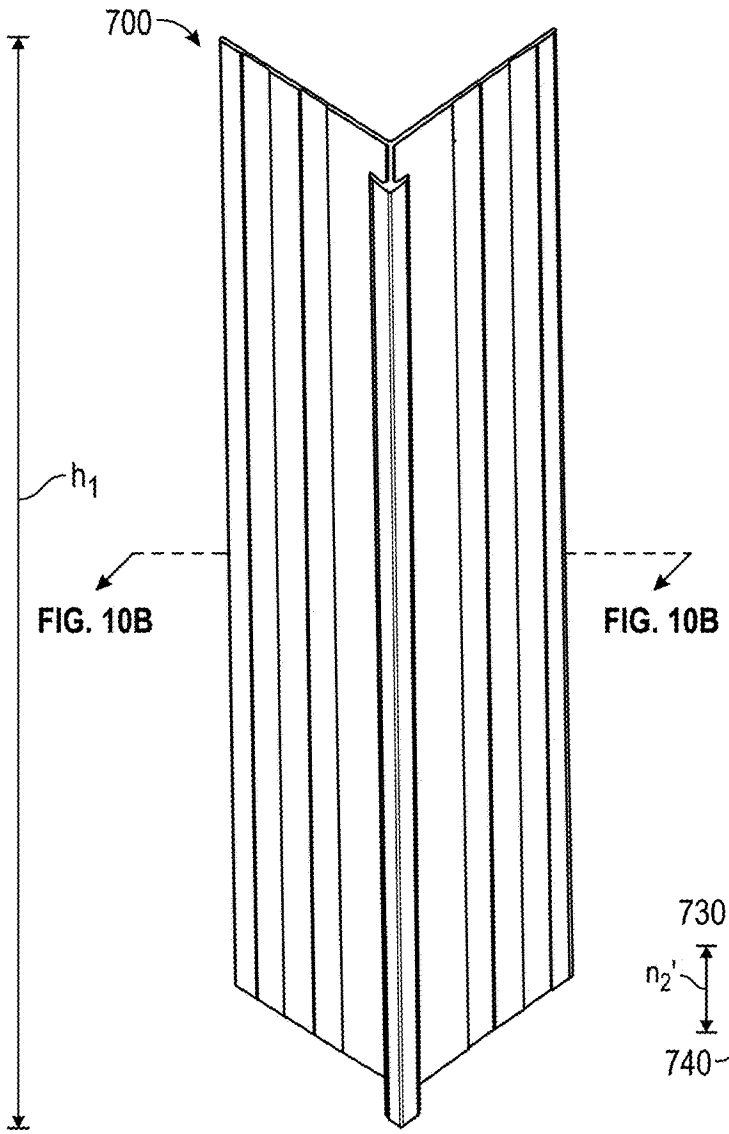

FIGS. 10A-10B illustrate a sixth embodiment of a corner trim element 700. As indicated by the similar reference numerals, sixth corner trim element 700 can include first, second and fifth legs 702, 704, 710, recessed portions 720, which can be identical to first, second and fifth legs 602, 604, 610 and recessed portions 620 of second corner trim element 600 and as such, the above discussion with respect to these components is equally applicable and not repeated here for the sake of brevity. Sixth corner trim element 700 can be identical to second corner trim element 600 except with respect to third and fourth legs 706, 708. As can be seen by comparison of FIGS. 9B and 10B, third and fourth legs 706, 708 have a length $n_2'$ that is smaller than the length $n_2$ of legs 606, 608 of second corner trim element 600. Length $n_2'$ of legs 706, 708 can be between approximately 1 mm and approximately 10 mm, for example, between approximately 2 mm and approximately 9 mm, between approximately 3 mm and approximately 8 mm, between approximately 4 mm and approximately 7 mm, between approximately 5 mm and approximately 6 mm, between approximately 3 mm and approximately 7 mm, between approximately 3 mm and approximately 4 mm, or between approximately 6 mm and approximately 7 mm, or any value or range within or bounded by any of these ranges or values, although values outside these values or ranges can be used in some cases. The first and second legs 702, 704 can have lengths $n_1'$ that are identical to the lengths $n_1$ discussed above with reference to second corner trim element 600.

Additionally, similar to second corner trim element 600, sixth corner trim element 700 can comprise a cross-section that is symmetrical along axis 3, as illustrated in FIG. 10B.

In some embodiments, ends of third and fourth legs 706 and/or 708 of sixth corner trim element 700 are chamfered and/or radiused as indicated by reference numeral 730. Additionally or alternatively, in some embodiments, a point or region where third, fourth and fifth legs 706, 708, and 710 of sixth corner trim element 700 meet comprises a radiused surface as indicated by reference numeral 740. Such surface 740 of sixth corner trim element 700 can have a radius of curvature that is between approximately 0.01 in and approximately 0.5 in. For example, the surface 740 of sixth corner trim element 700 can have a radius of curvature that is between approximately 0.02 in and approximately 0.4 in, between approximately 0.03 in and approximately 0.3 in, between approximately 0.04 in and approximately 0.2 in, between approximately 0.05 in and approximately 0.1 in, between approximately 0.06 in and approximately 0.09 in, between approximately 0.07 in and approximately 0.09 in, or between approximately 0.05 in and approximately 0.09 in, or any value or range within or bounded by any of these ranges or values, although values outside these values or ranges can be used in some cases. Such configurations can reduce interference between cladding elements 100 and/or other building components that may come in proximity to the chamfered and/or radiused ends 730 and/or surfaces 740 of sixth corner trim element 700 during installation.

First and second legs 702 and/or 704 of sixth corner trim element 700 can be angled with respect to fifth leg 710 of sixth corner trim element 700 at angles $\theta_1'$, $\theta_2'$ that can be similar or identical to the angles $\theta_1$, $\theta_2$ described with reference to first, second and fifth legs 602, 604, 610 above in second corner trim element 600. Additionally, similar to as discussed above with respect to angles $\theta_1$, $\theta_2$, angles $\theta_1'$, $\theta_2'$ can be equal or different from one another (for example, angle $\theta_1'$ can be less than or greater than angle $\theta_2'$). Similarly, third and fourth legs 706 and/or 708 of sixth corner trim element 700 can be angled with respect to fifth leg 710 of sixth corner trim element 700 at angle $\theta_3'$, $\theta_4'$ that can be similar or identical to angles $\theta_3$, $\theta_4$ described with reference to third, fourth and fifth legs 606, 608, 610 above in second corner trim element 600. Additionally, similar to as discussed above with respect to angles $\theta_3$, $\theta_4$, angles $\theta_3'$, $\theta_4'$ can be equal or different from one another (for example, angle $\theta_3'$ can be less than or greater than angle $\theta_4'$). First and third legs 702, 706 (for example, planes along surfaces of first and third legs 702, 706) can be spaced from one another by a distance $y_1'$ which can be identical to the distance $y_1$ described above between first and third legs 602, 606 of second corner trim element 600. Similarly, second and fourth legs 704, 708 (for example, planes along surfaces of second and fourth legs 704, 708) of sixth corner trim element 700 can be spaced from one another by a distance $y_1'$ which can be identical to the distance $y_1$ described above between second and fourth legs 604, 608 of second corner trim element 600.

Sixth corner trim element 700 can be secured to a building substrate (such as framing members 20, sheathing 30, and/or weather resistant barrier 40) and/or can receive ends/edges of cladding elements 100, 100' in a similar or identical manner as that described with reference to second corner trim element 600 and as shown in FIG. 9C. Accordingly, the above description with reference to second corner trim element 600 and FIG. 9C is equally applicable to sixth corner trim element 700 and is therefore not repeated here for the sake of brevity.

Figure 11B:
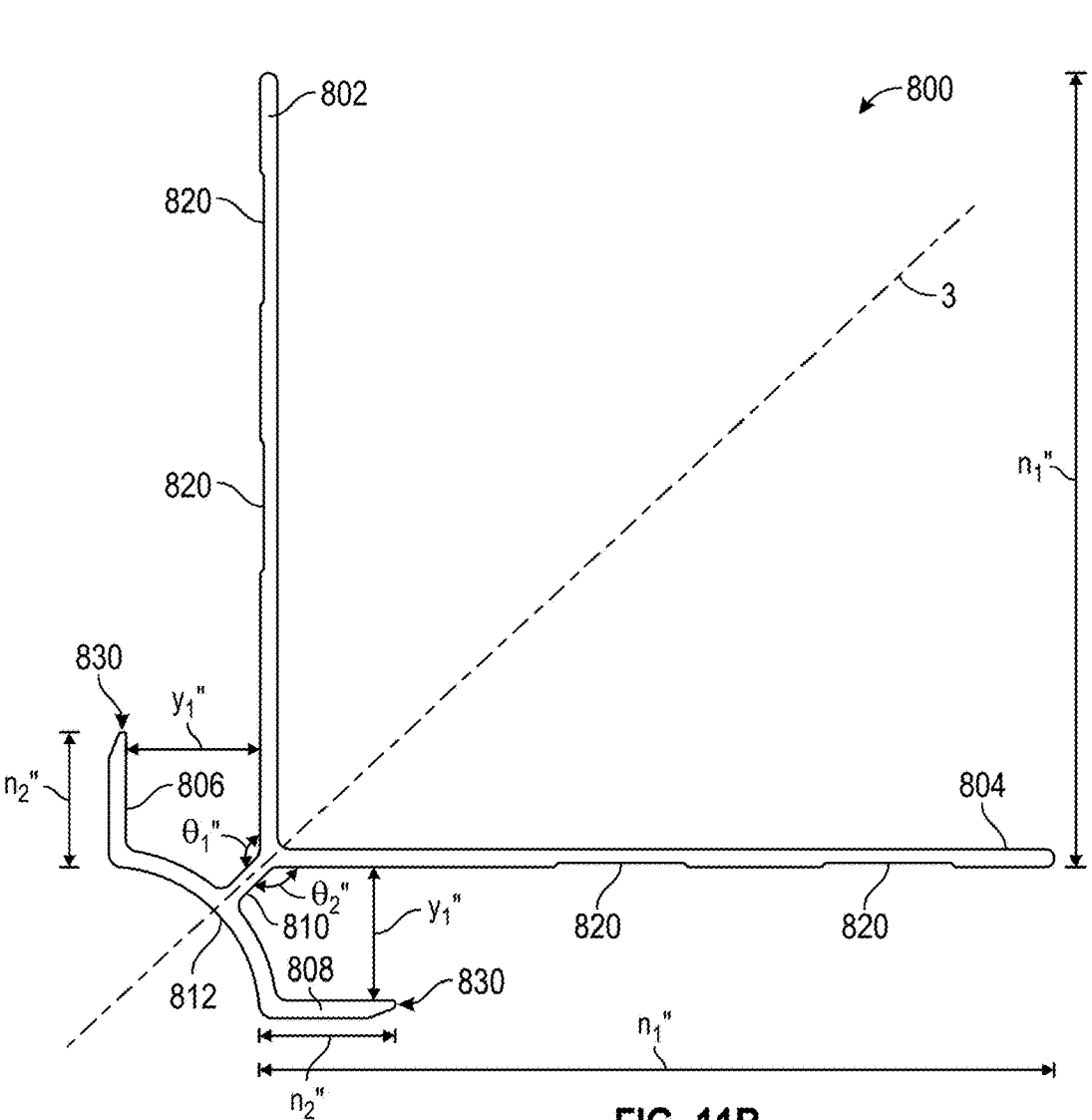
FIGS. 11A-11B illustrate another embodiment of a trim element in accordance with aspects of this disclosure.
Figure 11A:
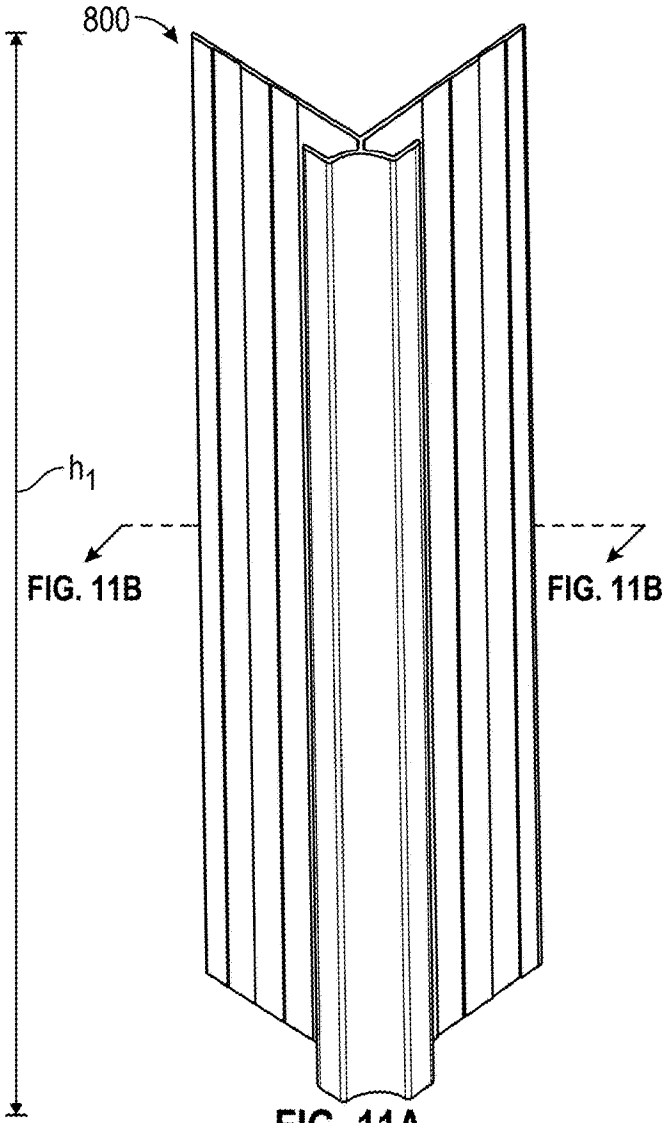

FIGS. 11A-11B illustrate a seventh embodiment of a corner trim element 800. As indicated by the similar reference numerals, seventh corner trim element 800 can include first and second legs 802, 804 and recessed portions 820, which can be identical to first and second legs 602, 604 and recessed portions 620 of second corner trim element 600 and as such, the above discussion with respect to these components is equally applicable and not repeated here for the sake of brevity. Seventh corner trim element 800 can be identical to second corner trim element 600 except with respect to third, fourth and fifth legs 806, 808, and leg 810, and that seventh corner trim element 800 additionally has a curved sixth leg 812 connected to third, fourth and fifth legs 806, 808, and 810 of seventh corner trim element 800. As can be seen by comparison of FIGS. 9B and 11B, third and fourth legs 806, 808 of seventh corner trim element 800 have a length $n_2''$ that is smaller than the length $n_2$ of legs 606, 608 of second corner trim element 600. As also can be seen by comparison of FIGS. 9B and 11B, fifth leg 810 of seventh corner trim element 800 has a length that is smaller than a length of leg 610 of second corner trim element 600.

Length $n_2$" of third and fourth legs 806, 808 of seventh corner trim element 800 can be between approximately 5 mm and approximately 20 mm, for example, between approximately 6 mm and approximately 19 mm, between approximately 7 mm and approximately 18 mm, between approximately 8 mm and approximately 17 mm, between approximately 9 mm and approximately 16 mm, between approximately 10 mm and approximately 15 mm, between approximately 11 mm and approximately 14 mm, between approximately 12 mm and approximately 13 mm, or between approximately 8 mm and approximately 12 mm, or any value or range within or bounded by any of these ranges or values, although values outside these values or ranges can be used in some cases.

The curved sixth leg 812 of seventh corner trim element 800 can have a radius of curvature between approximately 0.1 inch and approximately 1 inch. For example, the curved sixth leg 812 of seventh corner trim element 800 can have a radius of curvature between approximately 0.2 inch and approximately 0.9 inch, between approximately 0.3 inch and approximately 0.8 inch, between approximately 0.4 inch and approximately 0.7 inch, between approximately 0.5 inch and approximately 0.6 inch, or between approximately 0.3 inch and approximately 0.5 inch, or any value or range within or bounded by any of these ranges or values, although values outside these values or ranges can be used in some cases.

In some embodiments, ends of third and fourth legs 806 and/or 808 of seventh corner trim element 800 are chamfered and/or radiused as indicated by reference numeral 830. Such configurations can reduce interference between cladding elements 100, 100' and/or other building components that may come in proximity to the chamfered and/or radiused ends 830 of seventh corner trim element 800 during installation.

Similar to second corner trim element 600, seventh corner trim element 800 can comprise a cross-section that is symmetrical along axis 3, as illustrated in FIG. 11B.

First and third legs 802, 806 (for example, planes along surfaces of first and third legs 802, 806) of seventh corner trim element 800 can be spaced from one another by a distance $y_1$" which can be identical to the distance $y_1$ described above between first and third legs 602, 606 of second corner trim element 600. Similarly, second and fourth legs 804, 808 (for example, planes along surfaces of second and fourth legs 804, 808) of seventh corner trim element 800 can be spaced from one another by a distance $y_1$" which can be identical to the distance $y_1$ described above between second and fourth legs 604, 608 of second corner trim element 600.

First and second legs 802 and/or 804 can be angled with respect to fifth leg 810 at angles $\theta_1$", $\theta_2$" that can be similar or identical to the angles $\theta_1$, $\theta_2$ described with reference to first, second and fifth legs 602, 604, 610 above in second corner trim element 600. Additionally, similar to as discussed above with respect to angles $\theta_1$, $\theta_2$, angles $\theta_1$", $\theta_2$" can be equal or different from one another (for example, angle $\theta_1$" can be less than or greater than angle $\theta_2$").

Seventh corner trim element 800 can be secured to a building substrate (such as framing members 20, sheathing 30, and/or weather resistant barrier 40) and/or can receive ends/edges of cladding elements 100 in a similar or identical manner as that described with reference to second corner trim element 600 and as shown in FIG. 9C. Accordingly, the above description with reference to second corner trim element 600 and FIG. 9C is equally applicable to seventh corner trim element 800 and is therefore not repeated here for the sake of brevity.

Figure 12B:
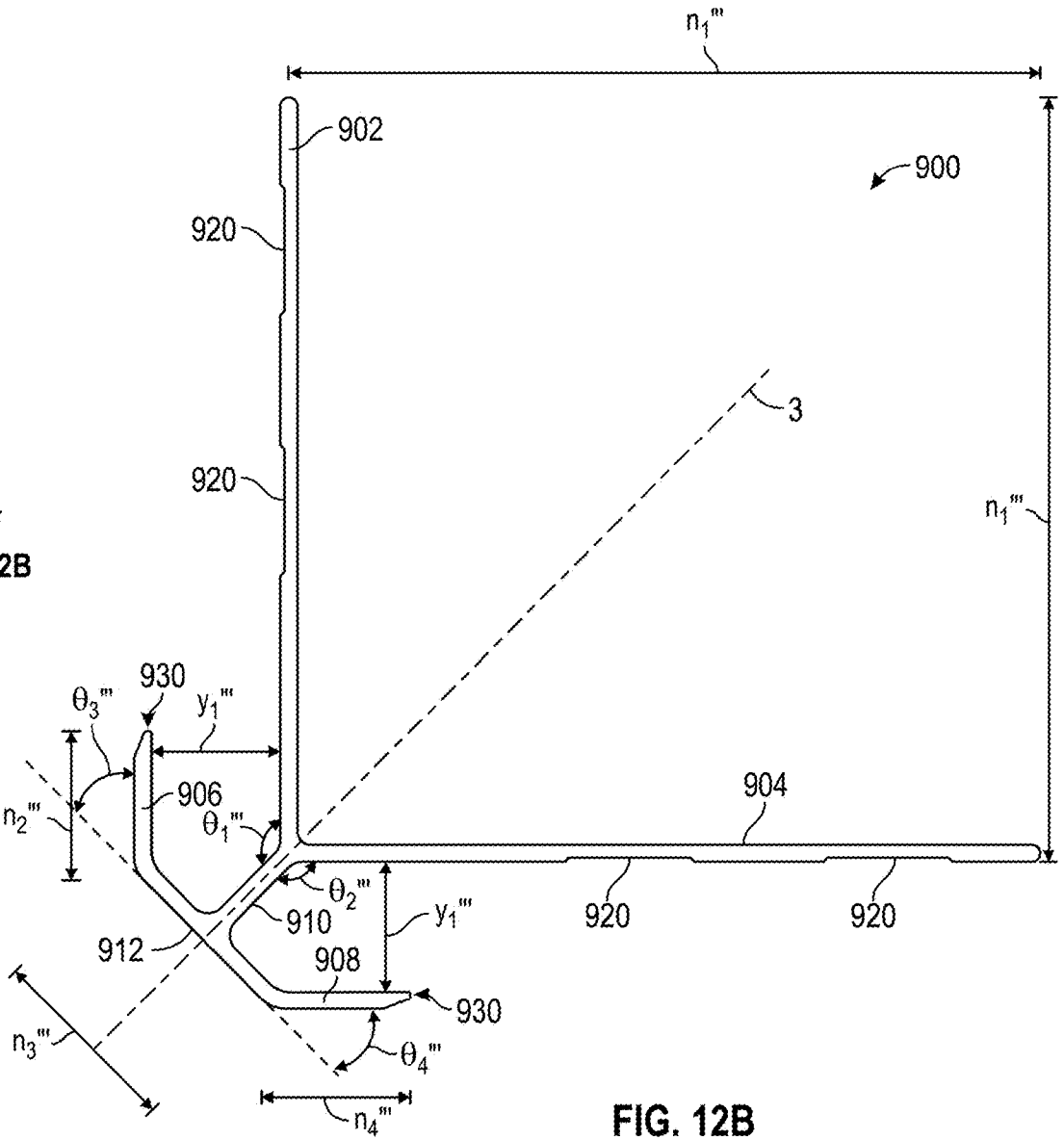
FIGS. 12A-12B illustrate another embodiment of a trim element in accordance with aspects of this disclosure.
Figure 12A:
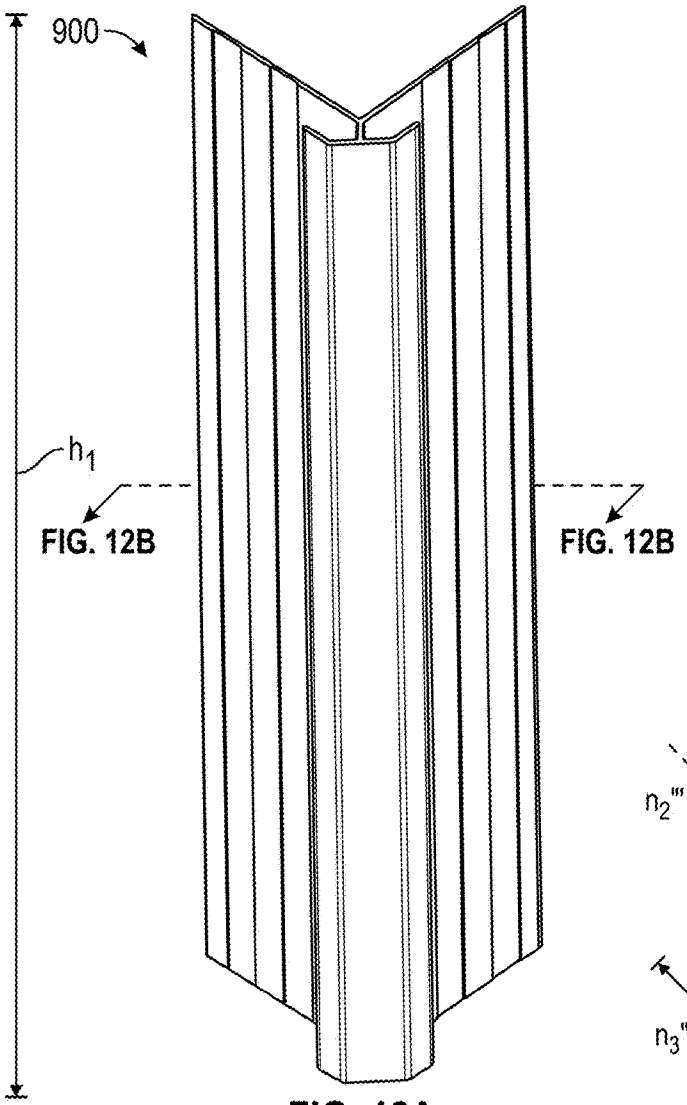

FIGS. 12A-12B illustrate an eighth embodiment of a corner trim element 900. As indicated by the similar reference numerals, eighth corner trim element 900 can include first and second legs 902, 904 and recessed portions 920, which can be identical to first and second legs 602, 604 and recessed portions 620 of second corner trim element 600 and as such, the above discussion with respect to these components is equally applicable and not repeated here for the sake of brevity. Eighth corner trim element 900 can be identical to seventh trim element 800 except with respect to lengths $n_2$'" of third and fourth legs 906, 908 (which can be greater than lengths $n_2$" of third and fourth legs 806, 808), a length of the fifth leg 910 (which can be greater than a length of the fifth leg 810), and/or the straight or planar sixth leg 912.

Planar sixth leg 912 of eighth corner trim element 900 can be connected to third, fourth and fifth legs 906, 908, 910 of eighth corner trim element 900. Sixth planar leg 912 of eighth corner trim element 900 can be transverse with respect to one or both of third and fourth legs 906, 908 of eighth corner trim element 900. For example, planar sixth leg 912 can be angled with respect to the third leg 906 of eighth corner trim element 900 at an angle $\theta_3$'" and/or can be angled with respect to the fourth leg 908 at an angle $\theta_4$'". Angle $\theta_3$'" and/or angle $\theta_4$'" can be between approximately 10° and approximately 80°, for example, between approximately 10° and approximately 15°, between approximately 15° and approximately 20°, between approximately 20° and approximately 25°, between approximately 25° and approximately 30°, between approximately 30° and approximately 35°, between approximately 35° and approximately 40°, between approximately 40° and approximately 45°, between approximately 45° and approximately 50°, between approximately 50° and approximately 55°, between approximately 55° and approximately 60°, between approximately 60° and approximately 65°, between approximately 65° and approximately 70°, between approximately 70° and approximately 75°, between approximately 75° and approximately 80°, or between approximately 40° and approximately or any value or range within or bounded by any of these ranges or values, although values outside these values or ranges can be used in some cases. As another example, angle $\theta_3$'" and/or angle $\theta_4$'" can be equal to 45°. Angle $\theta_3$'" and/or angle $\theta_4$'" can be equal or different from each other. For example, angle $\theta_3$'" can be less than or greater than angle $\theta_4$'". In some embodiments, planar sixth leg 912 is perpendicular to fifth leg 910 of eighth corner trim element 900.

First and second legs 902 and/or 904 of eighth corner trim element 900 can be angled with respect to fifth leg 910 of eighth corner trim element 900 at angles $\theta_1$'", $\theta_2$'" that can be similar or identical to the angles $\theta_1$, $\theta_2$ described with reference to first, second and fifth legs 602, 604, 610 above in second corner trim element 600. Additionally, similar to as discussed above with respect to angles $\theta_1$, $\theta_2$, angles $\theta_1$'", $\theta_2$'" can be equal or different from one another (for example, angle $\theta_1$'" can be less than or greater than angle $\theta_2$'").

Length $n_2$'" of third and fourth legs 906, 908 of eighth corner trim element 900 can be between approximately 5 mm and approximately 20 mm, for example, between approximately 6 mm and approximately 19 mm, between approximately 7 mm and approximately 18 mm, between approximately 8 mm and approximately 17 mm, between approximately 9 mm and approximately 16 mm, between approximately 10 mm and approximately 15 mm, between approximately 11 mm and approximately 14 mm, between approximately 12 mm and approximately 13 mm, or between approximately 8 mm and approximately 12 mm, or any value or range within or bounded by any of these ranges or values, although values outside these values or ranges can be used in some cases.

Length $n_3'''$ of planar sixth leg 912 of eighth corner trim element 900 can be between approximately 10 mm and approximately 30 mm, for example, between approximately 12 mm and approximately 28 mm, between approximately 14 mm and approximately 26 mm, between approximately 16 mm and approximately 24 mm, between approximately 18 mm and approximately 22 mm, or between approximately 16 mm and approximately 18 mm, or any value or range within or bounded by any of these ranges or values, although values outside these values or ranges can be used in some cases.

In some embodiments, ends of third and fourth legs 906 and/or 908 of eighth corner trim element 900 are chamfered and/or radiused as indicated by reference numeral 930. Such configurations can reduce interference between cladding elements 100, 100' and/or other building components that may come in proximity to the chamfered and/or radiused ends 930 of eighth corner trim element 900 during installation.

Similar to second corner trim element, eighth corner trim element 900 can comprise a cross-section that is symmetrical along axis 3, as illustrated in FIG. 12B.

First and third legs 902, 906 (for example, planes along surfaces of first and third legs 902, 906) of eighth corner trim element 900 can be spaced from one another by a distance $y_1'''$ which can be identical to the distance $y_1$ described above between first and third legs 602, 606 of second corner trim element 600. Similarly, second and fourth legs 904, 908 (for example, planes along surfaces of second and fourth legs 904, 908) of eighth corner trim element 900 can be spaced from one another by a distance $y_1'''$ which can be identical to the distance $y_1$ described above between second and fourth legs 604, 608 of second corner trim element 600.

Eighth corner trim element 900 can be secured to a building substrate (such as framing members 20, sheathing 30, and/or weather resistant barrier 40) and/or can receive ends/edges of cladding elements 100 in a similar or identical manner as that described with reference to eighth corner trim element 900 and as shown in FIG. 9C. Accordingly, the above description with reference to second corner trim element 600 and FIG. 9C is equally applicable to eighth corner trim element 900 and is therefore not repeated here for the sake of brevity.

Figure 13:
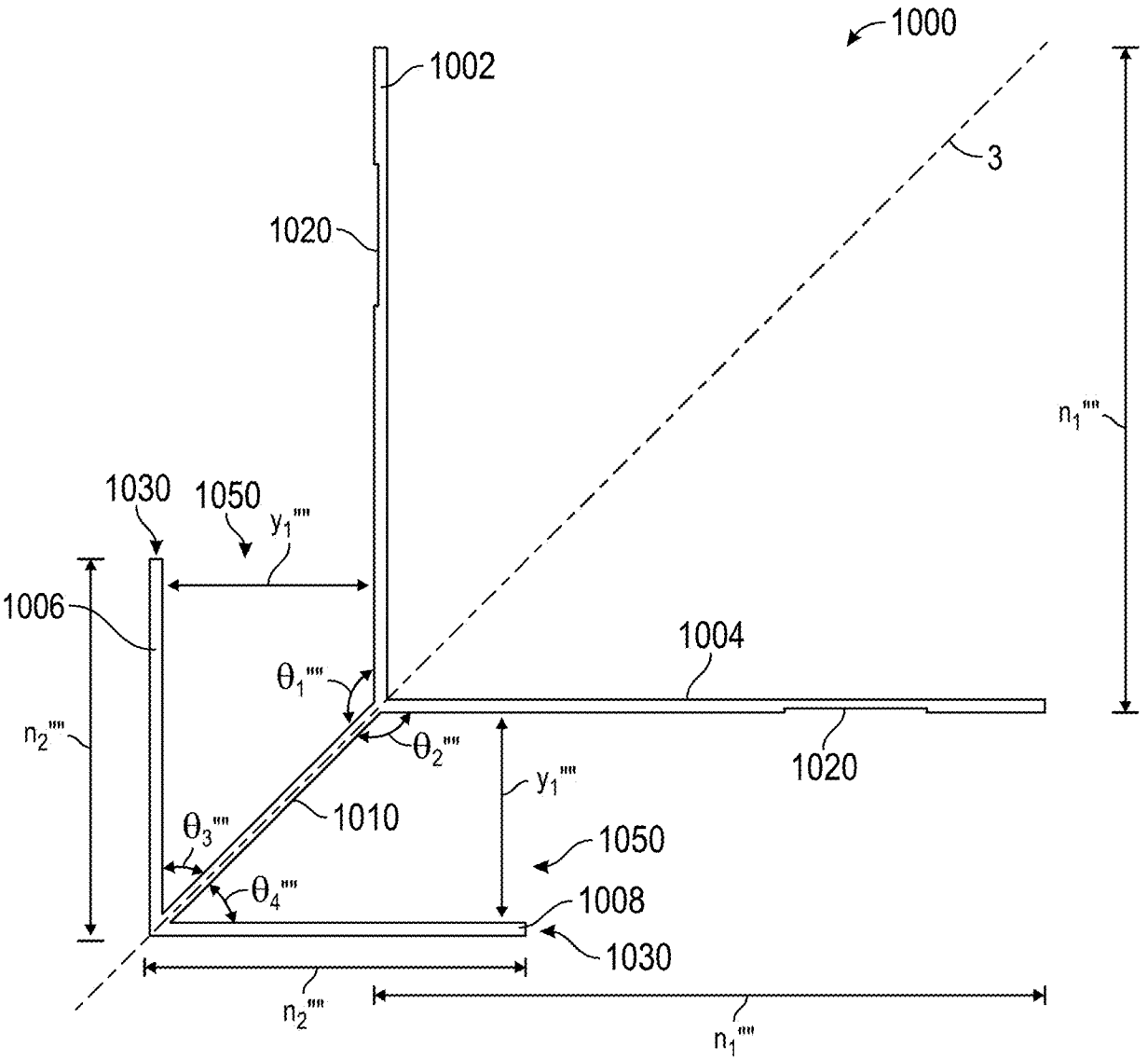
FIG. 13 illustrates another embodiment of a trim element in accordance with aspects of this disclosure.

FIG. 13 illustrates a ninth embodiment of a corner trim element 1000. Ninth corner trim element 1000 can be similar or identical to second, sixth, seventh, and eight corner trim elements 600, 700, 800, and/or 900 in some or many ways.

Ninth corner trim element 1000 can include a first leg 1002, second leg 1004, third leg 1006, fourth leg 1008, and a fifth leg 1010. As shown, the first and second legs 1002 and 1004 of ninth corner trim element 1000 can be transverse (e.g., perpendicular) to one another. Third and fourth legs 1006 and 1008 of ninth corner trim element 1000 can be transverse (e.g., perpendicular) to one another. As also shown, fifth leg 1010 of ninth corner trim element 1000 is angled with respect to one or more of first, second, third and fourth legs 1002, 1004, 1006, and/or 1008 of ninth corner trim element 1000. For example, fifth leg 1010 of ninth corner trim element 1000 can be angled with respect to the first leg 1002 of ninth corner trim element 1000 at an angle $\theta_1''''$ and/or fifth leg 1010 of ninth corner trim element 1000 can be angled with respect to the second leg 1004 of ninth corner trim element 1000 at an angle $\theta_2''''$. Angles $\theta_1''''$, $\theta_2''''$ can be similar or identical to the angles $\theta_1$, $\theta_2$ described with reference to first, second and fifth legs 602, 604, 610 above in second corner trim element 600. Additionally, similar to as discussed above with respect to angles $\theta_1$, $\theta_2$, angles $\theta_1''''$, $\theta_2''''$ can be equal or different from one another (for example, angle $\theta_1''''$ can be less than or greater than angle $\theta_2''''$). Similarly, the fifth leg 1010 of ninth corner trim element 1000 can be angled with respect to the third and fourth legs 1006, 1008 ninth corner trim element 1000 at angles $\theta_3''''$, $\theta_4''''$ that can be similar or identical to angles $\theta_3$, $\theta_4$ described with reference to third, fourth and fifth legs 606, 608, 610 above in second corner trim element 600. Additionally, similar to as discussed above with respect to angles $\theta_3$, $\theta_4$, angles $\theta_3''''$, $\theta_4''''$ can be equal or different from one another (for example, angle $\theta_3''''$ can be less than or greater than angle $\theta_4''''$).

Ninth corner trim element 1000 can include one or more or a plurality of recessed portions 1020 that can be identical to the recessed portions 620 described above with reference to second corner trim element 600. Accordingly, the above description with reference to second corner trim element 600 and recessed portions 620 is equally applicable to ninth corner trim element 1000 and is therefore not repeated here for the sake of brevity.

First, second, third, fourth and fifth legs 1002, 1004, 1006, 1008, and 1010 of ninth corner trim element 1000 define channels 1050 which can be sized and/or shaped to receive ends/edges of cladding elements 100 in a similar manner as that described above and illustrated with respect to second corner trim element 600. Additionally, similar to second corner trim element 600, ninth corner trim element 1000 can comprise a cross-section that is symmetrical along axis 3, as illustrated in FIG. 13. Ninth corner trim element 1000 can be secured to a building substrate (such as framing members 20, sheathing 30, and/or weather resistant barrier 40) and/or can receive ends/edges of cladding elements 100 in a similar or identical manner as that described with reference to second corner trim element 600 and as shown in FIG. 9C. Accordingly, the above description with reference to second corner trim element 600 and FIG. 9C is equally applicable to ninth corner trim element 1000 and is therefore not repeated here for the sake of brevity.

As shown in FIG. 13, first and second legs 1002, 1004 of ninth corner trim element 1000 can have lengths $n_1''''$ and third and fourth legs 1006, 1008 of ninth corner trim element 1000 can have lengths $n_2''''$. Third and fourth legs 1006 and 1008 of ninth corner trim element 1000 can be spaced from first and second legs 1002 and 1004 (respectively) of ninth corner trim element 1000 by a distance $y_1''''$.

First and third legs 1002, 1006 (for example, planes along surfaces of first and third legs 1002, 1006) of ninth corner trim element 1000 can be spaced from one another by a distance $y_1''''$ which can be identical to the distance $y_1$ described above between first and third legs 602, 606 of second corner trim element 600. Similarly, second and fourth legs 1004, 1008 (for example, planes along surfaces of second and fourth legs 1004, 1008) of ninth corner trim element 1000 can be spaced from one another by a distance $y_1''''$ which can be identical to the distance $y_1$ described above between second and fourth legs 604, 608 of second corner trim element 600.

Length $n_2''''$ of third and fourth leg 1006, 1008 of ninth corner trim element 1000 can be between approximately 0.1 inch and approximately 2 inch, for example, between approximately 0.2 inch and approximately 1.9 inch, between approximately 0.3 inch and approximately 1.8 inch, between approximately 0.4 inch and approximately 1.7 inch, between approximately 0.5 inch and approximately 1.6 inch, between approximately 0.6 inch and approximately 1.5 inch, between approximately 0.7 inch and approximately 1.4 inch, between approximately 0.8 inch and approximately 1.3 inch, between approximately 0.9 inch and approximately 1.2 inch, between approximately 1 inch and approximately 1.1 inch, or between approximately 0.7 inch and approximately 1 inch, or any value or range within or bounded by any of these ranges or values, although values outside these values or ranges can be used in some cases.

Distance $y_1$"" can be between approximately 0.1 inch and approximately 2 inch, for example, between approximately 0.1 inch and approximately 2 inch, between approximately 0.2 inch and approximately 1.9 inch, between approximately 0.3 inch and approximately 1.8 inch, between approximately 0.4 inch and approximately 1.7 inch, between approximately 0.5 inch and approximately 1.6 inch, between approximately 0.6 inch and approximately 1.5 inch, between approximately 0.7 inch and approximately 1.4 inch, between approximately 0.8 inch and approximately 1.3 inch, between approximately 0.9 inch and approximately 1.2 inch, between approximately 1 inch and approximately 1.1 inch, or between approximately 0.3 inch and approximately 0.5 inch, or any value or range within or bounded by any of these ranges or values, although values outside these values or ranges can be used inch some cases.

Length $n_1$"" can be between approximately 1 inch and approximately 3 inch, for example, between approximately 1.1 inch and approximately 2.9 inch, between approximately 1.2 inch and approximately 2.8 inch, between approximately 1.3 inch and approximately 2.7 inch, between approximately 1.4 inch and approximately 2.6 inch, between approximately 1.5 inch and approximately 2.5 inch, between approximately 1.6 inch and approximately 2.4 inch, between approximately 1.7 inch and approximately 2.3 inch, between approximately 1.8 inch and approximately 2.2 inch, between approximately 1.9 inch and approximately 2.1 inch, between approximately 1 inch and approximately 2 inch, between approximately 1.5 inch and approximately 2 inch, or between approximately 1.75 inch and approximately 2 inch, or any value or range within or bounded by any of these ranges or values, although values outside these values or ranges can be used inch some cases.

In some embodiments the length $n_1$"" of first leg 1002 and/or second leg 1004 of ninth corner trim element 1000 is greater than 1.5 inch. In some embodiments the length $n_1$"" of first leg 1002 and/or second leg 1004 of ninth corner trim element 1000 is at least 1.5 in, at least 1.6 inch, at least 1.7 inch, at least 1.8 inch, at least 1.9 inch, or at least 1.9 inch. Such configurations can advantageously allow the first and second legs 1002, 1004 of ninth corner trim element 1000 to have sufficient length to allow securement of the first and second legs 1002, 1004 in corner configurations where there is an insulation board or layer (e.g., foam) positioned in between the first and second legs 1002, 1004 and other components of the building substrate while at the same time allowing fasteners to extend through the first and second legs 1002, 1004 and into framing members.

While "free" ends 1030 of third and fourth legs 1006, 1008 of ninth corner trim element 1000 are illustrated are being planar, in some embodiments, such free ends of third and fourth legs 1006, 1008 of ninth corner trim element 1000 are radiused with a radius of curvature. Ends 1030 of ninth corner trim element 1000 can have a radius of curvature that is between approximately 0.01 inch and approximately 0.1 inch, for example, between approximately 0.02 inch and approximately 0.09 inch, between approximately 0.03 inch and approximately 0.08 inch, between approximately 0.04 inch and approximately 0.07 inch, between approximately 0.05 inch and approximately 0.06 inch, or between approximately 0.04 inch and approximately 0.06 inch, or any value or range within or bounded by any of these ranges or values, although values outside these values or ranges can be used in some cases. Such configurations can reduce interference between cladding elements 100, 100' and/or other building components that may come in proximity to the ends 1030 of ninth corner trim element 1000 during installation.

Flashing Elements

FIGS. 14A-17B illustrate various example embodiments of flashing elements or sections thereof. In each of the example embodiments, the flashing elements 1100, 1200, 1300, and 1400 can generally comprise a substantially uniform cross-section extending along a length k thereof. Although flashing element 1200 is only illustrated in cross-section (see FIG. 15), it is to be understood that such flashing element 1200 can also generally comprise a substantially uniform profile extending along a length thereof which may be similar to or identical to or greater than length k. The length k can be, for example, 1 ft, 2 ft, 4 ft, 6 ft, 8 ft, 10 ft, 12 ft, 14 ft, or 16 ft, or any value or range within or bounded by any of these ranges or values, although values outside these values or ranges can be used in some cases. The length k can be similar or identical to the length $L_1$ of the cladding elements 100 discussed above. Any of the components (for example, "arms") of the flashing elements 1100, 1200, 1300, and 1400 below can comprise thicknesses of, for example, between approximately 0.5 mm and approximately 5 mm, between approximately 1 mm and approximately 4 mm, between approximately 2 mm and approximately 3 mm, or between approximately 1 mm and approximately 2 mm, or any value or range within or bounded by any of these ranges or values, although values outside these values or ranges can be used in some cases.

Flashing elements 1100, 1200, 1300, and 1400 can be utilized at horizontal joints of a structure where adjacent cladding elements 100 meet. While FIG. 2 illustrates flashing elements 1100 and 1300 at horizontal joints in structure 10, any of the other flashing elements 1200 and/or 1400 can be utilized in a similar manner as that illustrated in FIG. 2 and/or as described with respect to flashing elements 1100 and/or 1300. Flashing elements 1100, 1200, 1300, and 1400 can advantageously provide waterproofing and/or drainage functionality along horizontal joints of the structure and also can provide alignment and/or positioning benefits as discussed further below.

Any or all of flashing elements 1100, 1200, 1300, and 1400 can include and/or be formed from a metallic material. For example, any or all of flashing elements 1100, 1200, 1300, and 1400 can include and/or be formed from aluminum.

Use of terms "first," "second," "third," "fourth," "fifth," "sixth," and "seventh" or similar terminology when describing "arms" of flashing elements 1100, 1200, 1300, and 1400 is not intended to be limiting nor is it intended to mean that the inclusion of any one of such numbered arms requires inclusion of any of the other numbered arms described with respect to flashing elements 1100, 1200, 1300, and 1400.

Figure 14A:
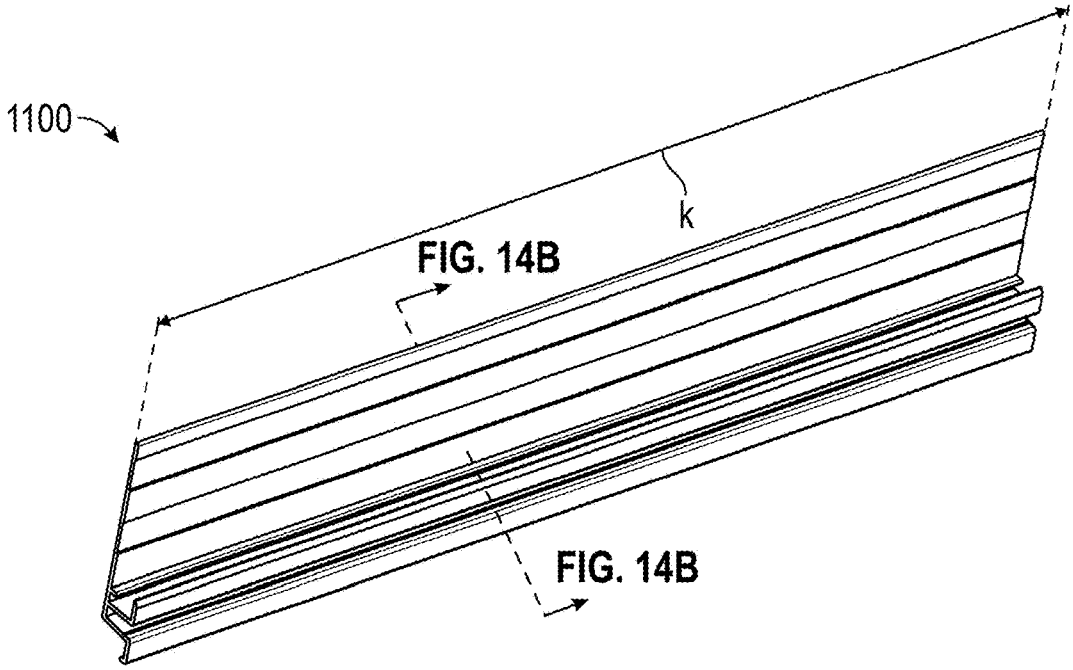
FIGS. 14A-14C illustrate an embodiment of a flashing element in accordance with aspects of this disclosure.
Figure 14B:
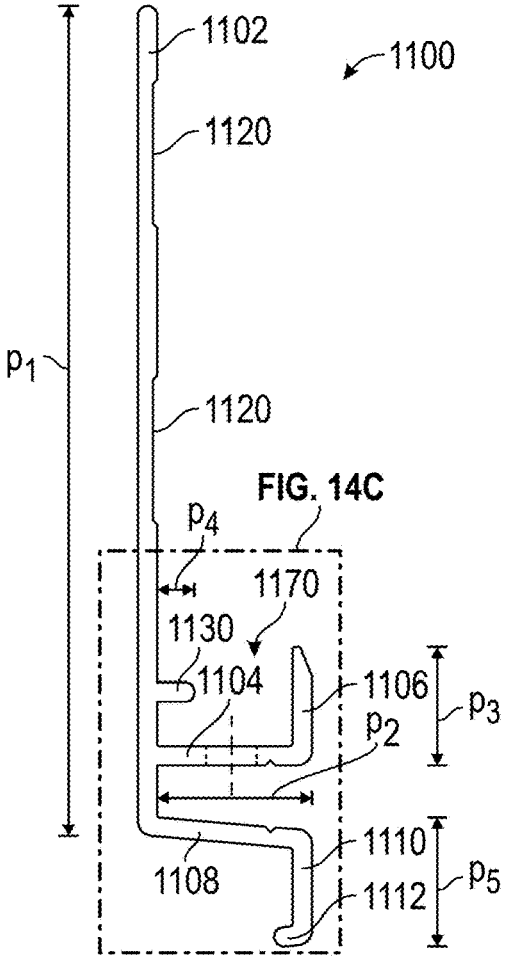
Figure 14C:
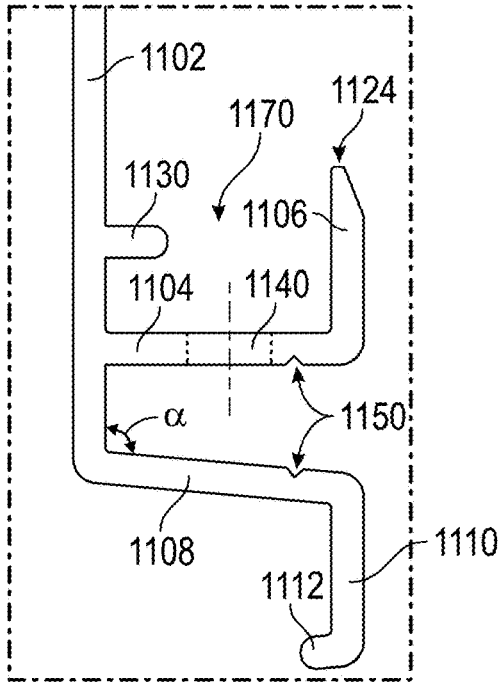
Figure 14D:
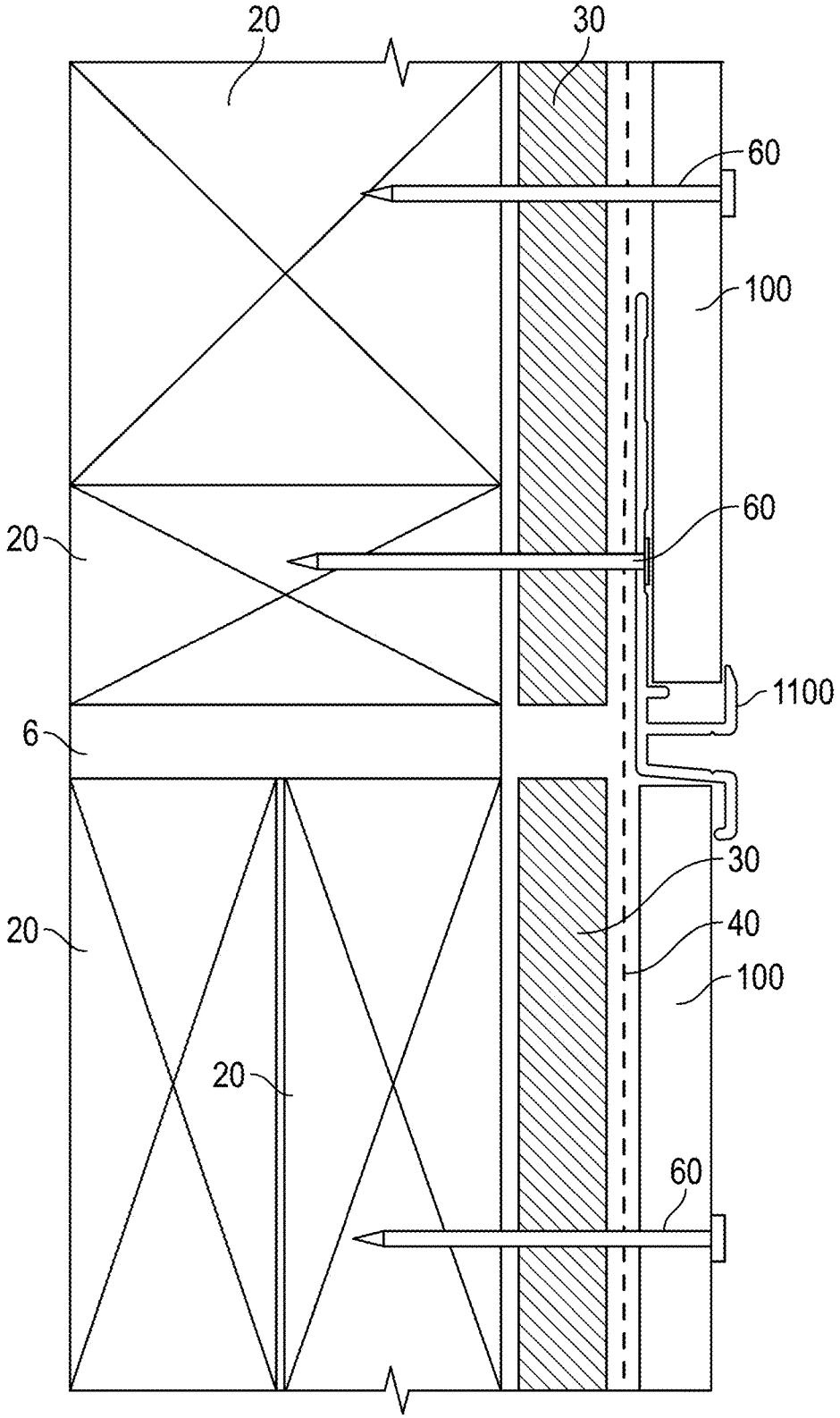
FIG. 14D illustrates an enlarged, cross-sectional view taken through a portion of the structure illustrated in FIG. 2 in accordance with aspects of this disclosure.

FIGS. 14A-14C illustrate an exemplary first flashing element 1100. FIG. 14D illustrates first flashing element 1100 secured to an exemplary building substrate as further described below. First flashing element 1100 can include a first arm 1102, a second arm 1104, a third arm 1106, a fourth arm 1108, a fifth arm 1110, and a sixth arm 1112. The second arm 1104 of first flashing element 1100 can extend outward from the first arm 1102 of first flashing element 1100 and can be transverse (e.g., perpendicular) to the first arm 1102 of first flashing element 1100. The third arm 1106 of first flashing element 1100 can extend from the second arm 1104 of first flashing element 1100 and can be transverse (e.g., perpendicular) to the second arm 1104 of first flashing element 1100. In some embodiments, the third arm 1106 of first flashing element 1100 is parallel to the first arm 1102 of first flashing element 1100. As shown, first flashing element 1100 includes an optional seventh arm 1130 that extends from the first arm 1102. Seventh arm 1130 of first flashing element 1100 can be spaced from the second arm 1104 of first flashing element 1100. Seventh arm 1130 of first flashing element 1100 can be transverse (e.g. perpendicular) to the first arm 1102 of first flashing element 1100 and/or parallel to second arm 1104 of first flashing element 1100. Seventh arm 1130 of first flashing element 1100 can extend from first arm 1102 of first flashing element 1100 in a direction towards third arm 1106 of first flashing element 1100. Seventh arm 1130 of first flashing element 1100 can be shorter than second arm 1104 of first flashing element 1100. As shown, first and third arms 1102 and 1106 of first flashing element 1100 can be spaced from one another such that channel 1170 is at least partially defined by the first, second and third arms 1102, 1104, 1106 of first flashing element 1100. Such channel 1170 of first flashing element 1100 can be sized and/or shaped to receive portions of the cladding elements 100 as discussed further below. As discussed further below, seventh arm 1130 of first flashing element 1100 advantageously provides a surface or platform that can at least partially support and/or align bottom edges of cladding elements 100 that are placed within at least a portion of channel 1170.

The fourth arm 1108 can extend outward from the first arm 1102 and can be transverse (e.g., perpendicular) to the first arm 1102 of first flashing element 1100. As illustrated in FIG. 14C, the fourth arm 1108 of first flashing element 1100 can be angled with respect to the first arm 1102 at an angle $\alpha$ which can be between approximately 90° and approximately 110°, for example, between approximately 90° and approximately 105°, between approximately 90° and approximately 100°, or between approximately 90° and approximately 95°, or any value or range within or bounded by any of these ranges or values, although values outside these values or ranges can be used in some cases. In one embodiment, angle $\alpha$ is approximately 95°. In such embodiment, fourth arm 1108 of first flashing element 1100 can be referred to as being "sloped" (e.g., angled relative to a horizontal axis/line) at 5°.

Fifth arm 1110 of first flashing element 1100 can extend from the fourth arm 1108 and can be transverse (e.g., perpendicular) with respect to fourth arm 1108 of first flashing element 1100. Sixth arm 1112 of first flashing element 1100 can extend from fifth arm 1110 and can be transverse (e.g., perpendicular) with respect to fifth arm 1110 of first flashing element 1100. In some embodiments, when the first flashing element 1100 is secured to a building substrate as described further below, the sixth arm 1112 extends in a direction toward the building substrate.

With reference to FIG. 14C, in some embodiments, a free end 1124 of third arm 1106 of first flashing element 1100 is chamfered and/or radiused. Such configurations can reduce interference between cladding elements 100 and/or other building components that may come in proximity to the end 1124 during installation.

As shown in FIG. 14B, first arm 1102 of first flashing element 1100 can have a length $p_1$, second arm 1104 of first flashing element 1100 can have a length $p_2$, third arm 1106 of first flashing element 1100 can have a length $p_3$, seventh arm 1130 of first flashing element 1100 can have a length $p_4$, and fifth arm 1110 of first flashing element 1100 can have a length $p_5$. Length $p_1$ can be greater than length $p_2$, $p_3$, $p_4$, and/or $p_5$. Length $p_4$ can be smaller than length $p_1$, $p_2$, $p_3$, and/or $p_5$. Length $p_5$ can be shorter than length $p_1$ and/or length $p_5$ can be equal to, greater than, or less than length $p_3$.

Length $p_1$ can be between approximately 1 inch and approximately 3 inch, for example, between approximately 1.1 inch and approximately 2.9 inch, between approximately 1.2 inch and approximately 2.8 inch, between approximately 1.3 inch and approximately 2.7 inch, between approximately 1.4 inch and approximately 2.6 inch, between approximately 1.5 inch and approximately 2.5 inch, between approximately 1.6 inch and approximately 2.4 inch, between approximately 1.7 inch and approximately 2.3 inch, between approximately 1.8 inch and approximately 2.2 inch, between approximately 1.9 inch and approximately 2.1 inch, between approximately 1 inch and approximately 2 inch, between approximately 1.5 inch and approximately 2 inch, or between approximately 2 inch and approximately 2.5 inch, or any value or range within or bounded by any of these ranges or values, although values outside these values or ranges can be used inch some cases.

Length $p_2$ can be between approximately 0.1 inch and approximately 2 inch, for example, between approximately 0.2 inch and approximately 1.9 inch, between approximately 0.3 inch and approximately 1.8 inch, between approximately 0.4 inch and approximately 1.7 inch, between approximately 0.5 inch and approximately 1.6 inch, between approximately 0.6 inch and approximately 1.5 inch, between approximately 0.7 inch and approximately 1.4 inch, between approximately 0.8 inch and approximately 1.3 inch, between approximately 0.9 inch and approximately 1.2 inch, between approximately 1 inch and approximately 1.1 inch, or between approximately 0.3 inch and approximately 0.5 inch, or any value or range within or bounded by any of these ranges or values, although values outside these values or ranges can be used inch some cases.

Length $p_3$ can be between approximately 0.1 inch and approximately 2 inch, for example, between approximately 0.2 inch and approximately 1.9 inch, between approximately 0.3 inch and approximately 1.8 inch, between approximately 0.4 inch and approximately 1.7 inch, between approximately 0.5 inch and approximately 1.6 inch, between approximately 0.6 inch and approximately 1.5 inch, between approximately 0.7 inch and approximately 1.4 inch, between approximately 0.8 inch and approximately 1.3 inch, between approximately 0.9 inch and approximately 1.2 inch, between approximately 1 inch and approximately 1.1 inch, or between approximately 0.2 inch and approximately 0.4 inch, or any value or range within or bounded by any of these ranges or values, although values outside these values or ranges can be used inch some cases.

Length $p_4$ can be between approximately 0.05 inch and approximately 1 inch, for example, between approximately 0.06 inch and approximately 0.9 inch, between approximately 0.07 inch and approximately 0.8 inch, between approximately 0.08 inch and approximately 0.7 inch, between approximately 0.09 inch and approximately 0.6 inch, between approximately 0.1 inch and approximately 0.5 inch, between approximately 0.2 inch and approximately 0.4 inch, or between approximately 0.09 inch and approximately 0.2 inch, or any value or range within or bounded by any of these ranges or values, although values outside these values or ranges can be used inch some cases.

Length $p_5$ can be between approximately 0.1 inch and approximately 2 inch, for example, between approximately 0.2 inch and approximately 1.9 inch, between approximately 0.3 inch and approximately 1.8 inch, between approximately 0.4 inch and approximately 1.7 inch, between approximately 0.5 inch and approximately 1.6 inch, between approximately 0.6 inch and approximately 1.5 inch, between approximately 0.7 inch and approximately 1.4 inch, between approximately 0.8 inch and approximately 1.3 inch, between approximately 0.9 inch and approximately 1.2 inch, between approximately 1 inch and approximately 1.1 inch, or between approximately 0.2 inch and approximately 0.4 inch, or any value or range within or bounded by any of these ranges or values, although values outside these values or ranges can be used inch some cases.

First flashing element 1100 can be secured to a building substrate via securement of the first arm 1102 to the building substrate. As shown in FIG. 14B, first flashing element 1100 can include one or more or a plurality of recessed portions, such as recessed portions 1120. Such recessed portions 1120 of first flashing element 1100 can be recessed from a surface of the first arm 1102 of first flashing element 1100, for example, as illustrated, and such recessed portions 1120 can have a thickness that is smaller than remainder thicknesses of the arm 1102. The recessed portions 1120 can advantageously provide an indication for where fasteners (such as fasteners 60) should be aligned when forced through the first arm 1102 and into a building substrate. The recessed portions 1120 of first flashing element 1100 can also provide a spaced for fastener heads to "seat" so that the fastener heads are at (e.g., "flush") or below surfaces of the first arm 1102 in order to minimize interference with surfaces of the cladding elements 100 when positioned within the channel 1170 of first flashing element 1100. First arm 1102 of first flashing element 1100 can include one or more or a plurality of recessed portions 1120, such as one, two, three, four, five, or six or more recessed portions 1120 of first flashing element 1100. Such recessed portions 1120 can extend continuously along the length k of the first flashing element 1100 or can extend non-continuously along the length k of the first flashing element 1100. The recessed portions 1120 of first flashing element 1100 can be spaced from one another along the length $p_1$ of the first arm 1102 at a spacing that is between approximately 5 mm and 30 mm. For example, the recessed portions 1120 of first flashing element 1100 can be spaced from one another along the length $p_1$ of the first arm 1102 at a spacing that is between approximately 10 mm and approximately 25 mm, between approximately 15 mm and approximately 20 mm, or between approximately 10 mm and approximately 20 mm, or any value or range within or bounded by any of these ranges or values, although values outside these values or ranges can be used in some cases.

The recessed portions 1120 of first flashing element 1100 can have a length (or "height") extending along the length $p_1$ of the first arm 1102 that is between approximately 5 mm and 20 mm, for example, between approximately 6 mm and 19 mm, between approximately 7 mm and 18 mm, between approximately 8 mm and 17 mm, between approximately 9 mm and 16 mm, between approximately 10 mm and 15 mm, between approximately 11 mm and 14 mm, or between approximately 12 mm and 13 mm, or between approximately 8 mm and approximately 12 mm, or any value or range within or bounded by any of these ranges or values, although values outside these values or ranges can be used in some cases.

FIG. 14D illustrates an exemplary cross-section through a portion of structure 10 (as indicated in FIG. 2), and in particular, illustrates how first flashing element 1100 can be secured to structure 10 along with cladding elements 100 and/or other building components. As shown, first flashing element 1100 can be secured to the framing members 20, sheathing 30, and/or weather resistant barrier 40, for example, via fasteners 60. Also shown in FIG. 14D is flooring 6 which may be present at or near the horizontal joint where first flashing element 1100 is utilized. FIG. 14D illustrates two fasteners 60 extending through the cladding elements 100, the weather resistant barrier 40, sheathing, and framing members 20 and also illustrates one fastener 60 extending only through the first flashing element 1100, the weather resistant barrier 40, sheathing, and framing members 20. This latter fastener 60 can extend through the recessed portion 1120, for example, as discussed above. Additionally, portions of ends or edges (such as top and/or bottom ends/edges) of the cladding elements 100 can be positioned within the channels 1170 formed by the first flashing element 1100. In such configurations, the first flashing element 1100 "hides" and/or "covers" such ends/edges of the cladding elements 100 which can advantageously provide a desirable aesthetic appearance. Such configuration can also ensure that drainage flowing along front faces 102 of the cladding elements 100 flows into the channel 1170 as discussed further below. As discussed above, first flashing element 1100 can include seventh arm 1130 which can extend from first arm 1102 across a portion of the channel 1170. Such seventh arm 1130 can advantageously provide a temporary support and/or alignment surface for bottom edges of the cladding elements 100 which can significantly improve efficiency of securing the cladding elements 100 to the building substrate.

When first flashing element 1100 is installed in a configuration like that illustrated in FIG. 14D along with cladding elements 100, drainage from surfaces of the top cladding element 100 can flow (e.g., downward) into the channel 1170. Advantageously, first flashing element 1100 can facilitate flow of such drainage to the bottom cladding element 100. With reference to FIGS. 14B-14D, first flashing element 1100 can include one or more or a plurality of openings 1140 in the second arm 1104 and extending along the length k of the first flashing element 1100. Such openings 1140 can be spaced apart along such length k on the second arm 1104 of first flashing element 1100. The first flashing element 1100 can include a given number of openings 1140 per length k of the first flashing element 1100. For example, the flashing element 1100 can include one, two, three, four, five, or six openings 1140 per linear foot of length of the first flashing element 1100. As another example, the first flashing element 1100 can include openings 1140 spaced at 1 inch, 2 inch, 3 inch, 4 inch, 5 inch, 6 inch, 7 inch, 8 inch, 9 inch, 10 inch, 11 inch, or 12 inch on center, or any value or range within or bounded by any of these ranges or values, although values outside these values or ranges can be used in some cases. The openings 1140 of first flashing element 1100 can have a length (extending along a portion the length k of the first flashing element 1100 of between approximately 0.5 inch and approximately 3 inch, between approximately 1 inch and approximately 2.5 inch, between approximately 1.5 inch and approximately 2 inch, between approximately 0.5 inch and approximately 3 inch, or between approximately 0.5 inch and approximately 3 inch, or any value or range within or bounded by any of these ranges or values, although values outside these values or ranges can be used in some cases. The openings 1140 of first flashing element 1100 can have a square, rectangular, circular, or oblong shape, among others, for example, when viewed from above. Openings 1140 of first flashing element 1100 allow for drainage to flow out of the channel 1170 onto the fourth arm 1108 of first flashing element 1100.

Fourth arm 1108 of first flashing element 1100 can be sloped to facilitate flow of such drainage along the fourth arm 1108 and onto fifth arm 1110, and in turn, to the front surface of the bottom cladding element 100 shown in FIG. 14D. As discussed above, fourth arm 1108 can be angled at an angle $\alpha$ relative to the first arm 1102 of first flashing element 1100. Described another way, fourth arm 1108 of first flashing element 1100 can be sloped relative to a horizontal plane at an angle of between approximately 1° and approximately 20°, such as between approximately 2° and approximately 19°, between approximately 3° and approximately 18°, between approximately 4° and approximately 17°, between approximately 5° and approximately 16°, between approximately 6° and approximately 15°, between approximately 7° and approximately 14°, between approximately 8° and approximately 13°, between approximately 9° and approximately 12°, between approximately 10° and approximately 11°, or between approximately 4° and approximately 6°, or any value or range within or bounded by any of these ranges or values, although values outside these values or ranges can be used in some cases. Accordingly, the flashing element 110 can provide an efficient drainage flow path while at the same time providing the support, alignment, and/or aesthetic benefits described above.

With reference to FIG. 14C, in some embodiments, the first flashing element 1100 includes notches 1150 along surfaces of second arm 1104 and/or fourth arm 1108 of first flashing element 1100. Such notches 1150 can extend along the second arm 1104 and/or fourth arm 1108 continuously or non-continuously along the length k of the first flashing element 1100. Such notches 1150 of first flashing element 1100 can have a V-shape as illustrated in FIG. 14C, among other shapes. Such notches 1150 can allow plates, such as covering plates, to at least partially secure in between the second and fourth arms 1104, 1108 and cover and/or hide portions of a channel defined between the second and fourth arms 1104, 1108, and/or first arm 1102 along length k of the first flashing element 1100.

Use of the term "length" with respect to lengths $p_1$, $p_2$, $p_3$, $p_4$, $p_5$ of first flashing element 1100 is not intended to be limiting, and the lengths $p_1$, $p_2$, $p_3$, $p_4$, $p_5$ can also be referred to as "heights" or "widths" based on the orientation of the cross-section view of FIG. 14B.

Figure 15:
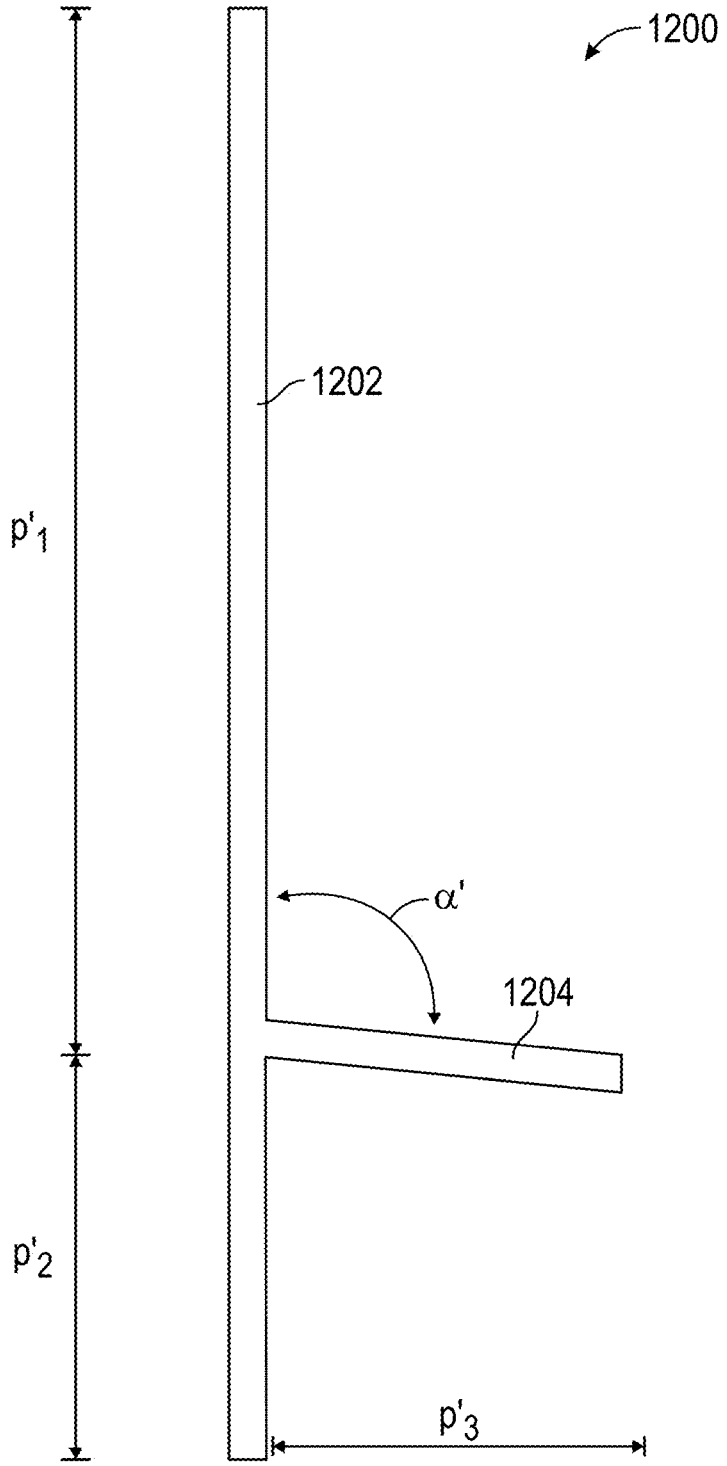
FIG. 15 illustrates another embodiment of a flashing element in accordance with aspects of this disclosure.

FIG. 15 illustrates a third embodiment of a flashing element 1200. Third flashing element 1200 can be utilized in a similar manner as shown and described with respect to first flashing element 1100 and FIG. 14D. For example, third flashing element 1200 can be utilized at a horizontal joint of structure 10 between vertically adjacent cladding elements 100.

Third flashing element 1200 can include a first arm 1202 and a second arm 1204 that can extend from the first arm 1202 of third flashing element 1200. Second arm 1204 of third flashing element 1200 can be angled with respect to first arm 1202 of third flashing element 1200 at an angle $\alpha'$ between approximately 90° and approximately 110°, for example, between approximately 90° and approximately 105°, between approximately 90° and approximately 100°, or between approximately 90° and approximately 95°, or any value or range within or bounded by any of these ranges or values, although values outside these values or ranges can be used in some cases. In one embodiment, angle $\alpha'$ is approximately 95°.

First arm 1202 of third flashing element 1200 can have a length that is defined by two portions, $p_1'$ and $p_2'$, which can represent lengths of first arm 1202 of third flashing element 1200 partitioned by a point or region where second arm 1204 of third flashing element 1200 connects to first arm 1202 of third flashing element 1200. Second arm 1204 of third flashing element 1200 can have a length $p_3'$. Length $p_1'$ can be greater than length $p_2'$ and/or length $p_3'$. Length $p_2'$ can be greater than, equal to, or less than length $p_3'$.

Length $p_1'$ can be between approximately 1 inch and approximately 2 inch, for example, between approximately 1.1 inch and approximately 1.9 inch, between approximately 1.2 inch and approximately 1.8 inch, between approximately 1.3 inch and approximately 1.7 inch, between approximately 1.4 inch and approximately 1.6 inch, or between approximately 1.2 inch and approximately 1.3 inch, or any value or range within or bounded by any of these ranges or values, although values outside these values or ranges can be used inch some cases.

Length $p_2'$ can be between approximately 0.1 inch and approximately 1 inch, for example, between approximately 0.2 inch and approximately 0.9 inch, between approximately 0.3 inch and approximately 0.8 inch, between approximately 0.4 inch and approximately 0.7 inch, between approximately 0.5 inch and approximately 0.6 inch, or between approximately 0.4 inch and approximately 0.6 inch, or any value or range within or bounded by any of these ranges or values, although values outside these values or ranges can be used inch some cases.

Length $p_3'$ can be between approximately 0.1 inch and approximately 1 inch, for example, between approximately 0.2 inch and approximately 0.9 inch, between approximately 0.3 inch and approximately 0.8 inch, between approximately 0.4 inch and approximately 0.7 inch, between approximately 0.5 inch and approximately 0.6 inch, or between approximately 0.3 inch and approximately 0.5 inch, or any value or range within or bounded by any of these ranges or values, although values outside these values or ranges can be used inch some cases.

Third flashing element 1200 can be secured to a building structure in a similar manner as that described above with respect to first flashing element 1100. For example, third flashing element 1200 can be secured to the framing members 20, sheathing 30, and/or weather resistant barrier 40, via fasteners 60 which can extend through the first arm 1202 of the flashing element 1200. When secured to the building substrate, a bottom edge of a first (e.g., top) cladding element 100 can be positioned above and/or can contact or rest upon the second arm 1204 and a top edge of a second (e.g., bottom) cladding element 100 can be positioned below and/or can contact the underside of second arm 1204 of third flashing element 1200, wherein the underside of the second arm 1204 is the opposing side of second arm 1204 to that which a first cladding element 100 rests upon. When second arm 1204 of third flashing element 1200 is "sloped" at an angle, drainage flowing downward from the first cladding element 100 can flow onto second arm 1204 and downward onto a front face 102 of the second cladding element 100.

Figure 16A:
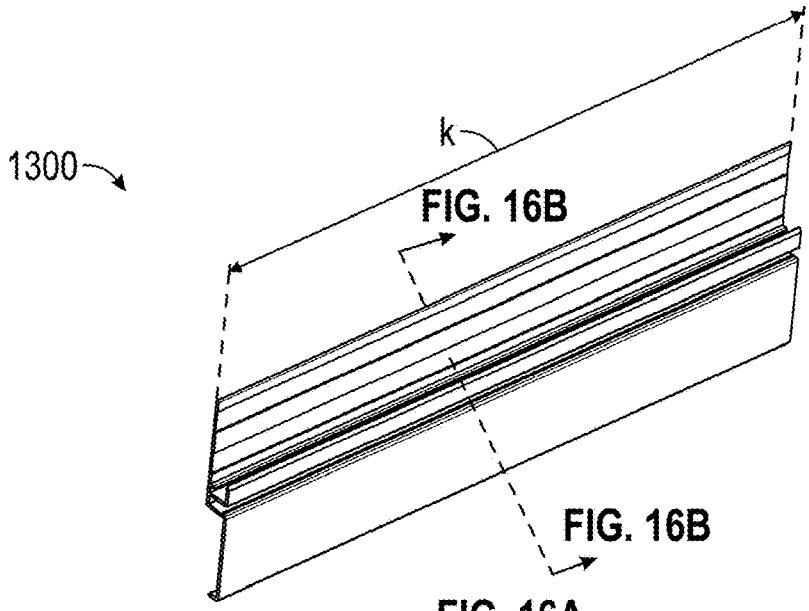
FIGS. 16A-16C illustrate another embodiment of a flashing element in accordance with aspects of this disclosure.
Figure 16B:
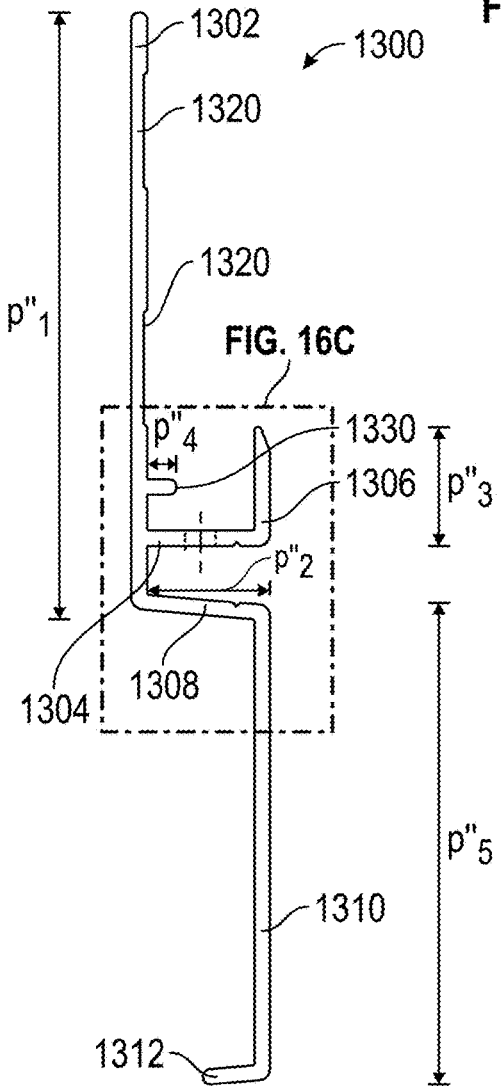
Figure 16C:
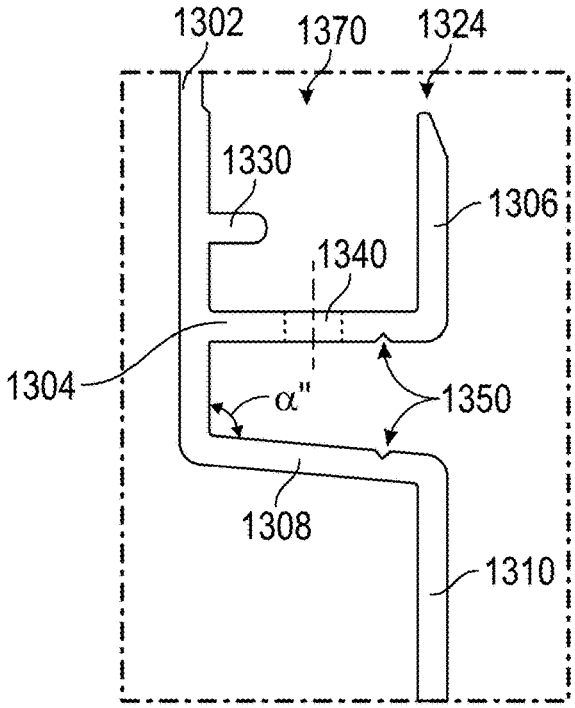

FIGS. 16A-16C illustrate a second embodiment of a flashing element 1300. Second flashing element 1300 can be similar or identical to first flashing element 1100 in some or many ways. For example, as indicated by the similar reference numerals, second flashing element 1300 can include first, second, third, fourth and seventh arms 1302, 1304, 1306, 1308, 1330, channel 1370, opening(s) 1340, recessed portions 1320, ends 1324, angle α", and/or notches 1350 which can be identical to first, second, third, fourth and seventh arms 1102, 1104, 1106, 1108, 1130, channel 1170, opening(s) 1140, recessed portions 1120, ends 1124, angle α, and/or notches 1150 of first flashing element 1100 (respectively). Accordingly, the above description with reference to these components of first flashing element 1100 is equally applicable to the corresponding components of second flashing element 1300 and is therefore not repeated here for the sake of brevity.

Length $p_1$" of first arm 1302, length $p_2$" of second arm 1304, length $p_3$" of third arm 1306, and length $p_4$" of seventh arm 1330 of second flashing element 1300 can be identical to that described above with respect to length $p_1$ of first arm 1102, length $p_2$ of second arm 1104, length $p_3$ of third arm 1106, and length $p_4$ of seventh arm 1130 of first flashing element 1100 (respectively).

Second flashing element 1300 is substantially identical to first flashing element 1100 except with respect to length $p_5$" of fifth arm 1310 which can be greater than length $p_5$ of fifth arm 1110 of first flashing element 1100 and/or with respect to a length of sixth arm 1312 which can be greater than a length of sixth arm 1112 of first flashing element 1100. Length $p_5$" of second flashing element 1300 can be between approximately 1 inch and approximately 3 inch, for example, between approximately 1.1 inch and approximately 2.9 inch, between approximately 1.2 inch and approximately 2.8 inch, between approximately 1.3 inch and approximately 2.7 inch, between approximately 1.4 inch and approximately 2.6 inch, between approximately 1.5 inch and approximately 2.5 inch, between approximately 1.6 inch and approximately 2.4 inch, between approximately 1.7 inch and approximately 2.3 inch, between approximately 1.8 inch and approximately 2.2 inch, between approximately 1.9 inch and approximately 2.1 inch, or between approximately 1.5 inch and approximately 1.7 inch, or any value or range within or bounded by any of these ranges or values, although values outside these values or ranges can be used inch some cases.

As illustrated in FIG. 2, second flashing element 1300 can advantageously be utilized along a bottom of structure 10 along an interface between the cladding elements 100 and the foundation 8 of the structure. With reference to FIGS. 2 and 16A-16B, fifth arm 1310 can extend over such interface and ensure that drainage flowing from the cladding elements 100, through the channel 1370, and over arm 1308 can be directed to the ground.

Figure 17A:
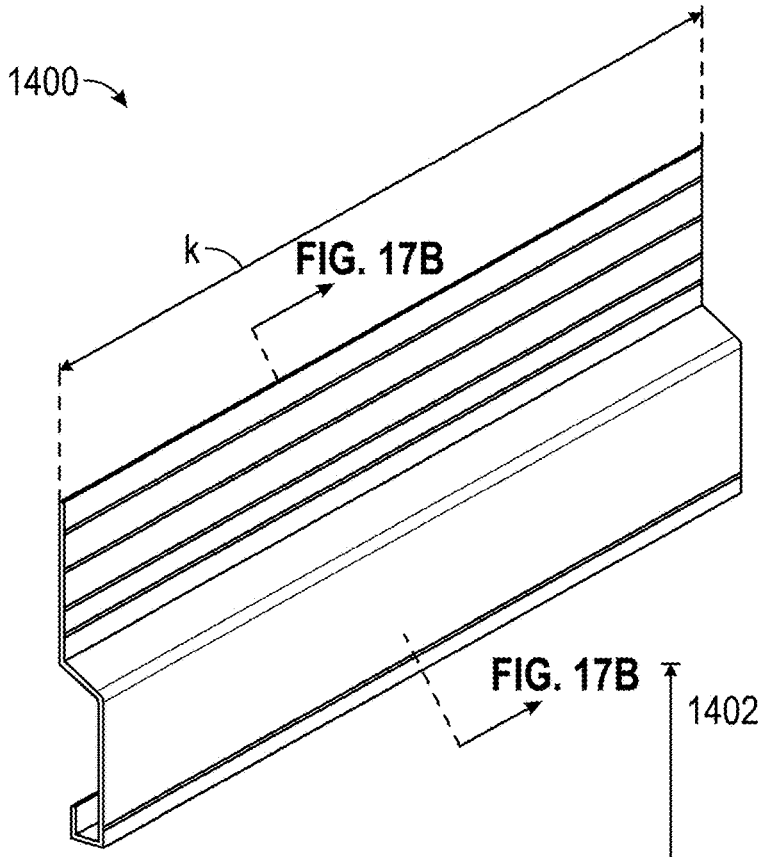
FIGS. 17A-17B illustrate another embodiment of a flashing element in accordance with aspects of this disclosure.
Figure 17B:
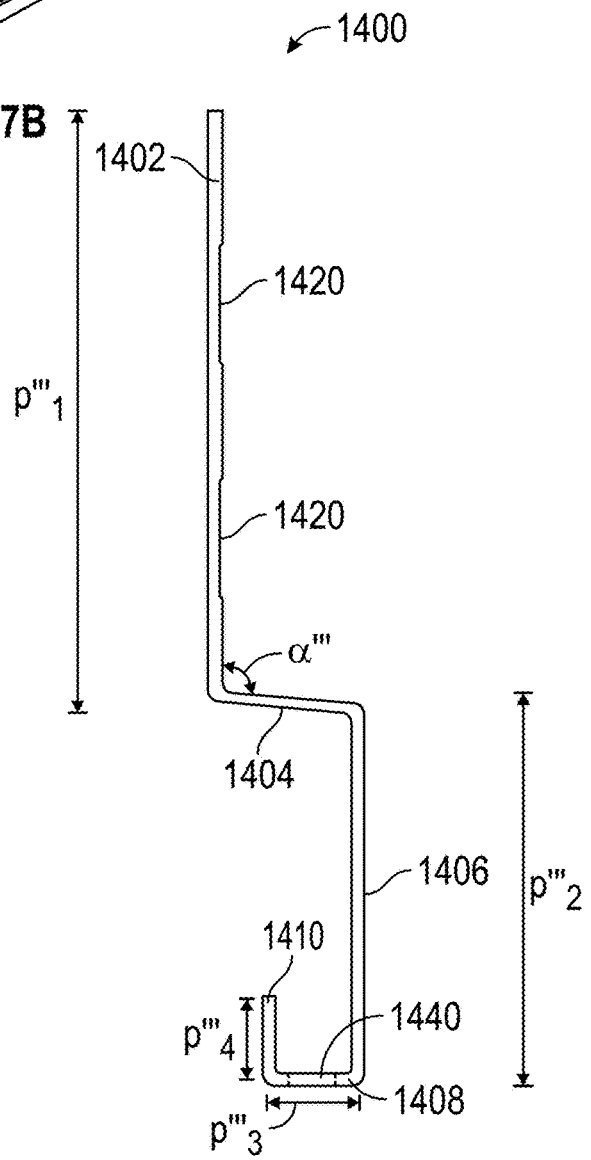

FIGS. 17A-17B illustrate a fourth embodiment of a flashing element 1400. Fourth flashing element 1400 can be similar to flashing elements 1100 and/or 1300 in some or many ways. Fourth flashing element 1400 can be utilized in a manner similar to that described with reference to second flashing element 1300 above, for example, at an interface of the structure 10 between cladding elements 100 and foundation 8.

Fourth flashing element 1400 includes a first arm 1402, second arm 1404, third arm 1406, fourth arm 1408, and a fifth arm 1410. Second arm 1404 can extend outward from first arm 1402 of fourth flashing element 1400 and can be angled with respect to first arm 1402 of fourth flashing element 1400 at an angle α''' that can be similar or identical to the angle α between arms 1102 and 1108 of first flashing element 1100 described above. First arm 1402 of fourth flashing element 1400 can include one or more or a plurality of recessed portions 1420 that can be similar or identical to the recessed portions 1120 described above with reference to first arm 1102 of first flashing element 1100.

Third arm 1406 of fourth flashing element 1400 can extend from second arm 1404 of fourth flashing element 1400 and can be parallel to first arm 1402 of fourth flashing element 1400 in some embodiments. Fourth arm 1408 of fourth flashing element 1400 can extend from and be transverse (e.g., perpendicular) to third arm 1406 of fourth flashing element 1400. Fifth arm 1410 of fourth flashing element 1400 can extend from and be transverse (e.g., perpendicular) to fourth arm 1408 of fourth flashing element 1400. In some embodiments, fifth arm 1410 of fourth flashing element 1400 extends in a direction at least partially toward the first arm 1402 and/or second arm 1404 (see FIG. 17B).

Fourth flashing element 1400 can be secured to a building structure in a similar manner as that described above with respect to first flashing element 1100. For example, fourth flashing element 1400 can be secured to the framing members 20, sheathing 30, and/or weather resistant barrier 40, via fasteners 60 which can extend through the first arm 1402 of the flashing element 1400 (for example, through recessed portions 1420 of arm 1402). When fourth flashing element 1400 is utilized in a similar manner as second flashing element 1300 as described above (e.g., at a foundation 8 of a structure 10), bottom edges of cladding elements 100 can contact and/or rest upon or above second arm 1404 of fourth flashing element 1400. Drainage flowing along surfaces of such cladding elements 100 can flow onto second arm 1404 of fourth flashing element 1400 which can be angled as described above to direct the drainage to third arm 1406 and/or to the ground.

Length $p_1$''' of first arm 1402 of fourth flashing element 1400 can be between approximately 1 inch and approximately 6 inch, for example, between approximately 1.5 inch and approximately 5.5 inch, between approximately 2 inch and approximately 5 inch, between approximately 2.5 inch and approximately 4.5 inch, between approximately 3 inch and approximately 4 inch, or between approximately 2.5 inch and approximately 3.5 inch, or any value or range within or bounded by any of these ranges or values, although values outside these values or ranges can be used inch some cases.

Length $p_2$''' of third arm 1406 of fourth flashing element 1400 can be between approximately 1 inch and approximately 3 inch, for example, between approximately 1.1 inch and approximately 2.9 inch, between approximately 1.2 inch and approximately 2.8 inch, between approximately 1.3 inch and approximately 2.7 inch, between approximately 1.4 inch and approximately 2.6 inch, between approximately 1.5 inch and approximately 2.5 inch, between approximately 1.6 inch and approximately 2.4 inch, between approximately 1.7 inch and approximately 2.3 inch, between approximately 1.8 inch and approximately 2.2 inch, between approximately 1.9 inch and approximately 2.1 inch, between approximately 1 inch and approximately 2 inch, between approximately 1.5 inch and approximately 2 inch, or between approximately 2 inch and approximately 2.5 inch, or any value or range within or bounded by any of these ranges or values, although values outside these values or ranges can be used inch some cases.

Length $p_3$''' of fourth arm 1408 of fourth flashing element 1400 can be between approximately 0.1 inch and approximately 2 inch, for example, between approximately 0.2 inch and approximately 1.9 inch, between approximately 0.3 inch and approximately 1.8 inch, between approximately 0.4 inch and approximately 1.7 inch, between approximately 0.5 inch and approximately 1.6 inch, between approximately 0.6 inch and approximately 1.5 inch, between approximately 0.7 inch and approximately 1.4 inch, between approximately 0.8 inch and approximately 1.3 inch, between approximately 0.9 inch and approximately 1.2 inch, between approximately 1 inch and approximately 1.1 inch, between approximately 0.2 inch and approximately 0.4 inch, or between approximately 0.4 inch and approximately 0.6 inch, or any value or range within or bounded by any of these ranges or values, although values outside these values or ranges can be used inch some cases.

Length $p_4'''$ of fifth arm 1410 of fourth flashing element 1400 can be between approximately 0.1 inch and approximately 2 inch, for example, between approximately 0.2 inch and approximately 1.9 inch, between approximately 0.3 inch and approximately 1.8 inch, between approximately 0.4 inch and approximately 1.7 inch, between approximately 0.5 inch and approximately 1.6 inch, between approximately 0.6 inch and approximately 1.5 inch, between approximately 0.7 inch and approximately 1.4 inch, between approximately 0.8 inch and approximately 1.3 inch, between approximately 0.9 inch and approximately 1.2 inch, between approximately 1 inch and approximately 1.1 inch, between approximately 0.2 inch and approximately 0.4 inch, or between approximately 0.4 inch and approximately 0.6 inch, or any value or range within or bounded by any of these ranges or values, although values outside these values or ranges can be used inch some cases.

With reference to FIG. 17B, in some embodiments flashing element 1400 includes one or more or a plurality of openings 1440 in the arm 1408 and extending along the length k of the flashing element 1400. Such openings 1440 can be similar or identical to openings 1140 of first flashing element 1100. Additionally, the number, positioning, and/or spacing of such openings 1440 can be identical to that described above with reference to flashing element 1100 and openings 1140.

Example Cladding System Installation Methods

A number of different methods can be employed to install the various cladding elements, trim elements, and/or flashing elements disclosed herein on a building substrate. Any of the cladding elements, trim elements, and/or flashing elements described herein can be installed (e.g., secured) to sheathing 30 and/or framing members 20, for example, subsequent to securement of a weather resistant barrier 40 to such sheathing 30 and/or framing members 20, for example. Although FIG. 2 illustrates sheathing 30, in some embodiments, sheathing 30 is not included in the building substrate, for example, where it is intended that the cladding elements 100 provide resistance against lateral forces (for example, wind and/or seismic forces).

With reference to FIG. 2, one or more cladding elements 100 can be installed on structure 10 in a variety of ways. For example, the cladding elements 100 can be installed on structure 10 after installation of one or more trim elements, such as first and second trim elements 200, 600, and/or after installation of one or more flashing elements, such as first and second flashing elements 1100, 1300. First corner trim element 200 can be installed along an exterior corner of structure 10, such as an "inside" exterior corner of structure 10 as described above and as shown in FIG. 2. Second corner trim element 600 can be installed along an exterior corner of structure 10, such as an "outside" exterior corner of structure 10 as described above and as shown in FIG. 2. Either or both of first and second corner trim elements 200, 600 can be secured to the weather resistant barrier 40, sheathing 30 (where sheathing 30 is present), and/or framing members 20 via one or more fasteners 60. For example, the first and second legs 202, 204 of first corner trim element 200 and/or first and second legs 602, 604 of second corner trim element 600 can be secured to the weather resistant barrier 40, sheathing (where sheathing 30 is present), and/or framing members 20 via one or more fasteners 60. As discussed above, the first and second corner trim elements 200, 600, can have recessed portions 220, 620 that can provide an indication of where fasteners should be positioned. In some cases, the first and second corner trim element 200, 600 can be secured with a plurality of fasteners forced through such recessed portions 220, 620 along heights of the trim elements 200, 600, for example, at given spacings. In some implementations, fasteners 60 are inserted through portions of trim elements 200, 600 such that heads of the fasteners 60 are "flush" with a surface of the trim elements 200, 600 intended to contact rear faces of the cladding elements 100. In some embodiments, the first and second corner trim elements 200, 600 may include one or more holes instead of or in addition to recessed portions 220, 620 sized and shaped to accommodate mechanical fasteners therethrough to secure the first and second corner trim elements 200, 600 to the structure 10. In some cases where it is desirable to provide an air gap or cavity between the cladding elements 100 and/or trim elements 200, 600 and the weather resistant barrier 40, the trim elements 200, 600 can be secured to furring strips. Such furring strips can be secured to the framing members 20 (through the weather resistant barrier 40) at and/or along heights of the framing members 20. Such furring strips can be made of wood or the same material as the cladding elements 100, among other materials. In some cases, furring strip flashing element having a channel can be installed below such furring strips, for example, behind flashing element 1300.

After the first and second corner trim elements 200, 600 are secured to the structure 10 at inside and/or outside exterior corners, cladding elements 100 can be installed by inserting edges of the cladding elements 100 into channels 250, 650 defined by the first and second corner trim element 200, 600 (see FIGS. 5B, 9B). For example, with reference to FIGS. 3A-3B, 5B, and 9B, edges (such as first and second mating edges 106 or 108) of cladding element 100 can be inserted into channels 250, 650 of the first and second corner trim element 200, 600. In some cases, a sealing agent (such as caulking) is applied along a vertical joint or seam defined along a height of the cladding element 100 and the first and/or second corner trim elements 200, 600.

Cladding element 100 can be positioned such that an edge opposite of the edge positioned in the channel 250, 650 is aligned (e.g., vertically) with a framing member 20 (for example, a center of a framing member 20). This may require the edge positioned in the channel 250, 650 to be cut so that the opposite edge of the cladding element 100 can be aligned with the framing member 20. In some cases, such opposite edge of the cladding element 100 is aligned with the framing member 20 such that a portion of such opposite edge that is intended to be "overlapped" by a portion of an edge of another adjacent cladding panel 100 is positioned over a center of the framing member 20. In some cases, such positioning may require trimming the edge of the cladding element 100 that is positioned in the channel 250, 650 (for example, to shorten a width of the cladding element 100). In some cases, edges of the cladding elements 100 are cut at an angle (for example, miter cut at a 45° angle) prior to inserting into respective channels 250, 650 of the first and second corner trim element 200, 600. This can be done in order to have the edges match an angle of a leg of the trim element, for example, as shown and discussed with respect to fifth leg 610 of trim element 600 and FIG. 9B. The edge of the cladding element 100 not positioned in the channel 250, 650 can be joined (e.g., "mated") with an edge of another cladding element 100. Such mating can be that illustrated and described above with reference to first and second mating edges 106, 108 of cladding element 100, for example. A sealing agent, such as caulking, can be applied to and/or along any of the joining (e.g., mating) edges of the cladding elements 100 installed on the structure 10. Such sealing agent can be applied as a continuous bead along one or both of mating edges of adjacent cladding elements 100, for example, as a ⅛ inch bead. In addition or as an alternative to such sealing agent, a sealing tape (for example, a foam back sealing tape) can be positioned behind mating edges of adjacent cladding elements 100, between the cladding elements 100 and the weather resistant barrier 20. In some cases, edges of adjacent cladding elements 100 can be joined at and/or along framing members 20.

In some cases, trim elements, such as second corner trim element 600, can be installed after certain ones of the cladding elements 100 are installed, for example, to ensure that proper tolerances are achieved along the exterior of the structure 10. For example, second corner trim element 600 can be installed onto the outside exterior corner of structure 10 (see FIG. 2) by inserting channel 650 over an edge of a cladding element 100 (and inserting second leg 604 behind the cladding element 100) prior to securing a final vertical row of fasteners 60 through cladding element 100 to a framing member 20.

The cladding elements 100 can be secured by a plurality of fasteners 60 to the weather resistant barrier 40, sheathing 30 (where present), and/or framing members 20 as illustrated in FIG. 2. Such fasteners 60 can be secured along heights of the cladding elements 100 at or near edges of the cladding elements 100, near first and second corner trim elements 200, 600, and/or along the lengths of the cladding elements 100 (see FIG. 2). In some cases, vertical rows of fasteners 60 can be inserted through cladding elements 100 over each framing member 20, for example, at a spacing of 4 inches on center, among other spacings which may depend upon local building standards. While first and second corner trim elements 200, 600 are used in the discussion above, it is to be understood that any of the other trim elements described herein (such as trim element 300, 400, 500, 700, 800, 900, 1000) can be installed on structure 10 in a similar manner. As discussed above, in some cases where it is desirable to provide an air gap or cavity between the cladding elements 100 and the weather resistant barrier furring strips can be installed to the structure 10. In such cases, fasteners 60 can be inserted through cladding elements 110 along heights of such furring strips and along framing member Fasteners 60 can be inserted through cladding elements 100, through weather resistant barrier 40, and into framing members 20 (and sheathing 30 where present) at various spacings, for example, 4 inch on center along and/or between framing members 20.

Where flashing elements, such as first and second flashing elements 1100, 1300, are employed, cladding elements 100 can be installed to the structure 10 after such flashing elements 1100, 1300 are installed. First flashing element 1100 can be installed along a horizontal joint of structure 10 where two cladding elements 100 are intended to meet, as illustrated in FIG. 2. For example, first flashing element 1100 can be placed on and along top edges of cladding elements 100. In some cases, a sealing agent (such as caulking) is applied along the top edges of cladding elements 100 before placement of the first flashing element 110. Such sealing agent can be applied as a continuous bead, for example. In some cases, an end of the first flashing element 1100 is inserted into channel 650 of first trim element 600. In some cases, such end of the first flashing element 1100 is cut (for example, at a 45° angle) prior to inserting into channel 650 in order to match an angle of the fifth leg 610 of trim element 600 (see FIG. 9B and discussion herein relating thereto).

Second flashing element 1300 can be installed at or near the interface between the structure 10 and the foundation 8, as mentioned previously. Either or both of first and second flashing elements 1100, 1300 can be secured to the weather resistant barrier 40, sheathing 30 (where present), and/or framing members 20 via one or more fasteners 60, as described previously. For example, the first arms 1102, 1302 of first and second flashing elements 1100, 1300 can be secured to the weather resistant barrier 40, sheathing 30, and/or framing members 20 via one or more fasteners 60. As discussed above, the first and second flashing elements 1100, 1300 can have recessed portions 1120, 1320 that can provide an indication of where fasteners should be positioned. In some cases, first and second flashing elements 1100, 1300 can be secured with a plurality of fasteners forced through such recessed portions 1120, 1320 along lengths of the first arm 1102, 1302. In some embodiments, the first and second flashing elements 1100, 1300 may include one or more holes instead of or in addition to recessed portions 1120, 1320 sized and shaped to accommodate mechanical fasteners therethrough to secure the first and second flashing elements 1100, 1300 to the structure 10.

In some cases, an end of the second flashing element 1300 is inserted into channel 650 of first trim element 600. In some cases, such end of the second flashing element 1300 can be cut (for example, at a 45° angle) prior to inserting into channel 650 in order to match an angle of the fifth leg 610 of trim element 600 (see FIG. 9B and discussion herein relating thereto). Although FIG. 2 illustrates the trim element 200 utilized in an inside exterior corner configuration in structure 10, in some cases, trim element 500 can be utilized on such inside exterior corner. In such cases, another end (opposite the end inserted into channel 650) of the second flashing element 1300 can be cut (for example, at a 45° angle) and inserted into channel 550 of trim element 500 in order to match an angle of the third leg 506 of trim element 500 (see FIG. 8 and discussion herein relating thereto). In some cases, however, ends of the second flashing element 1300 can be inserted into channels in any trim elements utilized on structure 10 (any of the trim elements discussed herein) without cutting.

After the first and second flashing elements 1100, 1300 are secured to the structure 10, cladding elements 100 can be installed by inserting edges of the cladding elements 100 (e.g., bottom edges) above and/or into channels 1170, 1370 of the first and second flashing elements 1100, 1300 (see FIGS. 14B-14C, 16B-16C and discussion herein relating thereto). Advantageously, first and second flashing elements 1100, 1300 can aid alignment and/or positioning of the cladding elements 100 prior to securement (e.g., via fasteners 60) to the structure 10. As discussed above, the first and second flashing elements 1100, 1300 can include seventh arms 1130, 1330 that extend (for example, partially) across the channels 1170, 1370 that can support bottom edges of the cladding elements 100 such that such bottom edges, when secured, are disposed at a position spaced above the bottom of the channels 1170, 1370. This spaced configuration can provide a number of advantages. For example, this configuration may provide advantageous drainage characteristics as water (e.g., rain, snowmelt, or the like) or other liquid flowing downward along the cladding elements 100 may flow off of an exterior face of the cladding elements 100 into the channels 1170, 1370, and thereafter be guided to a lower cladding element 100 or the ground (e.g., by passing downward out of the channels 1170, 1370 through openings 1140, 1340) to provide an efficient drainage path as described above.

Before, during, and/or after any of the above installation steps, the cladding elements 100 (for example, front faces of the cladding elements 100) can be painted, for example, with an acrylic paint.

The cladding element 100' described above and illustrated in FIG. 18A can be installed on structure 10 in a manner similar in some or many respects to that described above with respect to cladding element 100. As discussed above, the cladding element 100' includes first and second mating edges 110', 112' which can be "top" and "bottom" edges of the cladding elements 100' when installed as illustrated in FIG. 18A. Similar to as discussed above with respect to methods of installation for cladding elements 100, in some cases, cladding elements 100' are installed after one or more trim elements (for example, trim element 200 and/or 600) and/or after one or more flashing elements (for example, flashing element 1100 and/or 1300) are installed, for example, over weather resistant barrier 40, secured to sheathing 30 (where present) and framing members 20 using fasteners 60. Multiple cladding elements 100' can then be installed vertically (for example, "stacked") such that edges 110', 112' of two vertically adjacent cladding elements 100' mate with one another (for example, in an overlapping arrangement). Edges 106', 108' of cladding element 100' (which may comprise a flat surface) can be inserted into channels 250, 650 of first and second corner trim elements 200, 600 and mating edges 106', 108' of vertically adjacent cladding elements 100 can be positioned adjacent to one another such that the edges 106', 108' "mate" as discussed elsewhere herein. In some cases, the cladding elements 100' are installed such that edges 110' (which may be referred to as "underlap" edges) point upwards. The cladding elements 100' can be secured to the framing members 20 via fasteners 60 (for example, vertical rows of fasteners 60) along heights thereof at various spacings (such as 4 inches on center). In some cases, trim elements, such as second corner trim element 600, can be installed after certain ones of the cladding elements 100' are installed, for example, to ensure that proper tolerances are achieved along the exterior of the structure 10. For example, second corner trim element 600 can be installed onto the outside exterior corner of structure 10 (see FIG. 2) by inserting channel 650 over edges 106' of a cladding element 100' (and inserting second leg 604 behind the cladding elements 100') prior to securing a final vertical row of fasteners 60 through the cladding element 100' to a framing member 20. The second web 1504 have a length that is greater, equal to, or less than a thickness of the cladding elements 100'. The second web 1504 can provide a desirable aesthetic appearance at the joint where two cladding elements 100' meet.

Figure 26A:
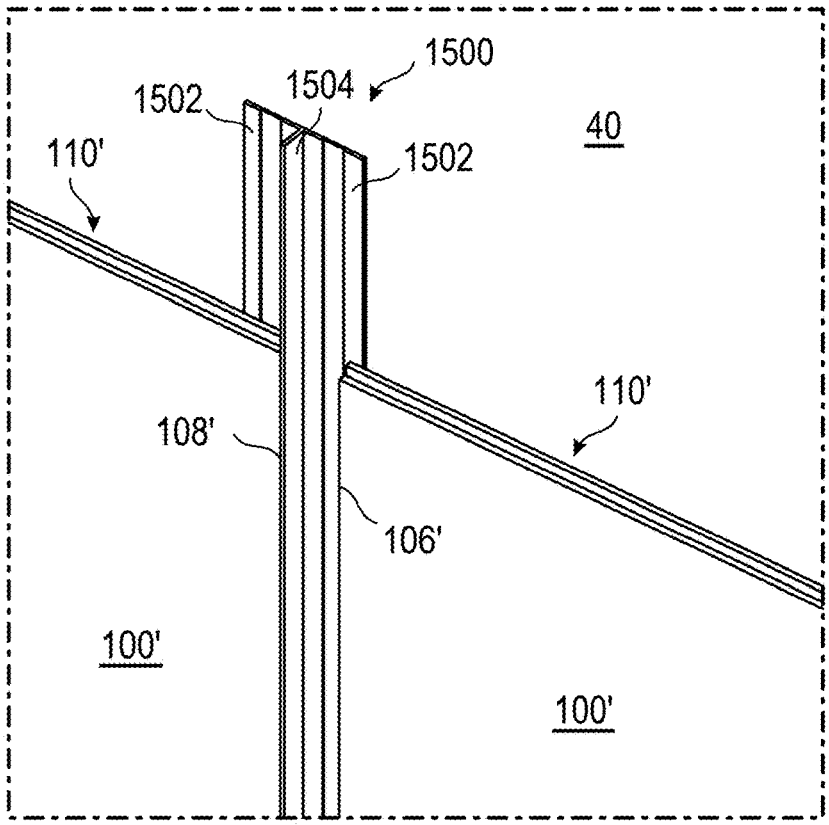
FIGS. 26A-26B illustrate trim elements in accordance with aspects of this disclosure.
Figure 26B:
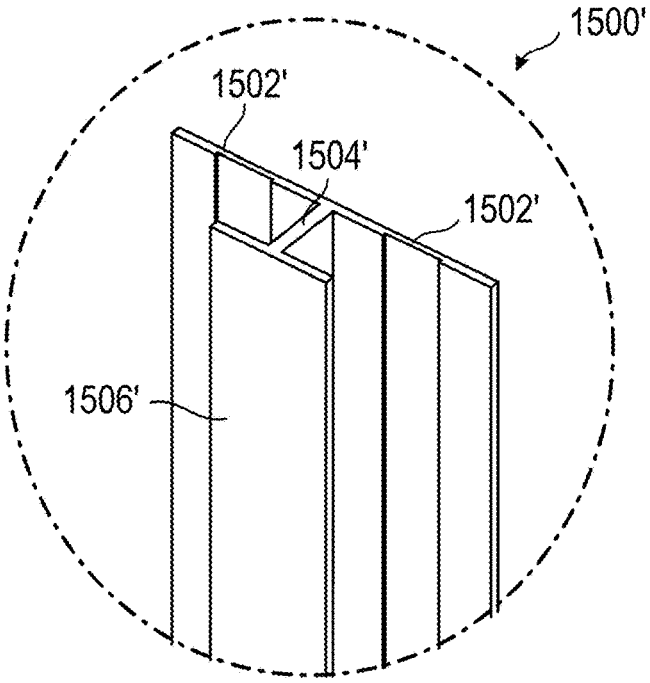

Depending on the dimensions of the cladding elements 100' and/or on the characteristics of the structure 10, adjacent vertical rows of cladding elements 100' may meet one another at non-corner locations of the structure 10, for example, along a width of a wall of the structure 10. FIG. 26A illustrates a trim element 1500 that can be utilized at such a non-corner location of the structure 10 between two adjacent cladding elements 100'. Trim element 1500 comprises T-shaped configuration, having a first web 1502 and a second web 1504 extending perpendicular to the first web 1502. In some cases, a sealing agent, such as caulking, can be applied to and/or along a height of the first web 1502 (on one of both sides of the second web 1504) prior to positioning edges 106', 108' of two cladding elements 100' against the second web 1504. Such sealing agent can be applied as a continuous bead along a height of the first web 1502 (or a portion of such height), for example, as a continuous ⅛ inch bead. Additional cladding elements 100' can be stacked vertically above the two cladding elements 100' shown in FIG. 26A, via engagement between mating edges 110' as described elsewhere herein. FIG. 26B illustrates another trim element 1500' that can be utilized in a similar manner as that described above with respect to trim element 1500. Trim element 1500' includes a first web 1502' and a second web 1504' that can be (respectively) identical to the first and second webs 1502, 1504 of trim element 1500. Trim element 1500" further includes a third web 1506 connected to an end of the second web 1504' that is opposite the end of second web 1504' that connects to the first web 1502'. The third web 1506' can be perpendicular to the second web 1504' and/or parallel to the first web 1502'. In such configuration, the first, second, and third webs 1502', 1504', 1506' form two channels that can receive portions of the cladding elements 100' For example, edges 108', 106' of two cladding elements 100' (see FIG. 26A) can be inserted into such channels of trim element 1500', which can provide a desirable aesthetic finish.

Cladding element 100" described above with reference to FIGS. 19A-19D can be installed in a similar or identical manner as described above with reference to cladding element 100 or 100' depending on the intended installation orientation of cladding element 100". Similar to as described above with respect to cladding element 100, cladding elements 100', 100" (for example, front faces of the cladding elements 100', 100") can be painted before, during, and/or after any of the above installation steps, for example, with an acrylic paint.

In some examples, a method of installing a cladding system includes: installing a weather resistant barrier onto a building substrate (e.g., sheathing 30, and/or framing members 20), installing one or more trim elements onto a building substrate, and installing one or more cladding elements (such as any of cladding elements 100, 100', 100") onto the building substrate. Optionally, the method includes applying a sealing agent (e.g., caulking) to edges of the cladding elements (and/or trim elements), for example, prior to positioning such edges adjacent toward one another. The method can further include painting the cladding elements (for example, painting a front face of the cladding elements). In some cases, the method can include installing one or more battens on the building substrate, for example, between the cladding elements and the weather resistant barrier, sheathing, and/or framing members. The method can also include installing one or more flashing elements onto the building substrate, such as any of the flashing elements discussed herein.

Any of the cladding elements (for example, cladding elements 100, 100', 100") disclosed herein can be made of fiber cement and can be manufactured using a Hatschek process. The Hatschek process can be utilized to integrally form one or more textured patterns (such as any of those disclosed herein) on any of the cladding elements (for example, cladding elements 100, 100', 100") disclosed herein with fiber cement.

Window Trim Systems

Traditionally, timber trim pieces (which may also be referred to as "trim elements") have been used to "trim" (for example, be placed adjacent to and/or surrounding) portions on a building section where an aesthetic finish is desired. Where solid brick or masonry construction is used to construct a building such as a residential dwelling, the relative thickness of the wall section compared to an element, such as an installed window or door is such that an aesthetically desirable perception of depth is provided. In lightweight construction such as, for example, wood or steel frame construction, total wall thickness is reduced. Accordingly, the corresponding perception of depth is reduced for installed elements such as windows and/or doors.

Traditional trim pieces are generally flat, elongate, rectangular cross-sectional strips of timber, or other nailable material, that are relatively wide compared to their thickness. They are generally configured to provide a "picture frame" around a building section element (for example, a window or door) whereby the width of the trim piece corresponds to the size of a front facing portion of the trim piece when viewed on the building section element whilst the thickness of the trim piece corresponds to the size of a side portion of the trim piece. In such an arrangement, traditional trim pieces are not able to provide a depth to the installed trim. Any depth perception is limited by the relative thickness of the wall section compared to the installed element to be trimmed. Similarly, when installed on a lightweight construction timber or steel frame which is clad with panelized cladding elements such as fiber cement cladding, traditional timber trim pieces provide little aesthetic benefit such as increased depth perception.

In addition, traditional timber trim pieces are normally fixed to a building section by fixing to a building frame through an exterior cladding, using nails or screws and the like. Timber trim, in a "picture frame" installation, is usually fixed to the building section through its face. To achieve a "deep depth" aesthetic with a traditional timber trim piece, the timber trim piece would have to be fixed to the building section with the side portion or edge orientated such that the side portion was the front facing portion (generally at right angles to the orientation of the trim piece for a "picture frame" aesthetic). This would then require that any fixings be installed at an angle to secure the trim element to the building section. Timber is likely to split if fixed to a building section in this way. Where an angled face trim is desired, timber trim would have to be nailed through a visible face of the trim, resulting in either visible fixings, or requiring additional installation time and costs to patch over fixings.

Traditional timber trim pieces are also not configured provide any water management functionality, for example managing or directing water flow such as water drainage, to direct rainwater and the like to drain away from the trimmed building section element, such as a window or door.

In view of the foregoing, there is a need to provide a building trim system that reduces or ameliorates the issues with traditional trim materials, provides a modern trim aesthetic, and provides an integral water management function.

Various embodiments of building trim systems will be described in greater detail below. The building trim system has been developed primarily for use as window trim for use in wall construction in residential dwellings and will be described hereinafter with reference to this application. However, it will be appreciated that the building trim systems are not limited to this particular use. In some implementations, the building system trim described herein provides a modern trim aesthetic and at least one water management feature.

Any of the building trim systems, trim elements (such as any of trim elements 2010, 2010', 2310, 2410, 2410', 2401, 2401'), and/or any of the components discussed below in such systems can be utilized in systems including any of the cladding elements (such as any of cladding elements 100, 100', 100"), trim elements (such as any of trim elements 200, 300, 400, 500, 600, 700, 800, 900, 1000, 1500, 1500'), and/or flashing elements (such as any of flashing elements 1100, 1200, 1300, 1400) described elsewhere herein.

Throughout this specification, wherever reference is made to a particular feature being present in "one embodiment" or "an embodiment", such references indicate that the feature should be taken as being present in at least one embodiment. Features described as present in "one embodiment" or "an embodiment" may also be combined in a single embodiment.

Figure 27A:
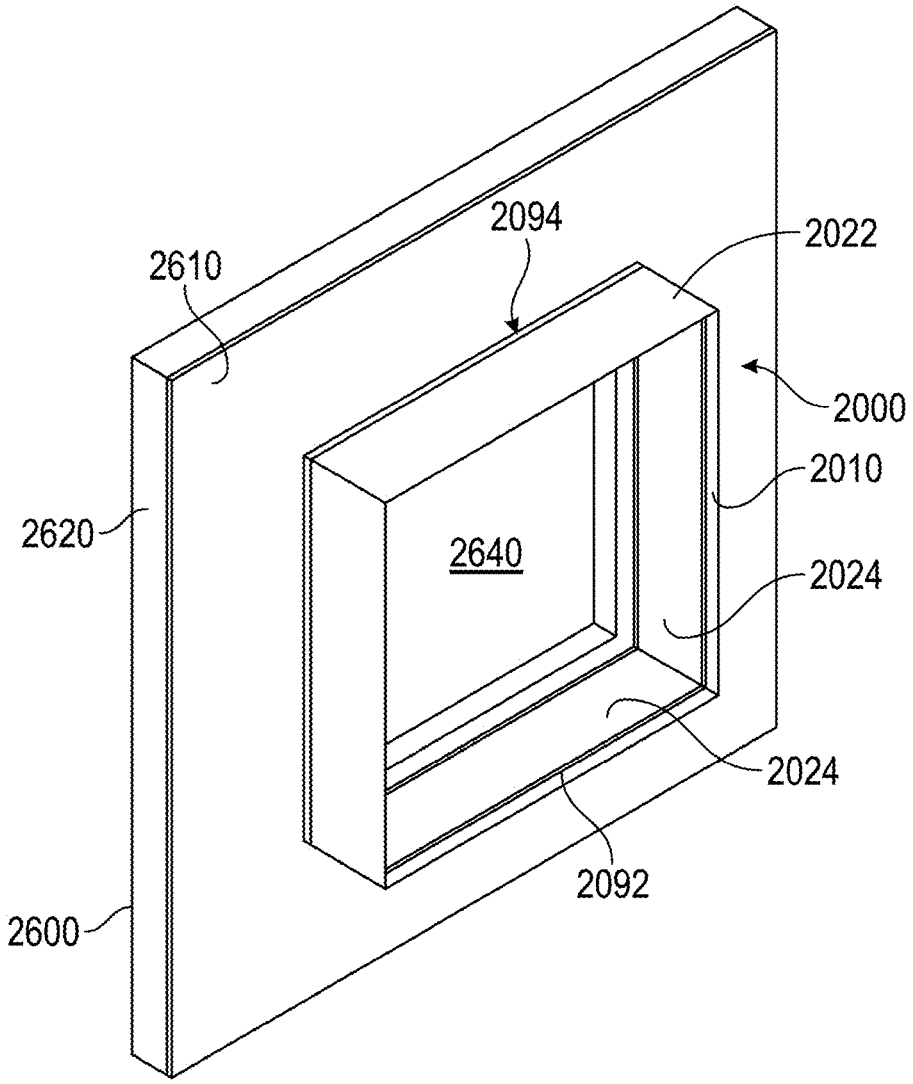
FIG. 27A shows a perspective view of a building trim system installed onto a building section in accordance with aspects of this disclosure.

FIG. 27A shows illustrates a building trim system 2000, suitable for use in trimming a building section 2600, including at least one trim element 2010. Building section 2600 can include framing element(s) 2620 (for example, sheathing and/or studs) and cladding 2610 secured to framing element(s) 2620. Building trim system 2000 can include one or a plurality of trim elements 2010 secured to building section 2600 depending on the configuration of the building section element 2640. For example, where building section element 2640 is a window, four trim elements 2010 can be employed to surround the window (which may have a square or rectangular configuration, for example). A different number of trim elements 2010 can be employed in different cases, for example, where building section element 2640 is a door opening. Each trim element 2010 is fixable to building section 2600 (for example, to framing element(s) 2620) adjacent building section element 2640. In some cases, ends of the trim elements 2010 can be cut or otherwise configured to join at an angle, for example, to form a corner and/or joint. Trim element(s) 2010 can include at least one water management feature configured to direct water drainage. In some embodiments, the at least one water management feature comprises a channel for directing water drainage (for example, channel 2094 discussed below and illustrated in FIG. 27B) that can be on an exterior facing portion of trim element 2010 (when installed). Additionally or alternatively, the at least one water management feature can comprise a groove, such as groove 2092 discussed below and illustrated in FIG. 27B. In some embodiments, trim element 2010 includes channel 2094 and groove 2092 positioned remote from channel 2094.

Figure 27B:
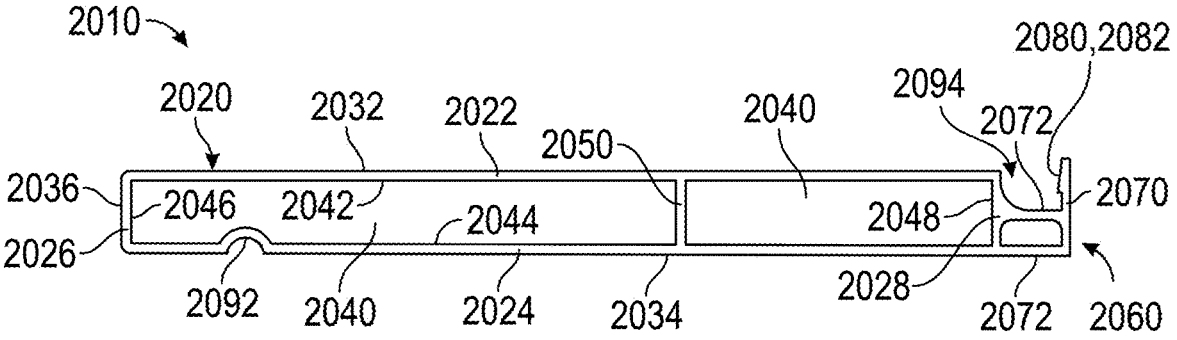
FIG. 27B shows a cross-sectional side view of a trim element in accordance with aspects of this disclosure.

FIG. 27B shows a cross-sectional side view of trim element 2010. Trim element 2010 can include a trim body 2020 and a trim element retaining formation 2060. Trim body 2020 and trim element retaining formation 2060 can be integral. Trim body 2020 can include a trim body rear wall 2028, a first trim body side wall 2022, and/or a second trim body side wall 2024. At least a portion of first trim body side wall 2022 and second trim body side wall 2024 are each angled at a predetermined angle with respect to trim body rear wall 2028. In some embodiments, trim body 2020 comprises first trim body side wall 2022, second trim body side wall 2024, a third trim body side wall 2026 and trim body rear wall 2028. Each of trim body side walls 2022, 2024, 2026 can have an exterior face that contributes to the aesthetic of trim element 2010 in an installed position as part of building trim system 2000. As shown in FIG. 27B, first trim body side wall 2022 has first trim body side face 2032, second trim body side wall 2024 has second trim body side face 2034, and third trim body side wall 2026 has third trim body side face 2036. In some embodiments, trim body 2020 is a hollow body comprising at least one trim body aperture 2040, making trim body 2020 lightweight for easier handling and installation. Trim body side walls 2022, 2024, 2026 and trim body rear wall 2028 together can enclose such at least one trim body aperture 2040. With continued reference to FIG. 27B, each of trim body side walls 2022, 2024, 2026, and rear wall 2028 can have respective inner faces 2042, 2044, 2046, 2048.

In some embodiments, first trim body side wall 2022 and second trim body side wall 2024 are substantially parallel, and first trim body side wall 2022 is disposed at an angle of approximately 90° to trim body rear wall 2028, thereby providing a hollow trim body that is substantially rectangular in cross-section, and capable of providing a modern aesthetic. Other configurations can be used to provide various other aesthetic and/or functional benefits. The height of the such shallow rectangular configuration for trim element 2010 can be between and 60 mm and the width can be between 150 mm to 300 mm in some implementations. In some embodiments, at least a portion of first trim body side wall 2022 extends at a predetermined angle of between approximately 45° and approximately 135° from trim body rear wall 2028. In the illustrated embodiment shown in FIG. 27B, the predetermined angle is approximately 90°. In some embodiments, the predetermined angle is between 45 and 90° with respect to the trim body rear wall 2028, which can advantageously allow water drainage to be directed across first trim body side face 2032 (for example, in a direction away from the building section 2600 when trim element 2010 is secured to building section 2600).

Trim body 2020 can be generally an elongate body having opposing ends. In some embodiments, such as that shown in FIG. 27B, one or both of such ends is open into aperture(s) 2040. In some embodiments, one or both of such opposing ends comprises an end face that is formed at a predetermined angle to a longitudinal axis of trim body 2020 (for example, an axis extending through the cross-section of trim body 2020 and along a length of the trim element 2010). In some embodiments, one or both of such opposing ends of trim body 2020 can be connected with an end piece, such as end piece 2011 which is discussed further below and illustrated in FIG. 28B.

In some embodiments, as shown in FIG. 27B, trim element 2010 includes a trim element retaining formation 2060 that comprises at least one trim retaining arm 2070 extending from trim body rear wall 2028. In some embodiments, trim retaining arm 2070 further comprises a pair of trim body extension arms 2072 extending from, and connected to, trim body rear wall 2028 and providing a predetermined spacing between trim body rear wall 2028 and trim retaining arm 2070, thereby defining the width of water management feature in the form of channel 2094. In some embodiments, an angled web 2080 is disposed on trim retaining arm 2070, providing a fixing face 2082. Fixing face 2082 assists the installer in visually assessing the correct angle to guide fixings (which may also be referred to as "fasteners") such as nails, screws and the like during installation, such that nail heads or screw heads sit flush and/or parallel with angled web 2080 and do not deform trim retaining arm 2070 through uneven fixing head pressure. Angled web 2080 and face 2082 can be secured to cladding 2610 in a manner similar to that shown with respect to fixings 2510, angled web 2080' of trim element 2010' (see FIG. 27E), such that a fixing is inserted through angled web 2080, face 2082, and/or trim retaining arm 2070, cladding 2610 and into a framing element 2620.

Figure 27C:
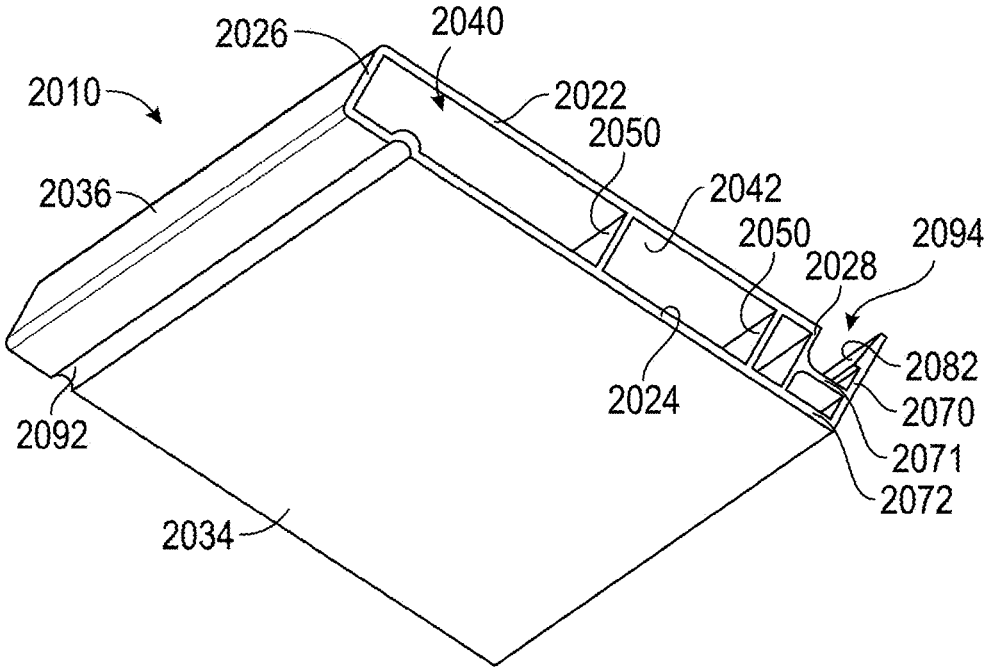
FIG. 27C shows a perspective view of a trim element in accordance with aspects of this disclosure.

With continued reference to FIG. 27B, in some embodiments, trim body 2020 comprises at least one reinforcing web 2050, each reinforcing web 2050 intersecting trim body aperture 2040 and dividing it into discrete sections. Each reinforcing web 2050 provides additional strength and rigidity to trim element 2010. Reinforcing web(s) 2050 can aid in providing strength during handling, installation and service life, particularly where hollow shaped trim body 2020 is configured with a shallow elongate hollow cross-section. FIG. 27B illustrates trim body 2020 having one reinforcing web 2050 while FIG. 27C illustrates trim body 2020 having two reinforcing webs 2050. FIG. 27C illustrates a side cross-section perspective view of trim element 2010 from below, in which trim element 2010 has a similar configuration to that illustrated in FIG. 27B, except that first trim body side wall 2022 and second trim body side wall 2024 are configured to be almost parallel but not exactly, with first trim body side wall 2022 angled approximately 80° to approximately 86° relative to trim body rear wall 2028. Such configuration can provide an additional water management feature when installed above an element to be trimmed such as building section element 2640 (for example, a window or door), for directing water drainage away from building section 2600 when in an installed position. In such configuration, trim body 2020 is also configured to have a shallow, approximately rectangular profile, for providing a modern aesthetic trim appearance.

In some embodiments, second trim body side wall 2024 comprises a water management feature in the form of groove 2092 that is configured to direct water drainage. Groove 2092 forms a capillary break to control and direct the flow of water across second trim body side face 2034. When trim element 2010 is installed above a building section element 2640 (such as a window) with second trim body side face 2034 facing downwards, groove 2092 provides a water management feature that will cause any water that migrates across first trim body side face 2032 and third trim body side face 2036 onto second trim body side face 2034 to accumulate in groove 2092 and drip away from trim element 2010 under the force of gravity. In some embodiments, groove 2092 is positioned closer to third trim body side wall 2026 than to trim body rear wall 2028.

Figure 27D:
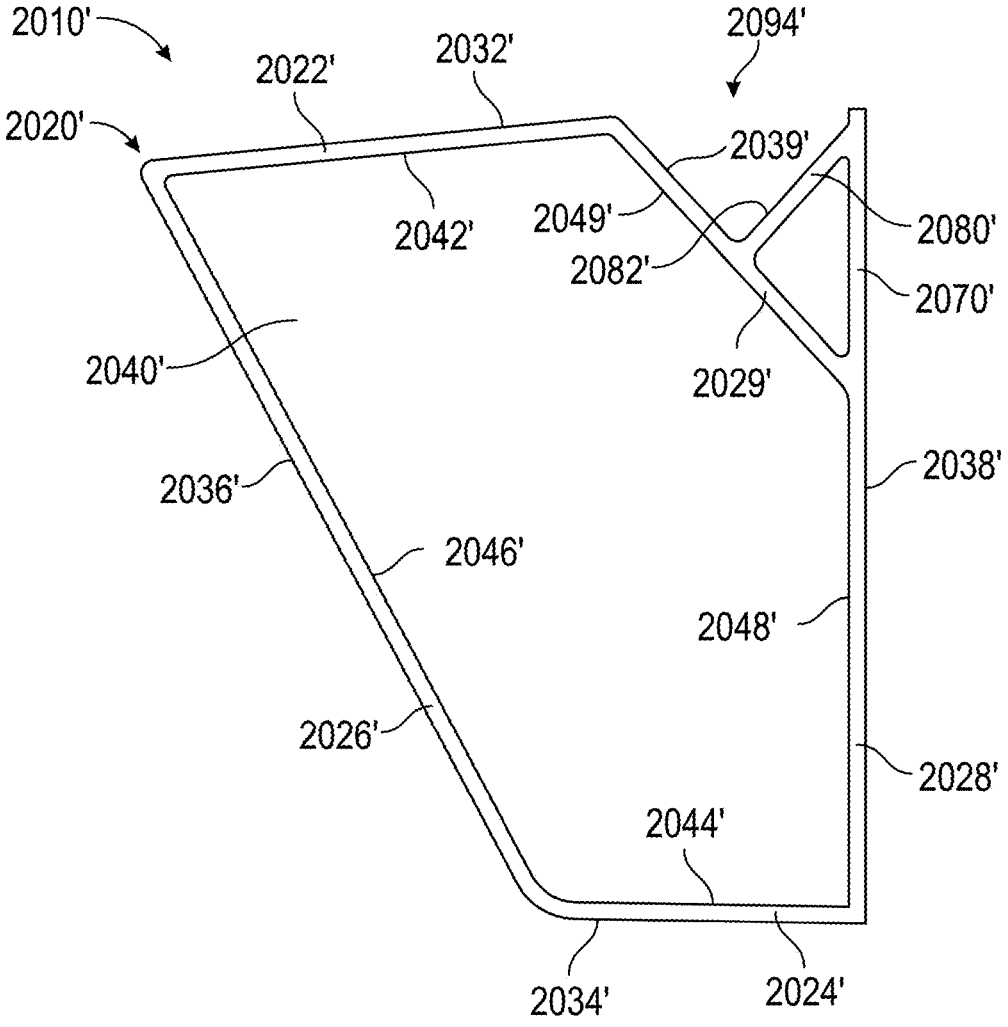
FIG. 27D shows a cross-sectional side view of a trim element in accordance with aspects of this disclosure.

FIG. 27D illustrates a cross-sectional side view of a trim element 2010'. Trim element 2010' includes a trim body 2020' having a polygonal cross-section comprising trim body side walls 2022', 2024', 2026' and trim body rear wall 2028'. Trim body side walls 2022', 2024', 2026' respectively have first trim body side face 2032', second trim body side face 2034', and third trim body side face 2036', which can together provide the critical faces for the visible trim aesthetic of trim element 2010' once installed in place on building section 2600. Trim body 2020' can include an angled portion 2029' extending from trim body rear wall 2028' to trim body side wall 2022', for example, at an angle of approximately 135° relative to trim body rear wall 2028'.

First trim body side wall 2022' can be angled at less than 90° with respect to trim body rear wall 2028' and can provide an additional water management feature that is configured to direct water drainage away from a building section 2600 to which trim element 2010' is secured. For example, first trim body side wall 2022' can be angled at less than approximately 85° with respect to trim body rear wall 2028', and this angle is sufficient to direct water drainage towards third trim body side face 2036' and away from channel 2094' and building section 2600 (when installed in a horizontal orientation above a building section element 2640 such as a window). In some embodiments, first trim body side wall 2022' is angled between approximately 60° to approximately 70° with respect to third body side wall 2026', and second trim body side wall 2024' is angled at approximately 120° to 135° with respect to third body side wall 2026', thereby providing a slight overhang of first trim body side face 2032' relative to second trim body side face 2034', to provide an alternative modern aesthetic. In some implementations, trim element 2010' is used to trim around a standard sized window, where the window width is generally between 600 mm and 2500 mm and the height is generally between 600 mm and 1500 mm. In some embodiments, dimensions of trim element 2010', as shown in FIG. 27D, to trim a standard sized window are 50 mm to 60 mm high, 50 mm to 60 mm wide from trim body rear face 2038' to the intersection of first trim body side face 2032' and third trim body side face 2036', and 25 mm to 30 mm from trim body rear face 2038' to the intersection of second trim body side face 2034' and third trim body side face 2036', although other suitable dimensions may be used.

In some embodiments, trim element 2010' includes an angled web 2080' disposed on a trim retaining arm 2070'. Angled web 2080' can extend between trim retaining arm 2070' and angled portion 2029'. Angled web 2080' provides a fixing face 2082' through which fixings (which may also be referred to as "fasteners") are driven into building section 2600. The angle of fixing face 2082' guides the angle at which fixings should be driven into building section 2600. Fixings (such as fixings 2510 shown in FIG. 27E), for example, fasteners such as nails or screws, can be driven so that their heads are parallel to the angle of angled web 2080', and as flush to fixing face 2082' as possible so as not to impede water flow in channel 2094'. In some embodiments, trim element 2010' includes one or more reinforcing webs 2050', as shown in FIG. 27F. Reinforcing web(s) 2050' can extend across aperture 2040', for example, between trim body side wall 2026' and rear wall 2028' and/or between trim body side wall 2026' and angled portion 2029'.

Channel 2094' formed between angled portion 2029' and angled web 2080' acts as a water management feature configured to direct water drainage. In a horizontal installation, water is directed laterally along a length of the channel 2094' and exits at an end of the channel 2094'. In some embodiments, a fifth face 2039' (which may also be referred to as "angled portion side wall face") and fixing face 2082' are angled at approximately 90° to each other to maximize the volume of water that can be accommodated in channel 2094'.

Figure 27E:
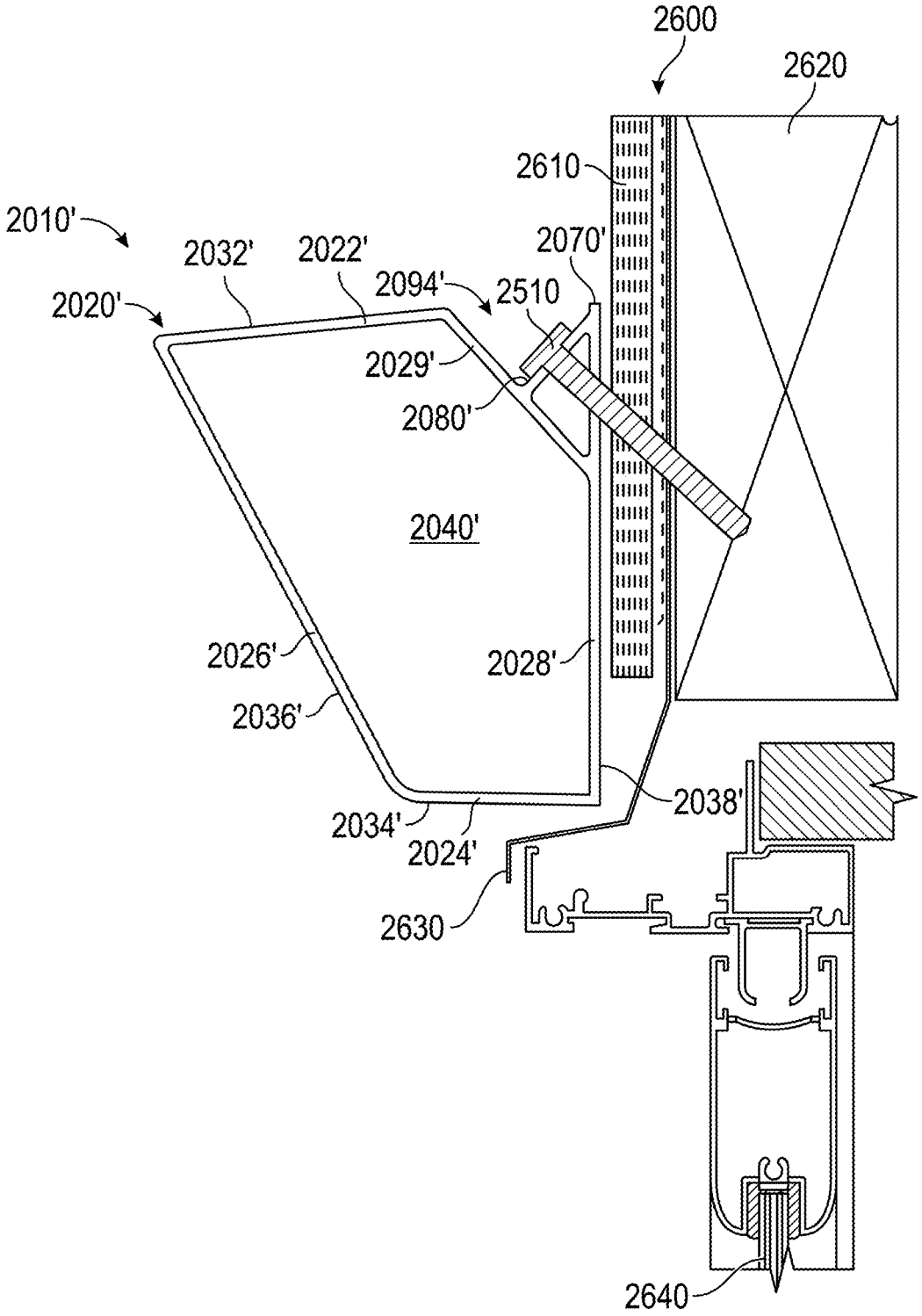
FIG. 27E shows a cross-sectional side view of a building trim system installed onto a building section in accordance with aspects of this disclosure.
Figure 27F:
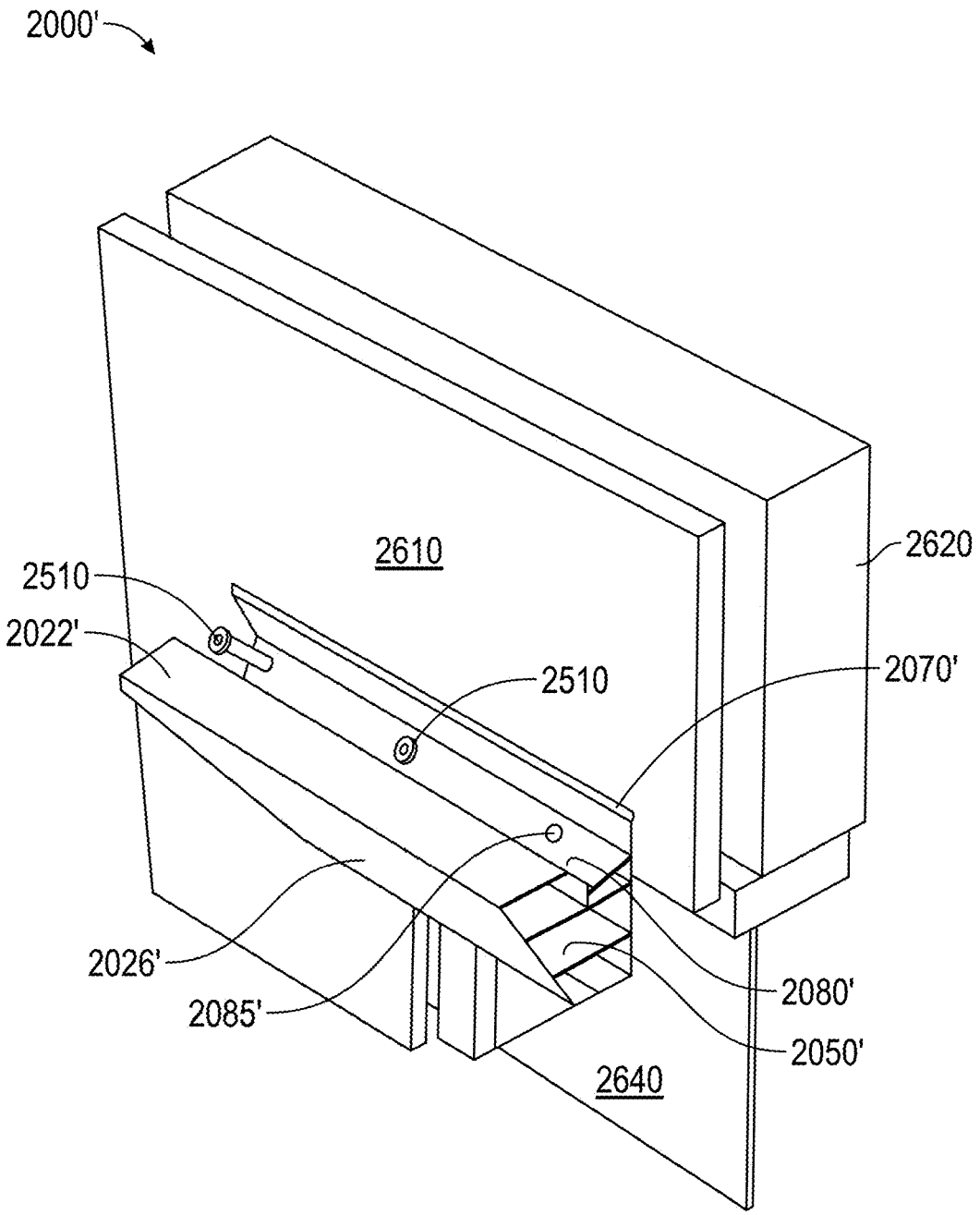
FIG. 27F shows a partial perspective view of a building trim system partially installed on a building section in accordance with aspects of this disclosure.

FIG. 27E shows a cross-sectional view of trim element 2010' when installed onto a building section 2600. As shown, first trim body side wall 2022', angled portion 2029', second trim body side wall 2024', third trim body side wall 2026', and trim body rear wall 2028', together define a substantially polygonal cross-section trim element 2010'. Within trim body 2020' is a single trim body aperture 2040'. Trim body 2020' further comprises a trim retaining formation in the form of trim retaining arm 2070' and angled web 2080', through which trim element 2010' can be directly fixed to building section 2600 using fixings 2510. Fixings 2510 are spaced apart as required by manufacturer's recommendations or local building regulations, local environmental, and/or local building practice requirements. Fixings 2510 can be inserted through angled web 2080', trim retaining arm 2070', cladding 2610, and through a portion of framing element 2620 as shown, thereby securing trim element 2010' in place. Channel 2094' between fixing face 2082' and angled portion side wall face 2039' provides a water management means whereby water, such as rainwater, that drains down the face of cladding 2610 of building section 2600 may be collected and directed away from draining across first trim body side face 2032'. Any rainwater that does run down third trim body side face 2036' will either drip off third trim body side face 2036' at its connection point with second trim body side face 2034', or will drain across second trim body side face 2034' and will drip off at the connection point between trim body rear wall 2028' and second trim body side face 2034'. In some embodiments that include flashing 2630 connected to the building section 2600, any water that drips off at the connection point between second trim body side wall 2024' and trim body rear wall 2028' will fall onto flashing 2630 and be directed away from building section element 2640 (which can be, for example, a window).

FIG. 27F illustrates a partial cut-away perspective view of a partially installed building trim system 2000 and an alternative view of the installation shown in FIG. 27E, where trim element 2010' has been cut to a desired length from an elongate extrusion length, and each end of trim body 2020' (for example, end faces of trim body 2020') has been miter cut to 45°. In some embodiments, trim element 2010' may be supplied pre-formed to a predetermined length. Ends of trim element 2010' (for example, end faces of trim element 2010') may be cut square (orthogonal to the long axis of the trim element 2010') or may be cut at an angle such as 45° (miter cut) if the trim is to provide a "frame" around the building section element 2640 to be trimmed (for example, a window). Other angles may be used, as required, to allow for out-of-square tolerances or non-rectangular shapes. Normal cutting means such as hand cutting, saw cutting or cutting with powered saws etc. may be used, such as are common in the building and construction industry. Ends of trim element 2010' (for example, end faces of trim element 2010') may be cleaned up after cutting by light sanding, deburring, and the like to remove cutting debris. Trim element 2010 can be cut and/or formed in a similar or identical manner as described above with respect to trim element 2010' to form a "frame" around a building section element 2640 (see FIG. 27A). In some embodiments, building system 2000 can include a plurality of trim elements 2010' (for example, four trim elements 2010' that form a frame around building section element 2640. As shown in FIG. 27E, trim body rear face 2038' of trim element 2010' can be located against cladding 2610 of building section 2600 in a desired position adjacent the building section element 2640 to be trimmed (for example, a window). Fixings 2510, such as screws, are used to secure trim element 2010' directly to building section 2600 through angled web 2080' and trim retaining arm 2070'. With reference to FIG. 27F, fixing indicia 2085' are optionally provided on fixing face 2082' to guide the installer on a desirable spacing of fixings 2510. In FIG. 27F, screws are used as fixings 2510, and one is shown partially installed, and one is shown fully installed. The process is then repeated for other edges of building section element 2640 to be trimmed. Fixing indicia 2085' may be integrally formed during manufacture or may be applied after manufacture, by suitable processes such as printing, stamping, embossing, punching, and the like.

Trim elements 2010, 2010' may be formed from any durable, resiliently deformable material. Additionally, metals such as aluminum or steel, or weather stabilized polymers such as PVC or polyolefin are suitable for use in forming trim elements 2010, 2010'. They may be formed by any suitable common manufacturing process, such as extrusion. The thickness of trim elements 2010, 2010' (for example, any portions thereof) is sufficient to provide the mechanical support required for installation and service life. For example, if trim element 2010, 2010' is integrally formed by extruding an aluminum section, the thickness of each trim side wall thereof may be between 0.75 mm and 2.5 mm with +/−10% due to manufacturing variations, with 0.8 mm, 0.9 mm, 1.0 mm, 1.1 mm, 1.2 mm, 1.3 mm, 1.4 mm, 1.5 mm, 1.6 mm, 1.7 mm, 1.8 mm, 1.9 mm, 2.0 mm, 2.1 mm, 2.2 mm, 2.3 mm, 2.4 mm, or 2.5 mm being usable thicknesses. Different wall thicknesses may be used on different trim body walls of trim element 2010, 2010', and where profile sections intersect, there may be a variation in wall thickness, as an outcome of the manufacturing process. If trim element 2010, 2010' is formed from a metal, decorative and/or protective surface coatings may be applied to enhance aesthetics and to protect trim element 2010, 2010' from corrosion. Examples of suitable types of surface treatments which may be selected, appropriate to the metal type, include painting, powder coating, galvanizing, anodizing, chromate or non-chromate anti-corrosion treatments, or other commercially available options.

Figure 28A:
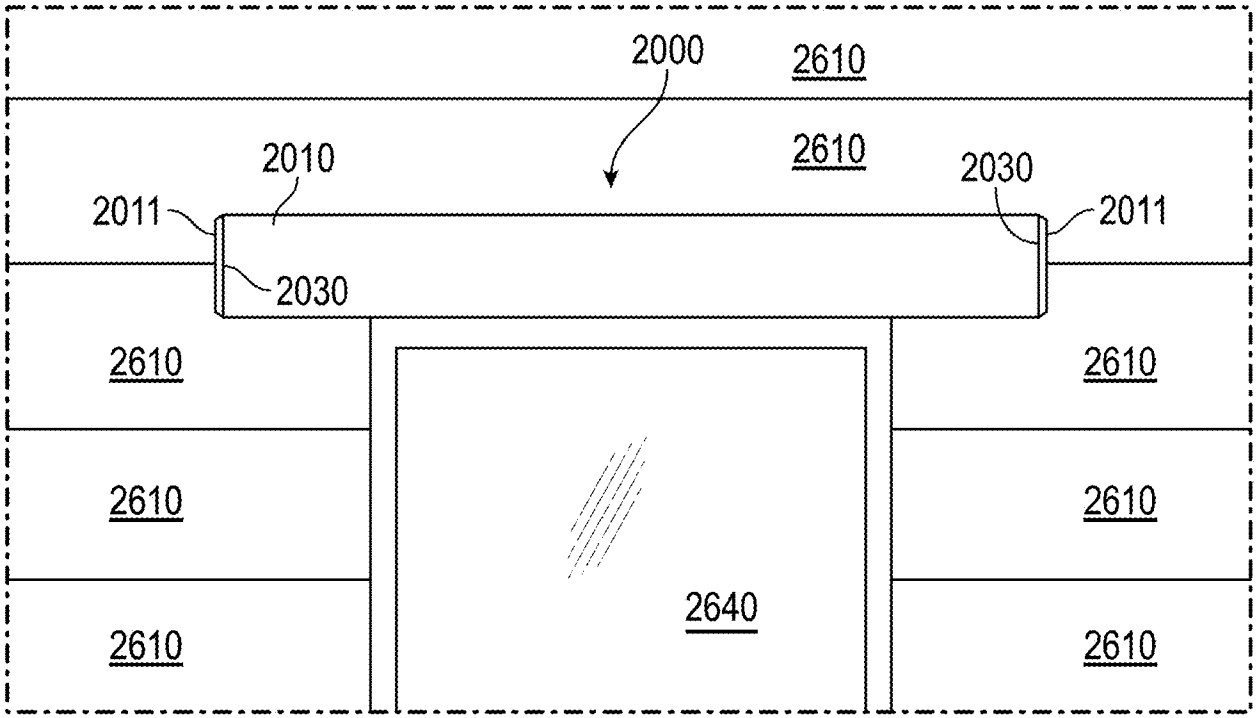
FIG. 28A shows partial front view of a trim element with end elements, each end element comprising an end cap, according to an embodiment of a building trim system, installed on a building section in accordance with aspects of this disclosure.

FIG. 28A illustrates a front view of trim element 2010 installed above a building section element 2640 (for example, a window). In some embodiments, building system 2000 includes at least one end piece 2011. End piece 2011 is an end cap for securing to an end 2030 of trim element 2010 and/or for closing end 2030 from exposure to weather and/or vermin, such as insects and spiders. In some embodiments, as shown in FIG. 28A, building system 2000 includes a single trim element 2010 that provides a sun shade and weather protection, as well as a decorative aesthetic, above a building section element 2640 (such as a window). In some embodiments, end pieces 2011 are secured to opposing ends 2030 of trim element 2010.

Figure 28B:
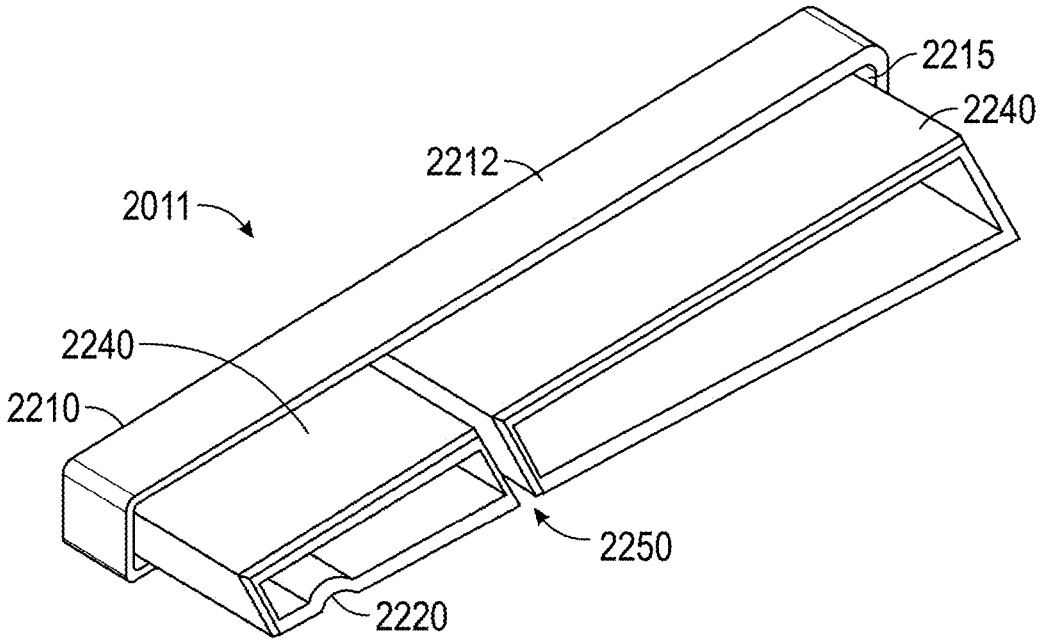
FIG. 28B shows a perspective view of an end cap in accordance with aspects of this disclosure.

FIG. 28B illustrates a perspective view of end piece 2011. End piece 2011 can include an end piece body 2210, end piece face 2212, and an end piece connector configured to secure to end 2030 of trim element 2010. Such end piece connector can comprise end piece insert formation 2240 configured to fit into a corresponding trim body aperture 2040 of trim element 2010. Where trim element 2010 includes at least one trim reinforcing web 2050 (see FIG. 27B), end piece connector 2240 includes a corresponding end piece connector aperture or gap 2250 so that end piece insert formation 2240 can be inserted into corresponding trim body aperture 2040 of trim element 2010 unimpeded. In such implementations, end piece insert formation 2240 can be defined by two portions separated by the aperture or gap 2250. Where trim element 2010 also includes groove 2092 to provide a capillary break (see FIG. 27B), corresponding end piece insert formation 2240 can include a recess 2220 to match (for example, to accommodate a size and/or shape of groove 2092). Where trim body 2020 and trim body aperture 2040 are not symmetrical, and a single configuration of end connector cannot be used, a matched pair of end elements can be provided in which each end piece body 2210 supports an oppositely directed end piece insert formation 2240, such that a "left" and a "right" handed configuration are provided. In some embodiments, end piece insert formation 2240 has a smaller cross-sectional area than end piece body 2210 such that end piece body 2210 remains outside of aperture 2040 of trim element 2010 when end piece insert formation 2240 is secured within aperture 2040.

Each end piece insert formation 2240 can be constructed to provide a friction fit into a respective trim body aperture 2040 and be held in place by friction forces. For trim element 2010 comprising first trim body side wall 2022, second trim body side wall 2024, third trim body side wall 2026 and at least a portion of trim body rear wall 2028, together enclosing and defining trim body aperture 2040, each wall 2022, 2024, 2026, 2028 presents a respective inner face 2042, 2044, 2046, 2048 respectively to trim body aperture 2040. Each end piece insert formation 2240 can be configured such that, when inserted into trim body aperture 2040, at least one surface of end piece insert formation 2240 contacts one of such inner faces 2042, 2044, 2046, 2048 of trim element 2010, resulting in a frictional contact. In other configurations, an adhesive or mechanical fastener can be used to fix end piece 2011 in place relative to trim element 2010. In some embodiments, end piece face 2212 is in the form of a solid cap and may be configured to provide an aesthetic match to trim element 2010 by providing a radiused, rounded or squared edges or the like.

End piece 2011 may be made from any durable material, such as exterior durable polymer compositions of PVC, polyolefin and the like, or from metals such as aluminum or steel. The wall thickness of end piece body 2210 and/or end piece insert formation 2240 is sufficient to provide the mechanical support required for installation and service life. The wall thickness is between 0.5 mm and 1.5 mm+/−10%, the variance being due to normal manufacturing variations.

Figure 29A:
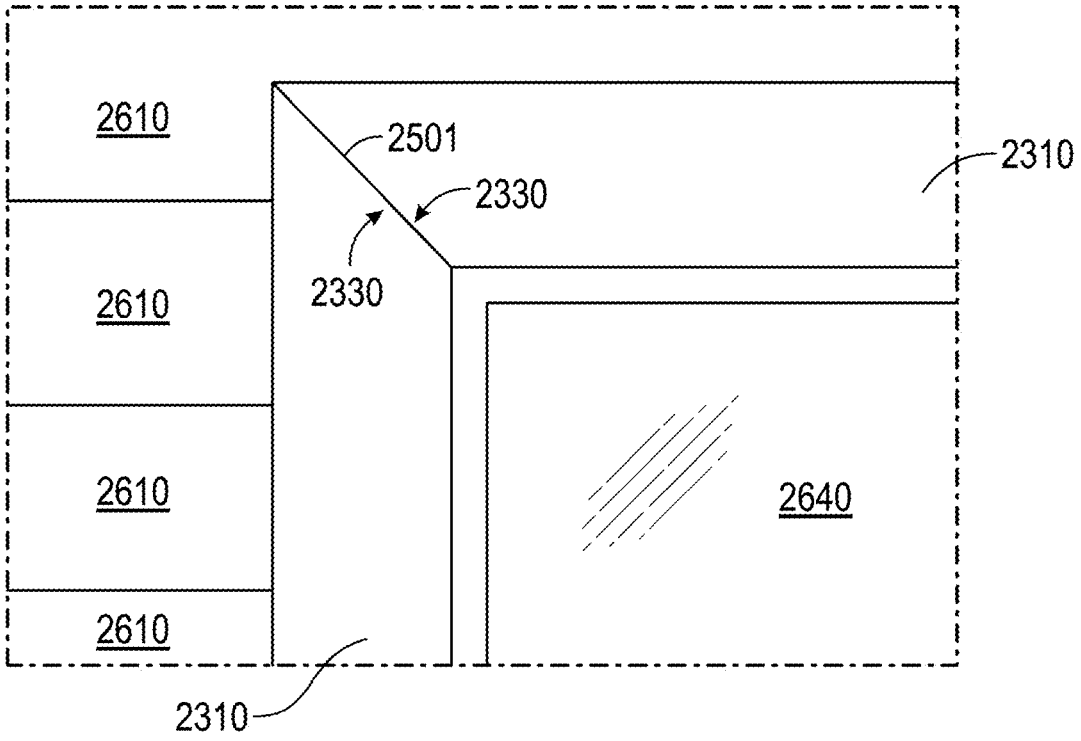
FIG. 29A shows a partial front view of a building trim system, where a bead of sealant has been applied to fill gaps between miter cut ends of adjacent trim elements in accordance with aspects of this disclosure.

FIG. 29A illustrates a front view of a portion of a building trim system installed on cladding 2610 and around a portion of a building section element 2640 (for example, a window). In such building trim system, four trim elements 2310 (portions of two of which are shown in FIG. 29A) can be cut to a required length to form a frame around building section element 2640, and each end 2330 of the trim elements 2310 can be miter cut to 45° and cleaned up by removing any burrs and/or debris. Trim elements 2310 can be similar or identical to any of the other trim elements discussed herein (for example, trim elements 2010, 2010'). Accordingly, trim elements 2010 and/or 2010' can be utilized in building system 2300, for example, as described with reference to sealant 2501 and/or accessory cover strip 2301 discussed below.

Trim elements 2310 can be secured to cladding 2610 with fixings such as any of the fixings discussed herein and using any of the securement methods discussed herein. Where trim elements 2310 are similar or identical to trim elements 2010, trim elements 2310 can be secured to cladding 2610 via securement of a trim body rear face of trim element 2310 (which can be identical to trim body rear face 2028) and/or via securement of at least one trim retaining arm of trim element 2310 (which can be identical to trim retaining arm 2070 of trim element 2010) as discussed elsewhere herein. Trim element 2310 can be levelled and/or otherwise adjusted as needed to the intended installed position and fixed to building section 2600 by fixings, such as nails or screws. Fixings can be positioned at required spacings, guided by fixing indicia (if present), and driven through a portion of trim element 2310 and into a building section (for example, through a fixing face of an angled web of trim element 2310 which can be similar or identical to fixing face 2082 of angled web 2080 of trim element 2010). Generally fixings are of sufficient length to penetrate cladding 2610 completely and at least partially penetrate a framing element (which can be behind cladding 2610 as shown in FIG. 27E) to ensure sufficient mechanical holding strength for trim element 2310. This process can be repeated for each subsequent trim element in turn so that, once installed, each trim element 2310 is fixed in an arrangement where each miter cut end 2330 abuts a corresponding miter end 2330 of an adjacent trim element 2310. Together, the trim elements 2310 form a frame around the building section element 2640. However, there may be some slight gap between adjacent ends 2330, depending on the measurement and cutting accuracy of the installer. The joints between ends 2330 of adjacent trim elements 2310 may be sealed and made more weatherproof by application of a bead of sealant 2501 as shown in FIG. 29A.

Figure 29B:
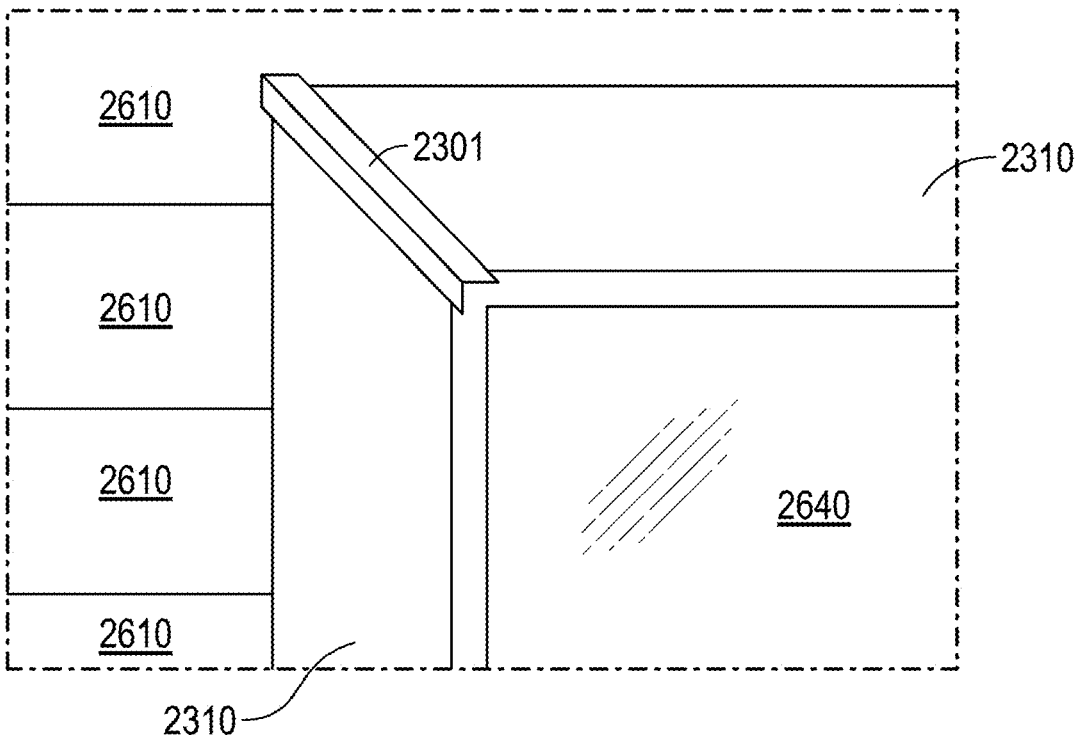
FIG. 29B shows a partial front view of a building section showing an accessory cover strip installed on a building trim system in accordance with aspects of this disclosure.

In some embodiments, after installation of each trim element 2310 adjacent a building section element 2640, an accessory cover strip 2301 is added to obscure the joint between adjacent trim elements 2310 and/or to provide improved aesthetics of the joint, as shown in partial front view in FIG. 29B. Accessory cover strip 2301 can be applied after each trim element 2310 has been installed, for example, in line with the method outlined above. In such cases, the use of bead of sealant 2501 is optional but may still be used to provide improved weather resistance. In one embodiment, accessory cover strip 2301 is a snap fit style, resiliently engageable cover to conceal joints between adjacent trim elements 2310. The use of accessory cover strip 2301 covers and disguises any cutting or alignment issues resulting from out-of-square or slight cut length mismatch issues of adjacent or opposing trim elements.

Figure 29C:
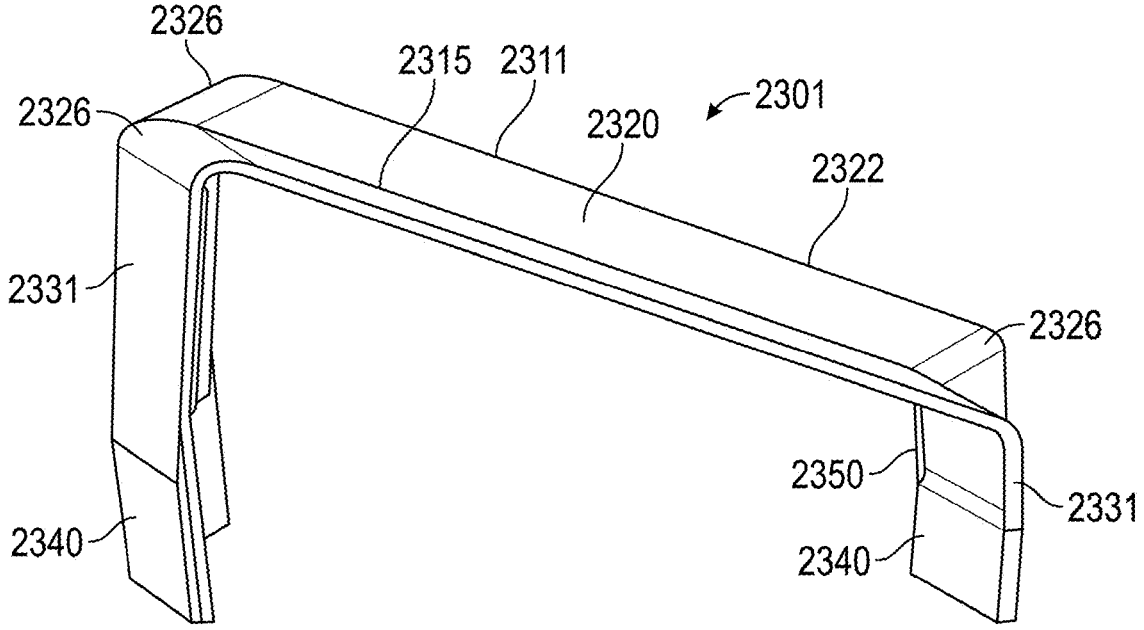
FIG. 29C shows a perspective view of an accessory cover strip in accordance with aspects of this disclosure.

FIG. 29C illustrates a perspective view of accessory cover strip 2301. Accessory cover strip 2301 can include a cover strip body 2311, a pair of cover strip side arms 2331, cover strip locking feature(s) 2340, a cover strip outer surface 2320, and a cover strip inner surface 2350. In some embodiments, cover strip 2301 is an elongate strip formed in a general "C" shaped profile, with a central axis 2315 configured to be aligned with a desirable and intended trimmed mitered corner angle (for example, defined along joining edges of ends of two trim elements 2310). On each respective side of the central axis 2315, a portion of cover strip body 2311 is directed parallel to the longitudinal axis of a respective abutting trim element 2310 whose end 2330 is to be covered. Each of cover strip side arms 2331 are disposed at a respective end of cover strip body 2311 and are angled relative to cover strip body 2311. The angle of cover strip side arms 2331 relative to cover strip body 2311 can be selected to correspond to angles of portions of the trim elements 2311 to which cover strip 2301 is intended to be secured to. For example, where trim element 2311 is similar or identical to trim element 2010, the angle of cover strip side arms 2331 relative to cover strip body 2311 can correspond to the angle between trim body side walls 2022, 2024, and/or 2026. Cover strip side arms 2331 can be transverse (for example, perpendicular) to cover strip body 2311. Radiused arm portion 2326 at each end of cover strip body 2311 provides an aesthetic effect, and the radius of radiused arm portions 2326 may be varied to provide more square or rounded effects. An edge 2322 of cover strip body 2311 can be spaced from central axis 2315 as shown in FIG. 29C.

Each cover strip side arm 2331 can comprise a locking feature 2340, which aids in retaining accessory cover strip 2301 in its installed position. Locking feature 2340 may be an angled portion which is resiliently biased towards trim element 2310, for increasing friction between accessory cover strip 2301 and trim element 2310 after installation, and increasing the force required to remove the cover strip once installed. Accessory cover strip 2301 is then unlikely to be removed accidentally. At least one side arm 2331 may further comprise at least one small protrusion at its end, forming part of locking feature 340. The at least one small protrusion acts as an additional locking device and snap locks in position to further increase the force required to remove accessory cover strip 2301 once installed. To install accessory cover strip 2301, cover strip body 2311 is positioned across the joint to be covered and each side arm 2331 is elastically deformed sufficiently that cover strip inner surface 2350 along locking feature 2340 is brought into contact with a respective first trim body side face of trim element 2310 (which can be similar or identical to first trim body side face 2032) and/or second trim body side face of trim element 2310 (which can be similar or identical to first trim body side face 2034).

Accessory cover strip 2301 may be made from any durable material, such as exterior durable polymer compositions of PVC, polyolefin and the like, or from metals such as aluminum or steel. The wall thickness of cover strip body 2311 and/or accessory strip side arms 2331 is sufficient to provide the mechanical support required for installation and service life. Such wall thickness can be between 0.5 mm and 1.5 mm+/−10%, the variance being due to normal manufacturing variations.

Figure 30A:
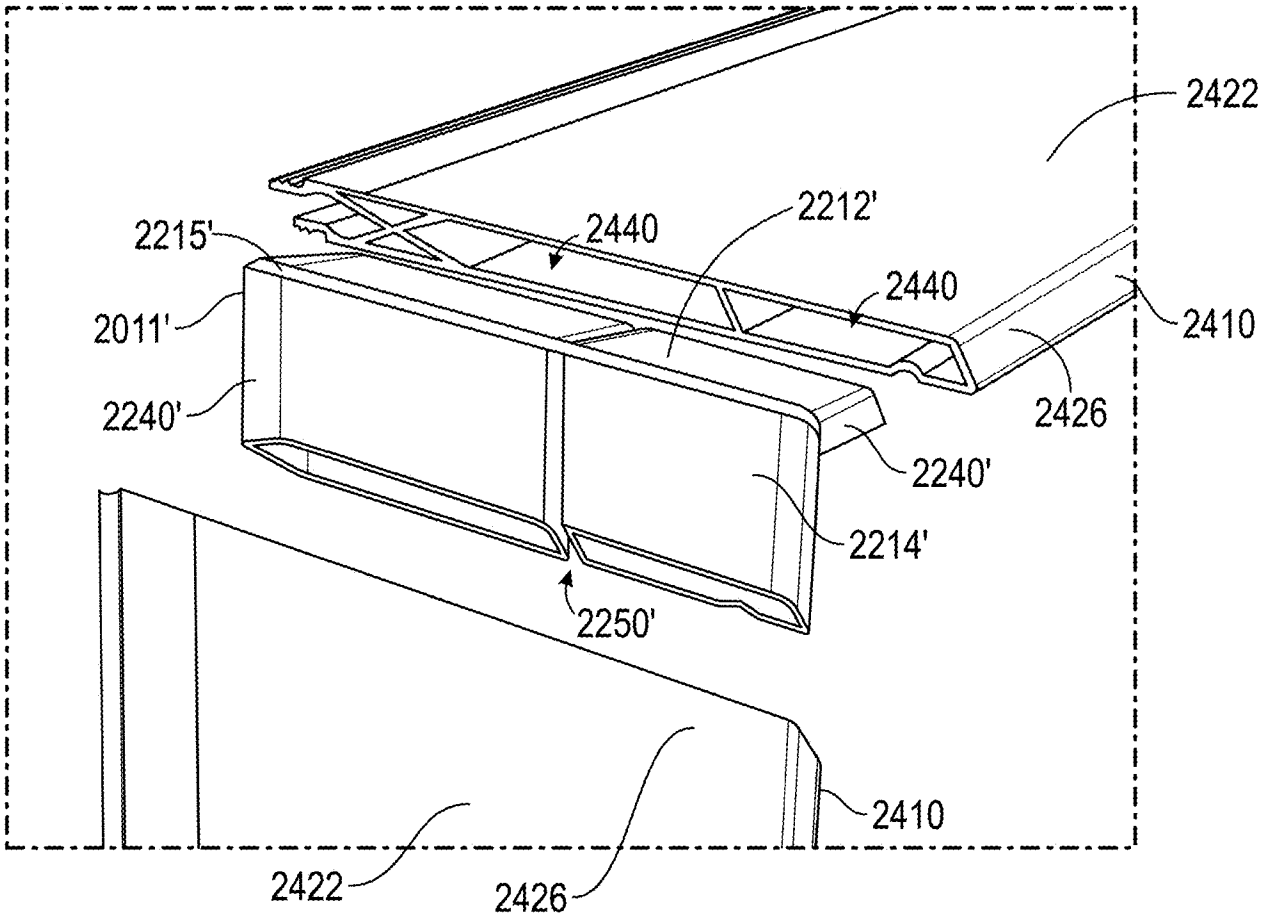
FIG. 30A shows an exploded view of a corner assembly of a building trim system comprising two trim elements and a corner connector in accordance with aspects of this disclosure.
Figure 30B:
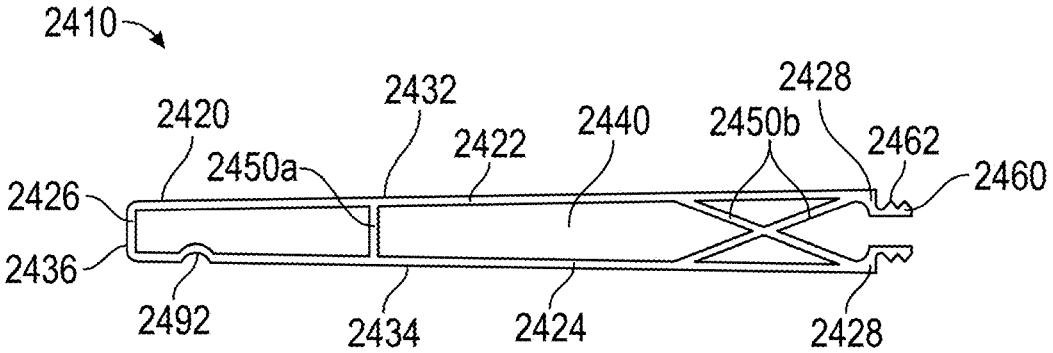
FIG. 30B shows a cross-sectional side view of a trim element in accordance with aspects of this disclosure.

FIG. 30A illustrates an exploded perspective view of two trim elements 2410 and an end piece 2011' that can be secured to trim elements 2410. FIG. 30B illustrates a cross-sectional view of trim element 2410. End piece 2011' is a corner connector having two end piece insert formations 2240', each directed at a predetermined angle with respect to the other. Generally, the predetermined angle is approximately 90° so that when each end piece insert formation 2240' is inserted into a respective end of a respective trim element 2410, a corner trim assembly is created. End piece insert formations 2240' are configured to fit within a corresponding trim body aperture 2440 (discussed further below) of trim element 2410, and provide a friction fit for retaining end piece 2011' in place. In some embodiments where trim element 2410 includes a reinforcing web 2450 (see FIG. 30B), end piece connector 2011' includes a corresponding aperture or gap 2250' in end piece insert formations 2240' so that end piece insert formations 2240' can be inserted into corresponding trim body apertures 2440 of trim elements 2410 unimpeded. In such implementations, end piece insert formations 2240' can be defined by two portions separated by the aperture or gap 2250. In some embodiments, four trim elements 2410 are connected by four respective end pieces 2011' to form a square or rectangular trim assembly. Such a trim assembly can be created and then positioned against a building section in a predetermined position so that each trim element 2410 is adjacent an edge of a building section element (such as a window) to be trimmed. Such trim assembly can then be fixed to the building section using fixings (such as fixings 2510), for example, as discussed further below with reference to FIGS. 30D-30E and base trim element 2401. End piece 2011' closes and weatherproofs a respective end of two adjacent trim elements 2410 when installed. In some embodiments, end piece 2011' further comprises an integrally formed cover strip for covering and disguising joints between adjacent trim elements. In some embodiments, end piece 2011' includes an edge or channel 2215' between surfaces 2212' and 2214' of end piece insert formations 2240' that is configured to accommodate and hide ends of trim elements 2410, thereby providing an integrally formed cover strip.

As mentioned above, FIG. 30B illustrates a cross-sectional view of trim element 2410. Trim element 2410 can include a first trim body side wall 2422, a second trim body side wall 2424, and/or a third trim body side wall 2426. Trim element 2410 can include a trim body 2420 that is defined by trim body side walls 2422, 2424, 2426 and/or a trim body rear wall 2428 (discussed below), similar to trim body 2020 of trim element 2010 as discussed previously. Each of trim body side walls 2422, 2424, 2426 can have an exterior face that contributes to the aesthetic of trim element 2410. For example, first trim body side wall 2422 can have a first trim body side face 2432, second trim body side wall 2424 can have a second trim body side face 2434, and third trim body side wall 2426 can have a third trim body side face 2436. With continued reference to FIG. 30B, trim element 2410 can include a trim body rear wall 2428 and a trim element retaining formation 2460 extending outward from the trim body rear wall 2428 (for example, in a direction that is outward from a central longitudinal axis of trim element 2410). Trim element retaining formation 2460 can be configured to secure to (for example, releasably engage) trim element retaining formation 2461 of base trim element 2401, which can allow trim element 2410 to be indirectly secured to a building section 2600 when base trim element 2401 as discussed further below. In some embodiments, trim element retaining formation 2460 comprises two arms flexible relative to one another and/or relative to trim body rear wall 2428. In some embodiments, trim element retaining formation 2460 (which can comprise two arms) comprises one or more protrusions, such as one or more teeth 2462 that can engage with teeth 2471 of trim element retaining formation 2461 of base trim element 2401 as discussed below.

In some embodiments, trim element 2410 includes a groove 2492 that is configured to direct water drainage. Similar to groove 2092 of trim element 2010, groove 2492 forms a capillary break to control and direct the flow of water across second trim body side face 2434. When trim element 2410 is installed above a building section element (such as a window) with second trim body side face 2434 facing downwards, groove 2492 provides a water management feature that will cause any water that migrates across first trim body side face 2432 and third trim body side face 2436 onto second trim body side face 2434 to accumulate in groove 2492 and drip away from trim element 2410 under the force of gravity. In some embodiments, groove 2492 is positioned closer to third trim body side wall 2426 than to trim body rear wall 2428.

With continued reference to FIG. 30B, in some embodiments of trim element 2410, first trim body side wall 2422 and second trim body side wall 2424 of trim body 2420 are substantially parallel, such that trim body 2420 is generally rectangular in cross-section, similar to that shown and discussed with respect to FIG. 27B. In some embodiments, trim element 2410 includes a trim body reinforcing web 2450*a*. Web 2450*a* can extend between and/or be substantially perpendicular to trim body side wall 2422 and/or trim body side wall 2424. Additionally or alternatively, trim element 2410 can include trim body reinforcing webs 2450*b*. Webs 2450*b* can be positioned proximate to rear wall 2428 as shown. Webs 2450*b* can intersect one another in some embodiments, as shown. Webs 2450*b* can form a cross or X-shape, for example. In some embodiments, trim element 2410 includes only one of web 2450*a* or webs 2450*b*. In some embodiments, trim element 2410 includes all of webs 2450*a*, 2450*b*.

Figure 30C:
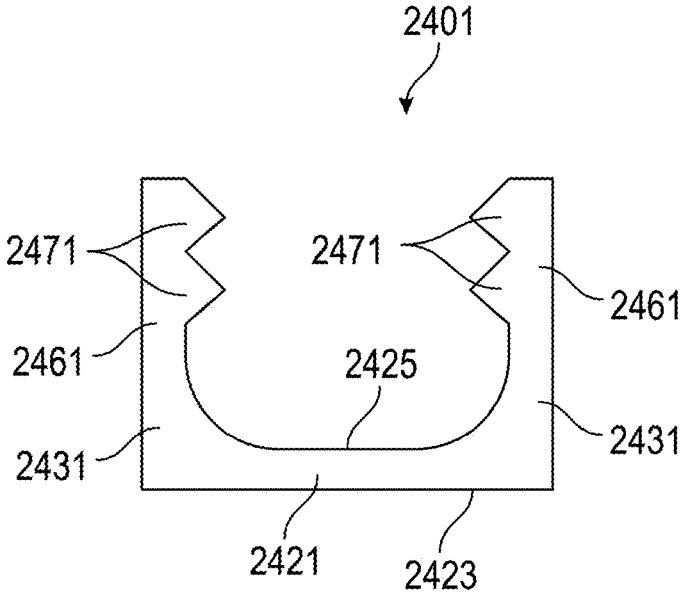
FIG. 30C shows a cross-sectional view of a base trim element in accordance with aspects of this disclosure.
Figure 30D:
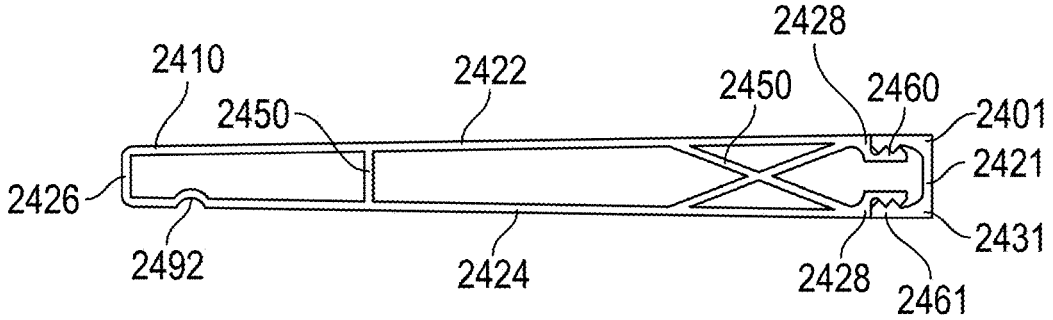
FIG. 30D shows a cross-sectional side view of the trim element of FIG. 30B and the base trim element of FIG. 30C engaged with one another in accordance with aspects of this disclosure.

In some embodiments, trim element 2410 may be fixed to a building section indirectly. For example, in some embodiments, trim element 2410 can be fixed to building section 2600 via a base trim element 2401 (see FIG. 30E). FIG. 30C illustrates a cross-section side view of base trim element 2401. Base trim element 2401 comprises a base trim central web 2421 and a pair of base trim side arms 2431 extending outwardly from base trim central web 2421. Such base trim central web 2421 and pair of base trim side arms 2431 can define a profiled section of base trim element 2401. In some embodiments, each base trim side arm 2431 extends substantially orthogonally from base trim central web 2421 and in the same direction from a respective side edge of base trim central web 2421. Base trim central web 2421 can include an outer face 2423 and an inner face 2425 opposite the outer face 2423. Outer face 2423 can be positioned adjacent cladding 2610 when base trim element 2401 is secured to a building section 2600 (see FIG. 30E). Base trim element 2401 can include a base trim retaining formation 2461 disposed on a portion of each side arm 2431 for securement with (for example, releasable engagement with) a respective complementary mating profile disposed on trim element 2410 (for example, teeth 462 of trim element retaining formation 2460 discussed elsewhere herein and shown in FIG. 30B). Base trim retaining formation 2461 can include one or more teeth 2471 that interlock, for example, by snap fitting together, with respective complementary mating profiles disposed on trim element 2410 (for example, teeth 462). In an alternate embodiment, base trim retaining formation 2461 and complementary mating profile disposed on trim element 2410 interlock by sliding engagement. FIG. 30D shows an illustrative manner by which trim element 2410 and base trim element 2401 can be secured together such that complementary mating profiles of trim element retaining formation 2460 and base trim retaining formation 2461 are releasably engaged.

Figure 30E:
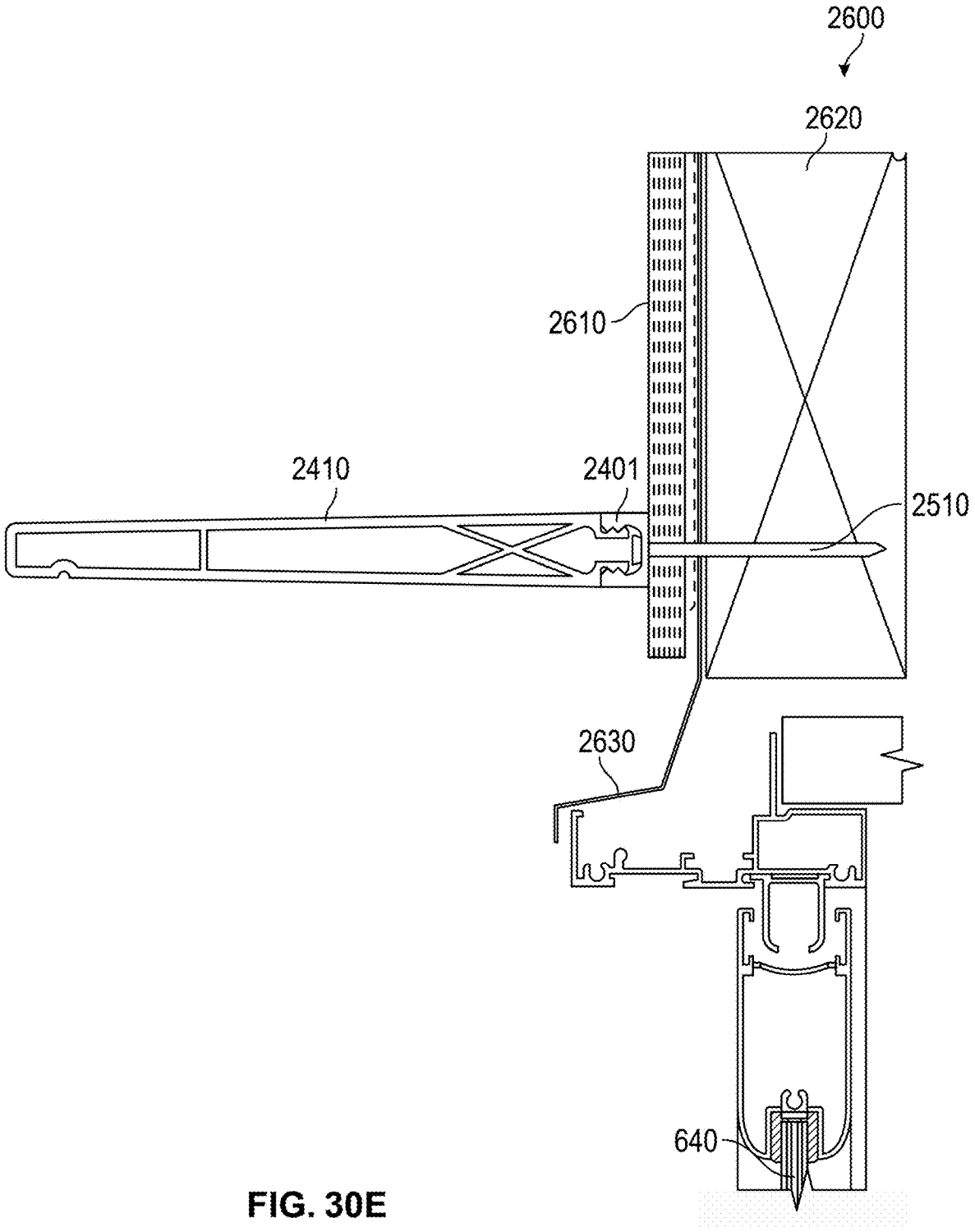
FIG. 30E shows a cross-sectional side view a building trim system where the trim element is connected indirectly to a building section through a base trim element in accordance with aspects of this disclosure.

As mentioned previously, trim element 2410 may be fixed to a building section 2600 indirectly via a base trim element 2401. FIG. 30E illustrates a cross-sectional side view of base trim element 2401 secured to framing element 2620 via a fixing 2510 (which can be a nail or screw) that extends through cladding 2610. FIG. 30E also illustrates trim element 2410 secured to base trim element 2401. As shown, base trim element 2401 is disposed between trim element 2410 and cladding 2610 and is configured to connect, retain, and support trim element 2410. Base trim element 2401 can be fixed directly to building section 2600 adjacent a building section element 2640 to be trimmed by fixings 2510, for example, by inserting fixings through base trim central web 2421, through cladding 2610 and into framing element 2620. In such configuration, heads of fixings 2510 can rest against an inner face 2425 (see FIG. 30C) of base trim central web 2421. Each trim element 2410 can be releasably connected to at least one base trim element 2401 via complementary engaging and retaining formations. For example, as discussed above, base trim retaining formation 2461 disposed on base trim element 2401 can engage and retain complementary trim element retaining formation 2460 disposed on trim element 2410. In some embodiments, each trim element 2410 is connected to a respective base trim element 2401 by sliding engagement. In some embodiments, each trim element 2410 is connected to a respective base trim element 2401 by a snap fit engagement, for example, via engagement between teeth 2462 of trim element retaining formation 2460 and teeth 2471 of base trim retaining formation 2461.

Figure 30F:
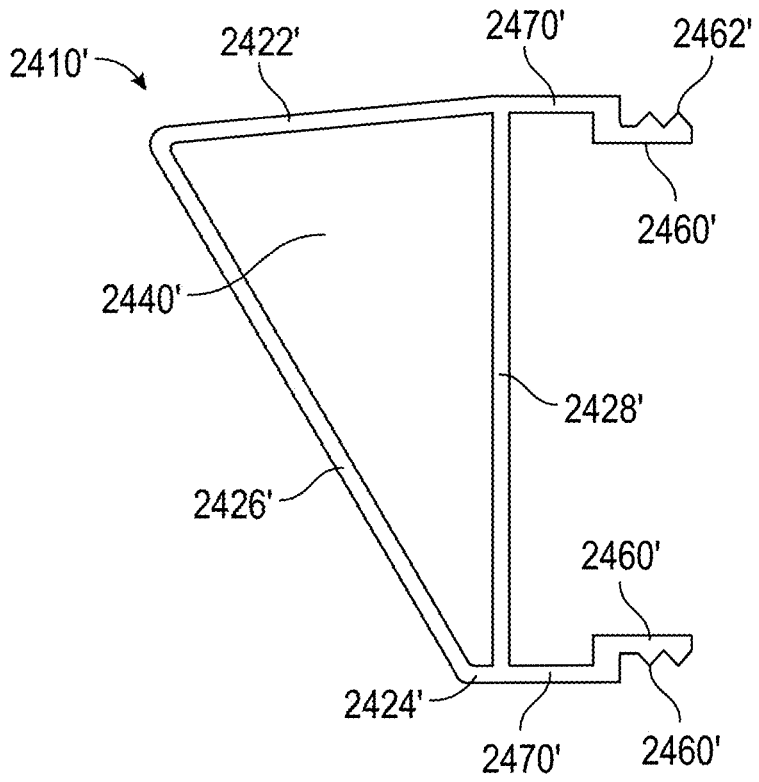
FIG. 30F shows a cross-sectional side view of a trim element in accordance with aspects of this disclosure.

FIG. 30F illustrates a cross-sectional side view of another embodiment of a trim element 2410'. Trim element 2410' includes a first trim body side wall 2422', a second trim body side wall 2424', a third trim body side wall 2426', a rear wall 2428', and an aperture 2440' between and/or defined by walls 2422', 2424', 2426', 2428' which form a trapezoidal shape. However, trim element 2410' can have an alternative polygonal shaped cross-sectional profile, such as a triangular or rectangular shape, among others. Trim element 2410' includes a pair of trim body extension arms 2470' extending from a respective end of trim body rear wall 2428'. Trim body extension arms 2470' can be transverse (for example, perpendicular) relative to trim body rear wall 2428'. Trim element 2410' can include trim element retaining formations 2460', which can connect to, extend from, and/or be adjacent to arms 2470'. In some implementations, trim element retaining formations 2460' are defined by two portions that are transverse (for example, perpendicular) relative to one another, one of which is perpendicular to arm 2470' and the other of which is parallel to arm 2470' (see FIG. 30F). Trim element retaining formations 2460' can include one or more protrusions, such as one or more teeth 2462' configured to accept and retain a complementary mating formation disposed on a base trim element 2401' as discussed below.

Figure 30G:
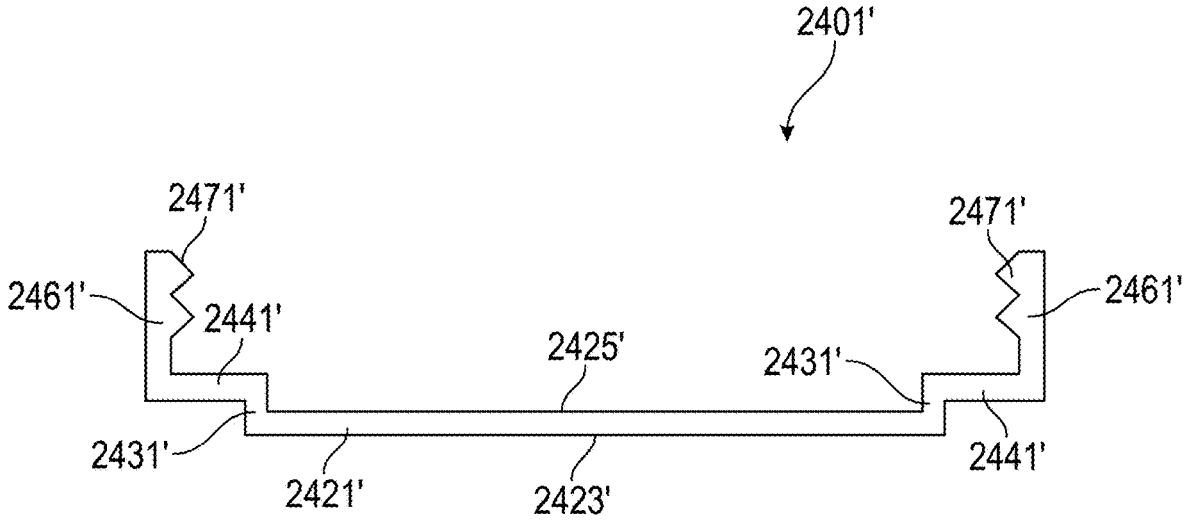
FIG. 30G shows a cross-sectional side view of a base trim element in accordance with aspects of this disclosure.
Figure 30H:
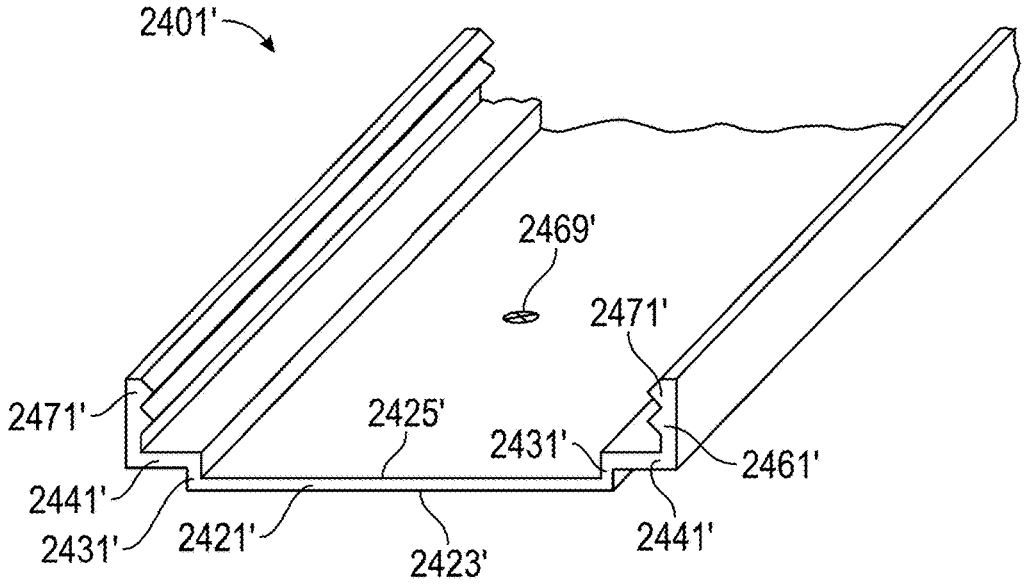
FIG. 30H shows a perspective view of the base trim element of FIG. 30G in accordance with aspects of this disclosure.

FIG. 30G illustrates a cross-sectional side view of another embodiment of a base trim element 2401'. FIG. 30H illustrates a perspective view of a portion of base trim element 2401' (with a portion cut away). Base trim element 2401' comprises a base trim central web 2421' and base trim side arms 2431' that can extend substantially perpendicular to base trim central web 2421'. Base trim central web 2421' can include an outer face 2423' and an inner face 2425' opposite the outer face 2423'. Outer face 2423' can be positioned adjacent cladding (such as cladding 2610 shown in FIG. 30E) when base trim element 2401' is secured to building section 2600. Base trim flanges 2441' can extend laterally from a respective end portion of base trim side arms 2431' (for example, in opposite directions) substantially parallel to base trim central web 2421'. From the distal end of each base trim flange 2441', respective base trim end arms 2461' (which may also be referred to as "base trim retaining formations") extend substantially parallel to base trim side arms 2431' and substantially perpendicular relative to base trim central web 2421'. Base trim retaining formations 2461' can include one or more protrusions, such as one or more teeth 2471'. However, base trim retaining formations 2461' can include alternative formations suitable for providing releasable locking engagement with trim element retaining formations 2460' of trim element 2410' in some variants. Complementary mating formations on trim element 2410' (for example, trim element retaining formations 2460') may be disposed in corresponding positions to allow releasable locking engagement with base trim element 2401'. Base trim retaining formations 2461' of base trim element 2401' can engage trim element retaining formations 2460' of trim element 2410' (for example, via engagement between teeth 2471' and teeth 2462') thereby allowing trim element 2410' and base trim element 2401' to be secured to one another. In some embodiments, teeth 2471' are disposed on an inner surface of base trim retaining formations 2461', for example, the surfaces facing inwards towards a center axis of base trim element 2401'. In an alternate embodiment, teeth 2471' are disposed on the outer surface of base trim retaining formations 2461' facing outwards (for example, away from a center axis of base trim element 2401'). In either case, corresponding teeth 2462' of trim element retaining formations 2460' are appropriately directed to engage with teeth 2471' of base trim retaining formations 2461'.

A length of base trim side arm 2431' and/or base trim end arms 2461' can define the width of a channel formed between base trim element 2401' and building section 2600, once installed. Such channel can be configured to accommodate and direct water drainage. As shown in FIG. 30H, base trim element 2401' can be an elongated extruded section, optionally including fixing indicia 2469' which may be applied after manufacture, by suitable processes such as printing, stamping, embossing, punching, and the like. Fixing indicia 2496' can provide an indication of where fixings are to be placed and/or spaced from one another when securing base trim element 2401' to building section 2600.

Trim elements 2410, 2410' and/or base trim elements 2401, 2401' may be made (for example, integrally formed) from any durable, resiliently deformable material, and metals such as aluminum or steel, or plastics such as PVC or polyolefin are suitable. Trim elements 2410, 2410' and/or base trim elements 2401, 2401' may be formed by common manufacturing processes, but extrusion is preferable. Trim elements 2410, 2410' and/or base trim elements 2401, 2401' may be supplied in convenient lengths sufficient to trim a building section element 2640 in a single length. The thickness of any of walls 2422, 2424, 2426, 2428, webs 2450*a*, 2450*b*, trim element retaining formation 2460, walls 2422', 2424', 2426', 2428', arms 2470', trim element retaining formations 2460', base trim central webs 2421, 2421', base trim side arms 2431, 2431', base trim flanges 2441', base trim end arms 2461' can be selected to be sufficient to provide the mechanical support required for installation and service life, for example, between 0.5 mm and 1.5 mm+/−10% due to manufacturing variations.

Figure 31A:
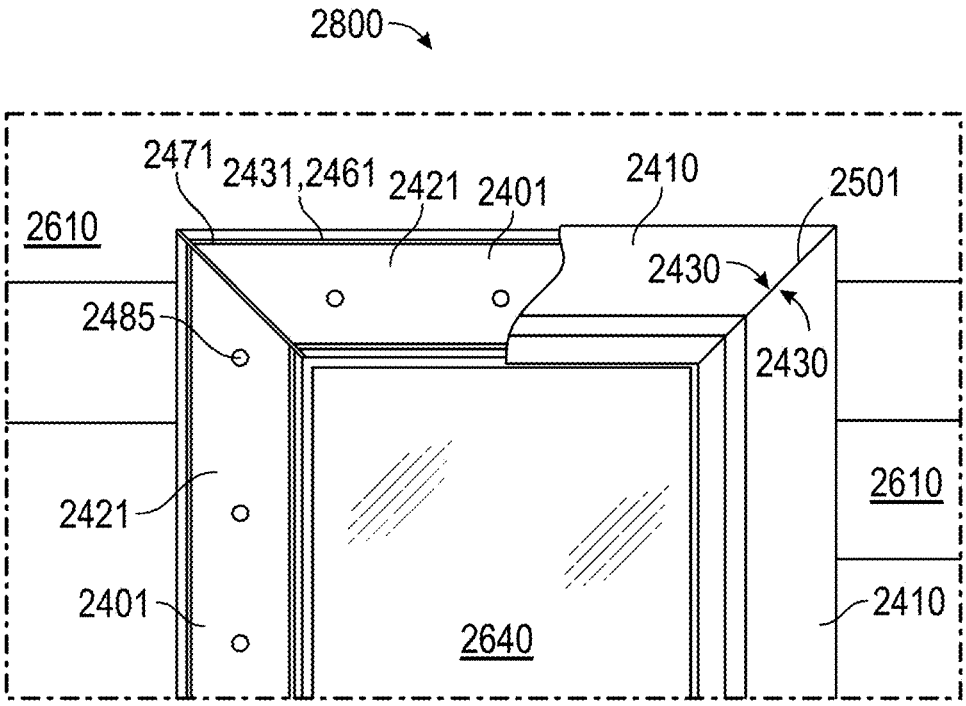
FIG. 31A shows a partial cut away front view of a building trim system with elongate base trim elements in accordance with aspects of this disclosure.

FIG. 31A illustrates a method of installing a building trim system 2800 in which trim elements 2410 are indirectly secured to a building section (for example, adjacent cladding 2610) around a building section element 2640 (such as a window). Base trim elements 2401 (described above) can be secured to the building section around building section element 2640 for example as described above. Base trim elements 2401 can be cut to the required predetermined length, and ends thereof can be cut to a predetermined angle, such as miter cut, and debris resulting from such cuts can be cleaned. Base trim elements 2401 can be secured such that back faces of the base trim central webs 2421 (for example, outer face 2323) are positioned in a predetermined location on cladding 2610 adjacent a building section element 2640 to be trimmed. Base trim elements 2401 can be adjusted, as necessary, to ensure proper placement relative to the building section element 2640. Base trim elements 2401 can be fixed in place using fixings (such as any of those discussed herein). Base trim elements 2401 optionally can include at least one fixing indicia 2485 (for example, on base trim central web 2421) to provide a guide to installers on desirable spacing between fixing locations. Subsequent base trim elements 2401 can be similarly installed so that each side of the building section element 2640 has a base trim element 2401 installed adjacent it.

After base trim elements 2401 are secured around building section element 2640, trim elements 2410 can be secured to the base trim elements 2401, for example, in the manner described above. Each trim element 2410 can be cut to a predetermined length and ends 2430 of each trim element 2410 (see FIG. 31A) can be cut to a predetermined angle, such a miter cut and the ends 2430 can be cleaned to remove cutting debris. Trim element 2410 can be positioned on a corresponding respective base trim element 2401 and urged into releasable engagement with a respective base trim element 2401 by applying pressure to trim element 2410 to resiliently deform the trim body extension arms of trim element retaining formation 2460 and allowing trim element retaining formation 2460 to secure (for example, via a snap fit arrangement) into corresponding base trim retaining formation 2461 on base trim element 2401 (for example, via engagement between teeth 2462 and teeth 2471 as discussed above and shown in at least FIG. 30D). Subsequent trim elements 2410 can be similarly installed in turn until each edge of the building section element 2640 is trimmed (e.g., surrounded).

Figure 31B:
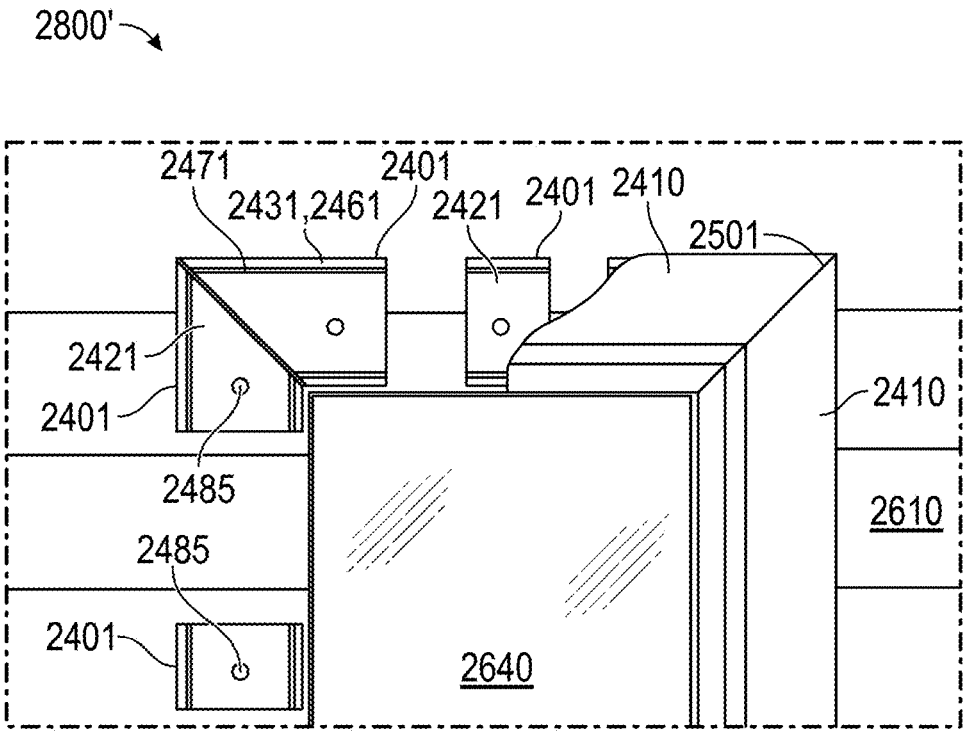
FIG. 31B shows a partial cut away front view of a building trim system with discrete base trim elements in accordance with aspects of this disclosure.

In an alternate configuration, as shown in FIG. 31B, each base trim element 2401 may be in the form of a discrete, short channel section. Base trim elements 2401 may be manufactured as discrete sections or may be cut from an elongate section. Where short discrete sections are required or utilized, discrete base trim elements may be supplied or may be provided by cutting from an elongate base trim element 2401. Cutting from an elongate base trim element 2401 may be done on a construction site by the builders or installers. Where discrete sections of base trim elements 2401 are used, a number of base trim elements 2401 may be used to engage a single trim element 2410. FIG. 31B, in a partial cutaway front view of a partially installed building trim system 2800', shows a plurality of discrete base trim elements 2401, each fixed to building section adjacent cladding 2610 in a respective predetermined position adjacent a building section element 2640 to be trimmed, ready for installation of at least one trim element 2410. In some implementations, gaps are positioned between adjacent ones of such discrete sections of base trim elements 2401, for example, such that there is a gap between a portion of the trim elements 2410 and cladding 2610. FIG. 31B also shows trim elements 2410, one in partial cut-away view, in an installed position. In some embodiments, at least one trim element 2410, comprising trim element retaining formation 2460, is releasably engaged with respective discrete base trim elements 2410 by sliding engagement. In some embodiments, at least one trim element 2410, comprising trim retaining formation 2460, is releasably engaged with discrete respective base trim elements 2401 by snap-fit engagement (for example, via engagement between teeth 2462 and teeth 2471). During installation, a portion of trim element 2410, such as a pair of trim body extension arms that define trim retaining formation 2460, resiliently deform when engaged by base trim retaining formation 2461. Additionally or alternatively, a portion of base trim element 2401, such as base trim retaining formation 2461, can resiliently deform when engaged by trim retaining formation 2460. Trim element 2410 and base trim element 2401 can be released from engagement with one another by applying a removal force sufficient to resiliently deform base trim retaining formation 2461 relative to trim retaining formation 2460.

With reference to FIG. 31A, once each trim element 2410 has been installed, and at each corner, ends or end faces 2430 of two adjacent trim elements 2410 can abut to form a mitered corner joint. An optional bead of sealant 2501 can be applied to the mitered corner joint to finish the joint and prevent water ingress such as during rain events. Bead of sealant 2501 can be wiped or smoothed before curing to remove any excess and to minimize the visible bead of sealant, to maintain the aesthetic appearance of the completed building trim system installation. In some implementations, accessory cover strip 2301 (see FIG. 29C) can be applied (in addition or as an alternative to sealant 2501) across such joint between two adjacent trim elements 2410 to conceal the joint. Such accessory cover strip 2301 can be resiliently deformable and can be installed in place by urging inner surface 2350 of the accessory strip 2301 (see FIG. 29C) against trim element(s) 2410, for example, until accessory strip locking formations 2340 snap into position.

Figure 31C:
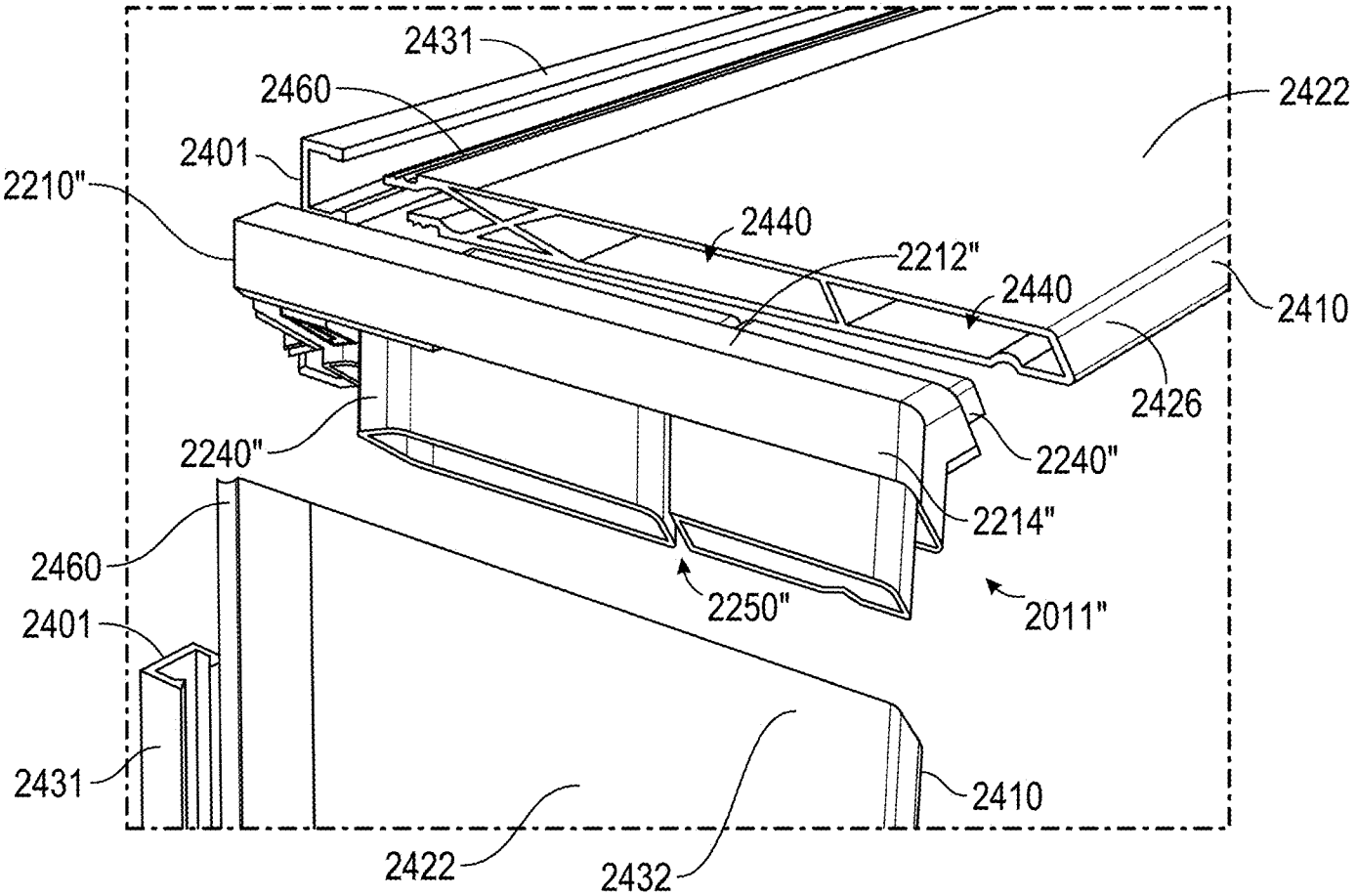
FIG. 31C shows an exploded view of a building trim system where an end connector has an integrally formed cover strip in accordance with aspects of this disclosure.

FIG. 31C illustrates an exploded perspective view of two trim elements 2410, two base trim elements 2401, and an end piece 2011". End piece 2011" can be similar to end piece 2011 and/or 2011' in some or many respects. End piece 2011" includes an end piece body 2210", end piece faces 2212', 2214', and end piece insert formations 2240" extending outward from end piece body 2210". End piece insert formations 2240" can extend substantially perpendicular to end piece body 2210", for example, where end piece 2011" is utilized for a corner connection between two trim elements 2410 as shown. End piece insert formations 2240" can be configured to secure within trim body aperture 2440 of trim element 2410. As discussed above, trim element 2410 can include a web 2450*a* that extends between and/or substantially perpendicular relative to trim body side walls 2422, 2424 and divides the trim body aperture 2440. In such cases, end piece insert formations 2240" can include an aperture or gap 2250" so that end piece insert formations 2240" can be inserted into such divided aperture 2440 unimpeded. End piece 2011' can close and weatherproof ends of two adjacent trim elements 2410 when installed. In some cases, end piece insert formations 2240" have a smaller cross-sectional area than end piece body 2210" such that end piece body 2210" remains outside of aperture 2440 of trim element 2410 when end piece insert formations 2240" are secured within aperture 2440. Base trim elements 2401 can be installed to a building section as described herein. A trim assembly can be formed with one or more or a plurality of trim elements 2410 and one or more or a plurality of end pieces 2011" by connecting end pieces 2011" between corner joints of the trim elements 2410 prior to installing each trim element 2410 to a respective base trim element 2401. In some embodiments, end piece 2011" further comprises an integrally formed cover strip for covering and disguising joints between adjacent trim elements. Such integrally formed cover strip can be defined by one or both of end piece faces 2212', 2214'

Additional Considerations and Terminology

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

It is acknowledged that the term "comprise" may, under varying jurisdictions be provided with either an exclusive or inclusive meaning. For the purpose of this specification, and unless the context clearly requires otherwise, the terms "comprise" and "comprising" shall have an inclusive meaning that it should be taken to mean an inclusion of not only the listed components it directly references, but also other non-specified components. Accordingly, the term "comprise" is to be attributed with as broad an interpretation as possible within any given jurisdiction and this rationale should also be used when the terms "comprised" and/or "comprising" are used.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally" and "substantially" may refer to an amount that is within less than or equal to 10% of, within less than or equal to 5% of, or within less than or equal to 1% of the stated value, amount, or characteristic.

Although making and using various embodiments are discussed herein, it should be appreciated that the description provides many inventive concepts that may be embodied in a wide variety of contexts. The specific aspects and embodiments discussed herein are merely illustrative of ways to make and use the systems and methods disclosed herein and do not limit the scope of the disclosure.

What is claimed is:

1. A cladding system configured to be installed on an exterior of a building substrate, the cladding system comprising:

a plurality of cladding elements, the plurality of cladding elements comprising at least a first cladding element and a second cladding element, each of the first and second cladding elements comprising fiber cement and further comprising:

a front face configured to face away from the building substrate when each of the first and second cladding elements is secured to the building substrate, wherein the front face comprises a textured pattern;

a rear face opposite the front face and configured to face toward the building substrate when each of the first and second cladding elements is secured to the building substrate;

a first mating edge extending between the front and rear faces and extending along a length or height of each of the first and second cladding elements;

a second mating edge opposite the first mating edge and extending between the front and rear faces and along the length or height of each of the first and second cladding elements, wherein the first mating edge of the first cladding element is configured to mate with the second mating edge of the second cladding element to form a joint groove extending along the length or height of each of the first and second cladding elements; and a plurality of intermediate grooves recessed from the front face and extending substantially parallel to the first and second mating edges, wherein each of the plurality of intermediate grooves comprises:

a first curved surface extending from the front face at least partially toward the rear face and having a first radius of curvature;

a second curved surface connected to the first curved surface and having a second radius of curvature that is smaller than the first radius of curvature of the first curved surface;

a third curved surface spaced from and opposite to the first curved surface, the third curved surface extending from the front face at least partially toward the rear face and having a third radius of curvature that is substantially equal to the first radius of curvature of the first curved surface;

a fourth curved surface connected to the third curved surface and having a fourth radius of curvature that is smaller than the third radius of curvature of the third curved surface, wherein the fourth radius of curvature is substantially equal to the second radius of curvature of the second curved surface; and a planar surface connected to and positioned between the second and fourth curved surfaces, wherein the planar surface is substantially parallel to the front face.

2. The cladding system of claim 1, further comprising at least one trim element configured to be secured to the building substrate, the at least one trim element comprising one or more channels configured to receive a portion of at least one of the first and second cladding elements.

3. The cladding system of claim 1, wherein each of the first radius of curvature and the third radius of curvature is between approximately 0.3 inch (7.6 mm) and approximately 0.5 inch (12.7 mm).

4. The cladding system of claim 1, wherein each of the second radius of curvature and the fourth radius of curvature is between approximately 0.03 inch (0.76 mm) and approximately 0.05 inch (1.3 mm).

5. The cladding system of claim 1, wherein:

a tangent line of the first curved surface at an intersection of the first curved surface and the front face is angled at a first angle with respect to the front face, wherein the first angle is less than 90°; and a tangent line of the third curved surface at an intersection of the third curved surface and the front face is angled at a second angle with respect to the front face that is substantially equal to the first angle.

6. The cladding system of claim 1, wherein the first and second cladding elements are panels.

7. The cladding system of claim 1, wherein the plurality of intermediate grooves do not include said textured pattern.

8. The cladding system of claim 1, wherein the first and second mating edges do not include said textured pattern.

9. A cladding element configured to be secured to a building substrate, the cladding element comprising fiber cement and further comprising:

a front face comprising a textured pattern;

a rear face opposite the front face;

a first mating edge extending between the front and rear faces;

a second mating edge opposite the first mating edge and extending between the front and rear faces;

at least one intermediate groove recessed from the front face and extending along a length or height of the cladding element, wherein the at least one intermediate groove comprises:

a first curved surface extending from the front face at least partially toward the rear face and having a first radius of curvature;

a second curved surface connected to the first curved surface and having a second radius of curvature that is different than the first radius of curvature of the first curved surface;

a third curved surface spaced from the first curved surface, the third curved surface extending from the front face at least partially toward the rear face and having a third radius of curvature;

a fourth curved surface connected to the third curved surface and having a fourth radius of curvature that is different than the third radius of curvature of the third curved surface; and a planar surface connected to and positioned between the second and fourth curved surfaces, wherein the planar surface is substantially parallel to the front face.

10. The cladding element of claim 9, wherein the at least one intermediate groove does not include said textured pattern.

11. The cladding element of claim 9, wherein the at least one intermediate groove extends substantially parallel to the first and second mating edges.

12. The cladding element of claim 9, wherein the second radius of curvature of the second curved surface is smaller than the first radius of curvature of the first curved surface.

13. The cladding element of claim 9, wherein the third radius of curvature of the third curved surface is substantially equal to the first radius of curvature of the first curved surface.

14. The cladding element of claim 9, wherein the fourth radius of curvature of the fourth curved surface is smaller than the third radius of curvature of the third curved surface.

15. The cladding element of claim 9, wherein the fourth radius of curvature of the fourth curved surface is substantially equal to the second radius of curvature of the second curved surface.

16. The cladding element of claim 9, wherein each of the first radius of curvature and the third radius of curvature is between approximately 0.3 inch (7.6 mm) and approximately 0.5 inch (12.7 mm).

17. The cladding element of claim 9, wherein a ratio between the first radius of curvature of the first curved surface and the second radius of curvature of the second curved surface is between approximately 10 and approximately 12.

18. The cladding element of claim 9, wherein a ratio between the third radius of curvature of the third curved surface and the fourth radius of curvature of the fourth curved surface is between approximately 10 and approximately 12.

19. The cladding element of claim 9, wherein each of the second radius of curvature and the fourth radius of curvature is between approximately 0.03 inch (0.76 mm) and approximately 0.05 inch (1.3 mm).

20. The cladding element of claim 9, wherein the first curved surface, second curved surface, third curved surface, fourth curved surface, and the planar surface are the only surfaces of the at least one intermediate groove.

21. The cladding element of claim 9, wherein the planar surface is the only non-curved surface of the at least one intermediate groove.

22. The cladding element of claim 9, wherein:

a tangent line of the first curved surface at an intersection of the first curved surface and the front face is angled at a first angle with respect to the front face, wherein the first angle is less than 90°; and a tangent line of the third curved surface at an intersection of the third curved surface and the front face is angled at a second angle with respect to the front face that is substantially equal to the first angle.

23. The cladding element of claim 9, wherein cladding element is a panel.

24. The cladding element of claim 9, wherein the first and second mating edges do not include said textured pattern.

* * * * *